US006976541B2

(12) United States Patent
Brisco et al.

(10) Patent No.: US 6,976,541 B2
(45) Date of Patent: Dec. 20, 2005

(54) LINER HANGER WITH SLIDING SLEEVE VALVE

(75) Inventors: David Paul Brisco, Duncan, OK (US); Edwin Arnold Zwald, Jr., Houston, TX (US); Chan Daigle, Katy, TX (US); Gregory Noel, Katy, TX (US); William J. Dean, Katy, TX (US); Andrei Gregory Filippov, Wassenaar (NL); Ronald D. Nida, Fulshear, TX (US); Robert Lance Cook, Katy, TX (US); Lev Ring, Houston, TX (US); Kevin K. Waddell, Houston, TX (US); William Rusty Stephenson, Houston, TX (US); Rune T. Gusevik, Houston, TX (US)

(73) Assignee: Shell Oil Company, Houston, TX (US)

( * ) Notice: Subject to any disclaimer, the term of this patent is extended or adjusted under 35 U.S.C. 154(b) by 134 days.

(21) Appl. No.: 10/351,160

(22) Filed: Jan. 22, 2003

(65) Prior Publication Data

US 2004/0045718 A1 Mar. 11, 2004

Related U.S. Application Data

(63) Continuation of application No. PCT/US01/28960, filed on Sep. 17, 2001.

(60) Provisional application No. 60/233,638, filed on Sep. 18, 2000.

(51) Int. Cl.[7] ..... E21B 43/10

(52) U.S. Cl. ..... 166/382; 166/177.4; 166/207

(58) Field of Search ..... 166/277, 382, 166/177.4, 206, 207, 242.2

(56) References Cited

U.S. PATENT DOCUMENTS 46,818 A 3/1865 Patterson
331,940 A 12/1885 Bole
332,184 A 12/1885 Bole (Continued)

FOREIGN PATENT DOCUMENTS

AU 767364 2/2004

(Continued)

OTHER PUBLICATIONS

International Examination Report, Application PCT/US02/24399; Aug. 6, 2004.

Examination Report, Application PCT/US02/25727; Jul. 7, 2004.

Examination Report, Application PCT/US03/10144; Jul. 7, 2004.

International Search Report, Application PCT/US03/20870; Sep. 30, 2004.

International Examination Report, Appliction PCT/US03/25676, Aug. 17, 2004.

International Examination Report, Application PCT/US03/25677, Aug. 17, 2004.

(Continued)

*Primary Examiner*—Hoang Dang
(74) *Attorney, Agent, or Firm*—Haynes and Boone LLP; Todd Mattingly

(57) ABSTRACT

An apparatus and method for forming or repairing a wellbore casing, a pipeline, or a structural support. An expandable tubular member is radially expanded and plastically deformed by an expansion cone that is displaced by hydraulic pressure. Before or after the radial expansion of the expandable tubular member, a sliding sleeve valve within the apparatus permit a hardenable fluidic sealing material to be injected into an annulus between the expandable tubular member and a preexisting structure.

50 Claims, 100 Drawing Sheets

U.S. PATENT DOCUMENTS

| | | | |
|---|---|---|---|
| 341,237 | A | 5/1886 | Healy |
| 802,880 | A | 10/1905 | Phillips |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,880,218 | A | 10/1932 | Simmons |
| 1,981,525 | A | 11/1934 | Price |
| 2,046,870 | A | 7/1936 | Clasen et al. |
| 2,160,263 | A | 5/1939 | Fletcher |
| 2,187,275 | A | 1/1940 | Mclennan |
| 2,204,586 | A | 6/1940 | Grau |
| 2,214,226 | A | 9/1940 | English |
| 2,226,804 | A | 12/1940 | Carroll |
| 2,371,840 | A | 3/1945 | Otis |
| 2,447,629 | A | 8/1948 | Beissinger et al. |
| 2,500,276 | A | 3/1950 | Church |
| 2,583,316 | A | 1/1952 | Bannister |
| 2,647,847 | A | 8/1953 | Black et al. |
| 2,734,580 | A | 2/1956 | Layne |
| 2,796,134 | A | 6/1957 | Binkley |
| 2,812,025 | A | 11/1957 | Teague et al. |
| 2,907,589 | A | 10/1959 | Knox |
| 2,929,741 | A | 1/1960 | Strock et al. |
| 3,015,362 | A | 1/1962 | Moosman |
| 3,039,530 | A | 6/1962 | Condra |
| 3,067,819 | A | 12/1962 | Gore |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,424,244 | A | 1/1969 | Kinley |
| 3,477,506 | A | 11/1969 | Malone |
| 3,489,220 | A | 1/1970 | Kinley |
| 3,498,376 | A | 3/1970 | Sizer et al. |
| 3,504,515 | A | 4/1970 | Reardon |
| 3,520,049 | A | 7/1970 | Lysenko et al. |
| 3,568,773 | A | 3/1971 | Chancellor |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinley et al. |
| 3,797,259 | A | 3/1974 | Kammerer, Jr. |
| 3,812,912 | A | 5/1974 | Wuenschel |
| 3,818,734 | A | 6/1974 | Bateman |
| 3,834,742 | A | 9/1974 | McPhillips |
| 3,885,298 | A | 5/1975 | Pogonowski |
| 3,887,006 | A | 6/1975 | Pitts |
| 3,893,718 | A | 7/1975 | Powell |
| 3,915,478 | A | 10/1975 | Al et al. |
| 3,935,910 | A | 2/1976 | Gaudy et al. |
| 3,945,444 | A | 3/1976 | Knudson |
| 3,948,321 | A | 4/1976 | Owen et al. |
| 3,977,473 | A | 8/1976 | Page, Jr. |
| 3,989,280 | A | 11/1976 | Schwarz |
| 3,997,193 | A | 12/1976 | Tsuda et al. |
| 4,019,579 | A | 4/1977 | Thuse |
| 4,026,583 | A | 5/1977 | Gottlieb |
| 4,069,573 | A | 1/1978 | Rogers et al. |
| 4,076,287 | A | 2/1978 | Bill et al. |
| 4,096,913 | A | 6/1978 | Kenneday et al. |
| 4,098,334 | A | 7/1978 | Crowe |
| 4,168,747 | A | 9/1979 | Youmans |
| 4,190,108 | A | 2/1980 | Webber |
| 4,205,422 | A | 6/1980 | Hardwick |
| 4,253,687 | A | 3/1981 | Maples |
| RE30,802 | E | 11/1981 | Rogers, Jr. |
| 4,304,428 | A | 12/1981 | Grigorian et al. |
| 4,328,983 | A | 5/1982 | Gibson |
| 4,359,889 | A | 11/1982 | Kelly |
| 4,363,358 | A | 12/1982 | Ellis |
| 4,366,971 | A | 1/1983 | Lula |
| 4,368,571 | A | 1/1983 | Cooper, Jr. |
| 4,379,471 | A | 4/1983 | Kuenzel |
| 4,384,625 | A | 5/1983 | Roper et al. |
| 4,388,752 | A | 6/1983 | Vinciguerra et al. |
| 4,391,325 | A | 7/1983 | Baker et al. |
| 4,393,931 | A | 7/1983 | Muse et al. |
| 4,402,372 | A | 9/1983 | Cherrington |
| 4,407,681 | A | 10/1983 | Ina et al. |
| 4,411,435 | A | 10/1983 | McStravick |
| 4,413,395 | A | 11/1983 | Garnier |
| 4,413,682 | A | 11/1983 | Callihan et al. |
| 4,420,866 | A | 12/1983 | Mueller |
| 4,421,169 | A | 12/1983 | Dearth et al. |
| 4,422,317 | A | 12/1983 | Mueller |
| 4,423,889 | A | 1/1984 | Weise |
| 4,423,986 | A | 1/1984 | Skogberg |
| 4,429,741 | A | 2/1984 | Hyland |
| 4,440,233 | A | 4/1984 | Baugh et al. |
| 4,444,250 | A | 4/1984 | Keithahn et al. |
| 4,462,471 | A | 7/1984 | Hipp |
| 4,467,630 | A | 8/1984 | Kelly |
| 4,473,245 | A | 9/1984 | Raulins et al. |
| 4,483,399 | A | 11/1984 | Colgate |
| 4,485,847 | A | 12/1984 | Wentzell |
| 4,491,001 | A | 1/1985 | Yoshida |
| 4,501,327 | A | 2/1985 | Retz |
| 4,505,017 | A | 3/1985 | Schukei |
| 4,505,987 | A | 3/1985 | Yamada et al. |

4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,553,776 A 11/1985 Dodd
4,573,248 A 3/1986 Hackett
4,576,386 A 3/1986 Benson et al.
4,581,817 A 4/1986 Kelly
4,590,995 A 5/1986 Evans
4,592,577 A 6/1986 Ayres et al.
4,601,343 A 7/1986 Lindsey, et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,651,836 A 3/1987 Richards
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,711,474 A 12/1987 Patrick
4,714,117 A 12/1987 Dech
4,730,851 A 3/1988 Watts
4,735,444 A 4/1988 Skipper
4,739,916 A 4/1988 Ayres et al.
4,776,394 A 10/1988 Lynde et al.
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,842,082 A 6/1989 Springer
4,848,459 A 7/1989 Blackwell et al.
4,856,592 A 8/1989 Van Bilderbeek et al.
4,865,127 A 9/1989 Koster
4,871,199 A 10/1989 Ridenour et al.
4,892,337 A 1/1990 Gunderson et al.
4,893,658 A 1/1990 Kimura et al.
4,907,828 A 3/1990 Chang
4,913,758 A 4/1990 Koster
4,915,426 A 4/1990 Skipper
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
5,014,779 A 5/1991 Meling et al.
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,079,837 A 1/1992 Vanselow
5,083,608 A 1/1992 Abdrakhmanov et al.
5,093,015 A 3/1992 Oldiges
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,197,553 A 3/1993 Leturno
5,209,600 A 5/1993 Koster
5,226,492 A 7/1993 Solaeche P. et al.
5,242,017 A 9/1993 Hailey
5,275,242 A 1/1994 Payne
5,286,393 A 2/1994 Oldiges et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,332,038 A 7/1994 Tapp et al.
5,332,049 A 7/1994 Tew
5,333,692 A 8/1994 Baugh et al.
5,334,809 A 8/1994 DiFrancesco
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Baro et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurber et al.
5,431,831 A 7/1995 Vincent
5,435,395 A 7/1995 Connell
5,439,320 A 8/1995 Abrams
5,454,419 A 10/1995 Vloedman
5,456,319 A 10/1995 Schmidt et al.
5,458,194 A 10/1995 Brooks
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.

5,524,937 A 6/1996 Sides, III et al.
5,535,824 A 7/1996 Hudson
5,536,422 A 7/1996 Oldiges et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,685,369 A 11/1997 Ellis et al.
5,695,008 A 12/1997 Bertet et al.
5,695,009 A 12/1997 Hipp
5,697,449 A 12/1997 Hennig et al.
5,718,288 A 2/1998 Bertet et al.
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,522 A 1/2000 Donnelly et al.
6,012,523 A 1/2000 Campbell et al.
6,012,874 A 1/2000 Groneck et al.
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 3/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,065,500 A 5/2000 Metcalfe
6,070,671 A 6/2000 Cumming et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein Knudson et al.
6,275,556 B1 8/2001 Kinney et al.
6,283,211 B1 9/2001 Vloedman
6,315,043 B1 11/2001 Farrant et al.
6,318,457 B1 11/2001 Den Boer et al.
6,325,148 B1 12/2001 Trahan et al.
6,328,113 B1 12/2001 Cook
6,343,495 B1 2/2002 Cheppe et al.
6,343,657 B1 2/2002 Baugh et al.
6,354,373 B1 3/2002 Vercaemer et al.
6,405,761 B1 6/2002 Shimizu et al.
6,406,063 B1 6/2002 Pfeiffer
6,419,033 B1 7/2002 Hahn et al.
6,419,147 B1 7/2002 Daniel
6,425,444 B1 7/2002 Metcalfe et al.
6,446,724 B2 9/2002 Baugh et al.
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,014 B1 10/2002 Bernat
6,491,108 B1 12/2002 Slup et al.
6,550,539 B2 4/2003 Maguire et al.
6,568,488 B2 5/2003 Wentworth et al.
6,598,678 B1 7/2003 Simpson
6,607,220 B2 8/2003 Sivley
6,619,696 B2 9/2003 Baugh et al.
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,903 B1 11/2003 Cook et al.
6,648,075 B2 11/2003 Badrak et al.
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,695,012 B1 2/2004 Ring et al.
6,695,065 B2 2/2004 Simpson et al.
6,705,395 B2 3/2004 Cook et al.
6,712,154 B2 3/2004 Cook et al.
6,725,919 B2 4/2004 Cook et al.
6,745,845 B2 6/2004 Cook et al.
6,758,278 B2 7/2004 Cook et al.
6,823,937 B1 11/2004 Cook et al.
2001/0002626 A1 6/2001 Frank et al.
2001/0020532 A1 9/2001 Baugh et al.
2002/0011339 A1 1/2002 Murray
2002/0014339 A1 2/2002 Ross
2002/0020524 A1 2/2002 Gano
2002/0033261 A1 3/2002 Metcalfe
2002/0062956 A1 5/2002 Murray et al.

| | | | |
|---|---|---|---|
| 2002/0066576 | A1 | 6/2002 | Cook et al. |
| 2002/0066578 | A1 | 6/2002 | Broome |
| 2002/0070023 | A1 | 6/2002 | Turner et al. |
| 2002/0070031 | A1 | 6/2002 | Voll et al. |
| 2002/0079101 | A1 | 6/2002 | Baugh et al. |
| 2002/0084070 | A1 | 7/2002 | Voll et al. |
| 2002/0092654 | A1 | 7/2002 | Coronado et al. |
| 2002/0139540 | A1 | 10/2002 | Lauritzen |
| 2002/0144822 | A1 | 10/2002 | Hackworth et al. |
| 2002/0148612 | A1 | 10/2002 | Cook et al. |
| 2002/0185274 | A1 | 12/2002 | Simpson et al. |
| 2002/0189816 | A1 | 12/2002 | Cook et al. |
| 2002/0195252 | A1 | 12/2002 | Maguire et al. |
| 2002/0195256 | A1 | 12/2002 | Metcalfe et al. |
| 2003/0024708 | A1 | 2/2003 | Ring et al. |
| 2003/0024711 | A1 | 2/2003 | Simpson et al. |
| 2003/0067166 | A1 | 4/2003 | Maguire |
| 2003/0173090 | A1 | 9/2003 | Cook et al. |
| 2003/0192705 | A1 | 10/2003 | Cook et al. |
| 2003/0222455 | A1 | 12/2003 | Cook et al. |
| 2004/0045616 | A1 | 3/2004 | Cook et al. |
| 2004/0045718 | A1 | 3/2004 | Brisco et al. |
| 2004/0069499 | A1 | 4/2004 | Cook et al. |
| 2004/0188099 | A1 | 9/2004 | Cook et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| CA | 736288 | | 6/1966 |
| CA | 771462 | | 11/1967 |
| CA | 1171310 | | 7/1984 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 272511 | | 12/1987 |
| EP | 294264 | | 5/1988 |
| EP | 553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1152120 | A2 | 11/2001 |
| EP | 1152120 | A3 | 11/2001 |
| FR | 2717855 | A1 | 9/1995 |
| FR | 2741907 | A1 | 6/1997 |
| FR | 2771133 | A | 5/1999 |
| FR | 2780751 | | 1/2000 |
| GB | 557823 | | 12/1943 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2347950 | B | 8/2003 |
| GB | 2387405 | A | 10/2003 |
| GB | 2388134 | A | 11/2003 |
| GB | 2388860 | A | 11/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2390387 | B | 4/2004 |
| GB | 2391575 | B | 5/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |

| | | | |
|---|---|---|---|
| GB | 2399849 | A | 9/2004 |
| GB | 2399850 | A | 9/2004 |
| GB | 2384502 | B | 10/2004 |
| GB | 2396644 | B | 10/2004 |
| GB | 2400624 | A | 10/2004 |
| GB | 2396640 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| JP | 208458 | | 10/1985 |
| JP | 64-475715 | | 3/1989 |
| JP | 102875 | | 4/1995 |
| JP | 94068 | A | 4/2000 |
| JP | 107807 | A | 4/2000 |
| JP | 162192 | | 6/2000 |
| NL | 9001081 | | 12/1991 |
| RO | 113267 | B1 | 5/1998 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |

| | | | |
|---|---|---|---|
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04535 | A1 | 1/2001 |
| WO | WO01/18354 | A1 | 3/2001 |
| WO | WO01/26860 | A1 | 4/2001 |
| WO | WO01/83943 | A1 | 11/2001 |
| WO | WO02/25059 | A1 | 3/2002 |
| WO | WO02/095181 | A1 | 5/2002 |
| WO | WO02/053867 | A3 | 7/2002 |
| WO | WO02/053867 | A2 | 7/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/012255 | A1 | 2/2003 |
| WO | WO03/023178 | A3 | 3/2003 |
| WO | WO03/023178 | A2 | 3/2003 |
| WO | WO03/023179 | A2 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042487 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/059549 | A1 | 7/2003 |
| WO | WO03/086675 | A3 | 10/2003 |
| WO | WO03/106130 | A2 | 12/2003 |
| WO | WO04/003337 | A1 | 1/2004 |
| WO | WO04/009950 | A1 | 1/2004 |
| WO | WO04/010039 | A3 | 1/2004 |
| WO | WO04/010039 | A2 | 1/2004 |
| WO | WO04/011776 | A3 | 2/2004 |
| WO | WO04/011776 | A2 | 2/2004 |
| WO | WO04/018823 | A3 | 3/2004 |
| WO | WO04/018823 | A2 | 3/2004 |
| WO | WO04/018824 | A3 | 3/2004 |
| WO | WO04/018824 | A2 | 3/2004 |
| WO | WO04/020895 | A3 | 3/2004 |
| WO | WO04/020895 | A2 | 3/2004 |
| WO | WO04/023014 | A2 | 3/2004 |
| WO | WO04/026017 | A3 | 4/2004 |
| WO | WO04/026017 | A2 | 4/2004 |
| WO | WO04/026073 | A3 | 4/2004 |
| WO | WO04/026073 | A2 | 4/2004 |
| WO | WO04/026500 | A2 | 4/2004 |
| WO | WO04/027200 | A2 | 4/2004 |
| WO | WO04/027200 | A3 | 4/2004 |
| WO | WO04/027204 | A2 | 4/2004 |
| WO | WO04/027204 | A3 | 4/2004 |
| WO | WO04/027205 | A2 | 4/2004 |
| WO | WO04/027205 | A3 | 4/2004 |
| WO | WO04/027392 | A1 | 4/2004 |
| WO | WO04/027786 | A3 | 4/2004 |
| WO | WO04/027786 | A2 | 4/2004 |
| WO | WO04/053434 | A2 | 6/2004 |
| WO | WO04/053434 | A3 | 6/2004 |
| WO | WO04/067961 | A2 | 8/2004 |
| WO | WO04/074622 | A2 | 9/2004 |
| WO | WO04/076798 | A2 | 9/2004 |
| WO | WO04/081346 | A2 | 9/2004 |
| WO | WO04/083591 | A2 | 9/2004 |
| WO | WO04/083592 | A2 | 9/2004 |
| WO | WO04/083593 | A2 | 9/2004 |
| WO | WO04/083594 | A2 | 9/2004 |
| WO | WO04/085790 | A2 | 10/2004 |
| WO | WO04/089608 | A2 | 10/2004 |
| WO | WO04/092527 | A3 | 10/2004 |
| WO | WO04/092528 | A2 | 10/2004 |
| WO | WO04/092530 | A2 | 10/2004 |
| WO | WO04/094766 | A2 | 11/2004 |

OTHER PUBLICATIONS

Examination Report to Application No. GB 0220872.6, Oct. 29, 2004.
Examination Report to Application No. GB 0225505.7, Oct. 27, 2004.
Examination Report to Application No. GB 0306046.4, Sep. 10, 2004.
Examination Report to Application No. GB 0314846.7, Jul. 15, 2004.
Examination Report to Application No. GB 0400018.8; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0404830.2, Aug. 17, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.

Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/25727; May 17, 2004.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Haliburton Energy Services, "Halliburton Completion Products" 1996, Page Packers 5–37, United States of America.
Turcotte and Schubert, Geodynamics (1982) John Wiley & Sons, Inc., pp 9, 432.
Baker Hughes Incorporated, "EXPatch Expandable Cladding System" (2002).
Baker Hughes Incorporated, "EXPress Expandable Screen System".
High–Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet–Lok Product Application Description" (Aug. 8, 2003).
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jun. 12, 2000.
Search Report to Application No. GB 0003251.6, Jul. 13, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.
Search Report to Application No. GB 9926449.1, Sep. 5, 2001.
Search Report to Application No. 1999 5593, Aug. 20, 2002.
Search Report to Application No. GB 0004285.3, Aug. 28, 2002.
Examination Report Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6, Mar. 13, 2003.
Examination Report to Application No. 0004285.3, Mar. 28, 2003.
Examination Report to Application No. GB 0208367.3, Apr. 4, 2003.
Examination Report to Application No. GB 0212443.6, Apr. 10, 2003.

Search and Examination Report to Application No. GB 0308296.3, Jun. 2, 2003.
Search and Examination Report to Application No. GB 0308297.1, Jun. 2, 2003.
Search and Examination Report to Application No. GB 0308295.5, Jun. 2, 2003.
Search and Examination Report to Application No. GB 0308293.0, Jun. 2, 2003.
Search and Examination Report to Application No. GB 0308294.6, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Search Report to Application No. GB 0003251.6, Claims Searched 1–5, Jul. 13, 2000.
Search Report to Application No. GB 0004285.3, Claims Searched 2–3, 8–9, 13–16, Jan. 17, 2001.
Search Report to Application No. GB 0005399.1, Claims Searched 25–29, Feb. 15, 2001.
Search Report to Application No. GB 9930398.4, Claims Searched 1–35, Jun. 27, 2000.
International Search Report, Application No. PCT/US00/30022, Oct. 31, 2000.
International Search Report, Application No. PCT/US01/19014, Jun. 12, 2001.
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;" Analysis of Metal Sheet Formability and It's Factors of Influence" Prof. Dorel Banabic (2003).
www.materialsresources.com, "Low Temperature Bonding of Dissimilar and Hard–to–Bond Materials and Metal–Including . . . " (2004).
www.tribtech.com. "Trib–gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro–Surface Texturing on Breakaway Torque and Blister Formation on Carbon–Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingenman and I Etsion (2002).
Proceeding of the International Tribology Conference, "Microtexturing of Functional Surfaces for Improving Their Tribological Performance" Henry Haefke, Yvonne Gerbig; Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingeman and I. Etsion (Mar. 2003).
PT Design, "Scratching the Surface" Todd E. Lizotte (Jun. 1999).
Tribology Transactions, "Friction–Reducing Surface–Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Search Report, Application PCT/US02/25608; May 24, 2004.

International Search Report, Application PCT/US02/25727; Feb. 19, 2004.
International Search Report, Application PCT/US02/36157; Sep. 29, 2003.
International Search Report, Application PCT/US02/36157; Apr. 14, 2004.
International Search Report, Application PCT/US02/36257; May 21, 2004.
International Search Report, Application PCT/US02/39425; May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
Examination Report Application PCT/US03/10144; Jul. 7, 2004.
International Search Report, Application PCT/US03/11765; Nov. 13, 2003.
International Search Report, Application PCT/US03/13787; May 28, 2004.
International Search Report, Application PCT/US03/14153; May 28, 2004.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Search Report, Application PCT/US03/38550; Jun. 15, 2004.
Search Report to Application No. GB 0004285.3, Jan. 19, 2001.
Examination Report to Application No. GB 0005399.1; Jul. 24, 2000.
Examination Report to Application No. GB 0005399.1; Oct. 14, 2002.
Examination Report to Application No. GB 0013661.4, Nov. 25, 2003.
Search Report to Application No. GB 0013661.4, Oct. 20, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0216409.3, Feb. 9, 2004.
Examination Report to Application No. GB 0219757.2, May 10, 2004.
Examination Report to Application No. GB 0300085.8, Nov. 28, 2003.
Examination Report to Application No. GB 030086.6, Dec. 1, 2003.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Appl. No. GB 0308303.7, Jul. 14, 2003.
Examination Report to Application No. GB 0311596.1, May 18, 2004.
Search and Examination Report to Application No. GB 0313406.1, Sep. 3, 2003.
Search and Examination Report to Application No. GB 0316883.8, Nov. 25, 2003.
Search and Examination Report to Application No. GB 0316886.1, Nov. 25, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.

Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0404796.5; May 20, 2003.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Search and Examination Report to Application No. GB 0411894.9, Jun. 30, 2004.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/39418; Jun. 9, 2004.

10

300

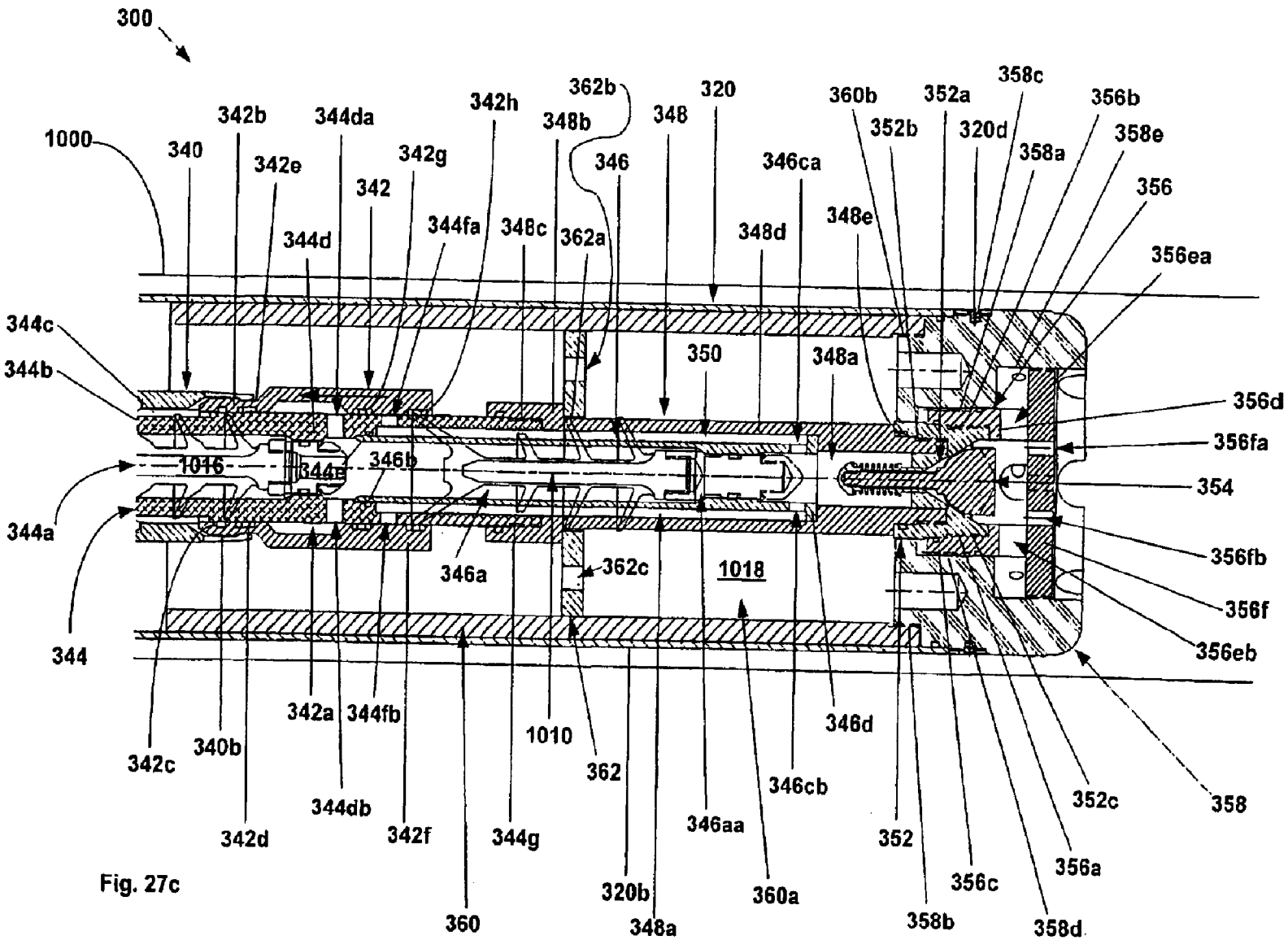
300
1000
340
342b
342e
344d
344da
342
342g
344fa
342h
348c
348b
362a
362b
346
348
320
348d
346ca
348e
360b
352b
352a
320d
358c
358a
356b
358e
356
356ea
356d
356fa
354
356fb
356f
356eb
358
352c
356a
358d
356c
358b
352
346d
346cb
360a
1018
346aa
348a
320b
362
362c
1010
344g
360
346a
342f
344fb
344db
342a
342d
340b
342c
344
344a
344b
344c
1016
346b
344ga
344d
342e
342b

300

300
1000
340
342b
342e
344d
344da
342
342g
344fa
342h
348b
362b
346
348c
362a
348
320
348d
346ca
348e
360b
352b
352a
320d
358a
358c
356b
358e
356
356ea
356d
356fa
354
356fb
356f
356eb
358
352c
356a
358d
356c
358b
352
346d
346cb
360a
1018
346aa
348a
320b
362
362c
1010
344g
360
346a
342f
344fb
344db
342a
342d
340b
342c
1016
344b
344c
344a
344

LINER HANGER WITH SLIDING SLEEVE VALVE

CROSS REFERENCE TO RELATED APPLICATIONS

This application is a National Phase of the International Application No. PCT/US01/28960 filed Sep. 17, 2001, which is based on U.S. application Ser. No. 60/233,638, filed on Sep. 18, 2000, the disclosure of which is incorporated herein by reference.

This application is related to the following applications: (1) U.S. patent application Ser. No. 09/454,139, filed on Dec. 3, 1999, now U.S. Pat. No. 6,497,289 issued Dec. 24, 2002, (2) U.S. patent application Ser. No. 09/510,913, filed on Feb. 23, 2000, (3) U.S. patent application Ser. No. 09/502,350, filed on Feb. 10, 2000, now U.S. Pat. No. 6,823,937 issued Nov. 30, 2004, (4) U.S. patent application Ser. No. 09/440,338, filed on Nov. 15 1999, now U.S. Pat. No. 6,328,113 issued Dec. 11, 2001, (5) U.S. patent application Ser. No. 09/523,468, filed on Mar. 10, 2000, now U.S. Pat. No. 6,640,903 issued Nov. 14, 2003, (6) U.S. patent application Ser. No. 09/512,895, filed on Feb. 24, 2000, (7) U.S. patent application Ser. No. 09/511,941, filed on Feb. 24, 2000, now U.S. Pat. No. 6,575,240 issued Jun. 10, 2003, (8) U.S. patent application Ser. No. 09/588,946, filed on Jun. 7, 2000, now U.S. Pat. No. 6,557,640 issued May 6, 2003, (9) U.S. patent application Ser. No. 09/559,122, filed on Apr. 26, 2000, now U.S. Pat. No. 6,604,763 issued Aug. 12, 2003, (10) U.S. patent application Ser. No. 10/030,593, filed on Jan. 18, 2002, (11) U.S. patent application Ser. No. 10/111,982, based on U.S. provisional patent application Ser. No. 60/162,671, filed on Nov. 1, 1999, (12) U.S. provisional patent application Ser. No. 60/154,047, filed on Sep. 16, 1999, (13) U.S patent application Ser. No. 09/679,907, now U.S. Pat. No. 6,564,875 issued May 20, 2004 based on U.S. provisional patent application Ser. No. 60/159,082, filed on Oct. 12, 1999, (14) U.S. patent application Ser. No. 10/089,419, filed Sep. 19, 2002 based on U.S. provisional patent application Ser. No. 60/159,039, filed on Oct. 12, 1999, (15) U.S. patent application Ser. No. 09/679,906, filed Oct. 5, 2000 based on U.S. provisional patent application Ser. No. 60/159,033, filed on Oct. 12, 1999, (16) U.S. patent application Ser. No. 10/303,992, filed Nov. 22, 2002 based on U.S. provisional patent application Ser. No. 60/212,359, filed on Jun. 19, 2000, (17) U.S. provisional patent application Ser. No. 60/165,228, filed on Nov. 12, 1999, (18) U.S. patent application Ser. No. 10/311,412, filed on Aug. 11, 2003 based on U.S. provisional patent application Ser. No. 60/221,443, filed on Jul. 28, 2000, and (19) U.S. patent application Ser. No. 10/322,947, filed Dec. 18, 2002 based on U.S. provisional patent application Ser. No. 60/221,645, filed on Jul. 28, 2000. Applicants incorporate by reference the disclosures of these applications.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming wellbores.

SUMMARY OF THE INVENTION

According to one aspect of the invention, a method of forming a wellbore casing within a borehole within a subterranean formation is provided that includes positioning an expandable tubular member within the borehole, injecting fluidic materials into the expandable tubular member, fluidicly isolating a first region from a second region within the expandable tubular member, fluidicly coupling the first and second regions, injecting a hardenable fluidic sealing material into the expandable tubular member, fluidicly decoupling the first and second regions, and injecting a non-hardenable fluidic material into the expandable tubular member to radially expand the tubular member.

According to another aspect of the present invention, an apparatus for forming a wellbore casing within a borehole within a subterranean formation is provided that includes means for positioning an expandable tubular member within the borehole, means for injecting fluidic materials into the expandable tubular member, means for fluidicly isolating a first region from a second region within the expandable tubular member, means for fluidicly coupling the first and second regions, means for injecting a hardenable fluidic sealing material into the expandable tubular member, means for fluidicly decoupling the first and second regions, and means for injecting a non-hardenable fluidic material into the expandable tubular member to radially expand the tubular member.

According to another aspect of the present invention, a method of forming a wellbore casing within a borehole within a subterranean formation is provided that includes positioning an expandable tubular member within the borehole, injecting fluidic materials into the expandable tubular member, fluidicly isolating a first region from a second region within the expandable tubular member, injecting a non-hardenable fluidic material into the expandable tubular member to radially expand at least a portion of the tubular member, fluidicly coupling the first and second regions, injecting a hardenable fluidic sealing material into the expandable tubular member, fluidicly decoupling the first and second regions, and injecting a non-hardenable fluidic material into the expandable tubular member to radially expand another portion of the tubular member.

According to another aspect of the present invention, an apparatus for forming a wellbore casing within a borehole within a subterranean formation is provided that includes means for positioning an expandable tubular member within the borehole, means for injecting fluidic materials into the expandable tubular member, means for fluidicly isolating a first region from a second region within the expandable tubular member, means for injecting a non-hardenable fluidic material into the expandable tubular member to radially expand at least a portion of the tubular member, means for fluidicly coupling the first and second regions, means for injecting a hardenable fluidic sealing material into the expandable tubular member, means for fluidicly decoupling the first and second regions, and means for injecting a non-hardenable fluidic material into the expandable tubular member to radially expand another portion of the tubular member.

According to another aspect of the present invention, an apparatus for forming a wellbore casing within a borehole within a subterranean formation is provided that includes a first annular support member defining a first fluid passage and one or more first radial passages having pressure sensitive valves fluidicly coupled to the first fluid passage, an annular expansion cone coupled to the first annular support member, an expandable tubular member movably coupled to the expansion cone, a second annular support member defining a second fluid passage coupled to the expandable tubular member, an annular valve member defining a third fluid passage fluidicly coupled to the first and second fluid passages having first and second throat passages, defining second and third radial passages fluidicly coupled to the third fluid passage, coupled to the second annular support member, and movably coupled to the first annular support member, and an annular sleeve releasably coupled to the first annular support member and movably coupled to the annular valve member for controllably fluidicly coupling the second and third radial passages. An annular region is defined by the region between the tubular member and the first annular support member, the second annular support member, the annular valve member, and the annular sleeve.

According to another aspect of the present invention, an apparatus for forming a wellbore casing in a borehole in a subterranean formation is provided that includes means for radially expanding an expandable tubular member and means for injecting a hardenable fluidic sealing material into an annulus between the expandable tubular member and the borehole.

According to another aspect of the present invention, a method of operating an apparatus for forming a wellbore casing within a borehole within a subterranean formation is provided. The apparatus includes a first annular support member defining a first fluid passage and one or more first radial passages having pressure sensitive valves fluidicly coupled to the first fluid passage, an annular expansion cone coupled to the first annular support member, an expandable tubular member movably coupled to the expansion cone, a second annular support member defining a second fluid passage coupled to the expandable tubular member, an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member, and an annular sleeve releasably coupled to the first annular support member and movably coupled to the annular valve member for controllably fluidicly coupling the second and third radial passages. An annular region is defined by the region between the tubular member and the first annular support member, the second annular support member, the annular valve member, and the annular sleeve. The method includes positioning the apparatus within the borehole, injecting fluidic materials into the first, second and third fluid passages, positioning a bottom plug in the bottom throat passage, displacing the annular sleeve to fluidicly couple the second and third radial passages, injecting a hardenable fluidic sealing material through the first, second, and third fluid passages, and the second and third radial passages, displacing the annular sleeve to fluidicly decouple the second and third radial passages, and injecting a non-hardenable fluidic material through the first fluid passage and the first radial passages and pressure sensitive valves into the annular region to radially expand the expandable tubular member.

According to another aspect of the present invention, a method of operating an apparatus for forming a wellbore casing within a borehole within a subterranean formation is provided in which the apparatus includes a first annular support member defining a first fluid passage and one or more first radial passages having pressure sensitive valves fluidicly coupled to the first fluid passage, an annular expansion cone coupled to the first annular support member, an expandable tubular member movably coupled to the expansion cone, a second annular support member defining a second fluid passage coupled to the expandable tubular member, an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member, and an annular sleeve releasably coupled to the first annular support member and movably coupled to the annular valve member for controllably fluidicly coupling the second and third radial passages. An annular region is defined by the region between the tubular member and the first annular support member, the second annular support member, the annular valve member, and the annular sleeve. The method includes positioning the apparatus within the borehole, injecting fluidic materials into the first, second and third fluid passages, positioning a bottom plug in the bottom throat passage, injecting a non-hardenable fluidic material through the first fluid passages and the first radial passages and pressure sensitive valves into the annular region to radially expand a portion of the expandable tubular member, displacing the annular sleeve to fluidicly couple the second and third radial passages, injecting a hardenable fluidic sealing material through the first, second, and third fluid passages, and the second and third radial passages, displacing the annular sleeve to fluidicly decouple the second and third radial passages, and injecting a non-hardenable fluidic material through the first fluid passage and the first radial passages and pressure sensitive valves into the annular region to radially expand another portion of the expandable tubular member.

According to one aspect of the invention, a method of coupling an expandable tubular member to a preexisting structure is provided that includes positioning an expandable tubular member within the preexisting structure, injecting fluidic materials into the expandable tubular member, fluidicly isolating a first region from a second region within the expandable tubular member, fluidicly coupling the first and second regions, injecting a hardenable fluidic sealing material into the expandable tubular member, fluidicly decoupling the first and second regions, and injecting a non-hardenable fluidic material into the expandable tubular member to radially expand the tubular member.

According to another aspect of the present invention, an apparatus for coupling an expandable tubular member to a preexisting structure is provided that includes means for positioning the expandable tubular member within the preexisting structure, means for injecting fluidic materials into the expandable tubular member, means for fluidicly isolating a first region from a second region within the expandable tubular member, means for fluidicly coupling the first and second regions, means for injecting a hardenable fluidic sealing material into the expandable tubular member, means for fluidicly decoupling the first and second regions, and means for injecting a non-hardenable fluidic material into the expandable tubular member to radially expand the tubular member.

According to another aspect of the present invention, a method of coupling an expandable tubular member to a preexisting structure is provided that includes positioning the expandable tubular member within the preexisting structure, injecting fluidic materials into the expandable tubular member, fluidicly isolating a first region from a second region within the expandable tubular member, injecting a non-hardenable fluidic material into the expandable tubular member to radially expand at least a portion of the tubular member, fluidicly coupling the first and second regions, injecting a hardenable fluidic sealing material into the expandable tubular member, fluidicly decoupling the first and second regions, and injecting a non-hardenable fluidic material into the expandable tubular member to radially expand another portion of the tubular member.

According to another aspect of the present invention, an apparatus for coupling an expandable tubular member to a preexisting structure is provided that includes means for positioning the expandable tubular member within the preexisting structure, means for injecting fluidic materials into the expandable tubular member, means for fluidicly isolating a first region from a second region within the expandable tubular member, means for injecting a non-hardenable fluidic material into the expandable tubular member to radially expand at least a portion of the tubular member, means for fluidicly coupling the first and second regions, means for injecting a hardenable fluidic sealing material into the expandable tubular member, means for fluidicly decoupling the first and second regions, and means for injecting a non-hardenable fluidic material into the expandable tubular member to radially expand another portion of the tubular member.

According to another aspect of the present invention, an apparatus for coupling an expandable tubular member to a preexisting structure is provided that includes a first annular support member defining a first fluid passage and one or more first radial passages having pressure sensitive valves fluidicly coupled to the first fluid passage, an annular expansion cone coupled to the first annular support member, an expandable tubular member movably coupled to the expansion cone, a second annular support member defining a second fluid passage coupled to the expandable tubular member, an annular valve member defining a third fluid passage fluidicly coupled to the first and second fluid passages having first and second throat passages, defining second and third radial passages fluidicly coupled to the third fluid passage, coupled to the second annular support member, and movably coupled to the first annular support member, and an annular sleeve releasably coupled to the first annular support member and movably coupled to the annular valve member for controllably fluidicly coupling the second and third radial passages. An annular region is defined by the region between the tubular member and the first annular support member, the second annular support member, the annular valve member, and the annular sleeve.

According to another aspect of the present invention, an apparatus for coupling an expandable tubular member to a preexisting structure is provided that includes means for radially expanding an expandable tubular member and means for injecting a hardenable fluidic sealing material into an annulus between the expandable tubular member and the borehole.

According to another aspect of the present invention, a method of operating an apparatus for coupling an expandable tubular member to a preexisting structure is provided. The apparatus includes a first annular support member defining a first fluid passage and one or more first radial passages having pressure sensitive valves fluidicly coupled to the first fluid passage, an annular expansion cone coupled to the first annular support member, an expandable tubular member movably coupled to the expansion cone, a second annular support member defining a second fluid passage coupled to the expandable tubular member, an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member, and an annular sleeve releasably coupled to the first annular support member and movably coupled to the annular valve member for controllably fluidicly coupling the second and third radial passages. An annular region is defined by the region between the tubular member and the first annular support member, the second annular support member, the annular valve member, and the annular sleeve. The method includes positioning the apparatus within the preexisting structure, injecting fluidic materials into the first, second and third fluid passages, positioning a bottom plug in the bottom throat passage, displacing the annular sleeve to fluidicly couple the second and third radial passages, injecting a hardenable fluidic sealing material through the first, second, and third fluid passages, and the second and third radial passages, displacing the annular sleeve to fluidicly decouple the second and third radial passages, and injecting a non-hardenable fluidic material through the first fluid passage and the first radial passages and pressure sensitive valves into the annular region to radially expand the expandable tubular member.

According to another aspect of the present invention, a method of operating an apparatus for coupling an expandable tubular member to a preexisting structure is provided in which the apparatus includes a first annular support member defining a first fluid passage and one or more first radial passages having pressure sensitive valves fluidicly coupled to the first fluid passage, an annular expansion cone coupled to the first annular support member, an expandable tubular member movably coupled to the expansion cone, a second annular support member defining a second fluid passage coupled to the expandable tubular member, an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member, and an annular sleeve releasably coupled to the first annular support member and movably coupled to the annular valve member for controllably fluidicly coupling the second and third radial passages. An annular region is defined by the region between the tubular member and the first annular support member, the second annular support member, the annular valve member, and the annular sleeve. The method includes positioning the apparatus within the preexisting structure, injecting fluidic materials into the first, second and third fluid passages, positioning a bottom plug in the bottom throat passage, injecting a non-hardenable fluidic material through the first fluid passages and the first radial passages and pressure sensitive valves into the annular region to radially expand a portion of the expandable tubular member, displacing the annular sleeve to fluidicly couple the second and third radial passages, injecting a hardenable fluidic sealing material through the first, second, and third fluid passages, and the second and third radial passages, displacing the annular sleeve to fluidicly decouple the second and third radial passages, and injecting a non-hardenable fluidic material through the first fluid passage and the first radial passages and pressure sensitive valves into the annular region to radially expand another portion of the expandable tubular member.

BRIEF DESCRIPTION OF THE DRAWINGS

FIGS. 27*a*–27*c* are cross sectional illustrations of the injection of a pressurized fluidic material into the liner hanger assembly of FIGS. 26*a*–26*c* in order to radially expand and plastically deform the expansion cone launcher.

DETAILED DESCRIPTION

Figure 1:
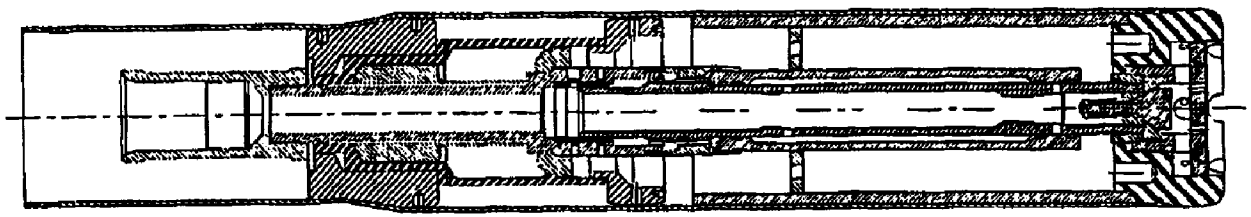
FIGS. 1 and 1*a*–1*c* are cross sectional illustrations of an embodiment of a liner hanger assembly including a sliding sleeve valve assembly.
Figure 1A:
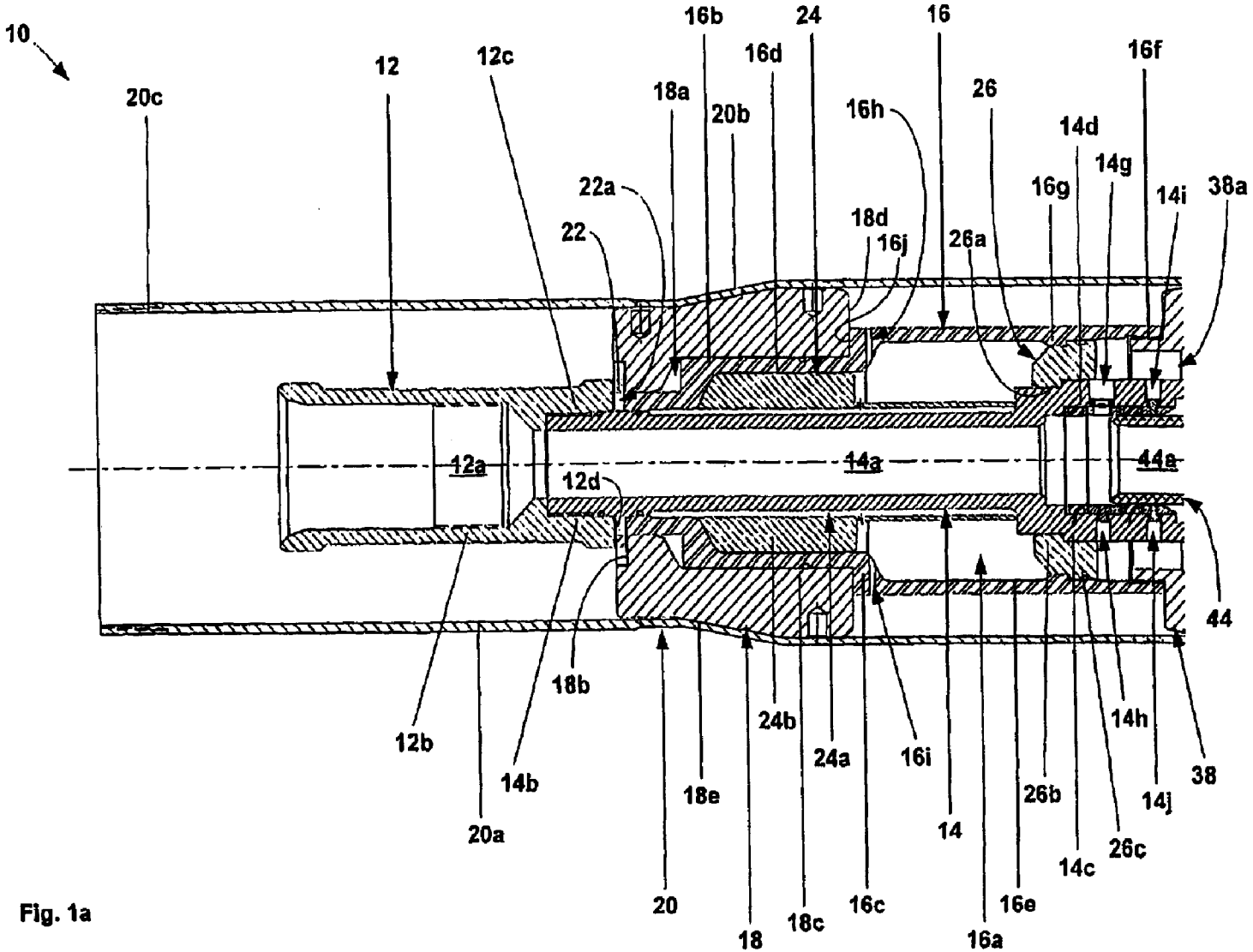
Figure 1B:
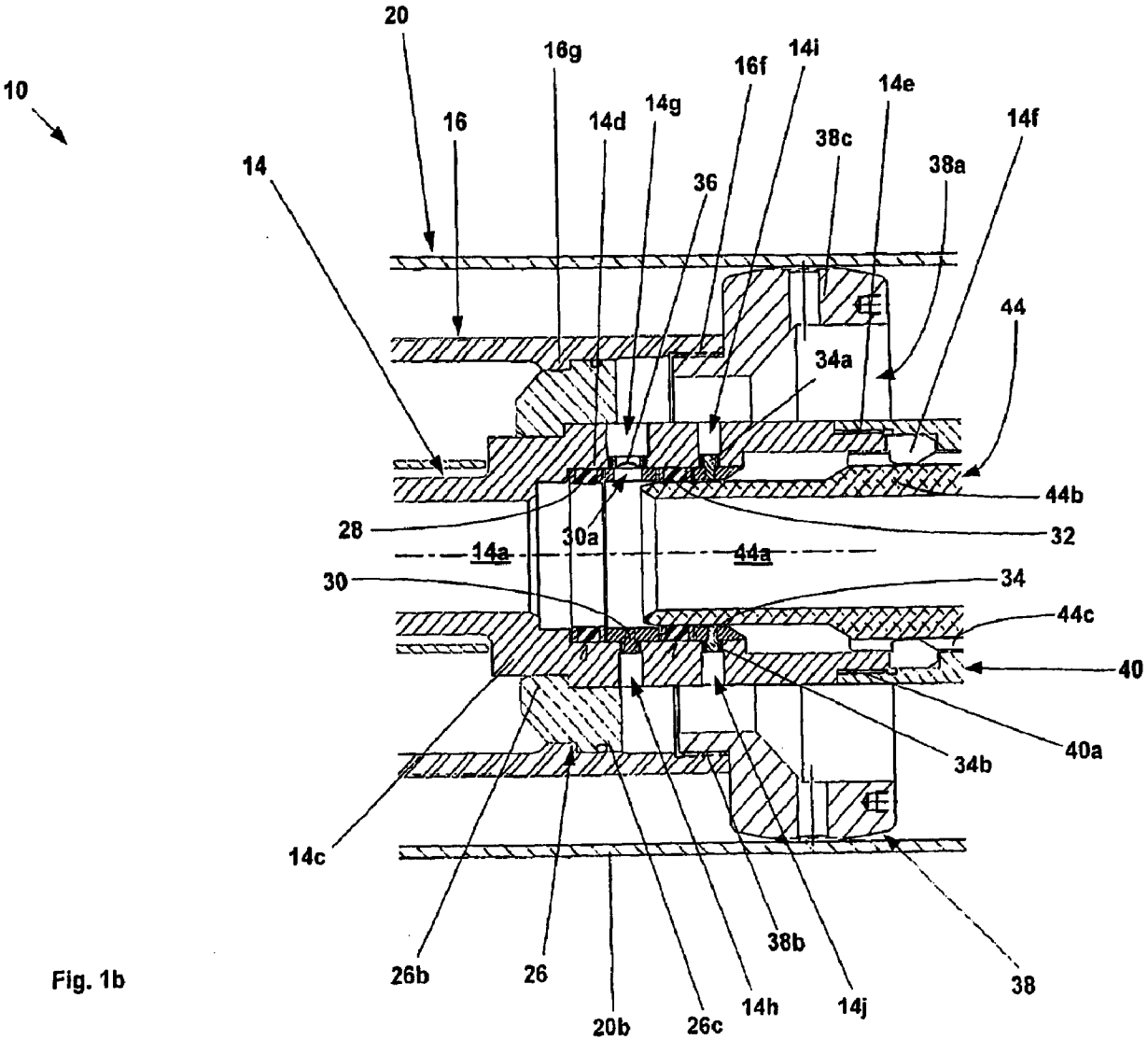
Figure 1C:
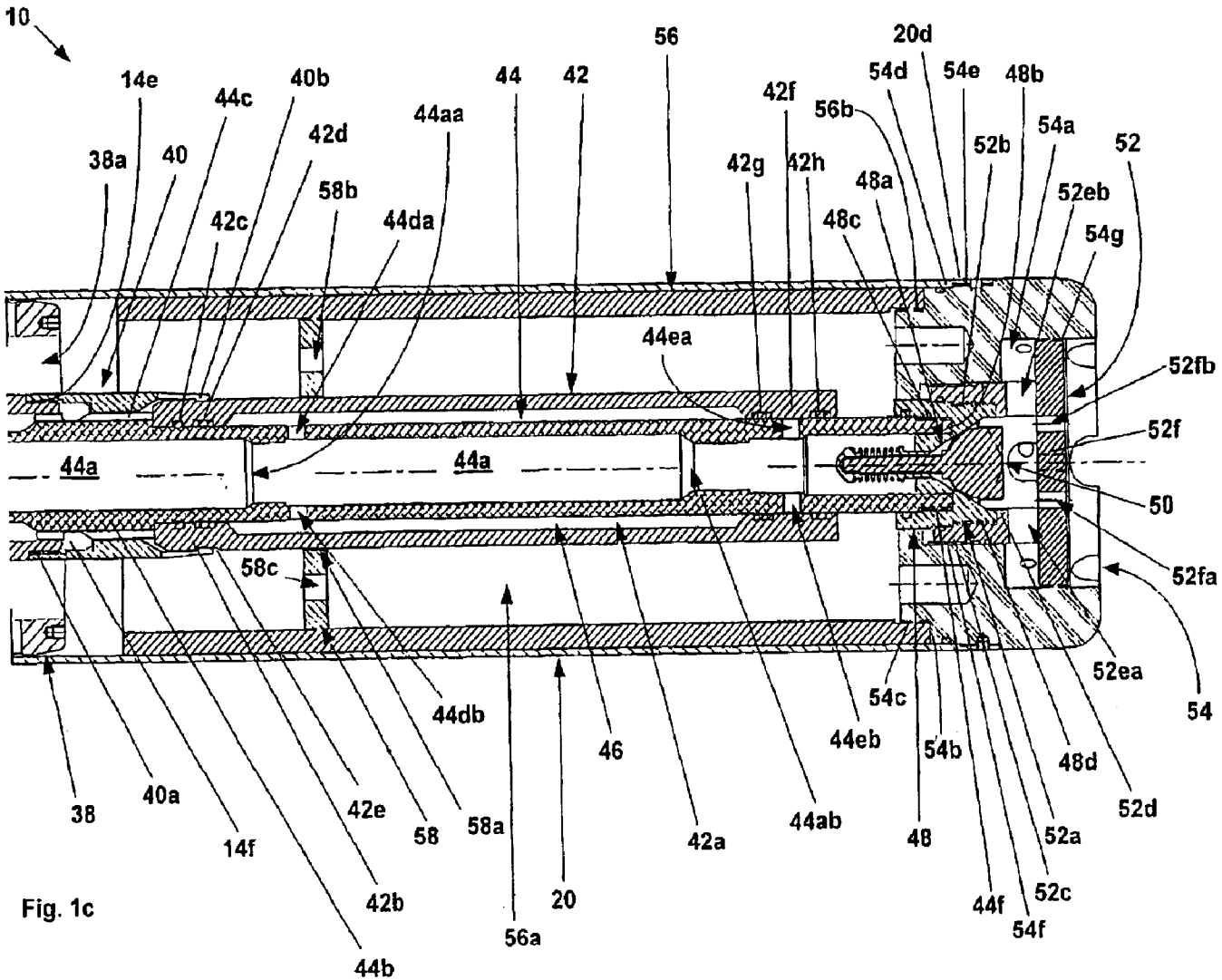

A liner hanger assembly having sliding sleeve bypass valve is provided. In several alternative embodiments, the liner hanger assembly provides a method and apparatus for forming or repairing a wellbore casing, a pipeline or a structural support.

Referring initially to FIGS. 1, 1*a*, 1*b*, and 1*c*, an embodiment of a liner hanger assembly 10 includes a first tubular support member 12 defining an internal passage 12*a* that includes a threaded counterbore 12*b* at one end, and a threaded counterbore 12*c* at another end. A second tubular support member 14 defining an internal passage 14*a* includes a first threaded portion 14*b* at a first end that is coupled to the threaded counterbore 12*c* of the first tubular support member 12, a stepped flange 14*c*, a counterbore 14*d*, a threaded portion 14*e*, and internal splines 14*f* at another end. The stepped flange 14*c* of the second tubular support member 14 further defines radial passages 14*g*, 14*h*, 14*i*, and 14*j*. A third tubular support member 16 defining an internal passage 16*a* for receiving the second tubular support member 14 includes a first flange 16*b*, a second flange 16*c*, a first counterbore 16*d*, a second counterbore 16*e* having an internally threaded portion 16*f*, and an internal flange 16*g*. The second flange 16*c* further includes radial passages 16*h* and 16*i*.

An annular expansion cone 18 defining an internal passage 18*a* for receiving the second and third tubular support members, 14 and 16, includes a counterbore 18*b* at one end, and a counterbore 18*c* at another end for receiving the flange 16*b* of the second tubular support member 16. The annular expansion cone 18 further includes an end face 18*d* that mates with an end face 16*j* of the flange 16*c* of the second tubular support member 16, and an exterior surface 18*e* having a conical shape in order to facilitate the radial expansion of tubular members. A tubular expansion cone launcher 20 is movably coupled to the exterior surface 18*e* of the expansion cone 18 and includes a first portion 20*a* having a first wall thickness, a second portion 20*b* having a second wall thickness, a threaded portion 20*c* at one end, and a threaded portion 20*d* at another end. In a preferred embodiment, the second portion 20*b* of the expansion cone launcher 20 mates with the conical outer surface 18*e* of the expansion cone 18. In a preferred embodiment, the second wall thickness is less than the first wall thickness in order to optimize the radial expansion of the expansion cone launcher 20 by the relative axial displacement of the expansion cone 18. In a preferred embodiment, one or more expandable tubulars are coupled to the threaded connection 20*c* of the expansion cone launcher 20. In this manner, the assembly 10 may be used to radially expand and plastically deform, for example, thousands of feet of expandable tubulars.

An annular spacer 22 defining an internal passage 22*a* for receiving the second tubular support member 14 is received within the counterbore 18*b* of the expansion cone 18, and is positioned between an end face 12*d* of the first tubular support member 12 and an end face of the counterbore 18*b* of the expansion cone 18. A fourth tubular support member 24 defining an internal passage 24*a* for receiving the second tubular support member 14 includes a flange 24*b* that is received within the counterbore 16*d* of the third tubular support member 16. A fifth tubular support member 26 defining an internal passage 26*a* for receiving the second tubular support member 14 includes an internal flange 26*b* for mating with the flange 14*c* of the second tubular support member and a flange 26*c* for mating with the internal flange 16*g* of the third tubular support member 16.

An annular sealing member 28, an annular sealing and support member 30, an annular sealing member 32, and an annular sealing and support member 34 are received within the counterbore 14*d* of the second tubular support member 14. The annular sealing and support member 30 further includes a radial opening 30*a* for supporting a rupture disc 36 within the radial opening 14*g* of the second tubular support member 14 and a sealing member 30*b* for sealing the radial opening 14*h* of the second tubular support member. The annular sealing and support member 34 further includes sealing members 34*a* and 34*b* for sealing the radial openings 14*i* and 14*j*, respectively, of the second tubular support member 14. In an exemplary embodiment, the rupture disc 36 opens when the operating pressure within the radial opening 30*b* is about 1000 to 5000 psi. In this manner, the rupture disc 36 provides a pressure sensitive valve for controlling the flow of fluidic materials through the radial opening 30*a*. In several alternative embodiments, the assembly 10 includes a plurality of radial passages 30*a*, each with corresponding rupture discs 36.

A sixth tubular support member 38 defining an internal passage 38*a* for receiving the second tubular support member 14 includes a threaded portion 38*b* at one end that is coupled to the threaded portion 16*f* of the third tubular support member 16 and a flange 38*c* at another end that is movably coupled to the interior of the expansion cone launcher 20. An annular collet 40 includes a threaded portion 40*a* that is coupled to the threaded portion 14*e* of the second tubular support member 14, and a resilient coupling 40*b* at another end.

An annular sliding sleeve 42 defining an internal passage 42*a* includes an internal flange 42*b*, having sealing members 42*c* and 42*d*, and an external groove 42*e* for releasably engaging the coupling 40*b* of the collet 40 at one end, and an internal flange 42*f*, having sealing members 42*g* and 42*h*, at another end. During operation the coupling 40*b* of the collet 40 may engage the external groove 42*e* of the sliding sleeve 42 and thereby displace the sliding sleeve in the longitudinal direction. Since the coupling 40*b* of the collet 40 is resilient, the collet 40 may be disengaged or reengaged with the sliding sleeve 42. An annular valve member 44 defining an internal passage 44*a*, having a first throat 44*aa* and a second throat 44*ab*, includes a flange 44*b* at one end, having external splines 44*c* for engaging the internal splines 14*f* of the second tubular support member 14, a first set of radial passages, 44*da* and 44*db*, a second set of radial passages, 44*ea* and 44*eb*, and a threaded portion 44*f* at another end. The sliding sleeve 42 and the valve member 44 define an annular bypass passage 46 that, depending upon the position of the sliding sleeve 42, permits fluidic materials to flow from the passage 44 through the first radial passages, 44*da* and 44*db*, the bypass passage 46, and the second radial passages, 44*ea* and 44*eb*, back into the passage 44. In this manner, fluidic materials may bypass the portion of the passage 44 between the first and second radial passages, 44*ea*, 44*eb*, 44*da*, and 44*db*. Furthermore, the sliding sleeve 42 and the valve member 44 together define a sliding sleeve valve for controllably permitting fluidic materials to bypass the intermediate portion of the passage 44*a* between the first and second passages, 44*da*, 44*db*, 44*ea*, and 44*eb*. During operation, the flange 44*b* limits movement of the sliding sleeve 42 in the longitudinal direction.

In a preferred embodiment, the collet 40 includes a set of couplings 40*b* such as, for example, fingers, that engage the external groove 42*e* of the sliding sleeve 42. During operation, the collet couplings 40*b* latch over and onto the external groove 42*e* of the sliding sleeve 42. In a preferred embodiment, a longitudinal force of at least about 10,000 to 13,000 lbf is required to pull the couplings 40*b* off of, and out of engagement with, the external groove 42*e* of the sliding sleeve 42. In an exemplary embodiment, the application of a longitudinal force less than about 10,000 to 13,000 lbf indicates that the collet couplings 40*b* are latched onto the external shoulder of the sliding sleeve 42, and that the sliding sleeve 42 is in the up or the down position relative to the valve member 44. In a preferred embodiment, the collet 40 includes a conventional internal shoulder that transfers the weight of the first tubular support member 12 and expansion cone 18 onto the sliding sleeve 42. In a preferred embodiment, the collet 40 further includes a conventional set of internal lugs for engaging the splines 44*c* of the valve member 44.

An annular valve seat 48 defining a conical internal passage 48*a* for receiving a conventional float valve element 50 includes an annular recess 48*b*, having an internally threaded portion 48*c* for engaging the threaded portion 44*f* of the valve member 44, at one end, and an externally threaded portion 48*d* at another end. In an alternative embodiment, the float valve element 50 is omitted. An annular valve seat mounting element 52 defining an internal passage 52*a* for receiving the valve seat 48 and float valve 50 includes an internally threaded portion 52*b* for engaging the externally threaded portion 48*d* of the valve seat 48, an externally threaded portion 52*c*, an internal flange 52*d*, radial passages, 52*ea* and 52*eb*, and an end member 52*f*, having axial passages, 52*fa* and 52*fb*.

A shoe 54 defining an internal passage 54*a* for receiving the valve seat mounting element 52 includes a first annular recess 54*b*, having an externally threaded portion 54*c*, and a second annular recess 54*d*, having an externally threaded portion 54*e* for engaging the threaded portion 20*d* of the expansion cone launcher 20, at one end, a first threaded counterbore 54*f* for engaging the threaded portion 52*c* of the of the mounting element, and a second counterbore 54*g* for mating with the end member 52*f* of the mounting element. In a preferred embodiment, the shoe 54 is fabricated from a ceramic and/or a composite material in order to facilitate the subsequent removal of the shoe by drilling. A seventh tubular support member 56 defining an internal passage 56*a* for receiving the sliding sleeve 42 and the valve member 44 is positioned within the expansion cone launcher 20 that includes an internally threaded portion 56*b* at one end for engaging the externally threaded portion 54*c* of the annular recess 54*b* of the shoe 54. In a preferred embodiment, during operation of the assembly, the end of the seventh tubular support member 56 limits the longitudinal movement of the expansion cone 18 in the direction of the shoe 54 by limiting the longitudinal movement of the sixth tubular support member 38. An annular centralizer 58 defining an internal passage 58*a* for movably supporting the sliding sleeve 42 is positioned within the seventh tubular support member 56 that includes axial passages 58*b* and 58*c*. In a preferred embodiment, the centralizer 58 maintains the sliding sleeve 42 and valve member 44 is a central position within the assembly 10.

Figure 2A:
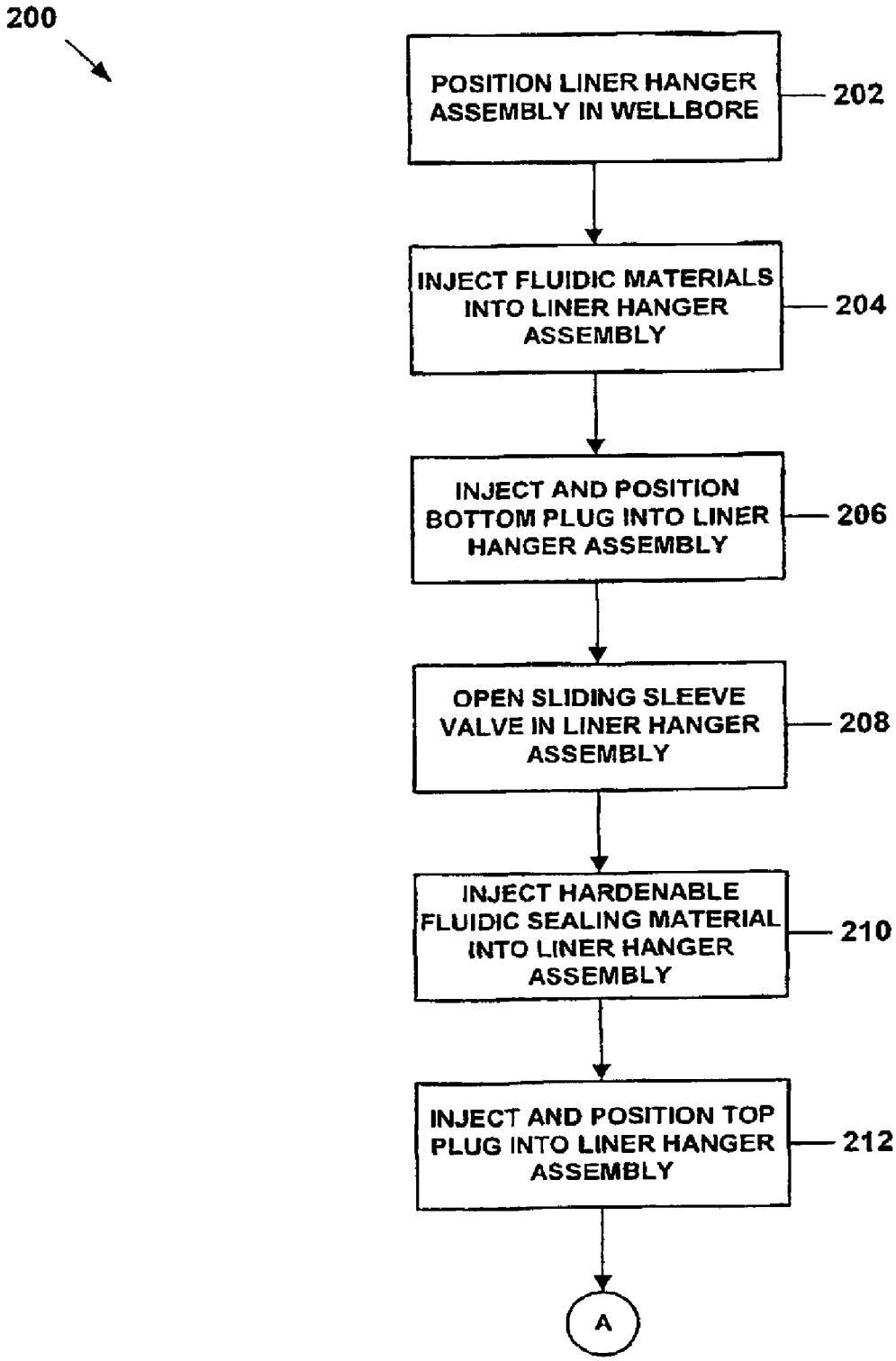
FIGS. 2*a*–2*b* is a flow chart illustration of an embodiment of a method for forming a wellbore casing using the liner hanger assembly of FIGS. 1 and 1*a*–1*c*.
Figure 2B:
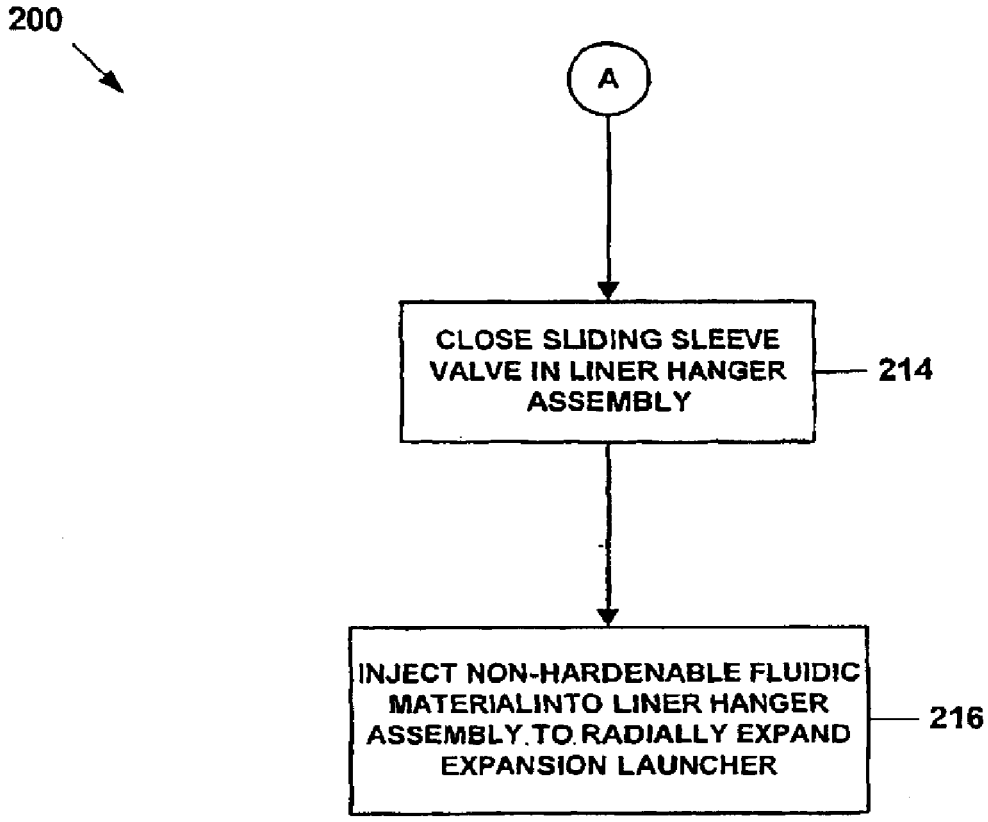
Figure 3A:
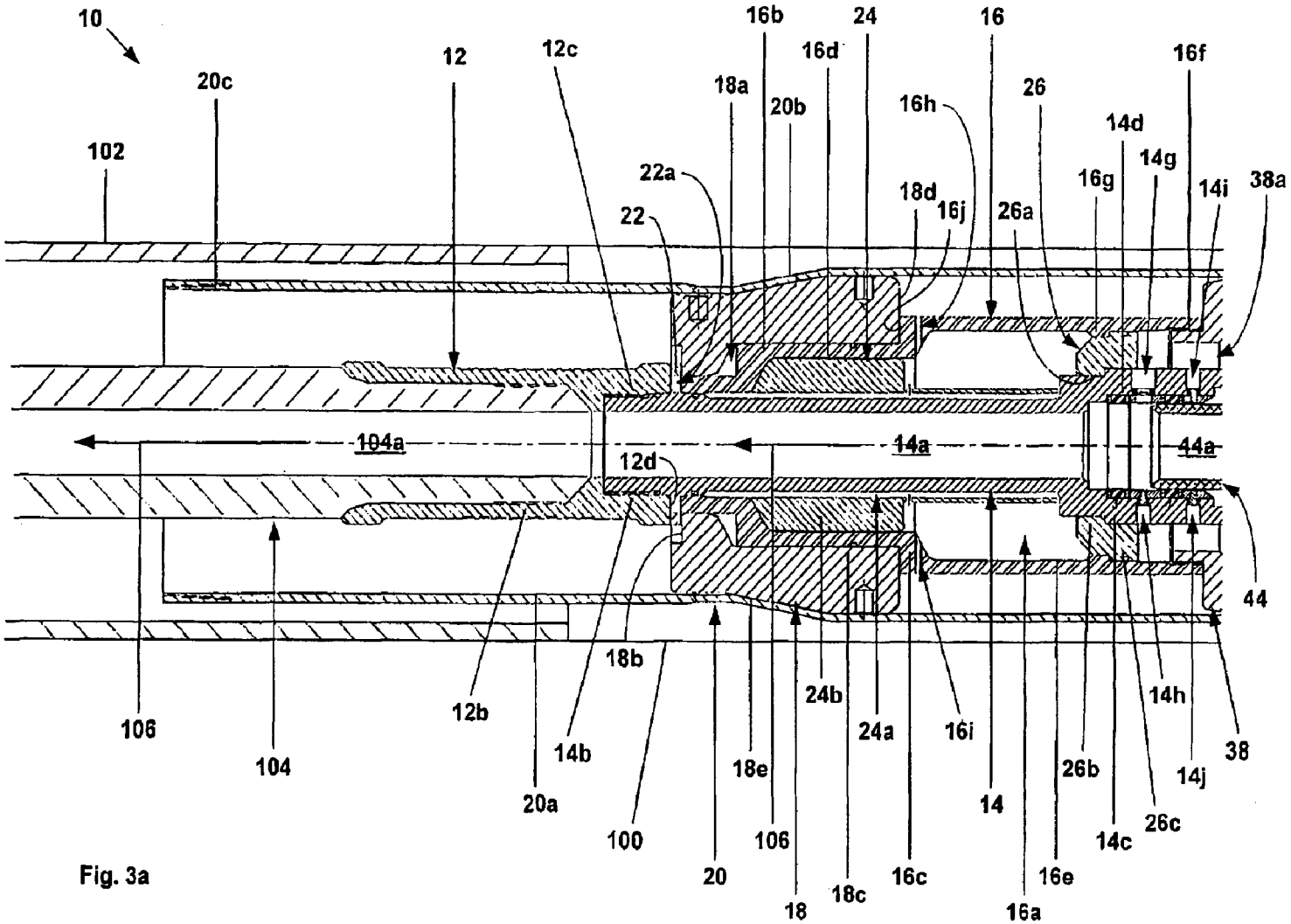
FIGS. 3*a*–3*c* are cross sectional illustrations of the placement of the liner hanger assembly of FIGS. 1 and 1*a*–1*c* into a wellbore.
Figure 3B:
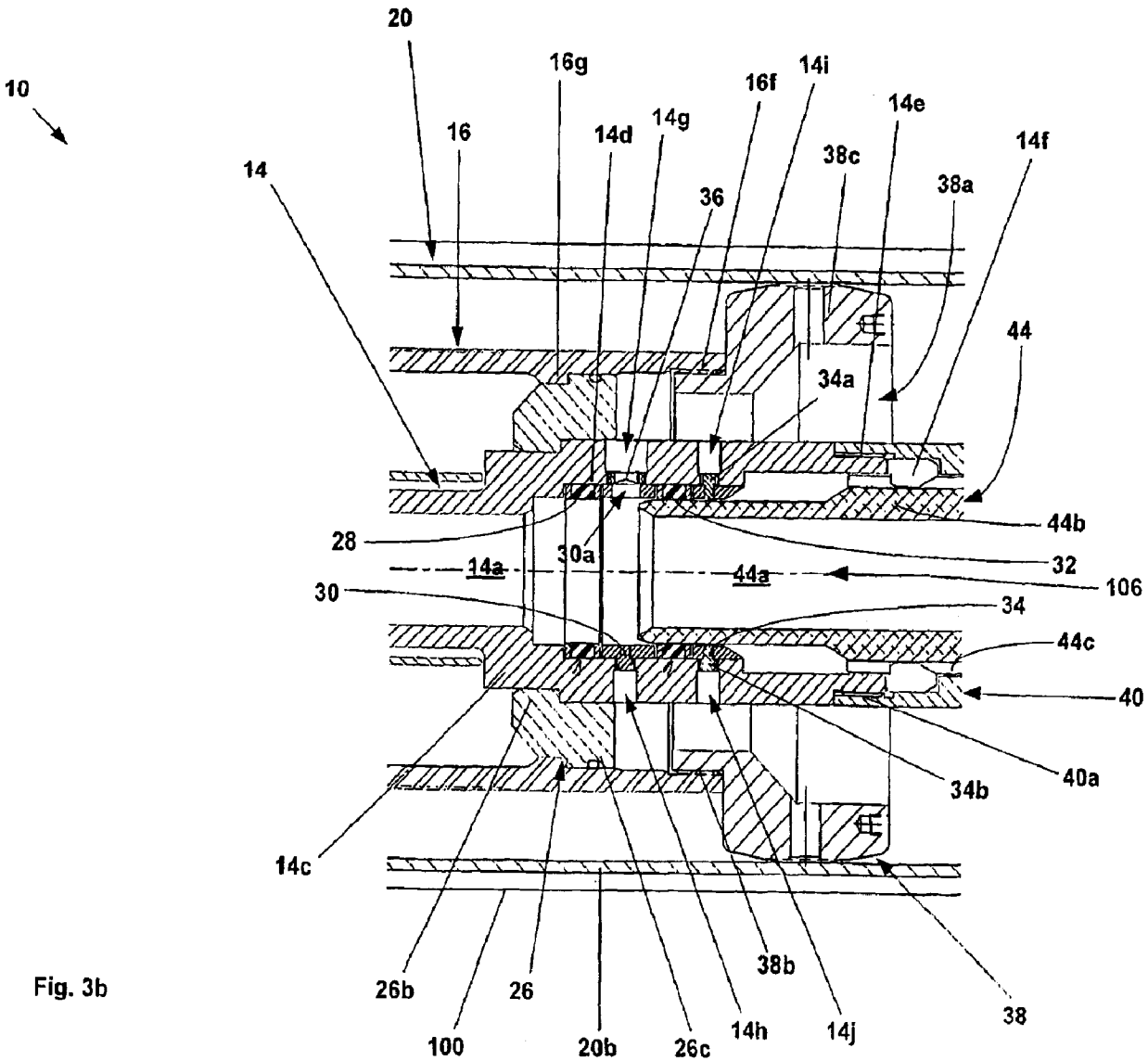
Figure 3C:
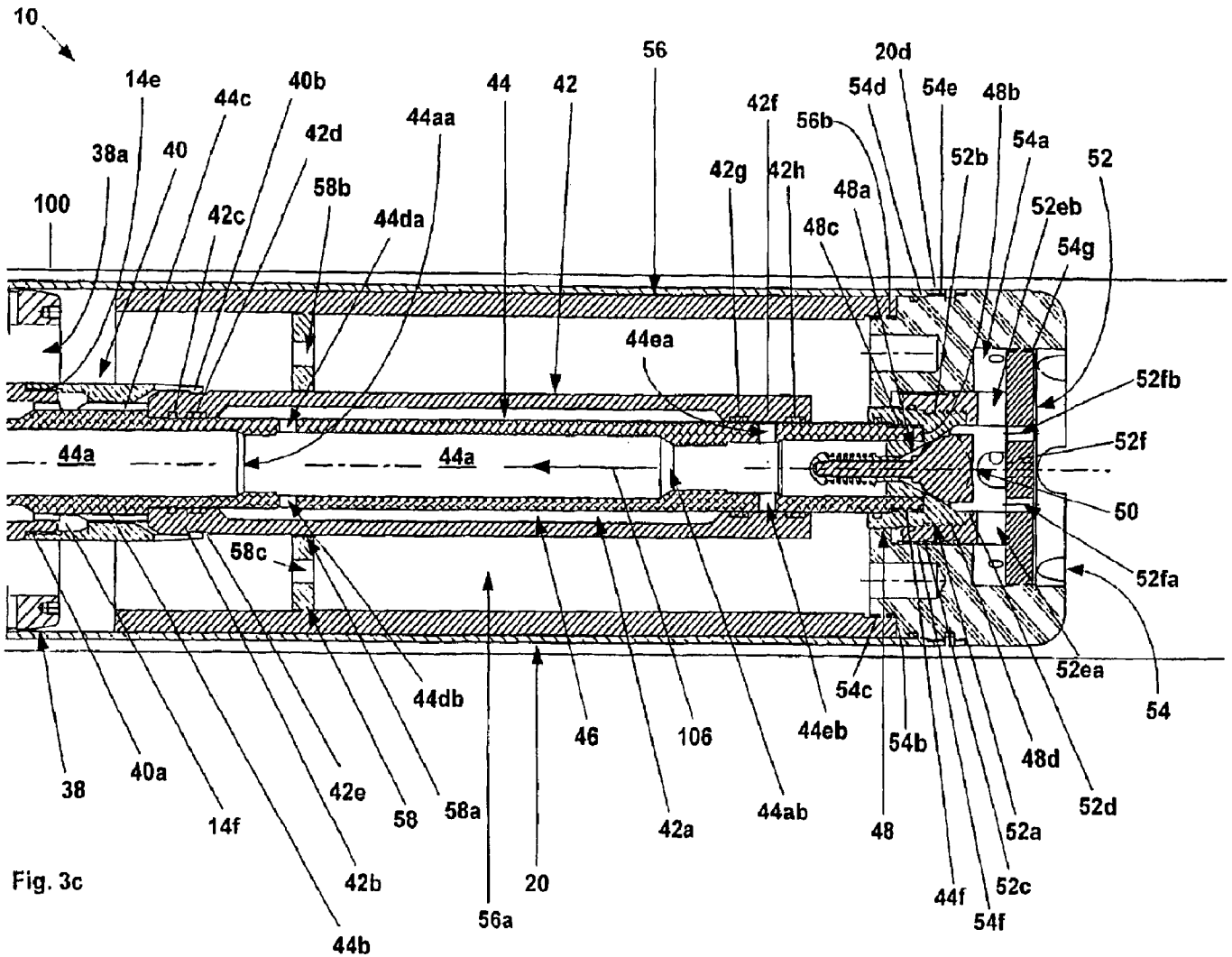

Referring to FIGS. 2*a*–2*b*, during operation, the assembly 10 may be used to form or repair a wellbore casing by implementing a method 200 in which, as illustrated in FIGS. 3*a*–3*c*, the assembly 10 may initially be positioned within a wellbore 100 having a preexisting wellbore casing 102 by coupling a conventional tubular member 104 defining an internal passage 104*a* to the threaded portion 12*b* of the first tubular support member 12 in step 202. In a preferred embodiment, during placement of the assembly 10 within the wellbore 100, fluidic materials 106 within the wellbore 100 below the assembly 10 are conveyed through the assembly 10 and into the passage 104*a* by the fluid passages 52*fa*, 52*fb*, 54*a*, 48*a*, 44*a*, and 14*a*. In this manner, surge pressures that can be created during placement of the assembly 10 within the wellbore 100 are minimized. In a preferred embodiment, the float valve element 50 is pre-set in an auto-fill configuration to permit the fluidic materials 106 to pass through the conical passage 48*a* of the valve seat 48.

Figure 4A:
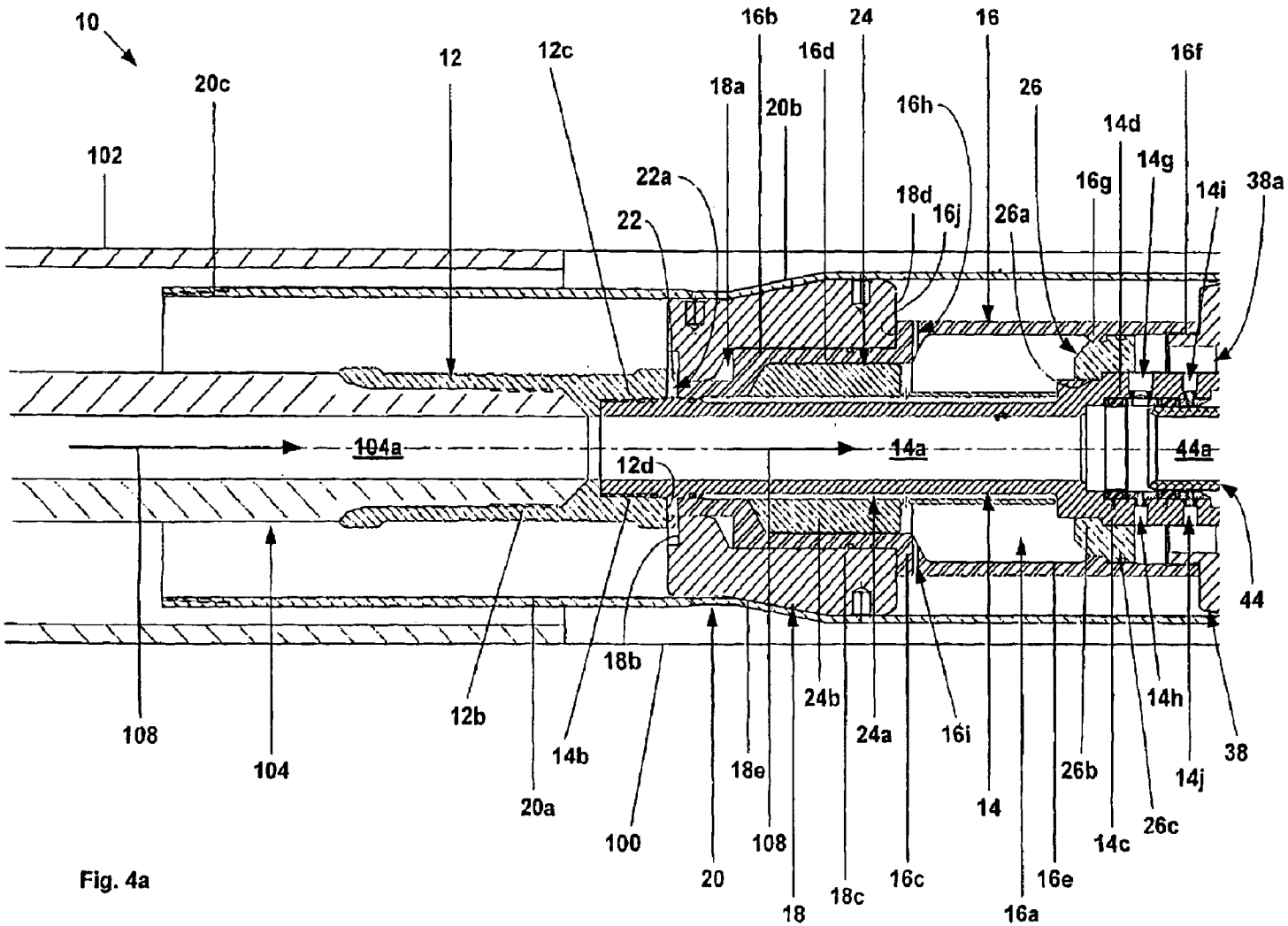
FIGS. 4*a*–4*c* are cross sectional illustrations of the injection of a fluidic materials into the liner hanger assembly of FIGS. 3*a*–3*c*.
Figure 4B:
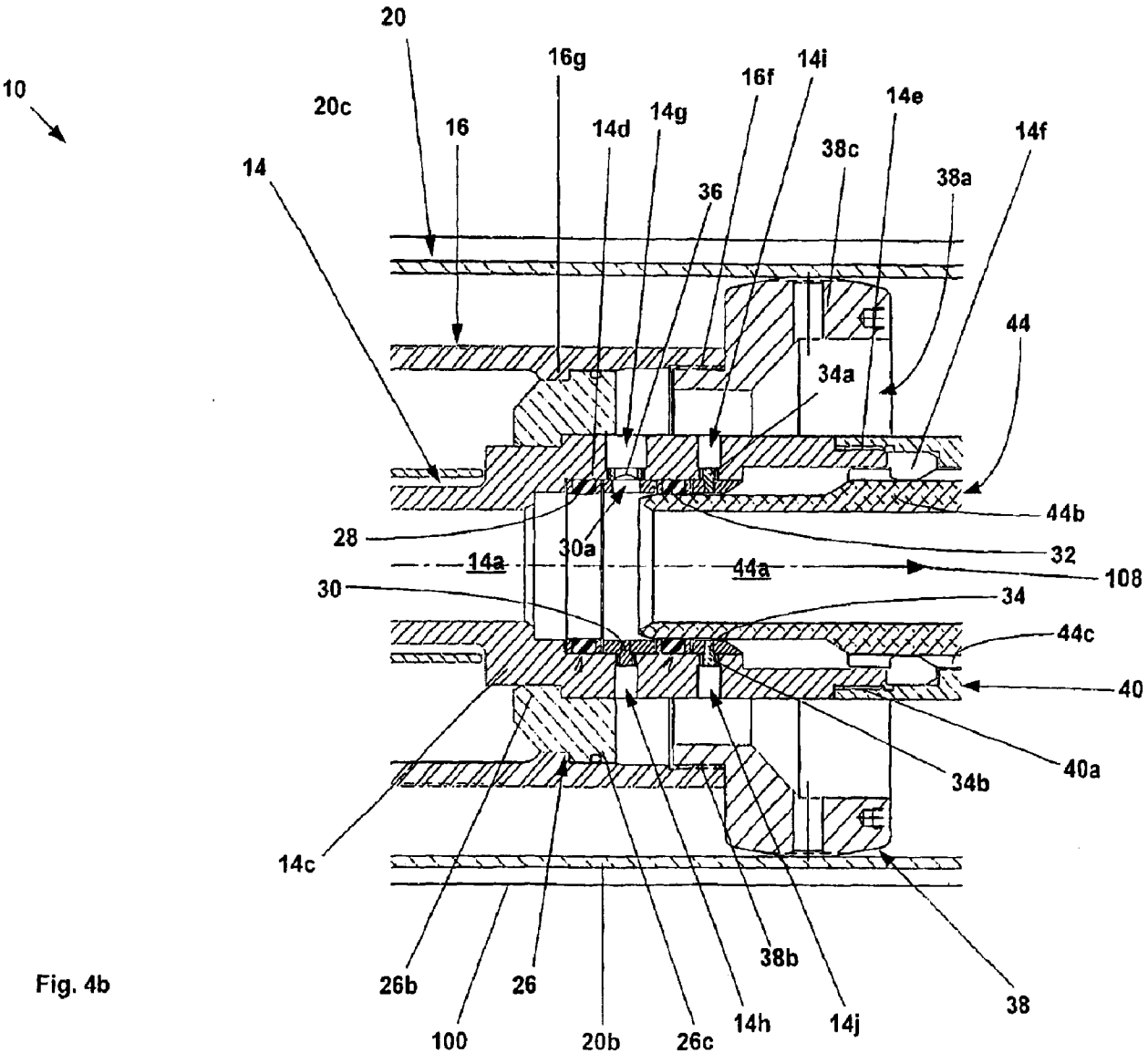
Figure 4C:
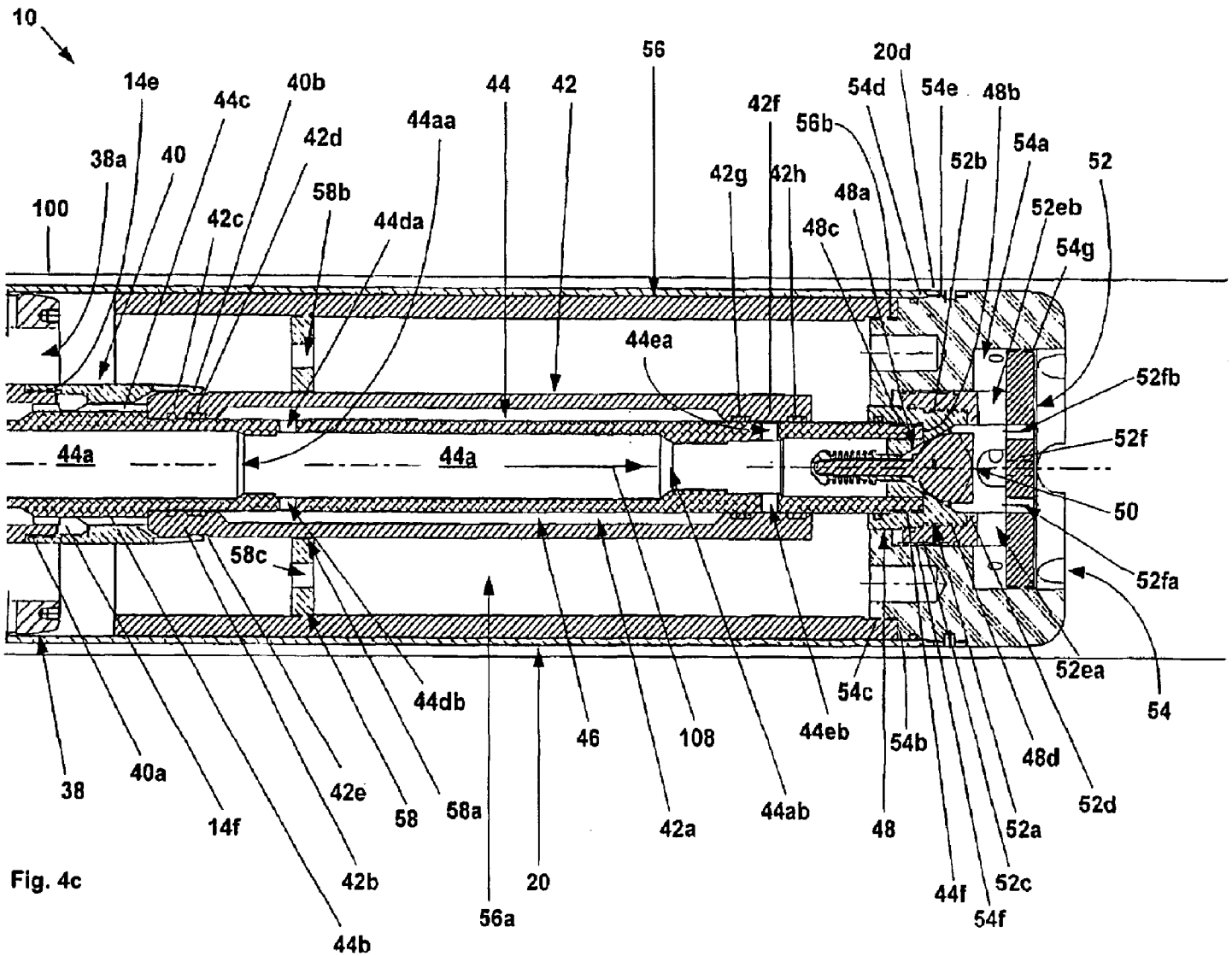

Referring to FIGS. 4*a*–4*c*, in step 204, fluidic materials 108 may then be injected into and through the tubular member 104 and assembly 10 to thereby ensure that all of the fluid passages 104*a*, 14*a*, 44*a*, 48*a*, 54*a*, 52*fa*, and 52*fb* are functioning properly.

Figure 5A:
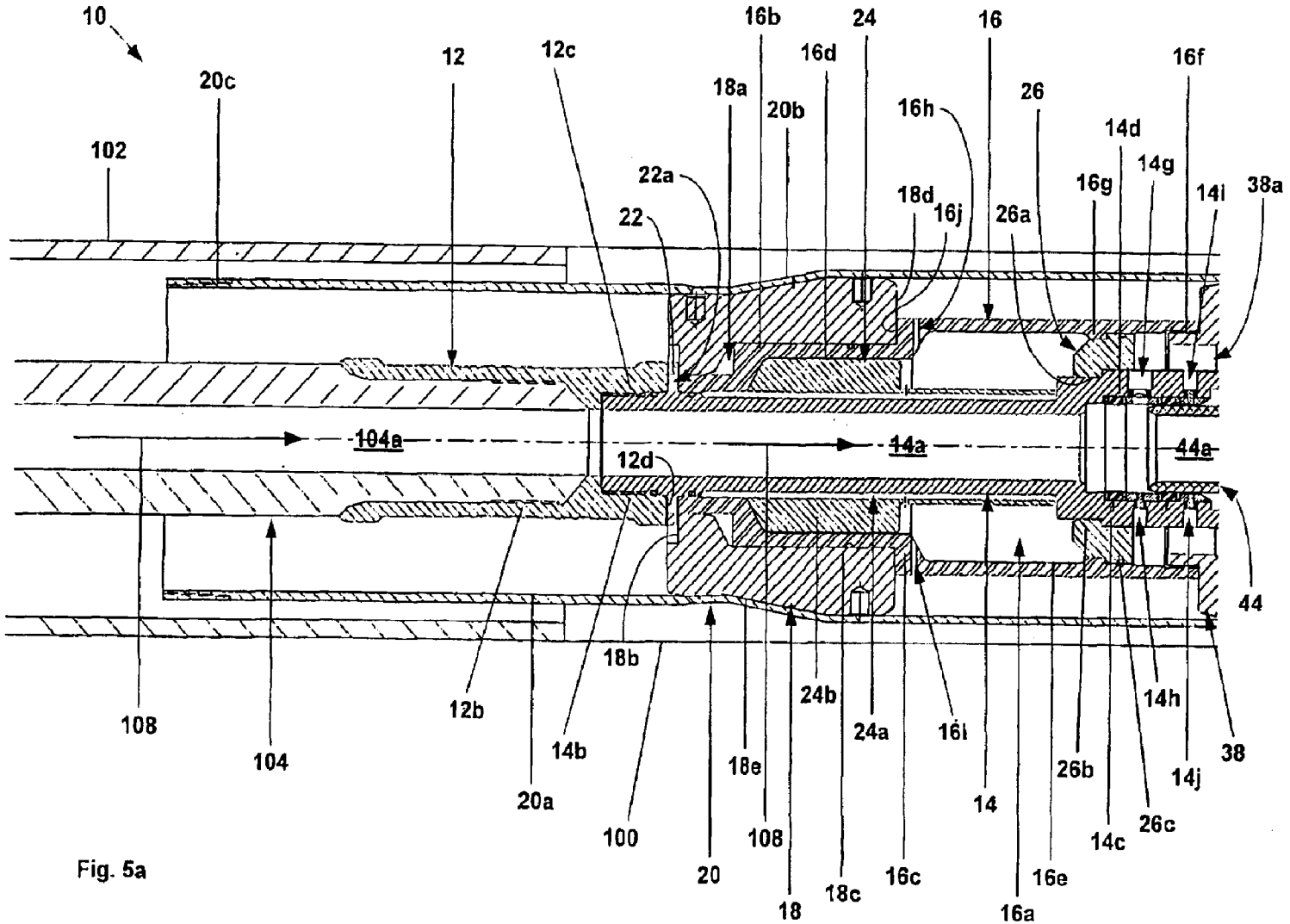
FIGS. 5*a*–5*c* are cross sectional illustrations of the placement of a bottom plug into the liner hanger assembly of FIGS. 4*a*–4*c*.
Figure 5B:
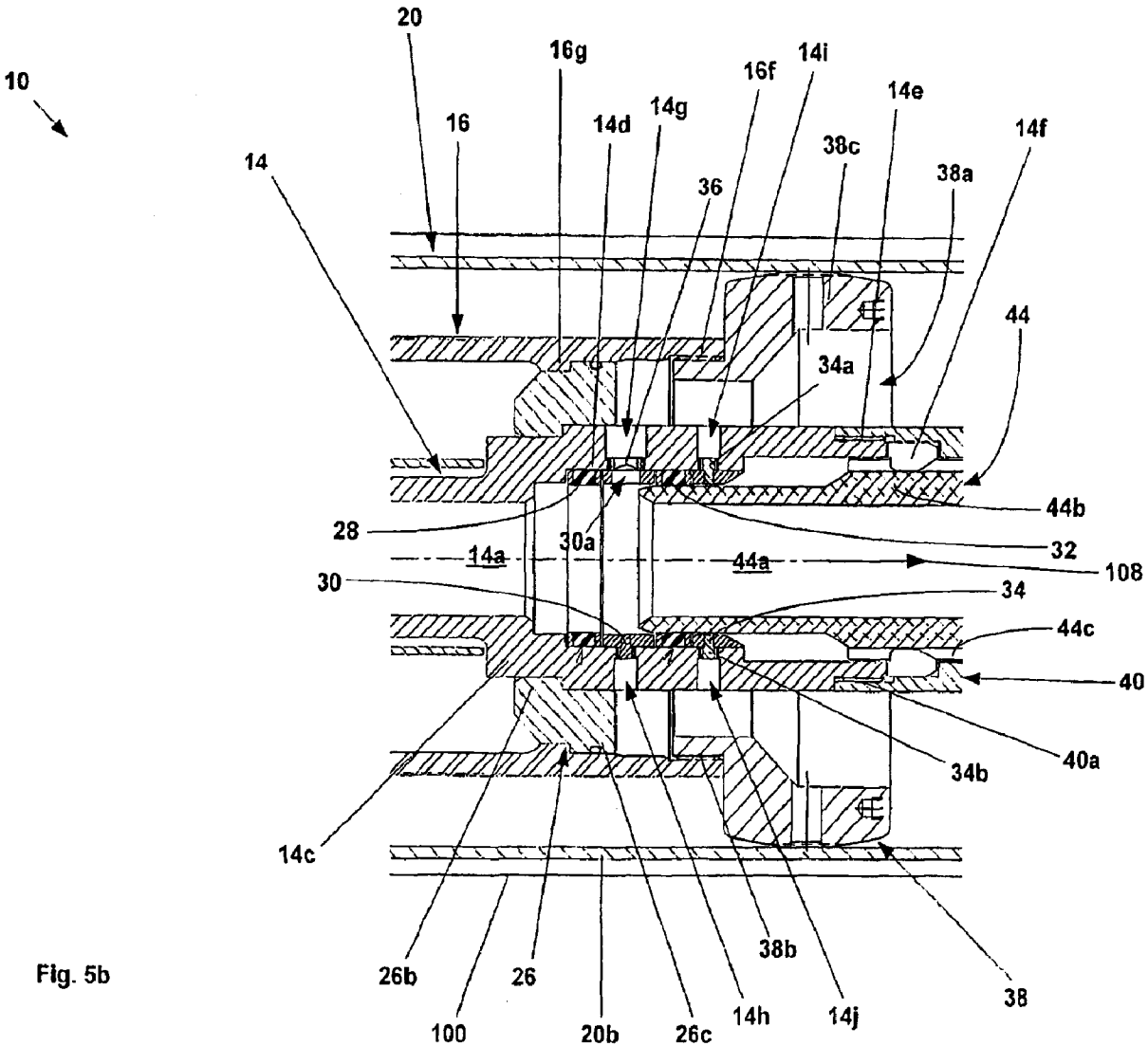
Figure 5C:
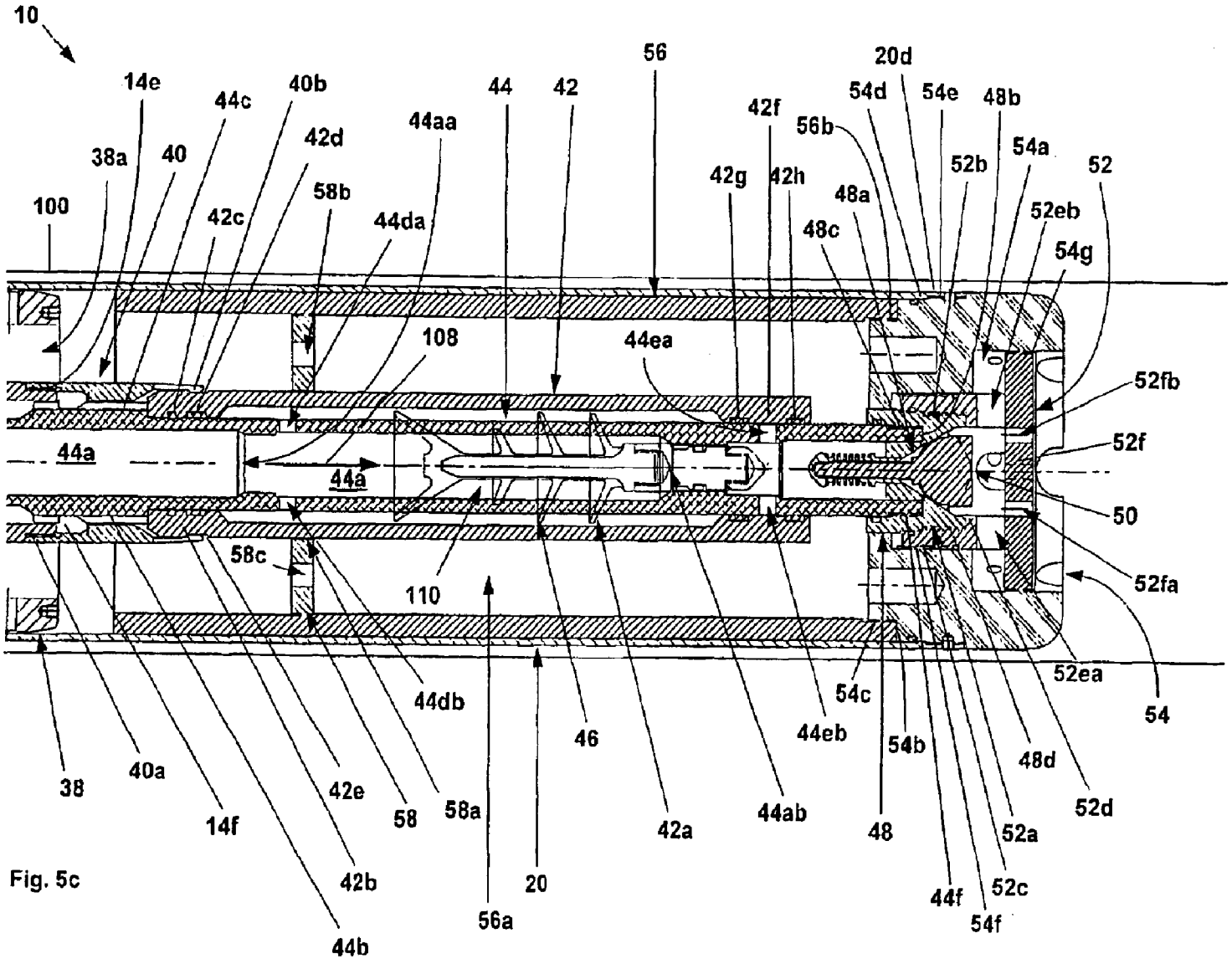

Referring to FIGS. 5*a*–5*c*, in step 206, a bottom plug 110 may then be injected into the fluidic materials 108 and into the assembly 10 and then positioned in the throat passage 44*ab* of the valve member 44. In this manner, the region of the passage 44*a* upstream from the plug 110 may be fluidicly isolated from the region of the passage 44*a* downstream from the plug 110. In a preferred embodiment, the proper placement of the plug 110 may be indicated by a corresponding increase in the operating pressure of the fluidic material 108.

Figure 6A:
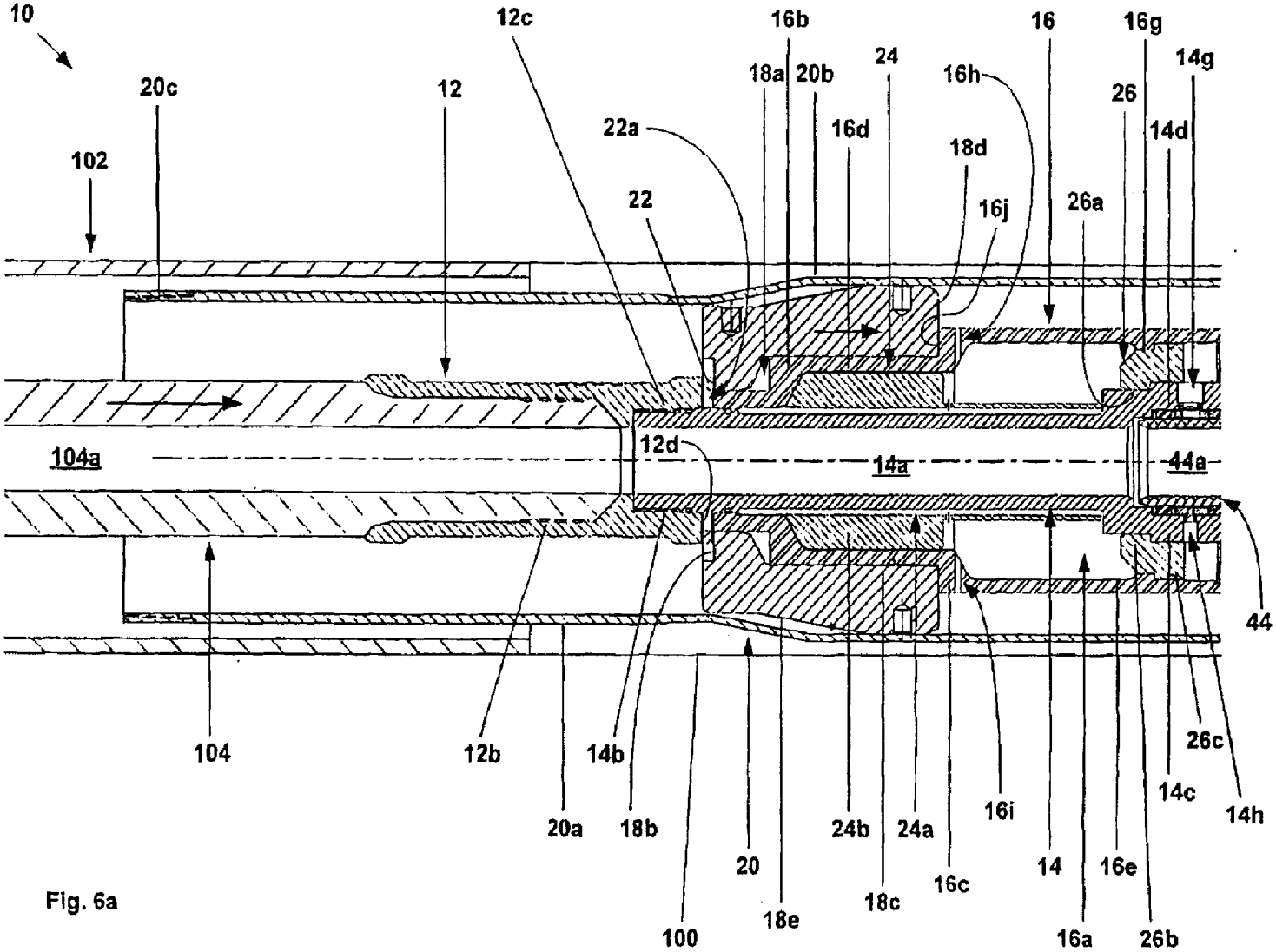
FIGS. 6*a*–6*c* are cross sectional illustrations of the downward displacement of sliding sleeve of the liner hanger assembly of FIGS. 5*a*–5*c*.
Figure 6B:
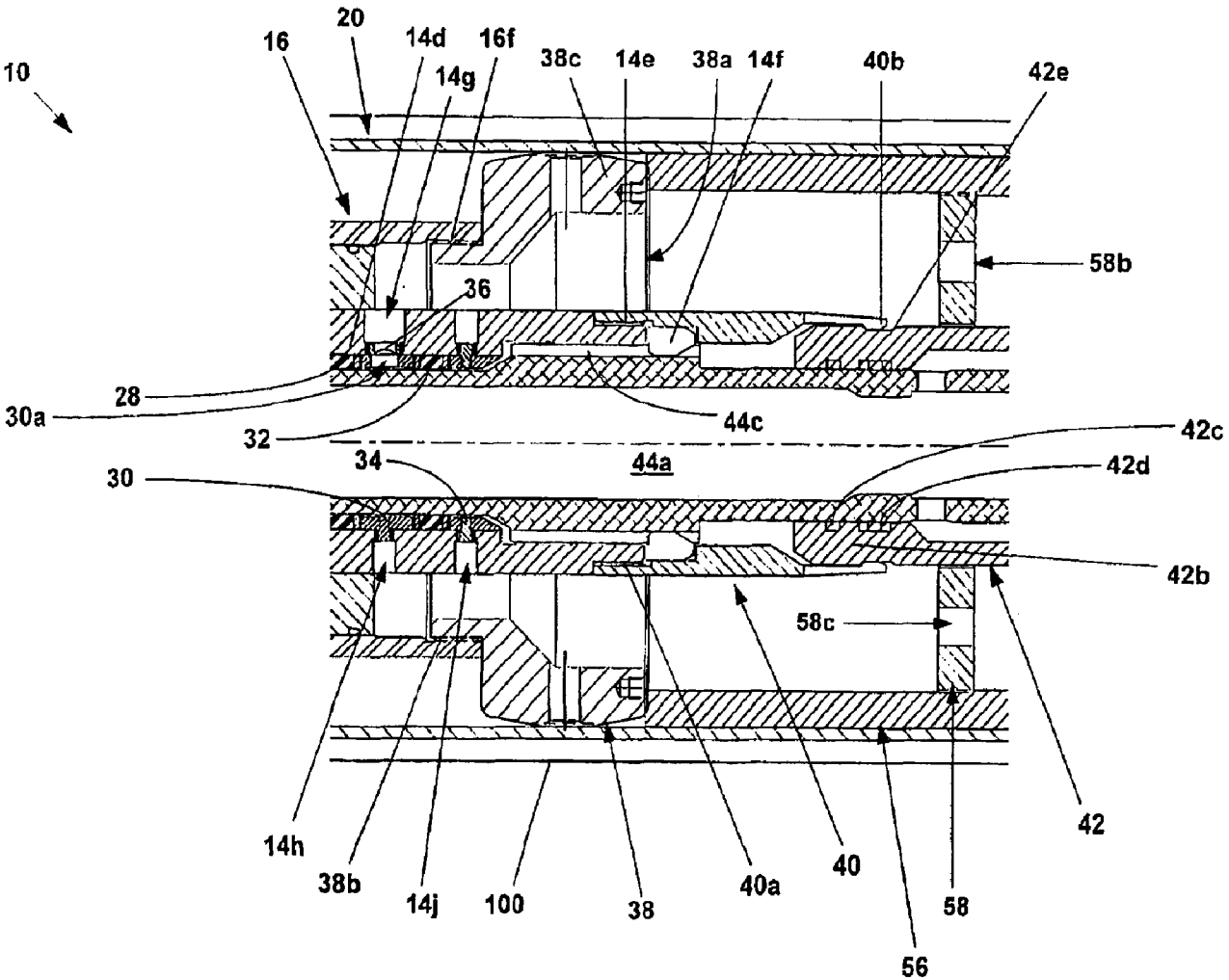
Figure 6C:
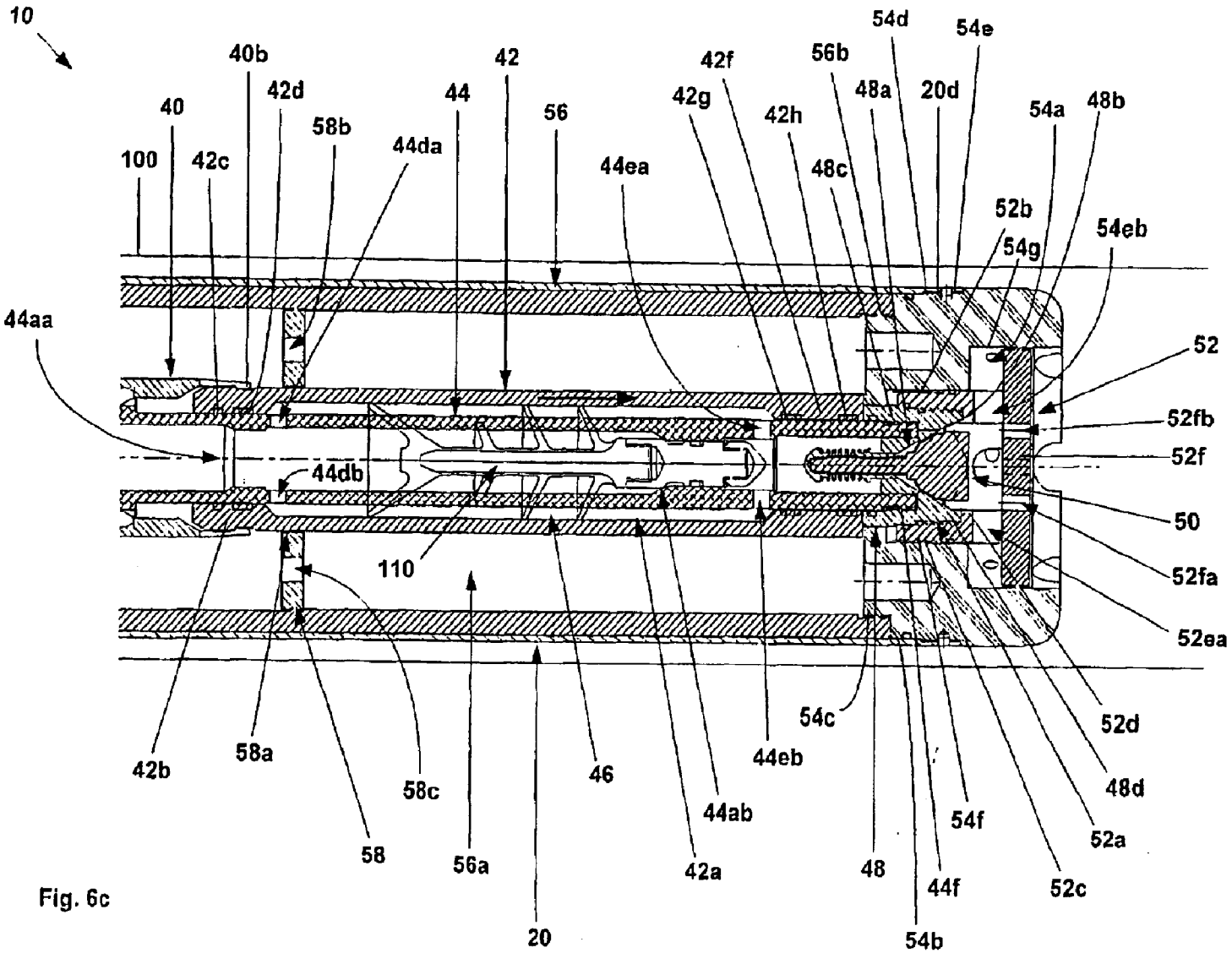

Referring to FIGS. 6*a*–6*c*, in step 208, the sliding sleeve 42 may then be displaced relative to the valve member 44 by displacing the tubular member 104 by applying, for example, a downward force of approximately 5,000 lbf on the assembly 10. In this manner, the tubular member 104, the first tubular support member 12, the second tubular support member 14, the third tubular support member 16, the expansion cone 18, the annular spacer 22, the fourth tubular support member 24, the fifth tubular support member 26, the sixth tubular support member 38, the collet 40, and the sliding sleeve 42 are displaced in the longitudinal direction relative to the expansion cone launcher 20 and the valve member 44. In this manner, fluidic materials within the passage 44*a* upstream of the plug 110 may bypass the plug by passing through the first passages, 44*da* and 44*db*, through the annular passage 46, and through the second passages, 44*ea* and 44*eb*, into the region of the passage 44*a* downstream from the plug. Furthermore, in this manner, the rupture disc 36 is fluidicly isolated from the passages 14*a* and 44*a*.

Figure 7A:
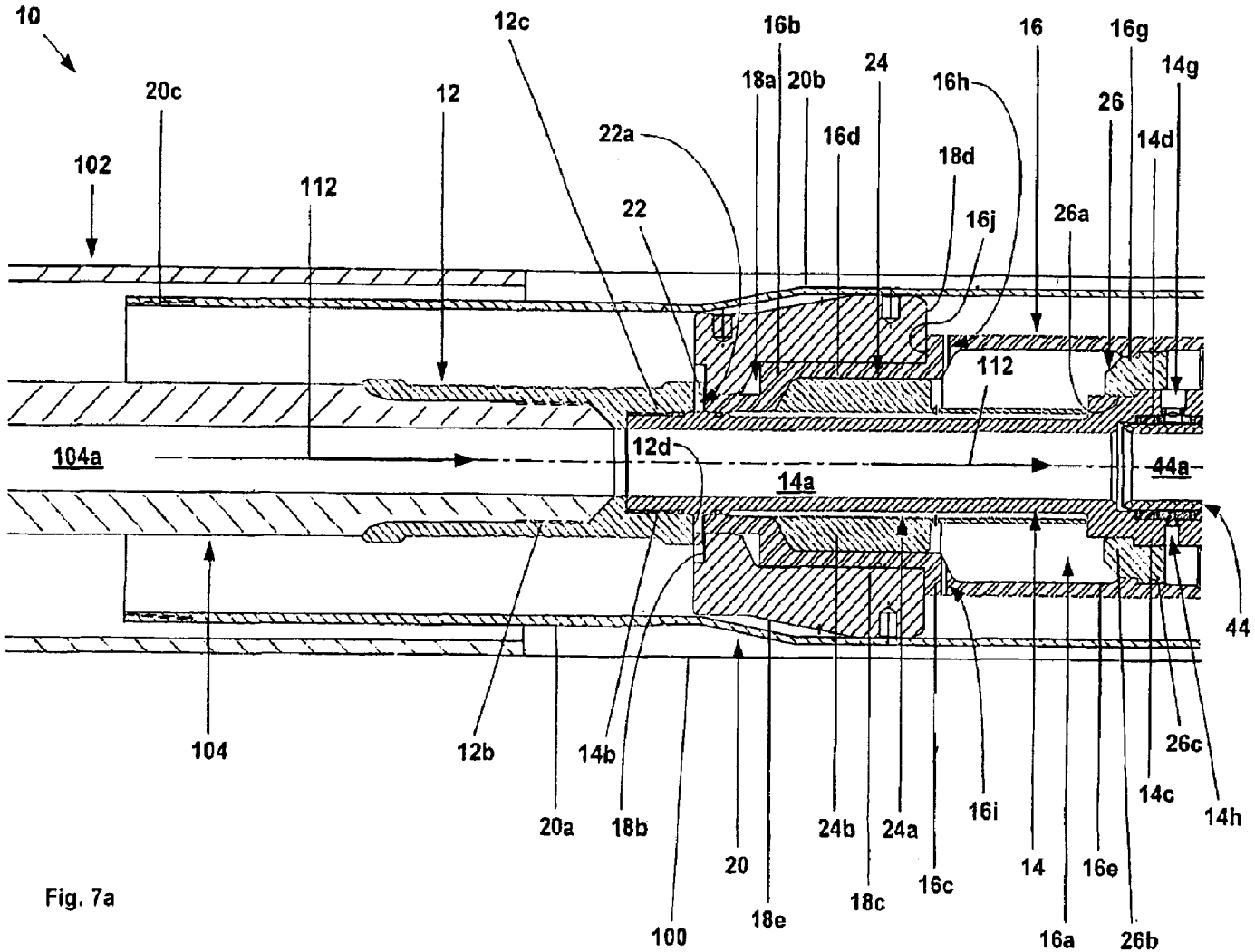
FIGS. 7*a*–7*c* are cross sectional illustrations of the injection of a hardenable fluidic sealing material into the liner hanger assembly of FIGS. 6*a*–6*c* that bypasses the plug.
Figure 7B:
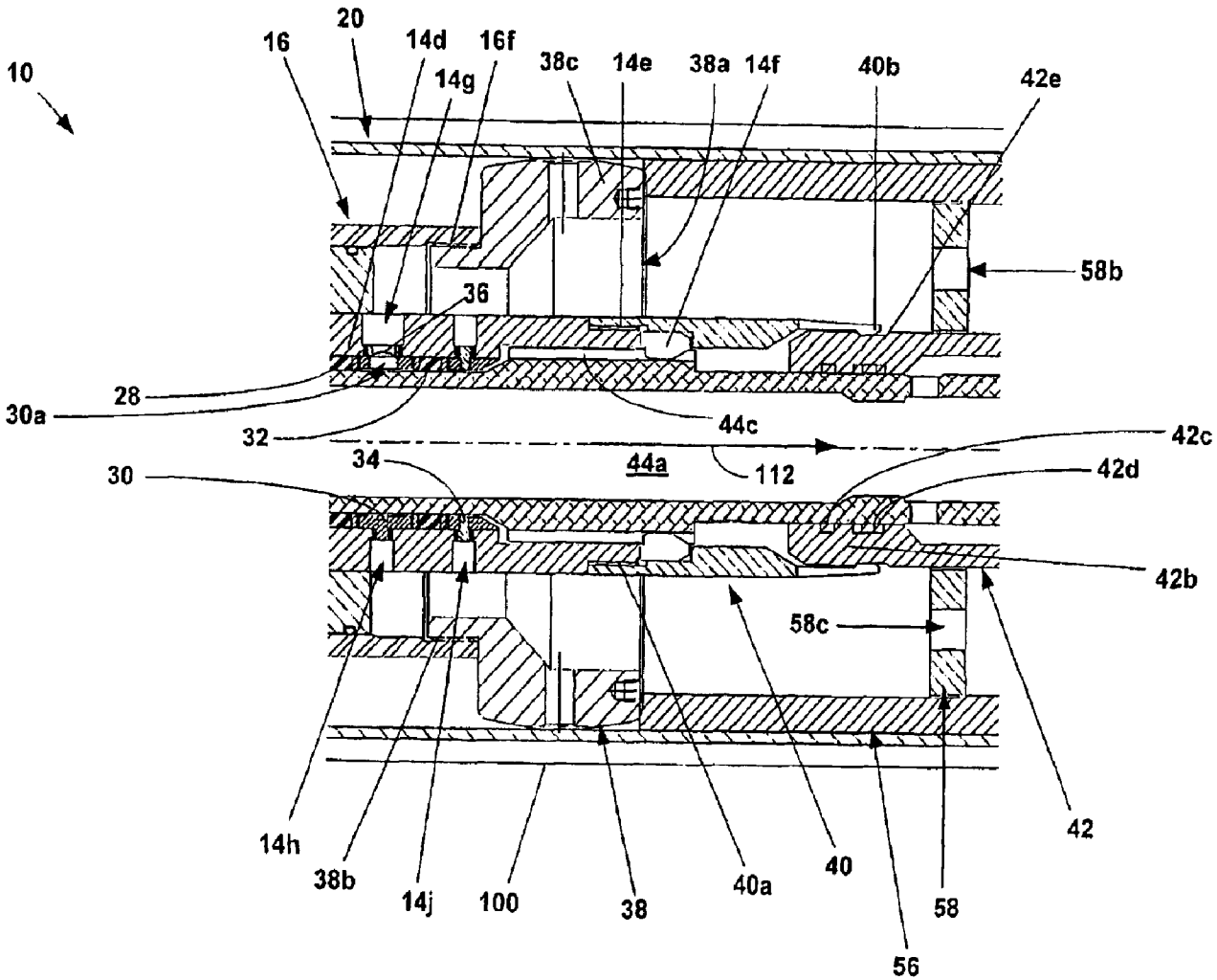
Figure 7C:
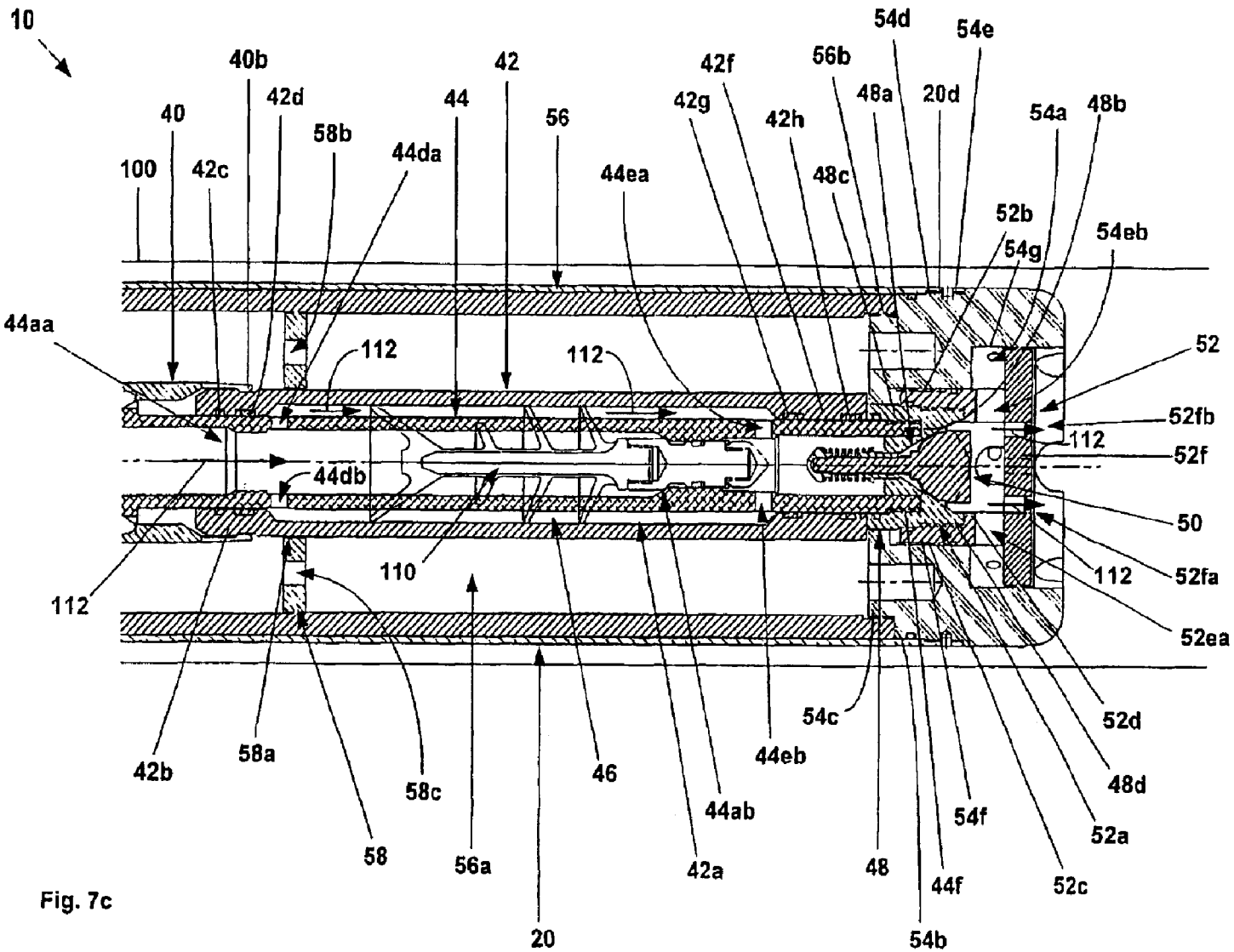

Referring to FIGS. 7*a*–7*c*, in step 210, a hardenable fluidic sealing material 112 may then be injected into the assembly 10 and conveyed through the passages 104*a*, 14*a*, 44*a*, 44*da*, 44*db*, 46, 44*ea*, 44*eb*, 48*a*, 54*a*, 52*fa*, and 52*fb* into the wellbore 100. In this manner, a hardenable fluidic sealing material such as, for example, cement, may be injected into the annular region between the expansion cone launcher 20 and the wellbore 100 in order to subsequently form an annular body of cement around the radially expanded expansion cone launcher 20. Furthermore, in this manner, the radial passage 30*a* and the rupture disc 36 are not exposed to the hardenable fluidic sealing material 112.

Figure 8A:
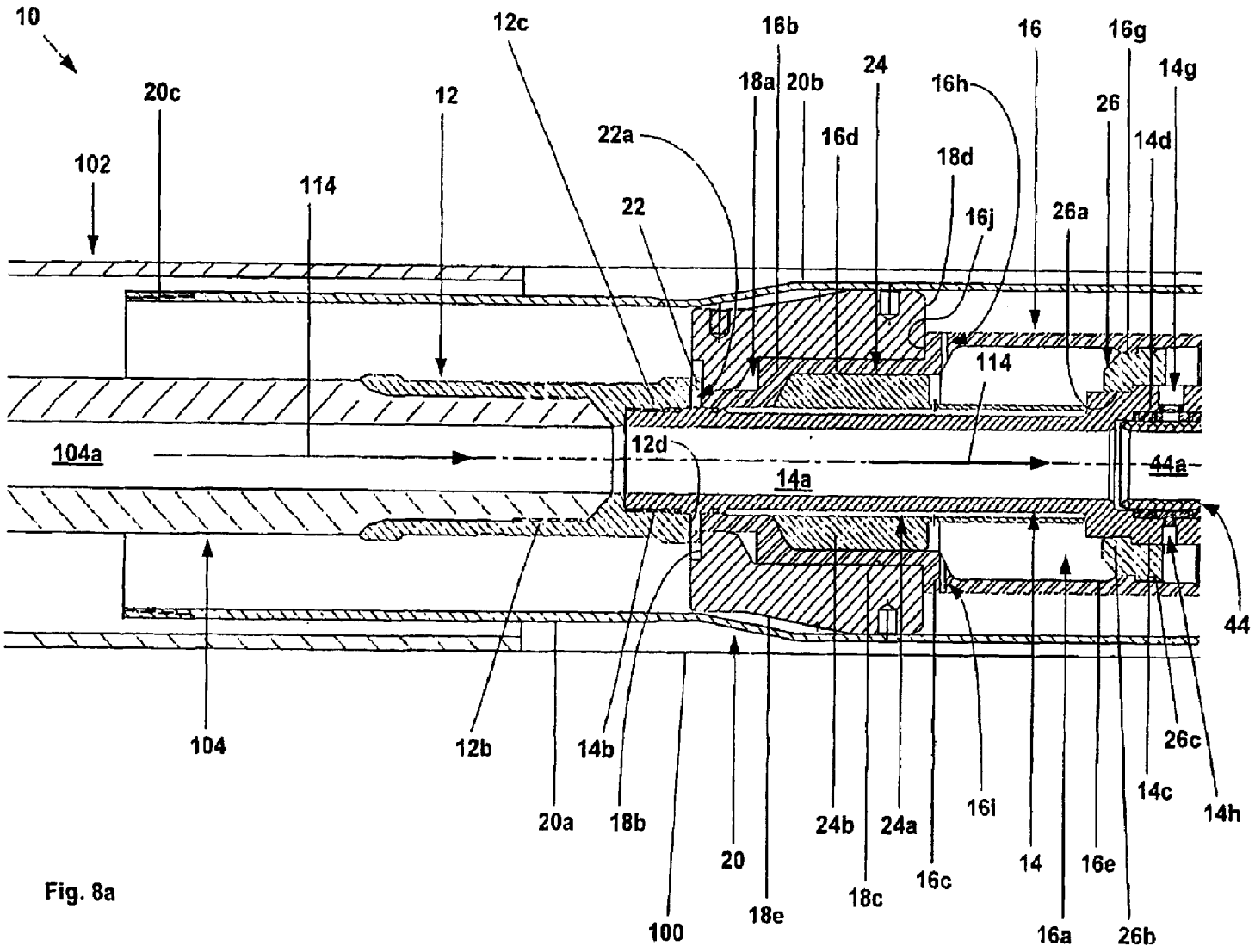
FIGS. 8*a*–8*c* are cross sectional illustrations of the placement of a top plug into the liner hanger assembly of FIGS. 7*a*–7*c*.
Figure 8B:
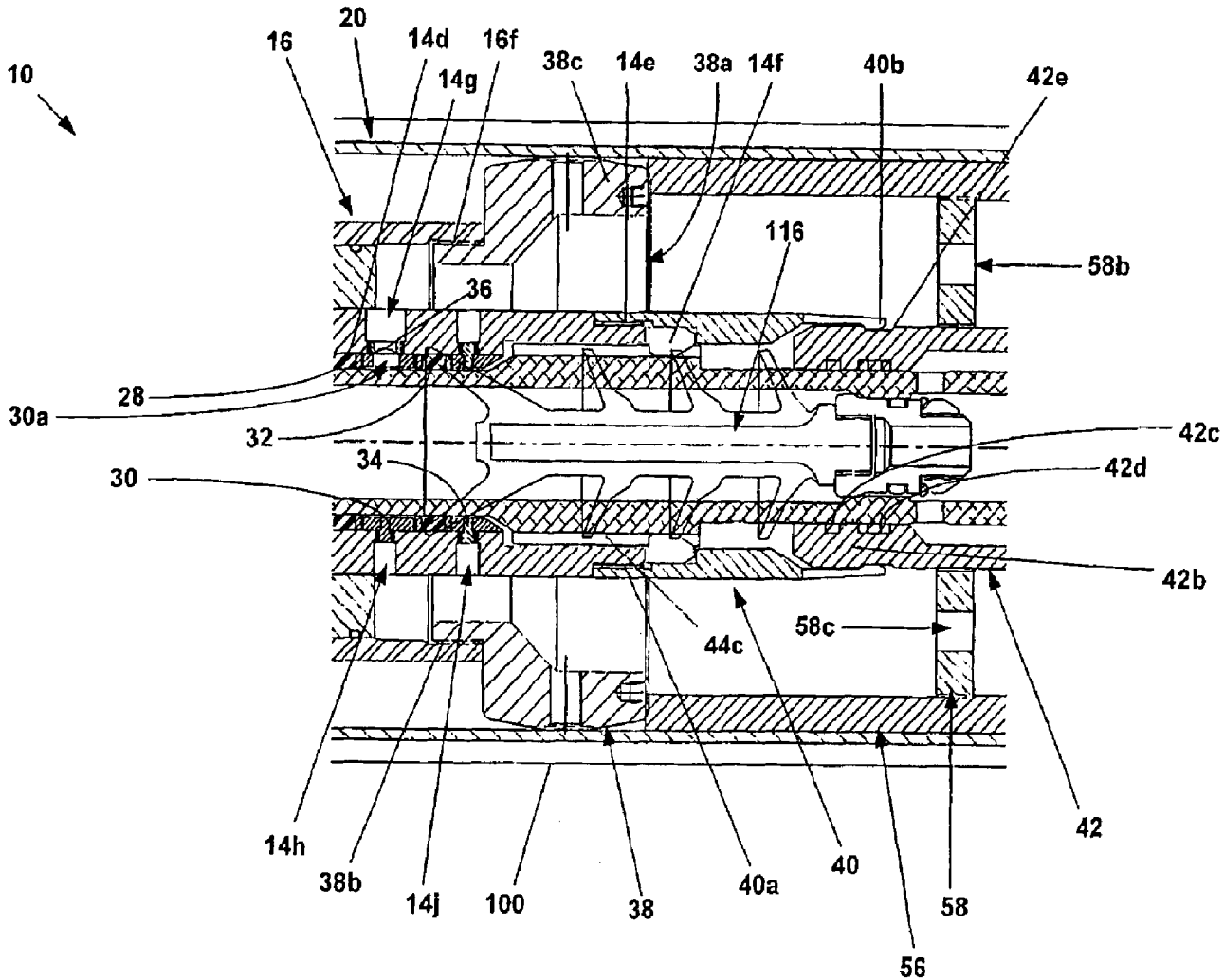
Figure 8C:
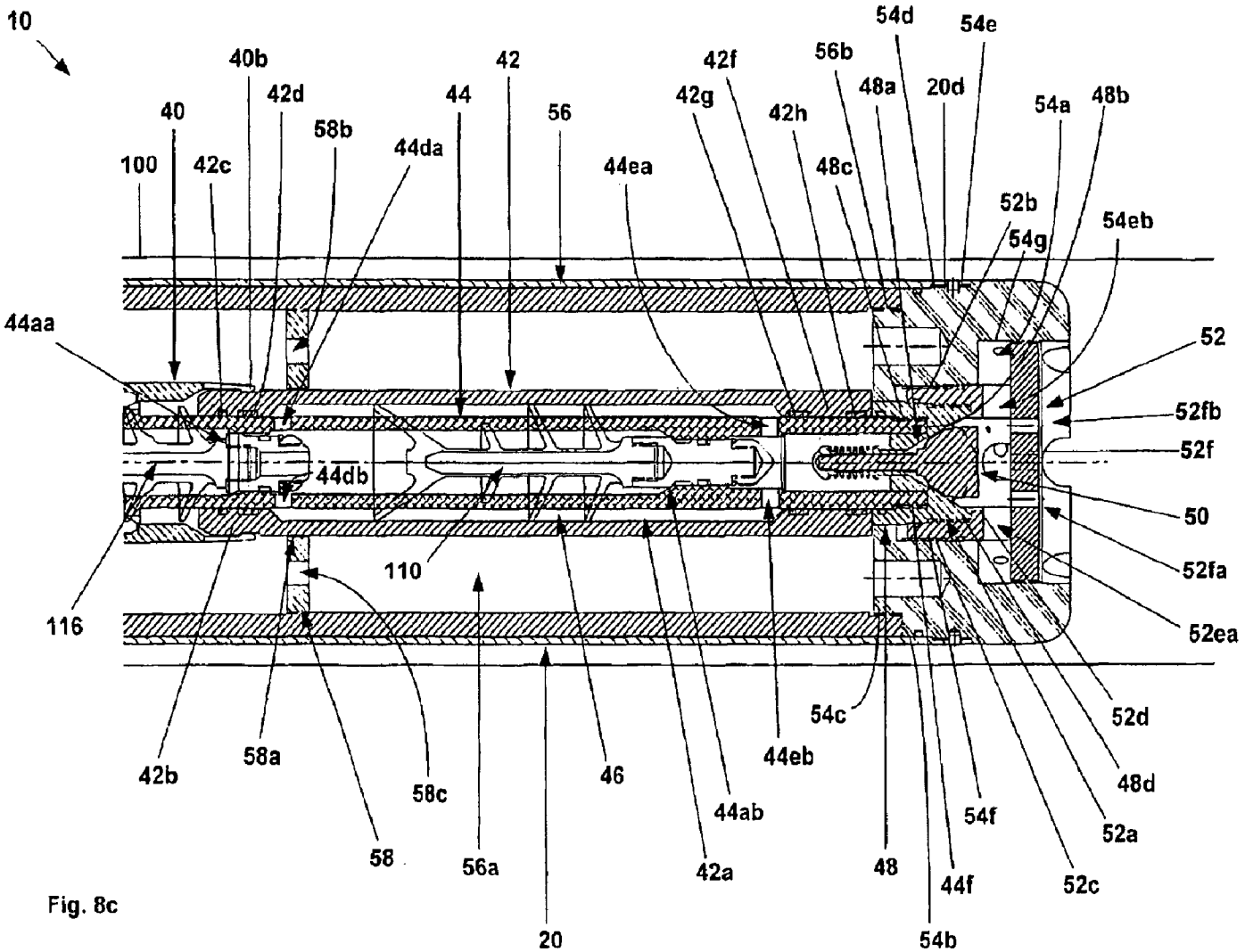

Referring to FIGS. 8*a*–8*c*, in step 212, upon the completion of the injection of the hardenable fluidic sealing material 112, a non-hardenable fluidic material 114 may be injected into the assembly 10, and a top plug 116 may then be injected into the assembly 10 along with the fluidic materials 114 and then positioned in the throat passage 44*aa* of the valve member 44. In this manner, the region of the passage 44*a* upstream from the first passages, 44*da* and 44*db*, may be fluidicly isolated from the first passages. In a preferred embodiment, the proper placement of the plug 116 may be indicated by a corresponding increase in the operating pressure of the fluidic material 114.

Figure 9A:
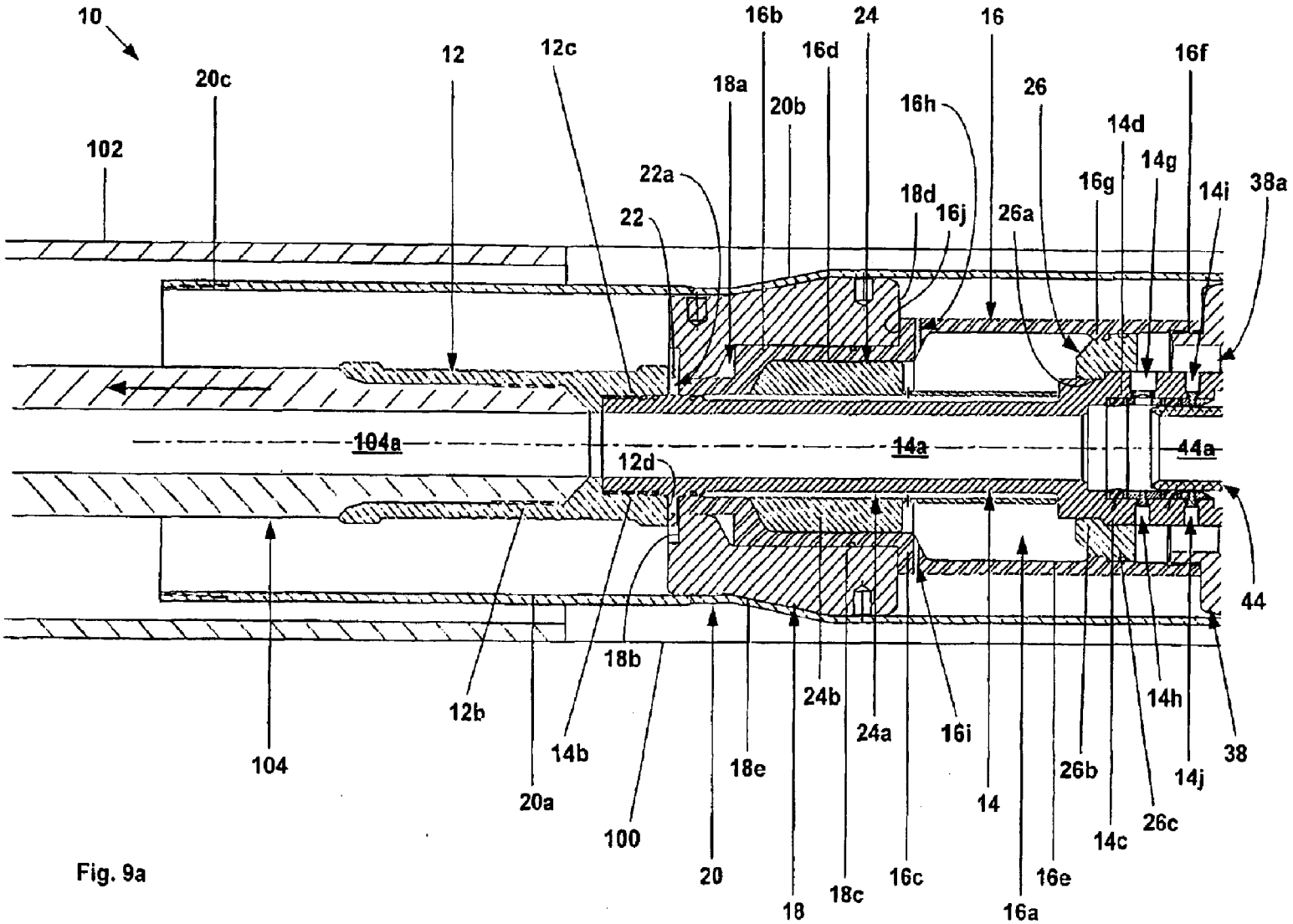
FIGS. 9*a*–9*c* are cross sectional illustrations of the upward displacement of sliding sleeve of the liner hanger assembly of FIGS. 8*a*–8*c*.
Figure 9B:
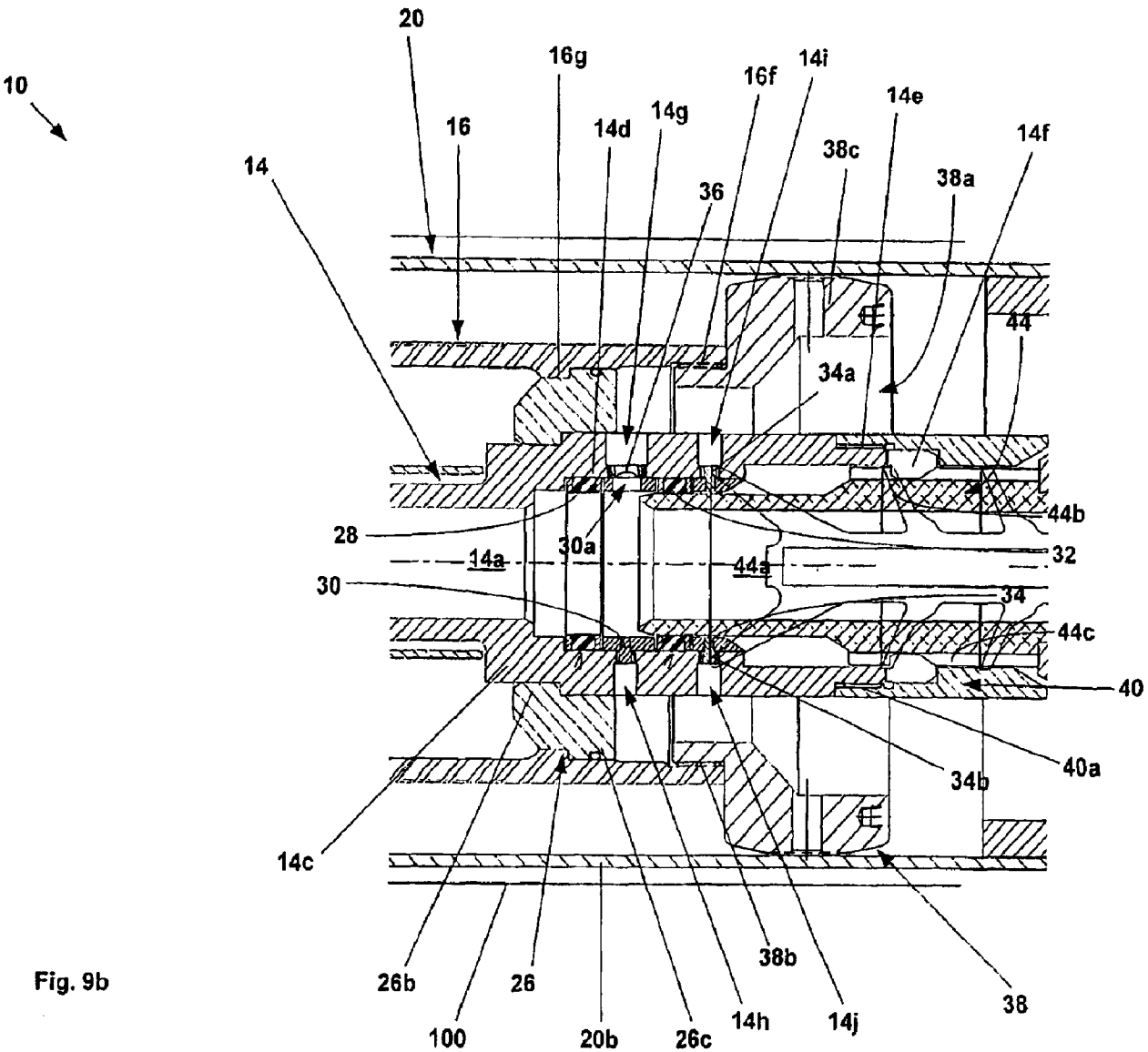
Figure 9C:
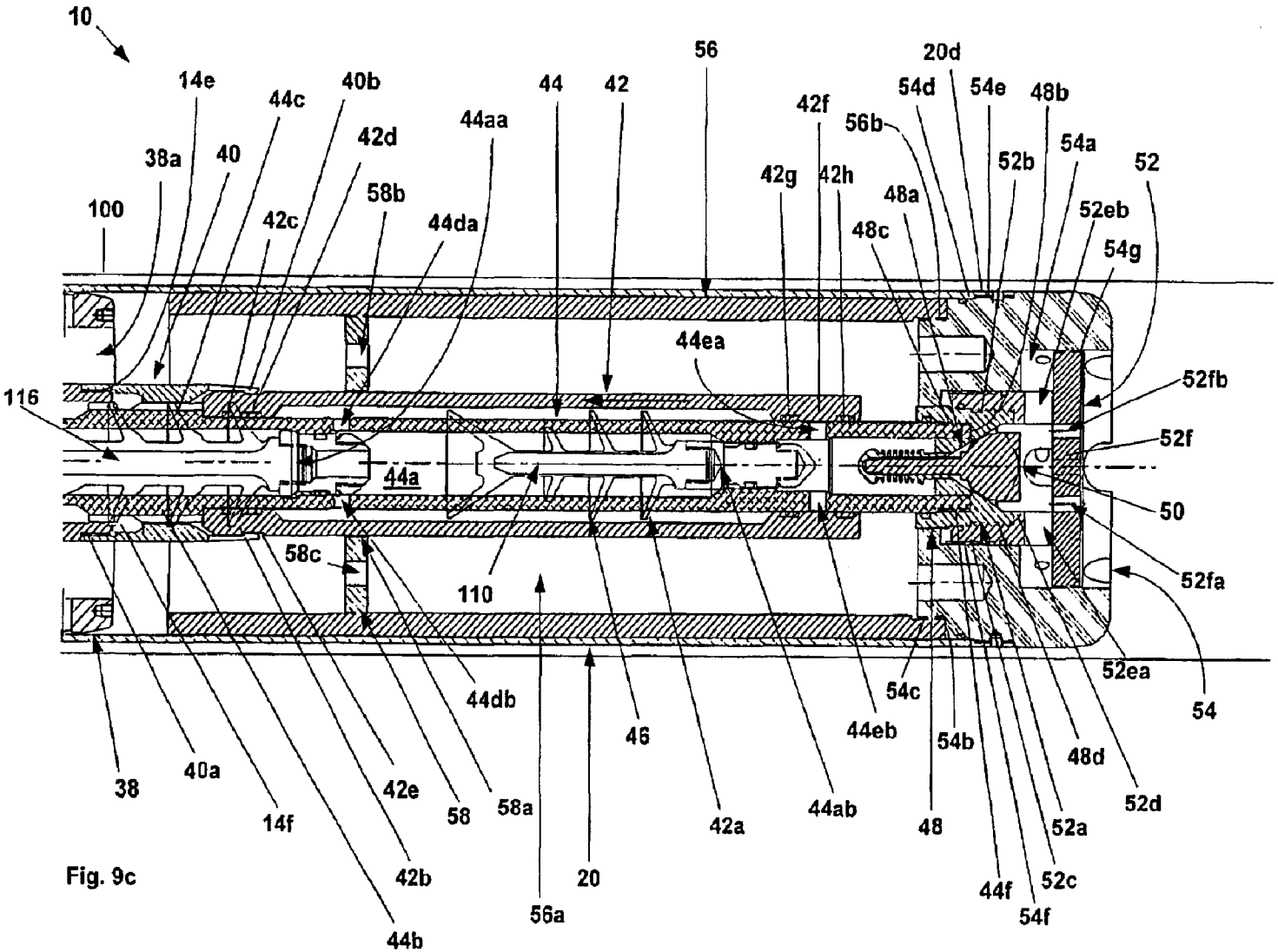

Referring to FIG. 9*a*–9*c*, in step 214, the sliding sleeve 42 may then be displaced relative to the valve member 44 by displacing the tubular member 104 by applying, for example, an upward force of approximately 13,000 lbf on the assembly 10. In this manner, the tubular member 104, the first tubular support member 12, the second tubular support member 14, the third tubular support member 16, the expansion cone 18, the annular spacer 22, the fourth tubular support member 24, the fifth tubular support member 26, the sixth tubular support member 38, the collet 40, and the sliding sleeve 42 are displaced in the longitudinal direction relative to the expansion cone launcher 20 and the valve member 44. In this manner, fluidic materials within the passage 44*a* upstream of the plug 110 may no longer bypass the plug by passing through the first passages, 44*da* and 44*db*, through the annular passage 46, and through the second passages, 44*ea* and 44*eb*, into the region of the passage 44*a* downstream from the plug. Furthermore, in this manner, the rupture disc 36 is no longer fluidicly isolated from the fluid passages 14*a* and 44*a*.

Figure 10A:
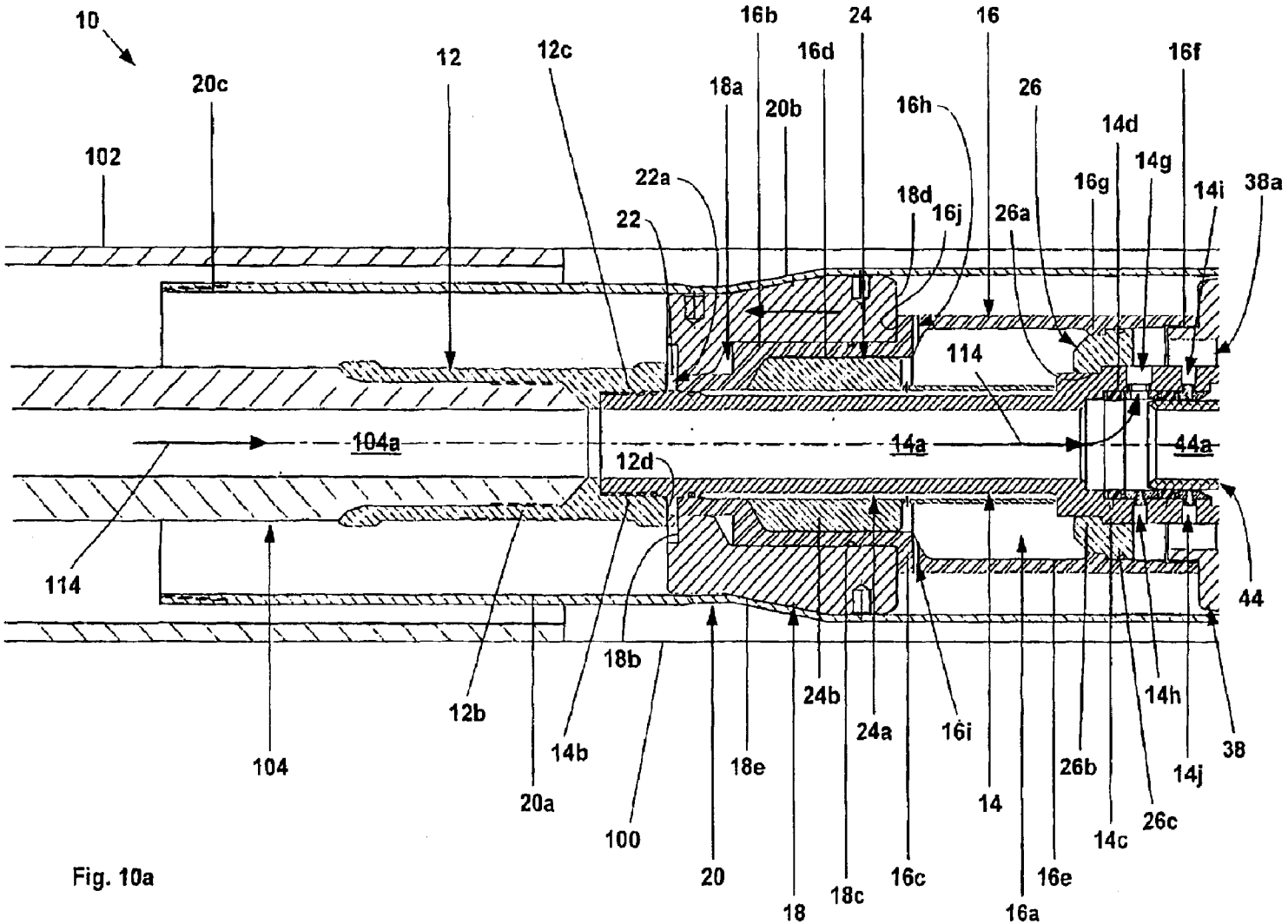
FIGS. 10*a*–10*c* are cross sectional illustrations of the injection of a pressurized fluidic material into the liner hanger assembly of FIGS. 9*a*–9*c* in order to radially expand and plastically deform the expansion cone launcher.
Figure 10B:
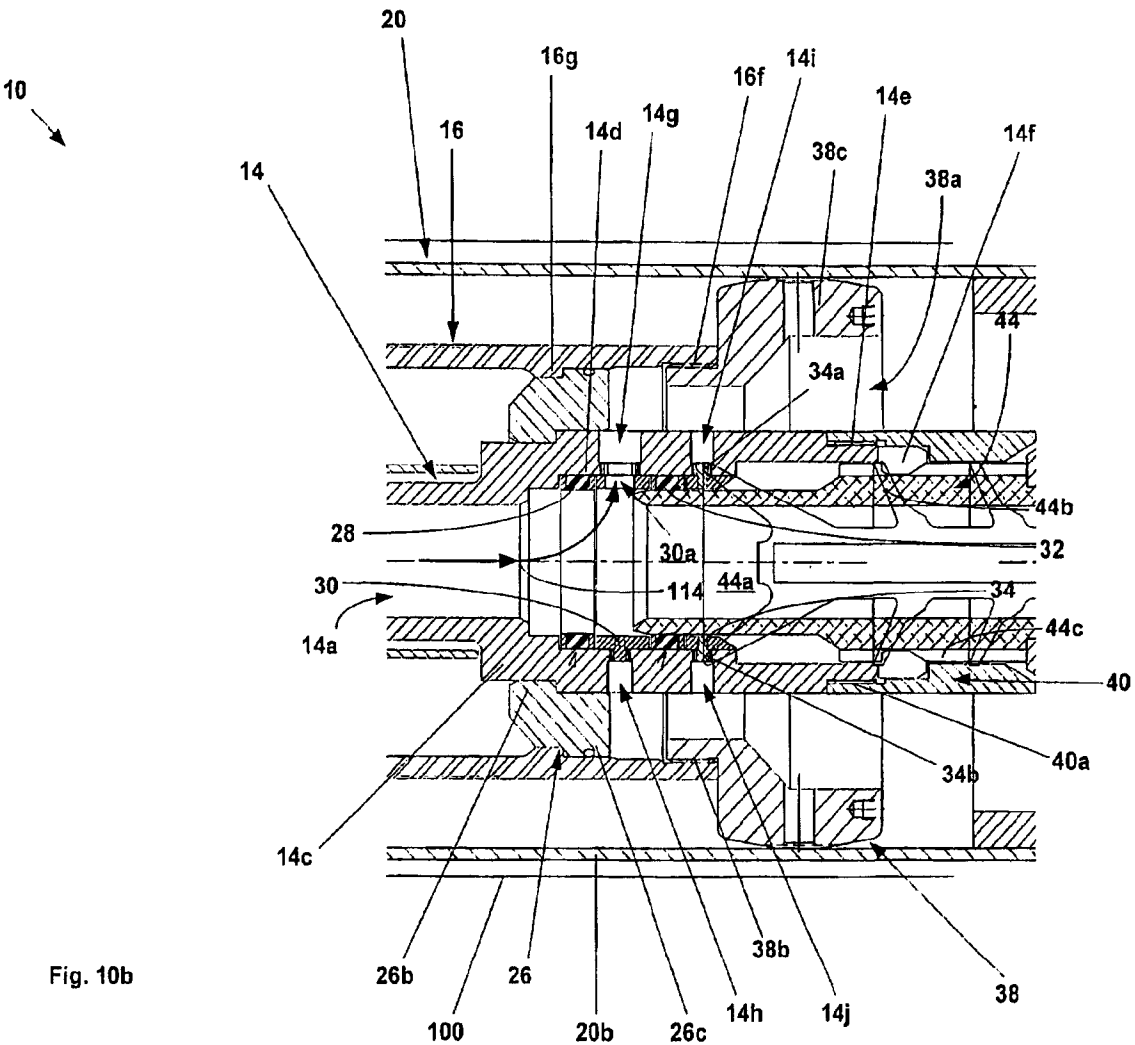
Figure 10C:
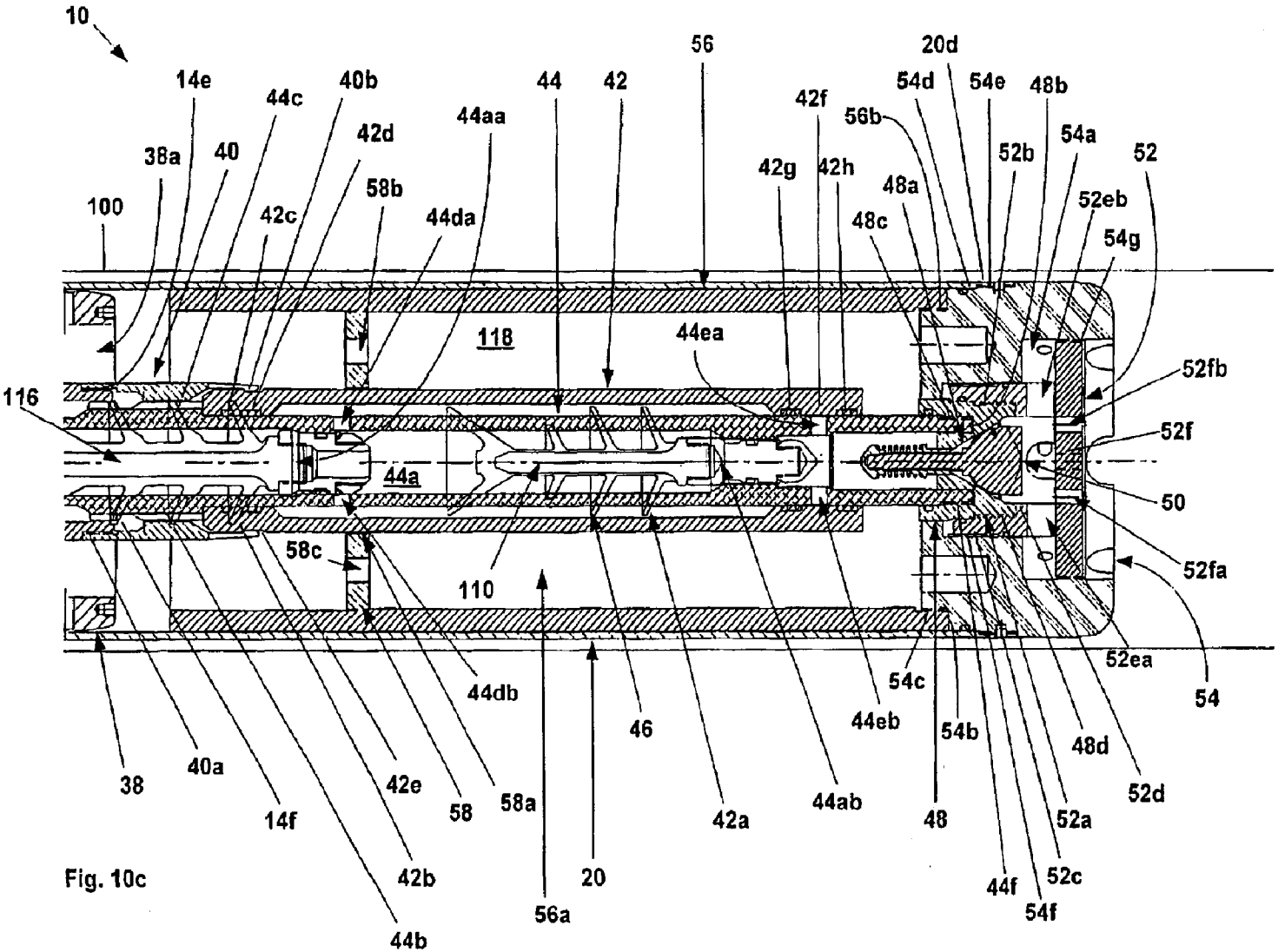

Referring to FIGS. 10*a*–10*c*, in step 216, the fluidic material 114 may be injected into the assembly 10. The continued injection of the fluidic material 114 may increase the operating pressure within the passages 14*a* and 44*a* until the burst disc 36 is opened thereby permitting the pressurized fluidic material 114 to pass through the radial passage 30*a* and into an annular region 118 defined by the second tubular support member 14, the third tubular support member 16, the sixth tubular support member 38, the collet 40, the sliding sleeve 42, the shoe 54, and the seventh tubular support member 56. The pressurized fluidic material 114 within the annular region 118 directly applies a longitudinal force upon the fifth tubular support member 26 and the sixth tubular support member 38. The longitudinal force in turn is applied to the expansion cone 18. In this manner, the expansion cone 18 is displaced relative to the expansion cone launcher 20 thereby radially expanding and plastically deforming the expansion cone launcher.

In an alternative embodiment of the method 200, the injection and placement of the top plug 116 into the liner hanger assembly 10 in step 212 may omitted.

In an alternative embodiment of the method 200, in step 202, the assembly 10 is positioned at the bottom of the wellbore 100.

Figure 11A:
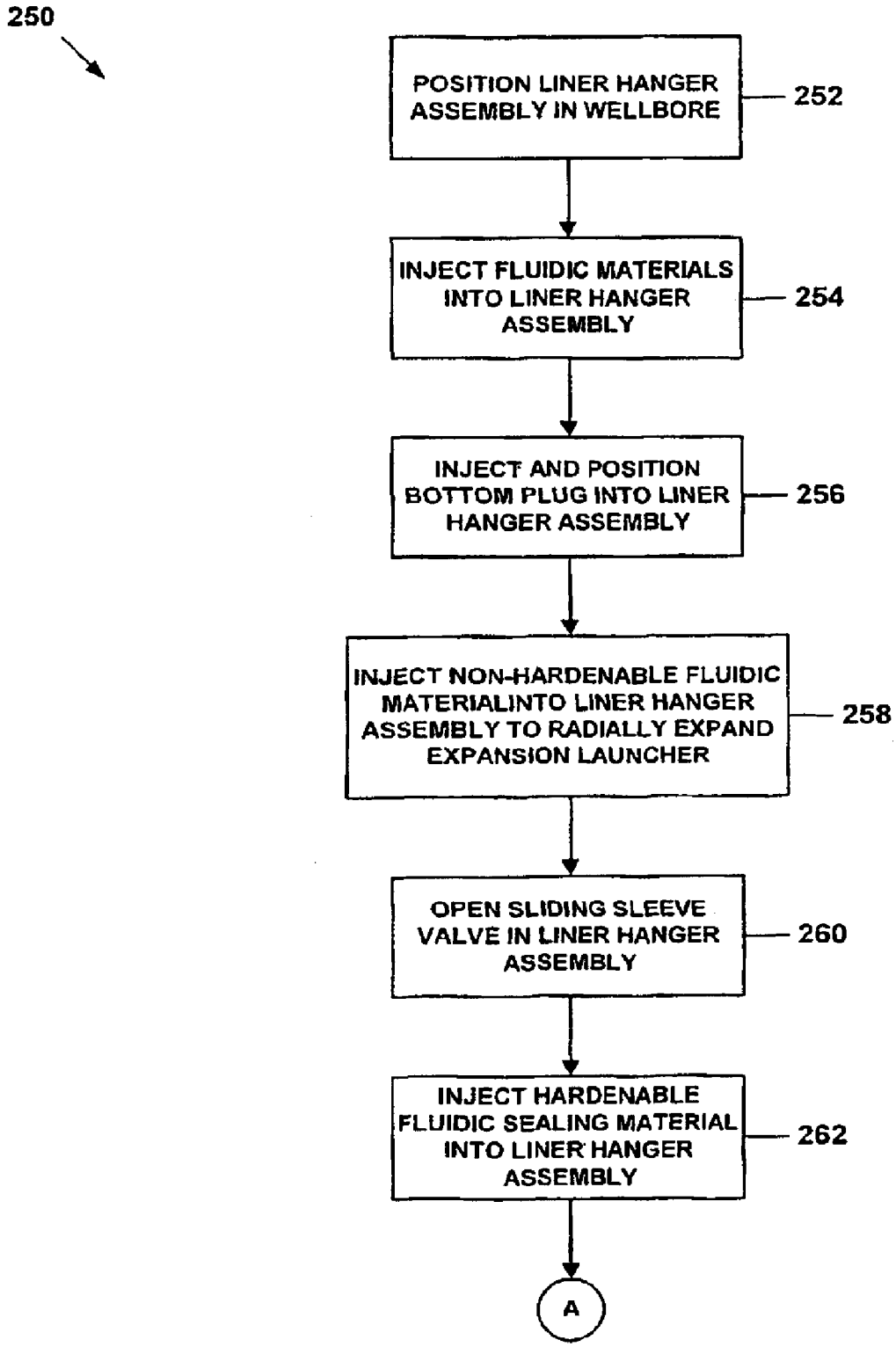
FIGS. 11*a*–11*b* is a flow chart illustration of an alternative embodiment of a method for forming a wellbore casing using the liner hanger assembly of FIGS. 1 and 1*a*–1*c*.
Figure 11B:
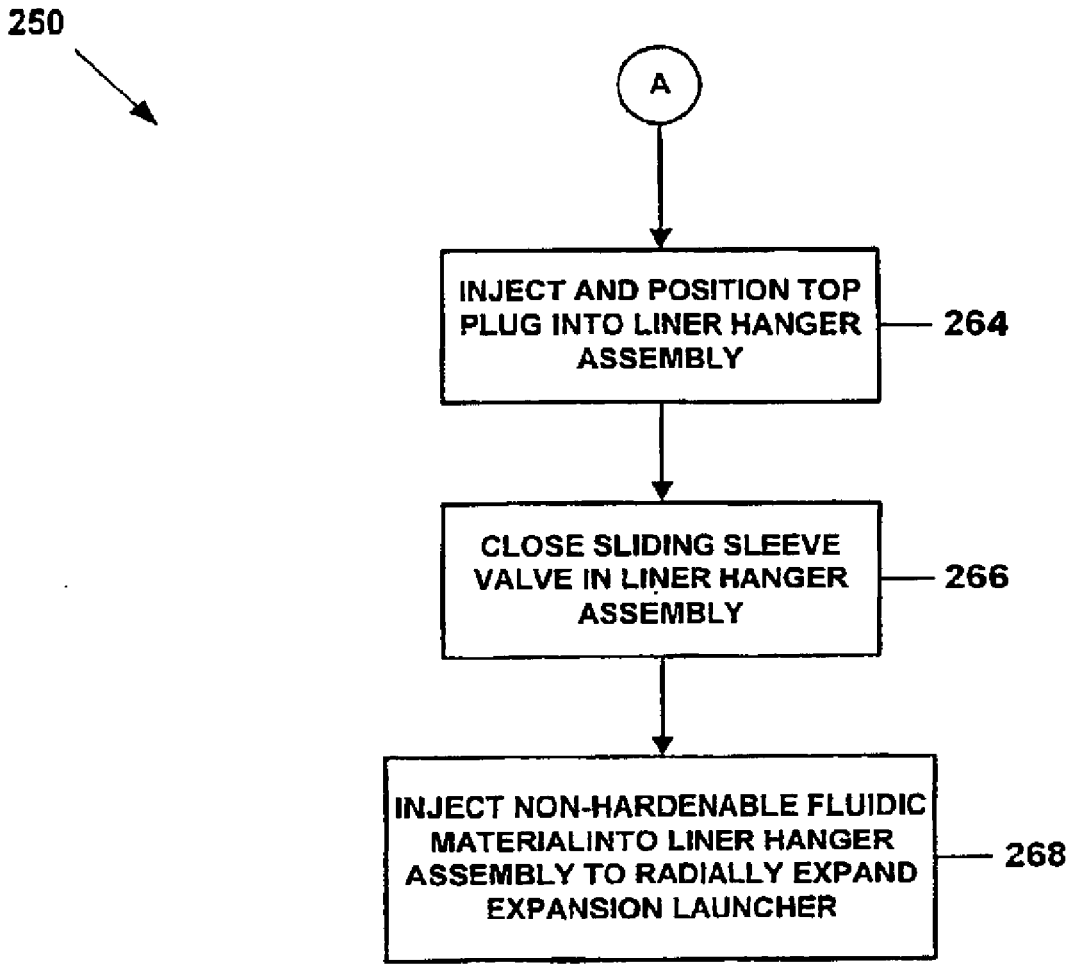

In an alternative embodiment, as illustrated in FIGS. 11*a*–11*b*, during operation, the assembly 10 may be used to form or repair a wellbore casing by implementing a method 250 in which, as illustrated in FIGS. 3*a*–3*c*, the assembly 10 may initially be positioned within a wellbore 100 having a preexisting wellbore casing 102 by coupling a conventional tubular member 104 defining an internal passage 104*a* to the threaded portion 12*b* of the first tubular support member 12 in step 252. In a preferred embodiment, during placement of the assembly 10 within the wellbore 100, fluidic materials 106 within the wellbore 100 below the assembly 10 are conveyed through the assembly 10 and into the passage 104*a* by the fluid passages 52*fa*, 52*fb*, 54*a*, 48*a*, 44*a*, and 14*a*. In this manner, surge pressures that can be created during placement of the assembly 10 within the wellbore 100 are minimized. In a preferred embodiment, the float valve element 50 is pre-set in an auto-fill configuration to permit the fluidic materials 106 to pass through the conical passage 48*a* of the valve seat 48.

Referring to FIGS. 4*a*–4*c*, in step 254, fluidic materials 108 may then be injected into and through the tubular member 104 and assembly 10 to thereby ensure that all of the fluid passages 104*a*, 14*a*, 44*a*, 48*a*, 54*a*, 52*fa*, and 52*fb* are functioning properly.

Referring to FIGS. 5*a*–5*c*, in step 256, the bottom plug 110 may then be injected into the fluidic materials 108 and into the assembly 10 and then positioned in the throat passage 44*ab* of the valve member 44. In this manner, the region of the passage 44*a* upstream from the plug 110 may be fluidicly isolated from the region of the passage 44*a* downstream from the plug 110. In a preferred embodiment, the proper placement of the plug 110 may be indicated by a corresponding increase in the operating pressure of the fluidic material 108.

Figure 12A:
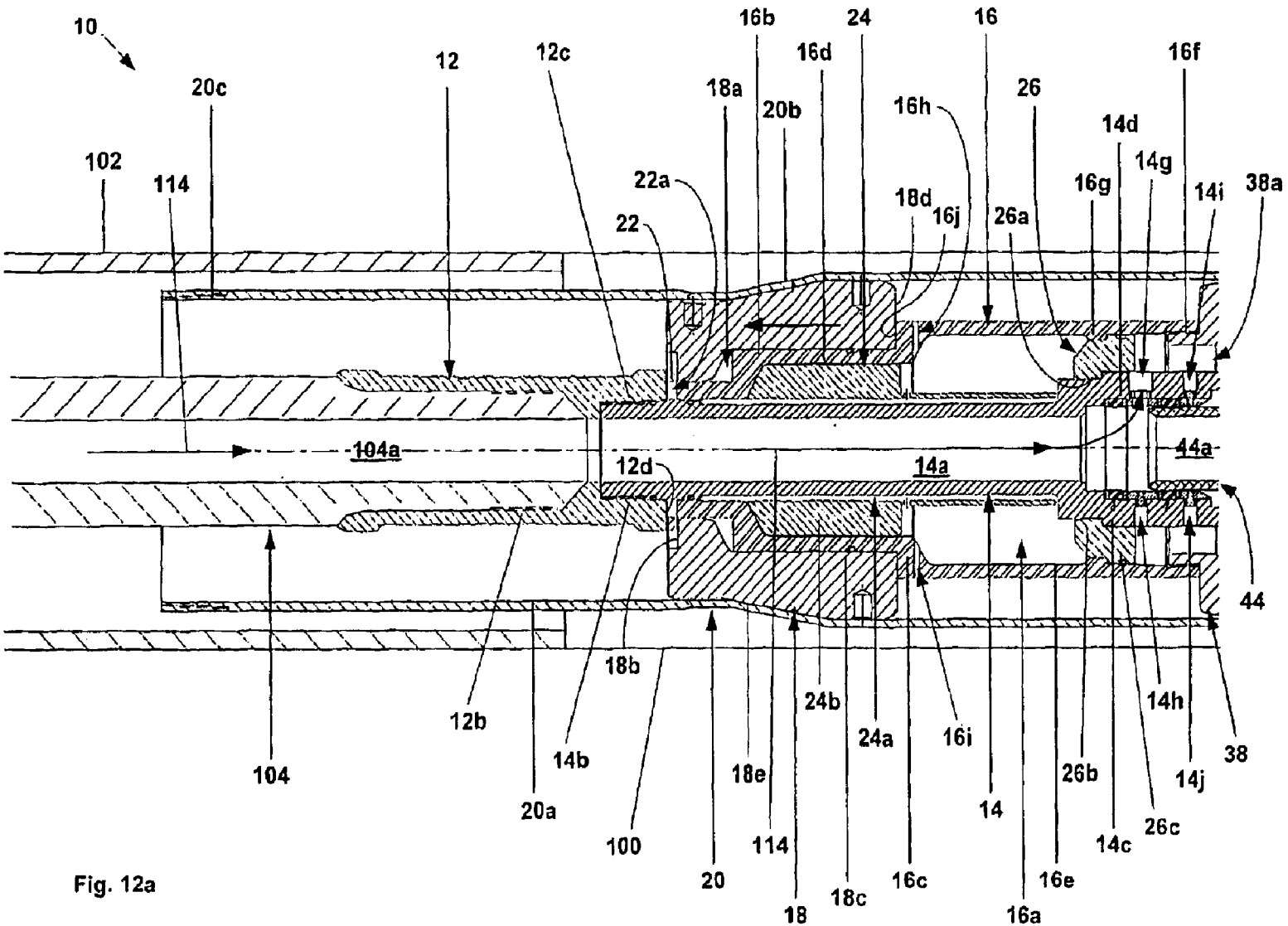
FIGS. 12*a*–12*c* are cross sectional illustrations of the injection of a pressurized fluidic material into the liner hanger assembly of FIGS. 5*a*–5*c* in order to at least partially radially expand and plastically deform the expansion cone launcher.
Figure 12B:
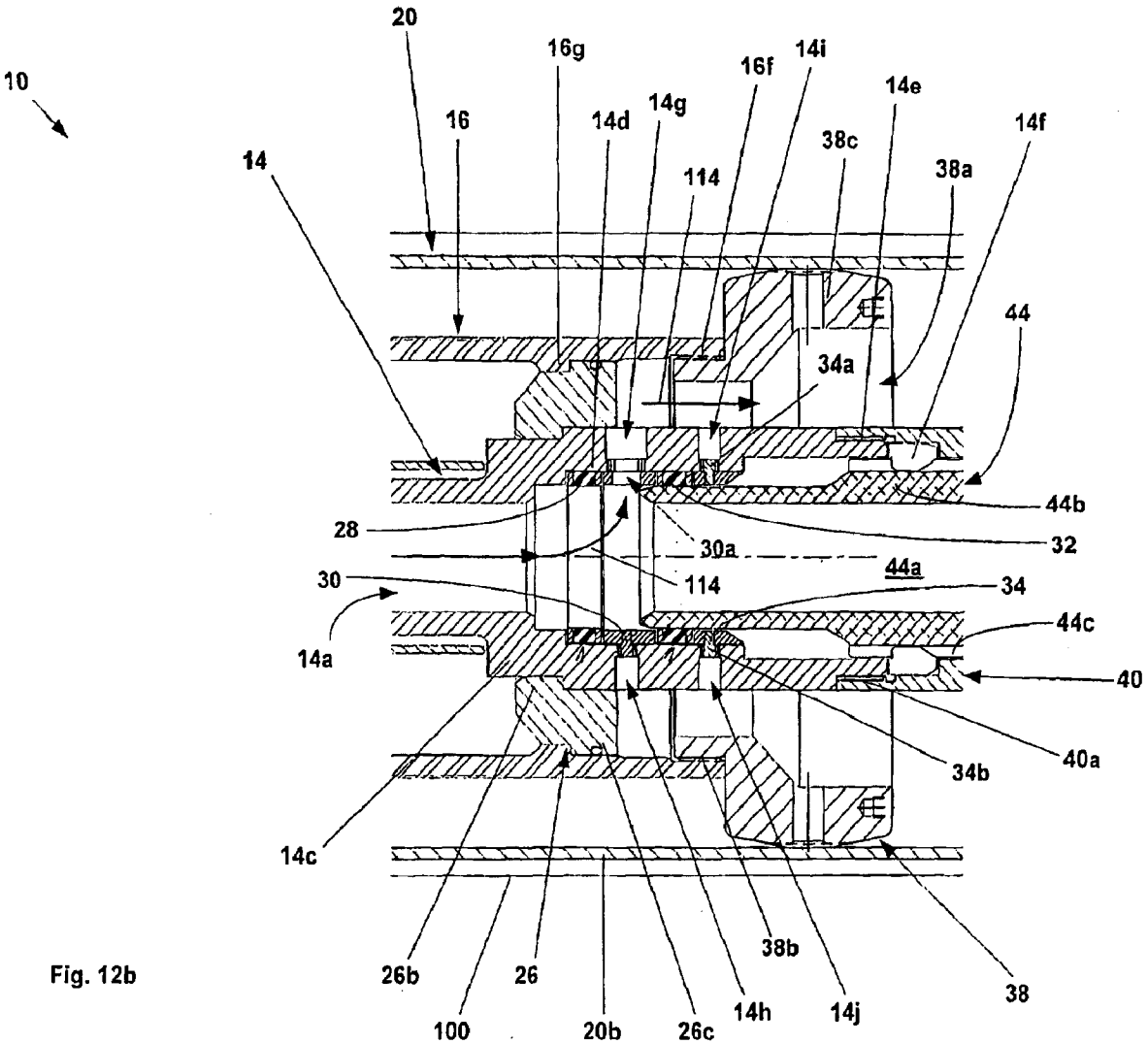
Figure 12C:
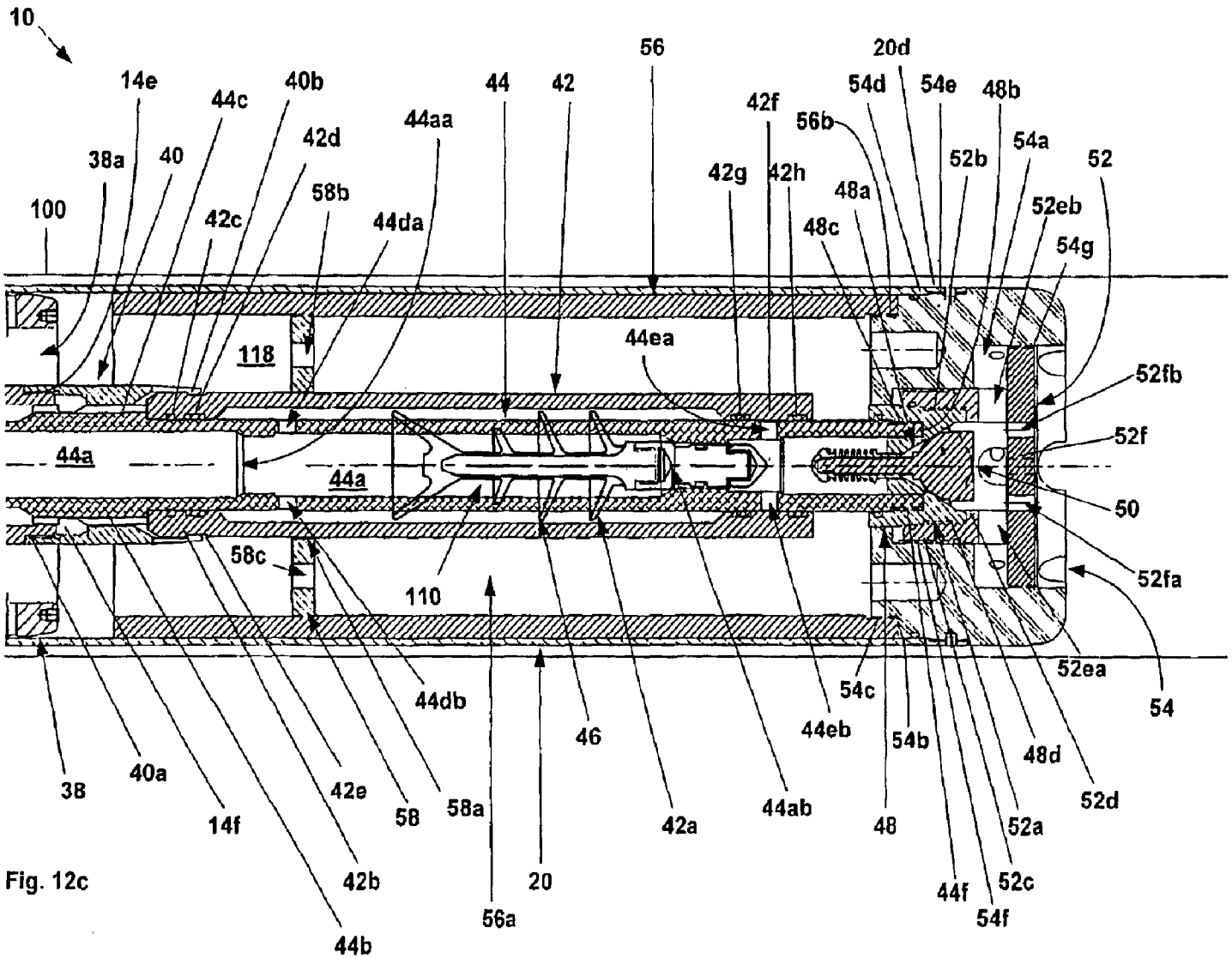

Referring to FIGS. 12*a*–12*c*, in step 258, a fluidic material 114 may then be injected into the assembly to thereby increase the operating pressure within the passages 14*a* and 44*a* until the burst disc 36 is opened thereby permitting the pressurized fluidic material 114 to pass through the radial passage 30*a* and into an annular region 118 defined by the second tubular support member 14, the third tubular support member 16, the sixth tubular support member 38, the collet 40, the sliding sleeve 42, the shoe 54, and the seventh tubular support member 56. The pressurized fluidic material 114 within the annular region 118 directly applies a longitudinal force upon the fifth tubular support member 26 and the sixth tubular support member 38. The longitudinal force in turn is applied to the expansion cone 18. In this manner, the expansion cone 18 is displaced relative to the expansion cone launcher 20 thereby disengaging the collet 40 and the sliding sleeve 42 and radially expanding and plastically deforming the expansion cone launcher. In a preferred embodiment, the radial expansion process in step 408 is continued to a location below the overlap between the expansion cone launcher 20 and the preexisting wellbore casing 102.

Figure 13A:
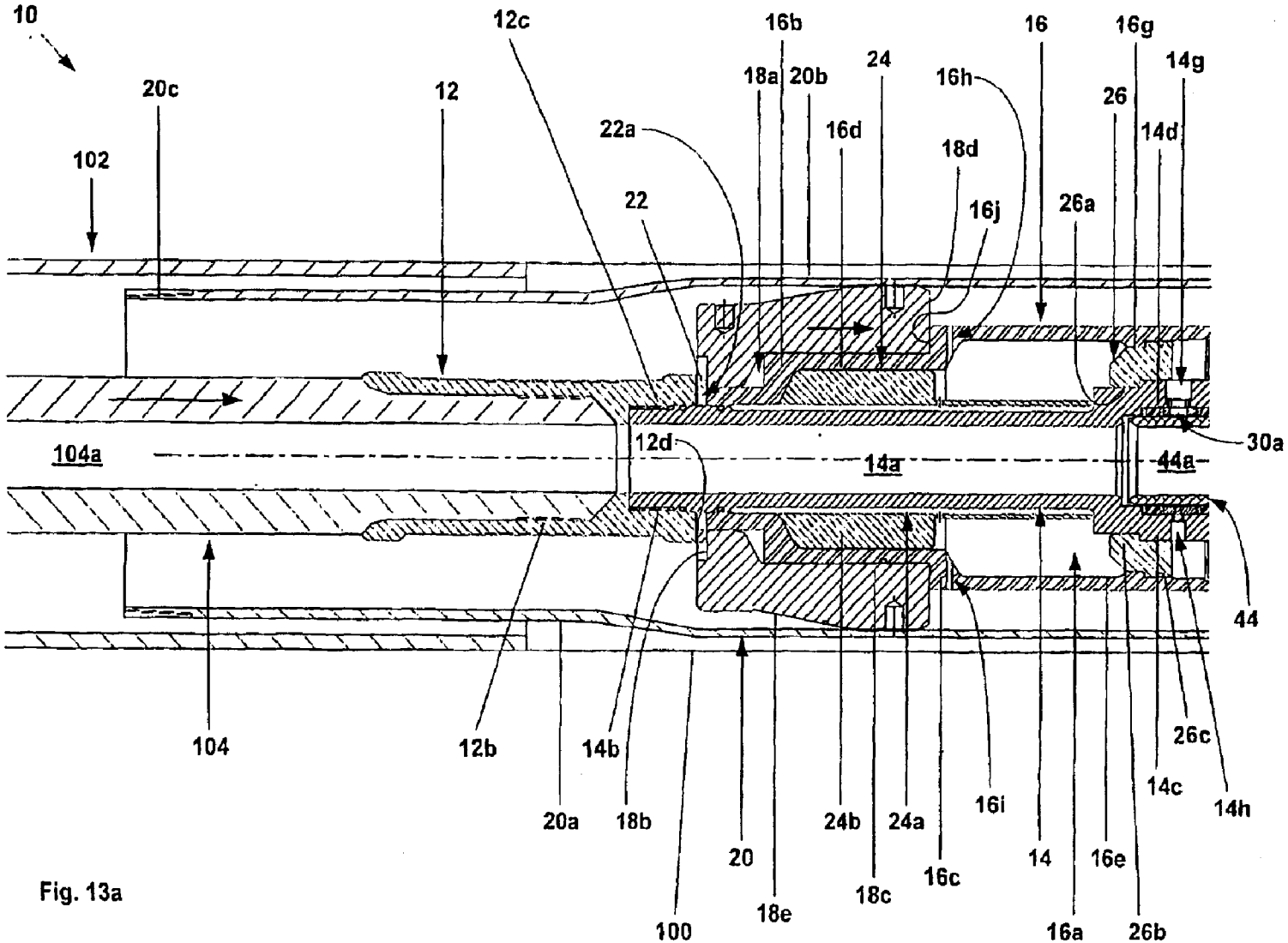
FIGS. 13*a*–13*c* are cross sectional illustrations of the downward displacement of the sliding sleeve of the liner hanger assembly of FIGS. 12*a*–12*c*.
Figure 13B:
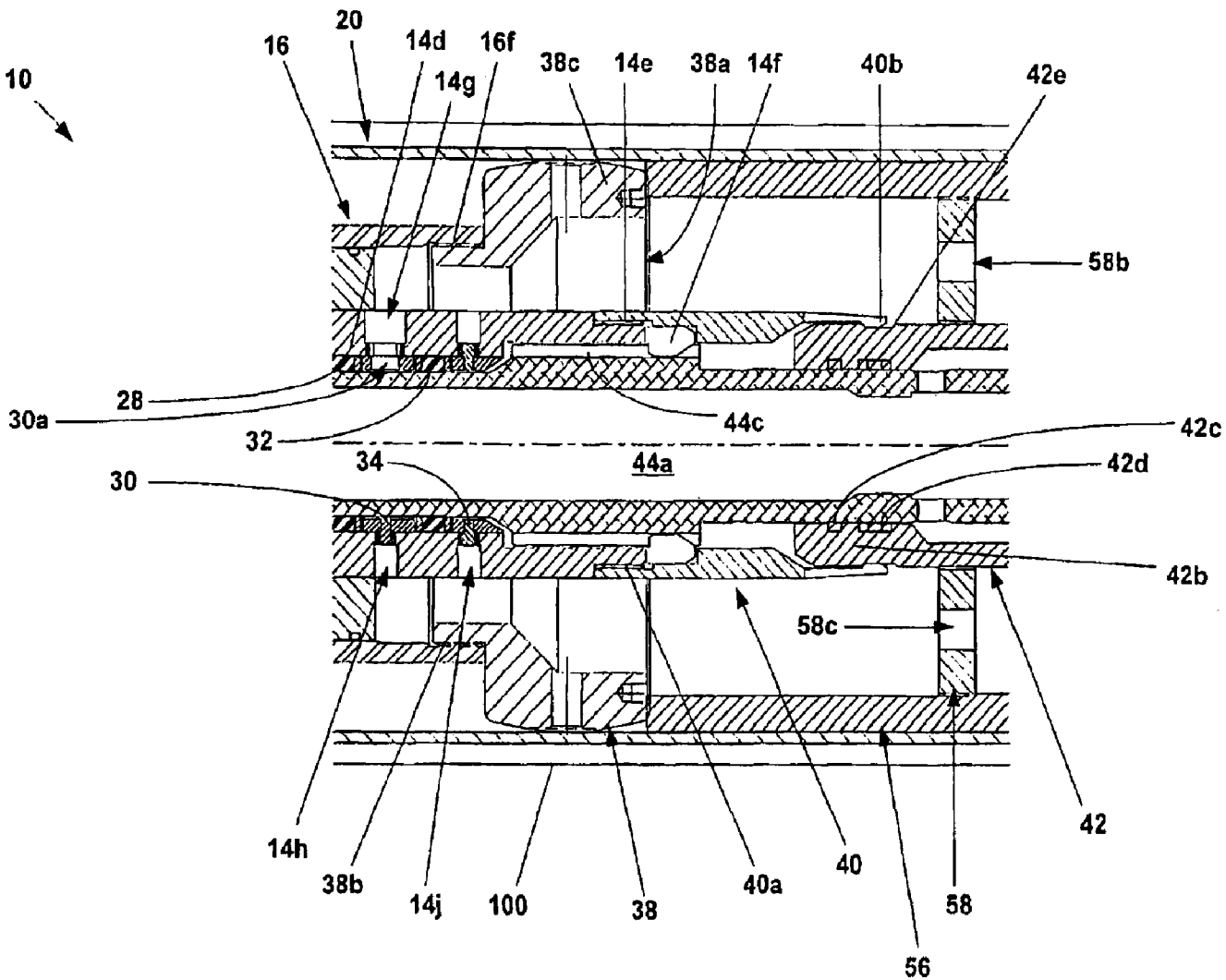
Figure 13C:
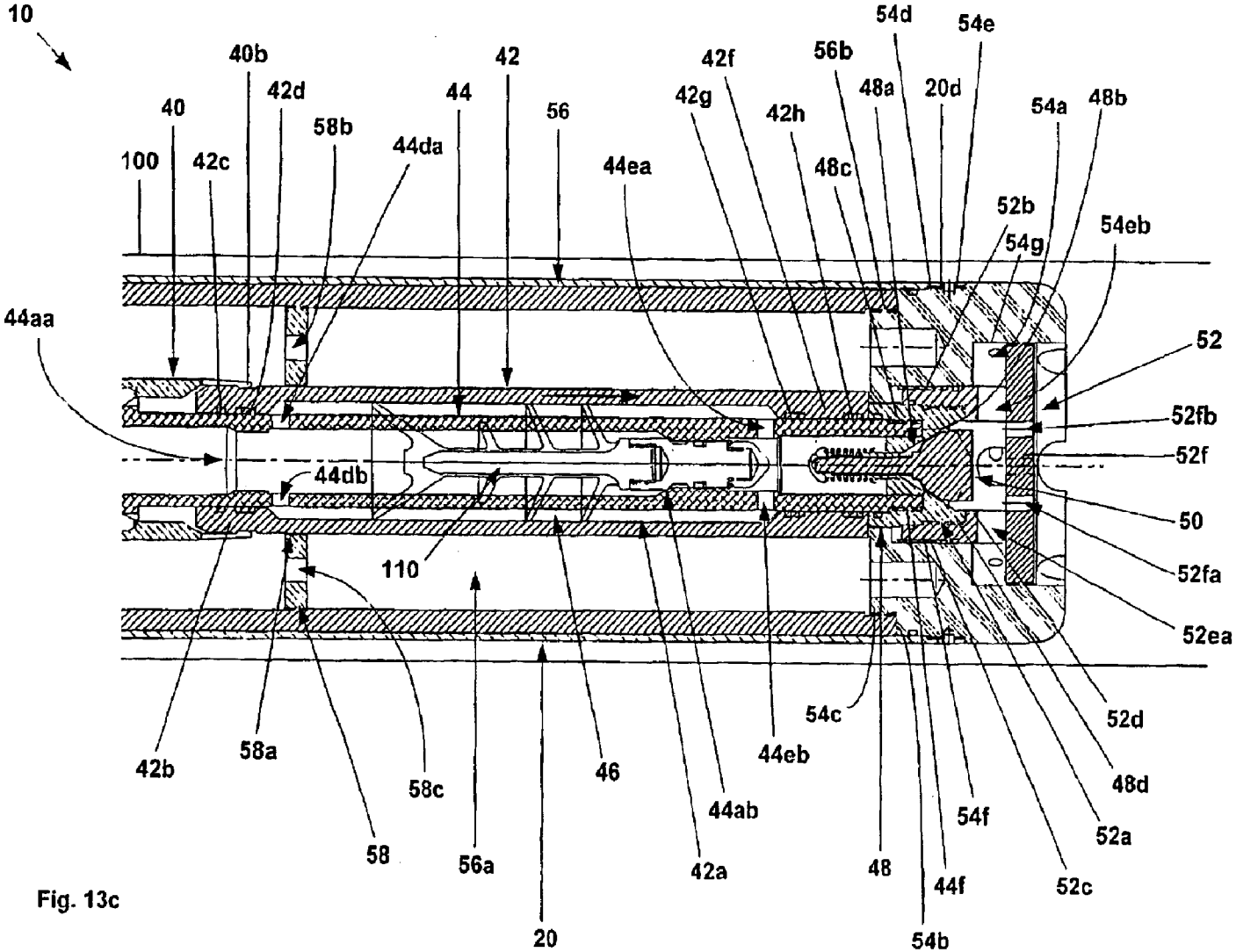

Referring to FIGS. 13*a*–13*c*, in step 260, the sliding sleeve 42 may then be displaced relative to the valve member 44 by (1) displacing the expansion cone 18 in a downward direction using the tubular member 104 and (2) applying, using the tubular member 104 a downward force of, for example, approximately 5,000 lbf on the assembly 10. In this manner, the coupling 40*b* of the collet 40 reengages the external groove 42*e* of the sliding sleeve 42. Furthermore, in this manner, the tubular member 104, the first tubular support member 12, the second tubular support member 14, the third tubular support member 16, the expansion cone 18, the annular spacer 22, the fourth tubular support member 24, the fifth tubular support member 26, the sixth tubular support member 38, the collet 40, and the sliding sleeve 42 are displaced in the longitudinal direction relative to the expansion cone launcher 20 and the valve member 44. In this manner, fluidic materials within the passage 44*a* upstream of the plug 110 may bypass the plug by passing through the first passages, 44*da* and 44*db*, through the annular passage 46, and through the second passages, 44*ea* and 44*eb*, into the region of the passage 44*a* downstream from the plug. Furthermore, in this manner, the fluid passage 30*a* is fluidicly isolated from the passages 14*a* and 44*a*.

Figure 14A:
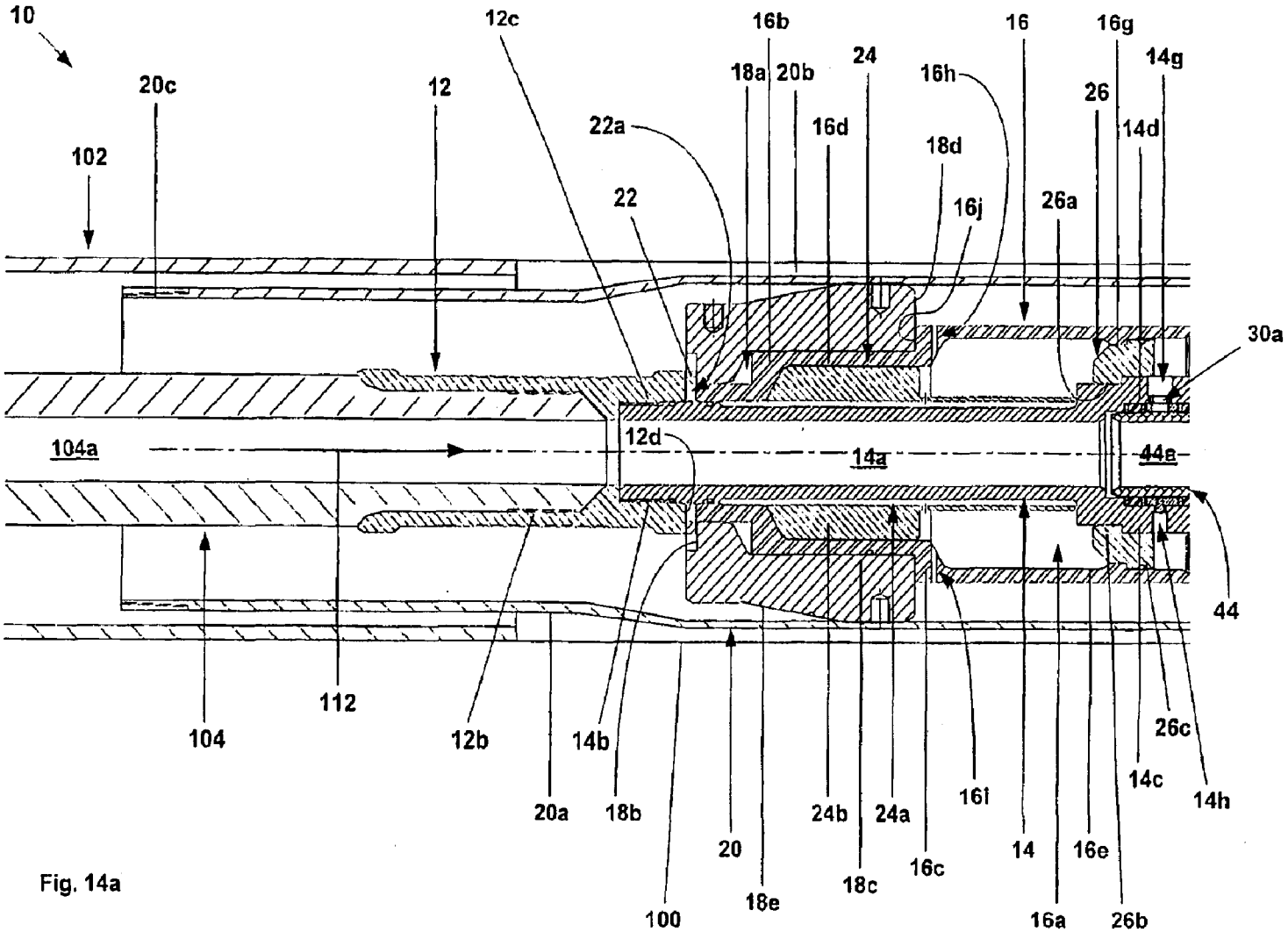
FIGS. 14*a*–14*c* are cross sectional illustrations of the injection of a hardenable fluidic sealing material through the liner hanger assembly of FIGS. 13*a*–13*c*.
Figure 14B:
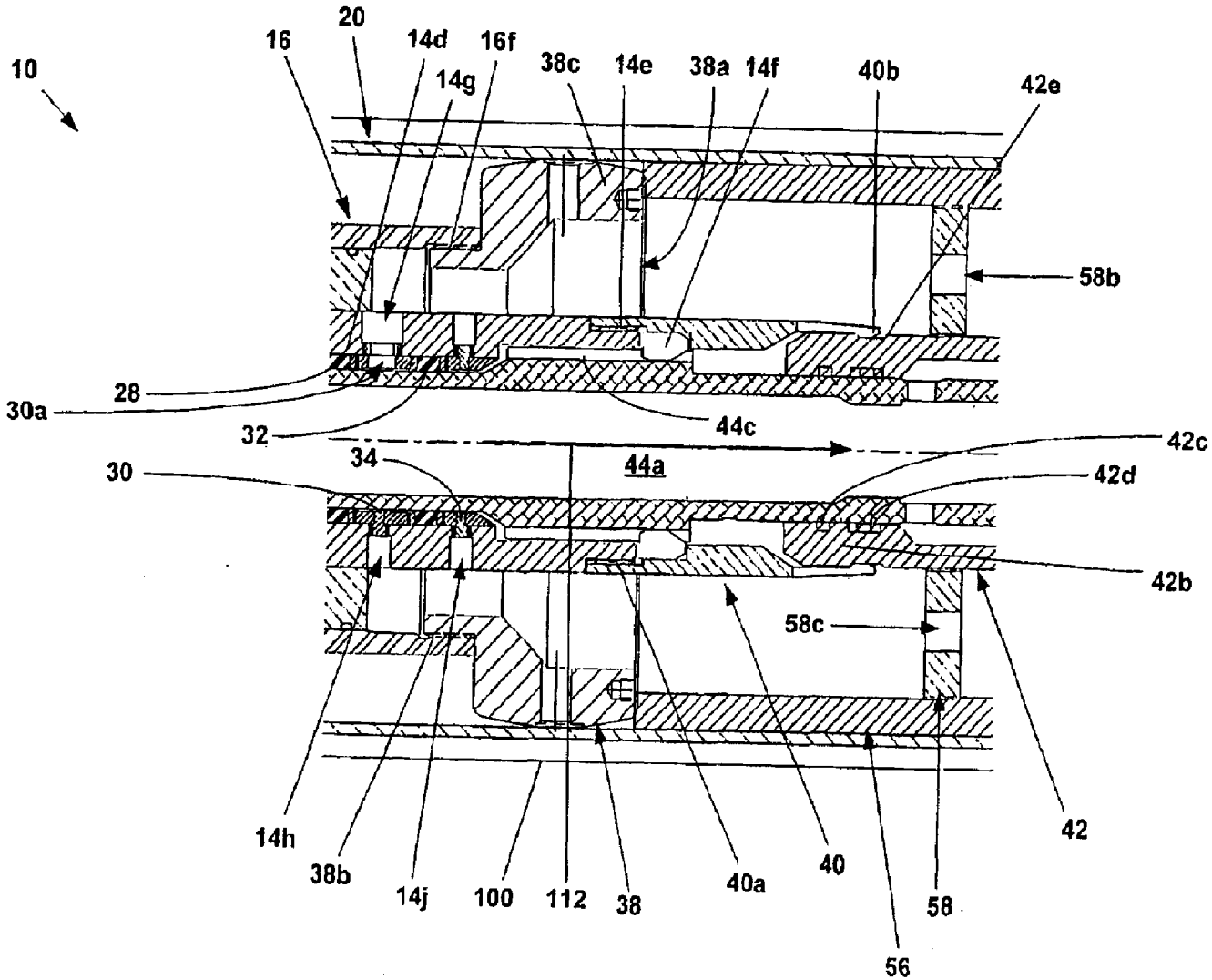
Figure 14C:
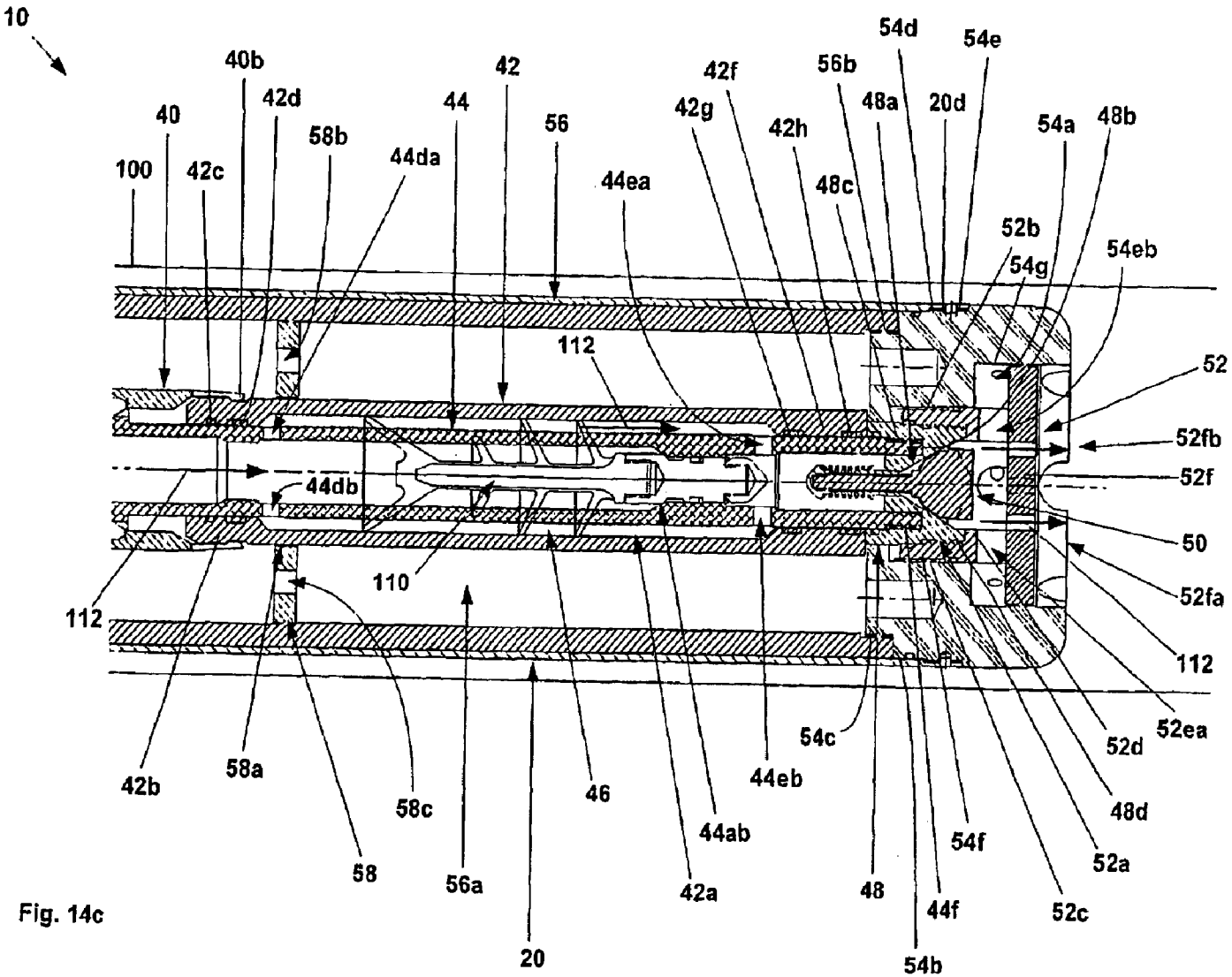

Referring to FIGS. 14*a*–14*c*, in step 262, the hardenable fluidic sealing material 112 may then be injected into the assembly 10 and conveyed through the passages 104*a*, 14*a*, 44*a*, 44*da*, 44*db*, 46, 44*ea*, 44*eb*, 48*a*, 54*a*, 52*fa*, and 52*fb* into the wellbore 100. In this manner, a hardenable fluidic sealing material such as, for example, cement, may be injected into the annular region between the expansion cone launcher 20 and the wellbore 100 in order to subsequently form an annular body of cement around the radially expanded expansion cone launcher 20. Furthermore, in this manner, the radial passage 30*a* and the rupture disc 36 are not exposed to the hardenable fluidic sealing material 112.

Figure 15A:
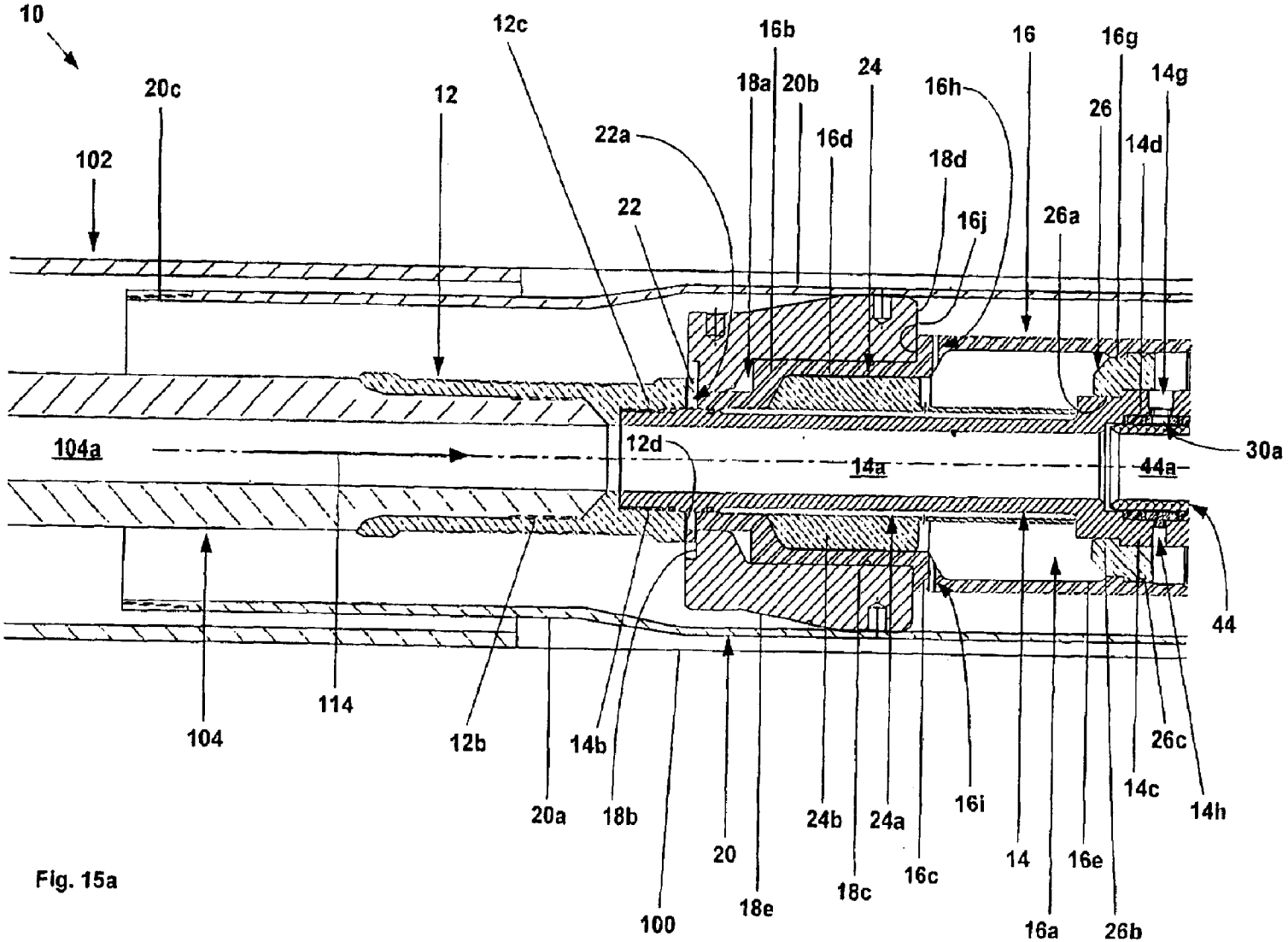
FIGS. 15*a*–15*c* are cross sectional illustrations of the injection and placement of a top plug into the liner hanger assembly of FIGS. 14*a*–14*c*.
Figure 15B:
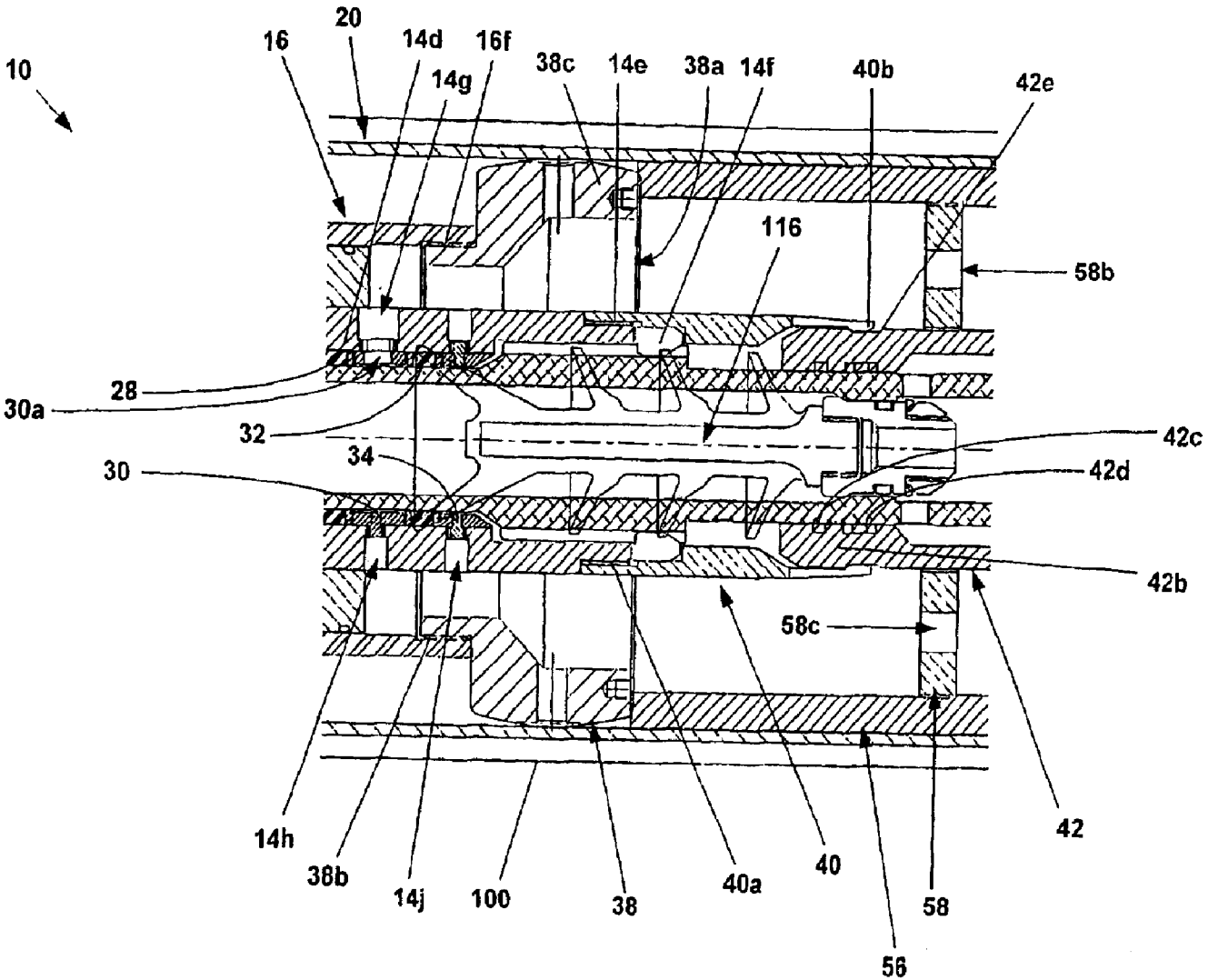
Figure 15C:
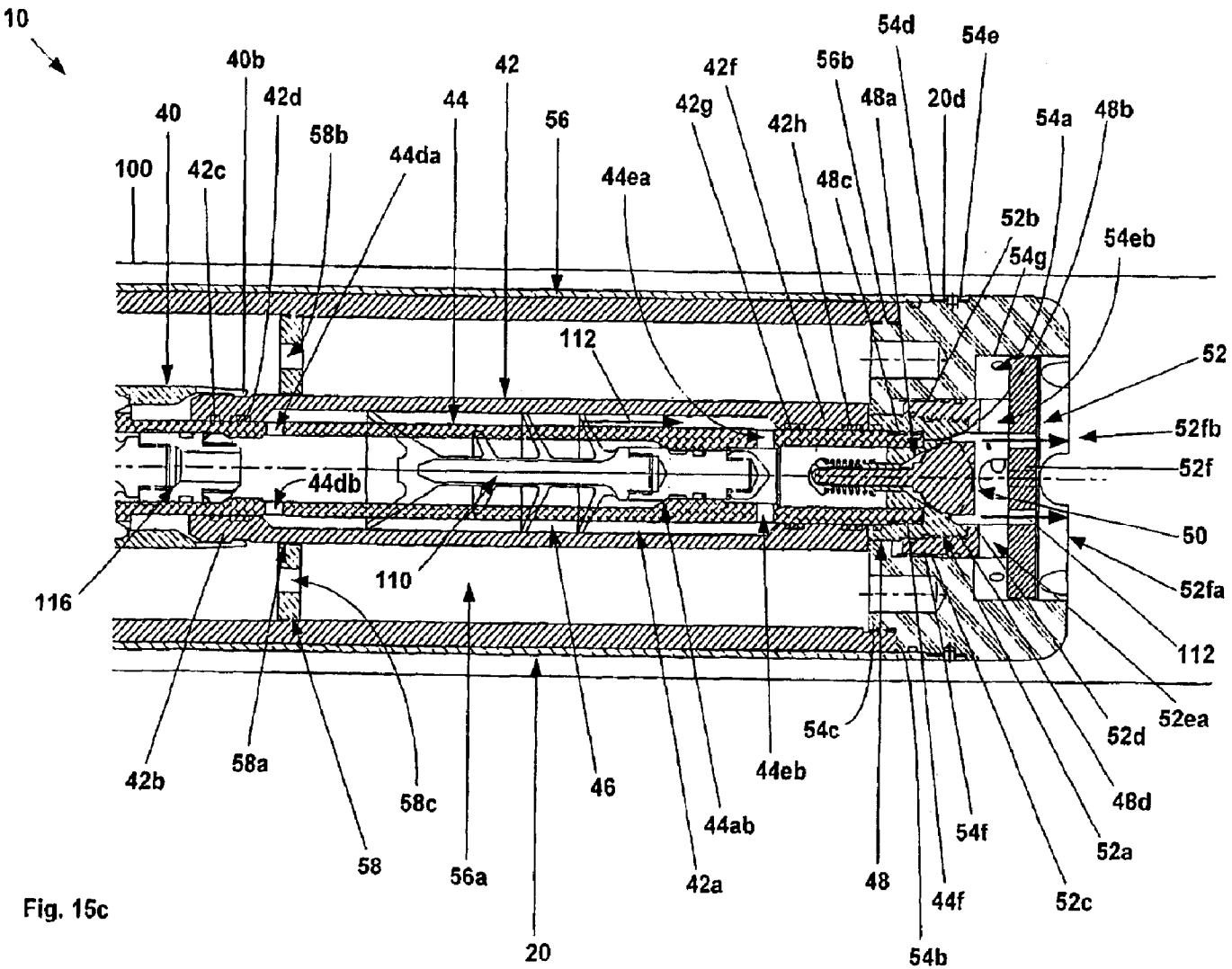

Referring to FIGS. 15*a*–15*c*, in step 264, upon the completion of the injection of the hardenable fluidic sealing material 112, the non-hardenable fluidic material 114 may be injected into the assembly 10, and the top plug 116 may then be injected into the assembly 10 along with the fluidic materials 114 and then positioned in the throat passage 44*aa* of the valve member 44. In this manner, the region of the passage 44*a* upstream from the first passages, 44*da* and 44*db*, may be fluidicly isolated from the first passages. In a preferred embodiment, the proper placement of the plug 116 may be indicated by a corresponding increase in the operating pressure of the fluidic material 114.

Figure 16A:
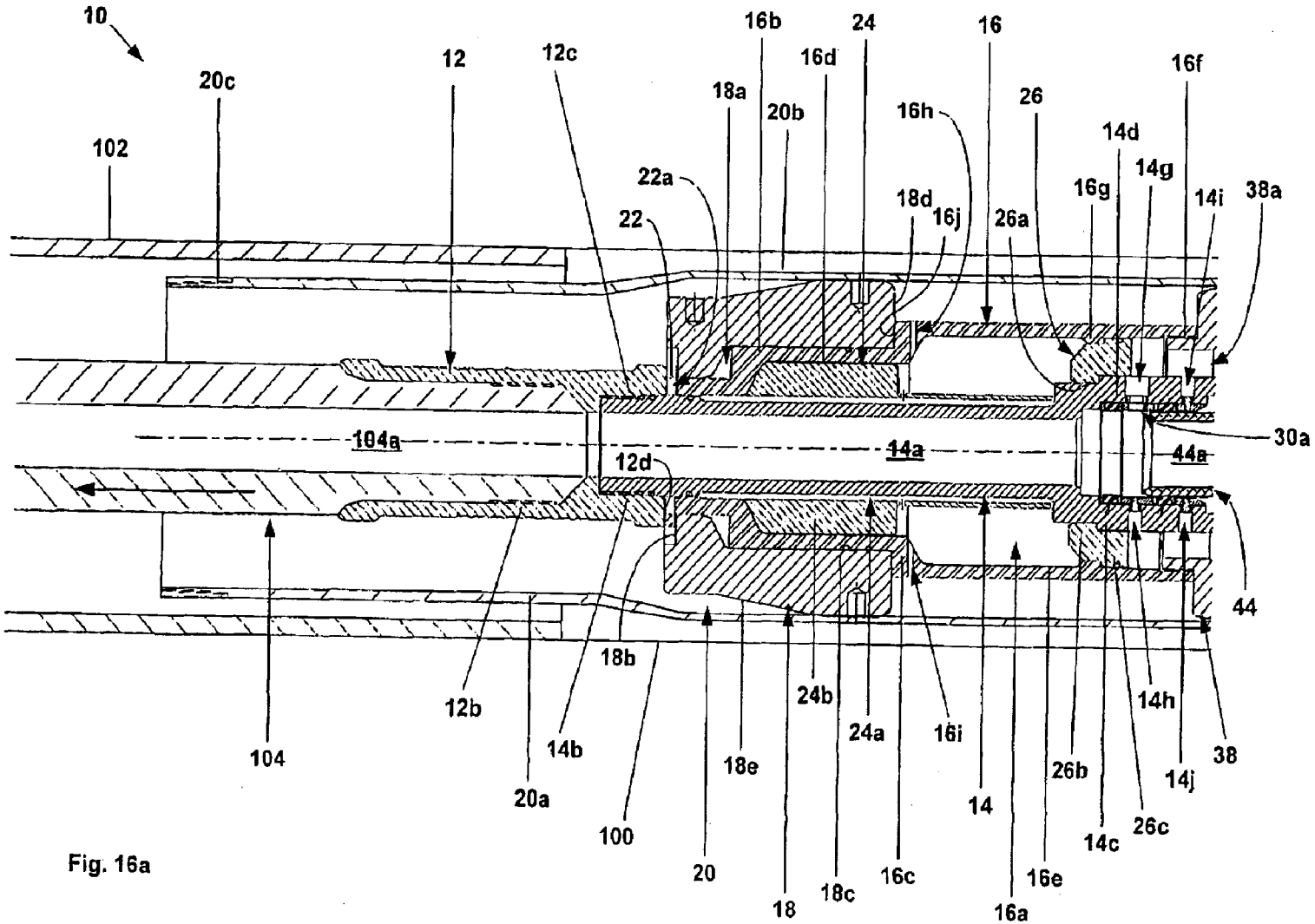
FIGS. 16*a*–16*c* are cross sectional illustrations of the upward displacement of the sliding sleeve of the liner hanger assembly of FIGS. 15*a*–15*c*.
Figure 16B:
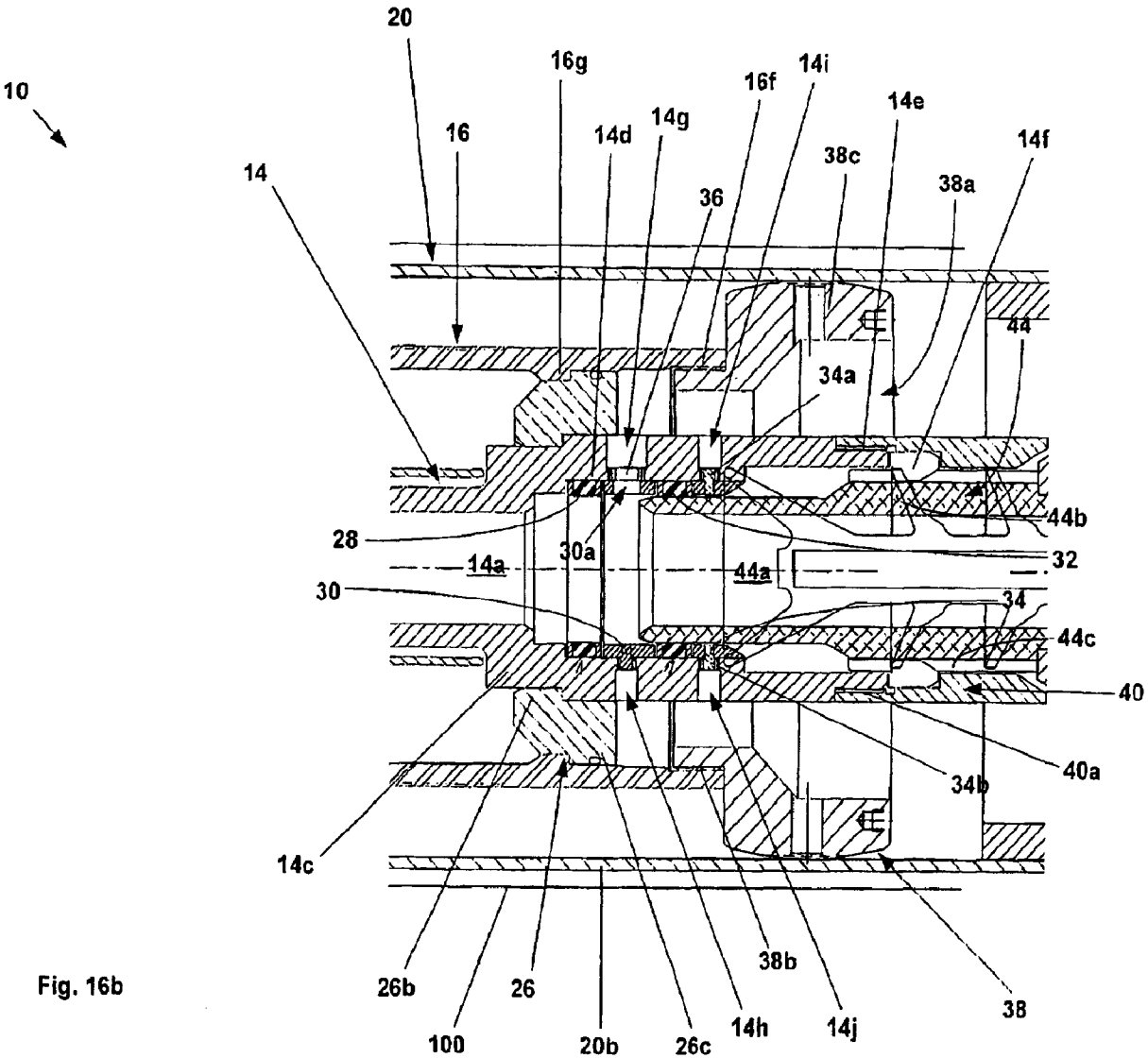
Figure 16C:
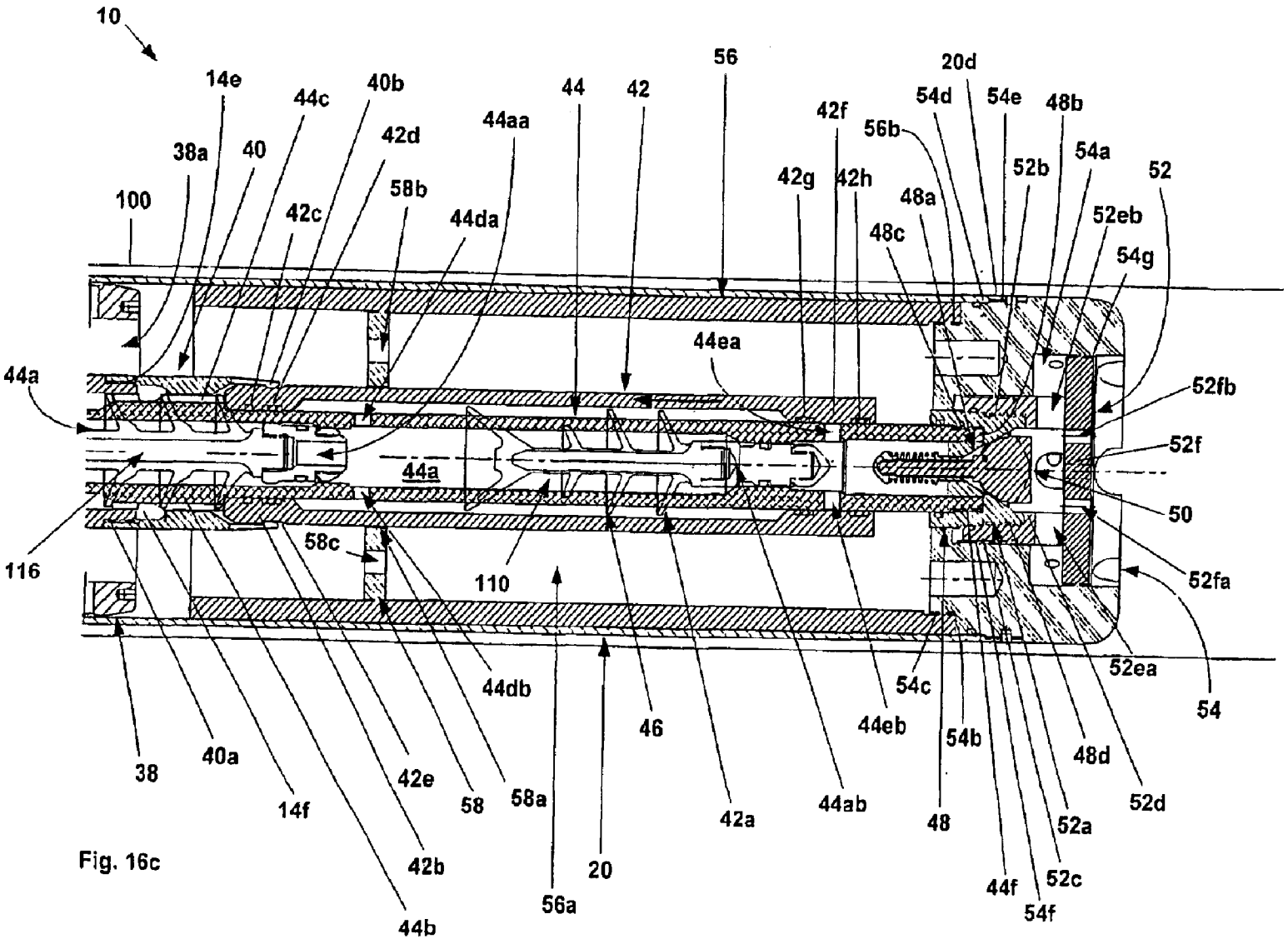

Referring to FIGS. 16*a*–16*c*, in step 266, the sliding sleeve 42 may then be displaced relative to the valve member 44 by displacing the tubular member 104 by applying, for example, an upward force of approximately 13,000 lbf on the assembly 10. In this manner, the tubular member 104, the first tubular support member 12, the second tubular support member 14, the third tubular support member 16, the expansion cone 18, the annular spacer 22, the fourth tubular support member 24, the fifth tubular support member 26, the sixth tubular support member 38, the collet 40, and the sliding sleeve 42 are displaced in the longitudinal direction relative to the expansion cone launcher 20 and the valve member 44. In this manner, fluidic materials within the passage 44*a* upstream of the plug 110 may no longer bypass the plug by passing through the first passages, 44*da* and 44*db*, through the annular passage 46, and through the second passages, 44*ea* and 44*eb*, into the region of the passage 44*a* downstream from the plug. Furthermore, in this manner, the passage 30*a* is no longer fluidicly isolated from the fluid passages 14*a* and 44*a*.

Figure 17A:
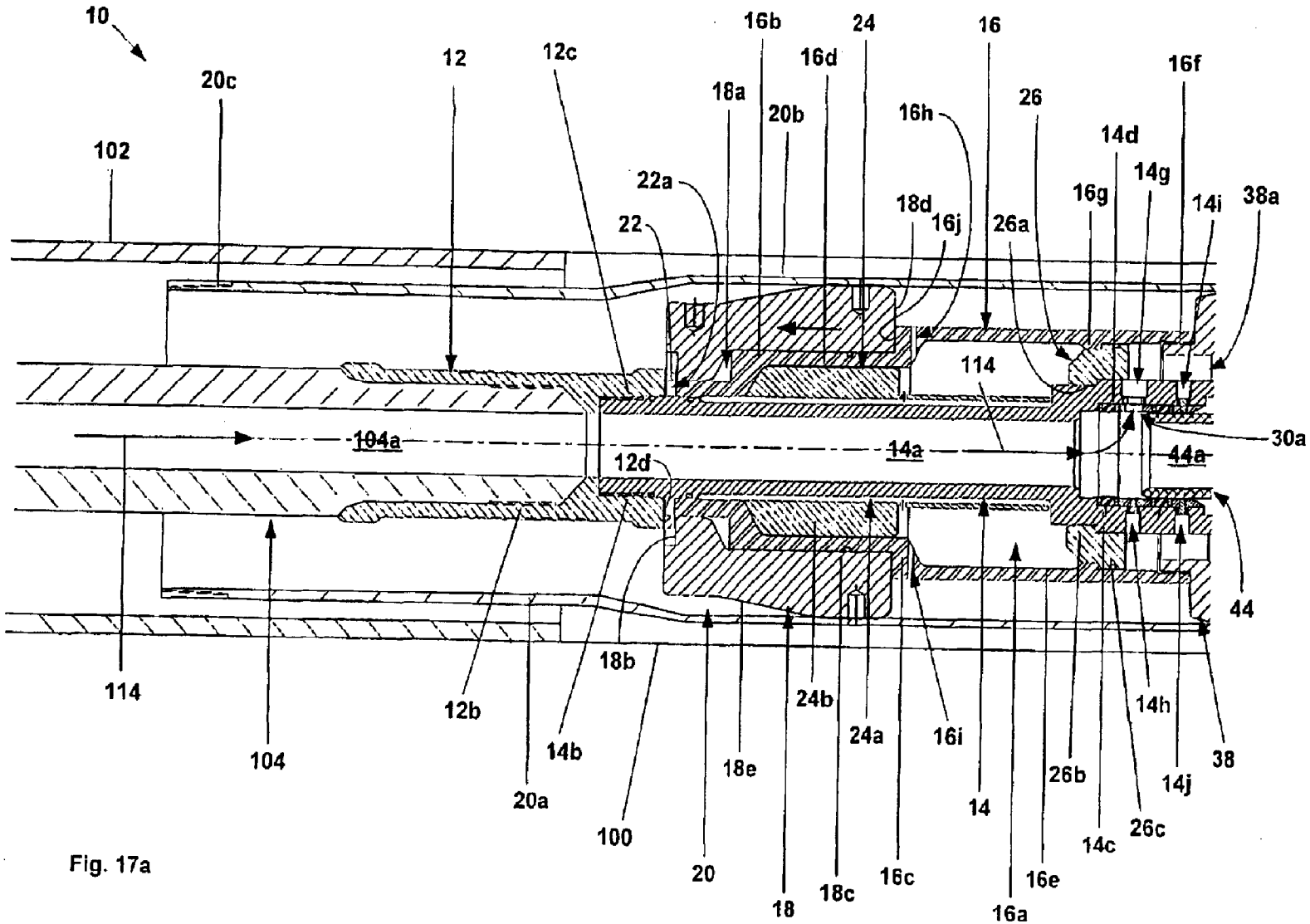
FIGS. 17*a*–17*c* are cross sectional illustrations of the injection of a pressurized fluidic material into the liner hanger assembly of FIGS. 16*a*–16*c* in order to complete the radial expansion of the expansion cone launcher.
Figure 17B:
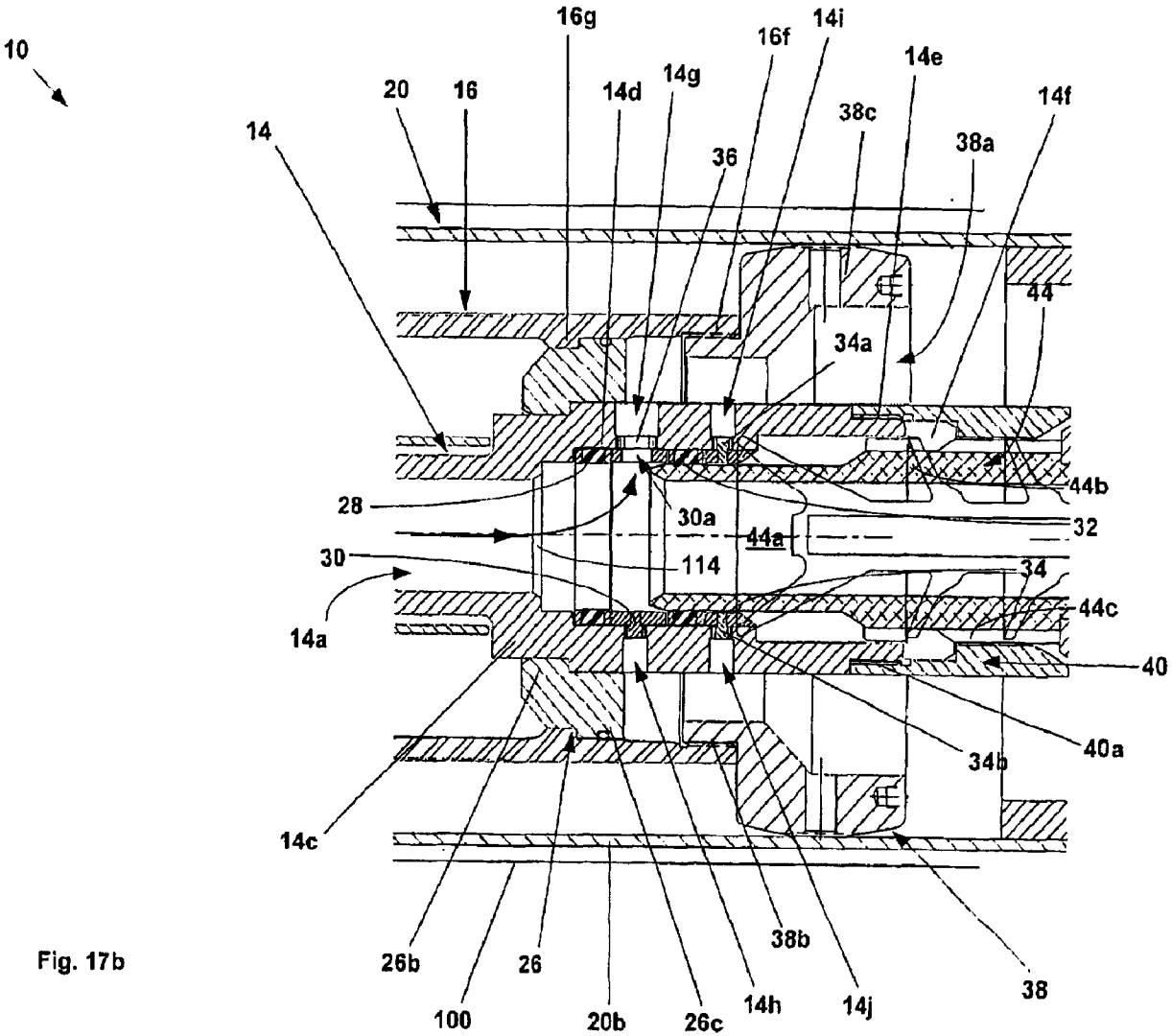
Figure 17C:
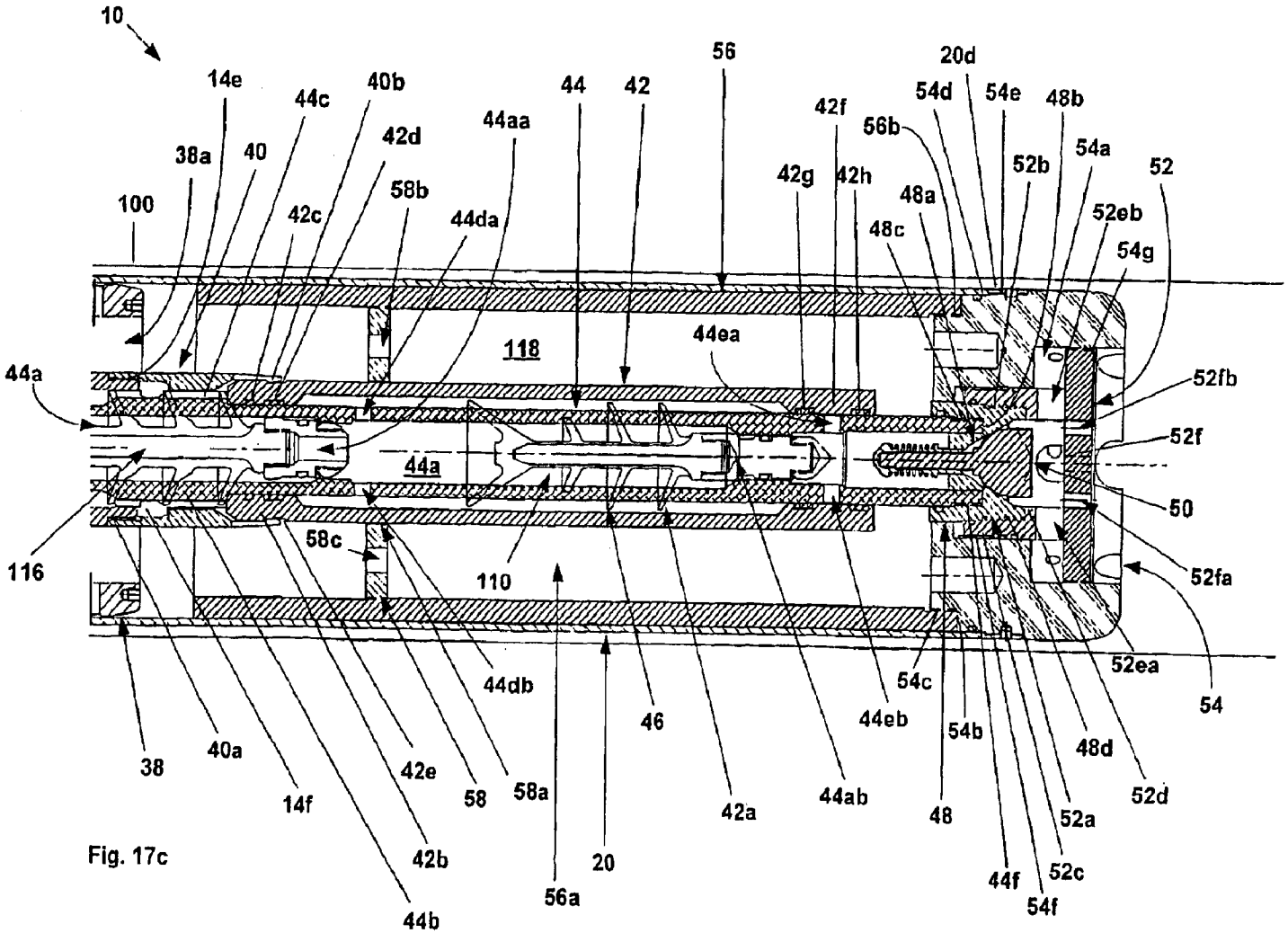
Figure 18:
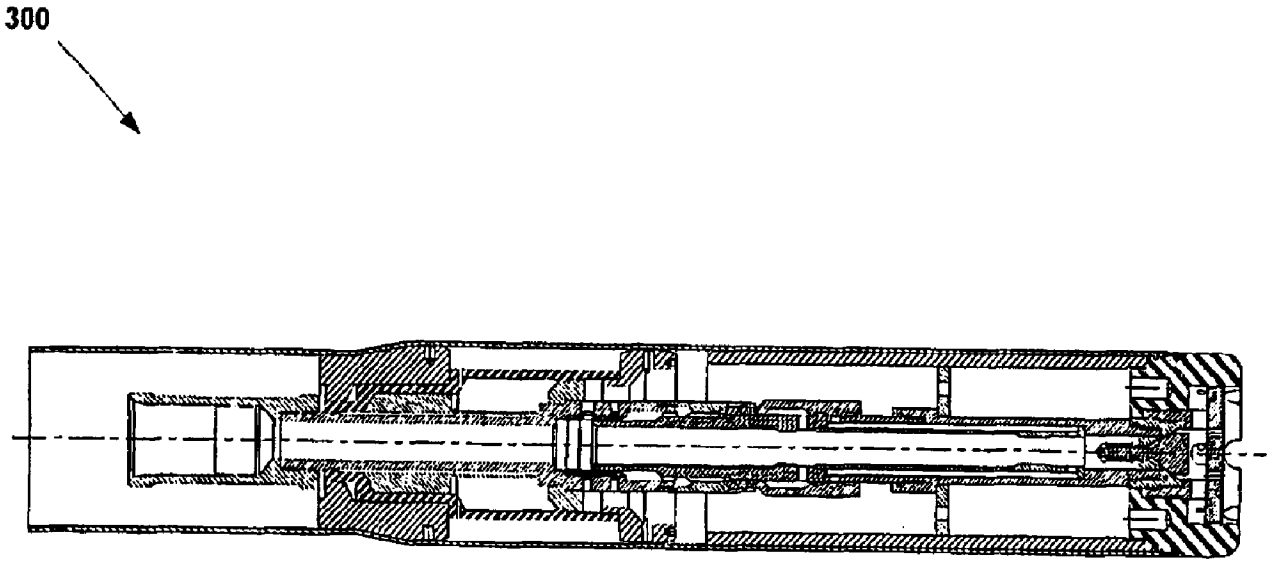
FIGS. 18, 18*a*, 18*b*, and 18*c* are cross sectional illustrations of an alternative embodiment of a liner hanger assembly including a sliding sleeve valve assembly.
Figure 18A:
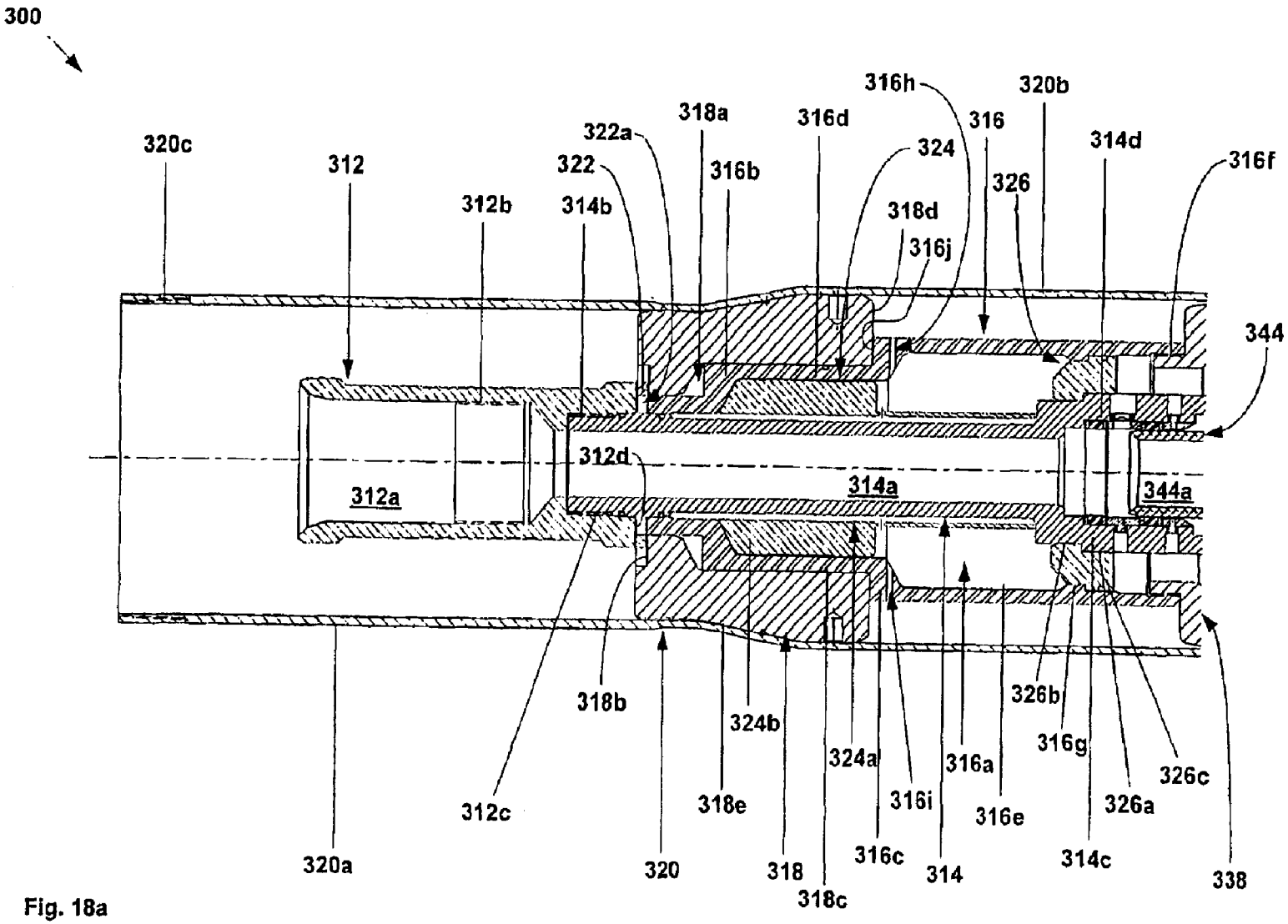
Figure 18B:
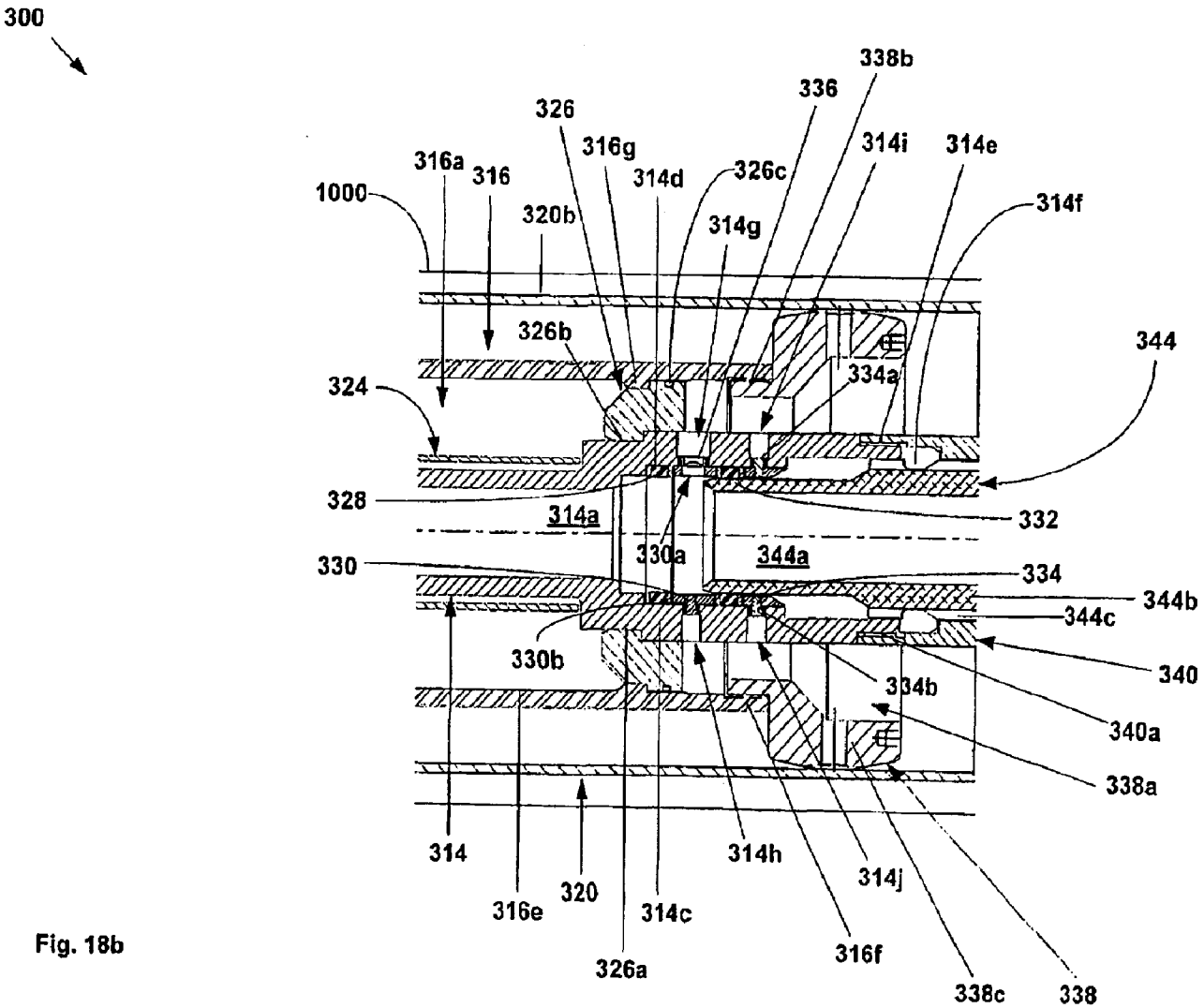
Figure 18C:
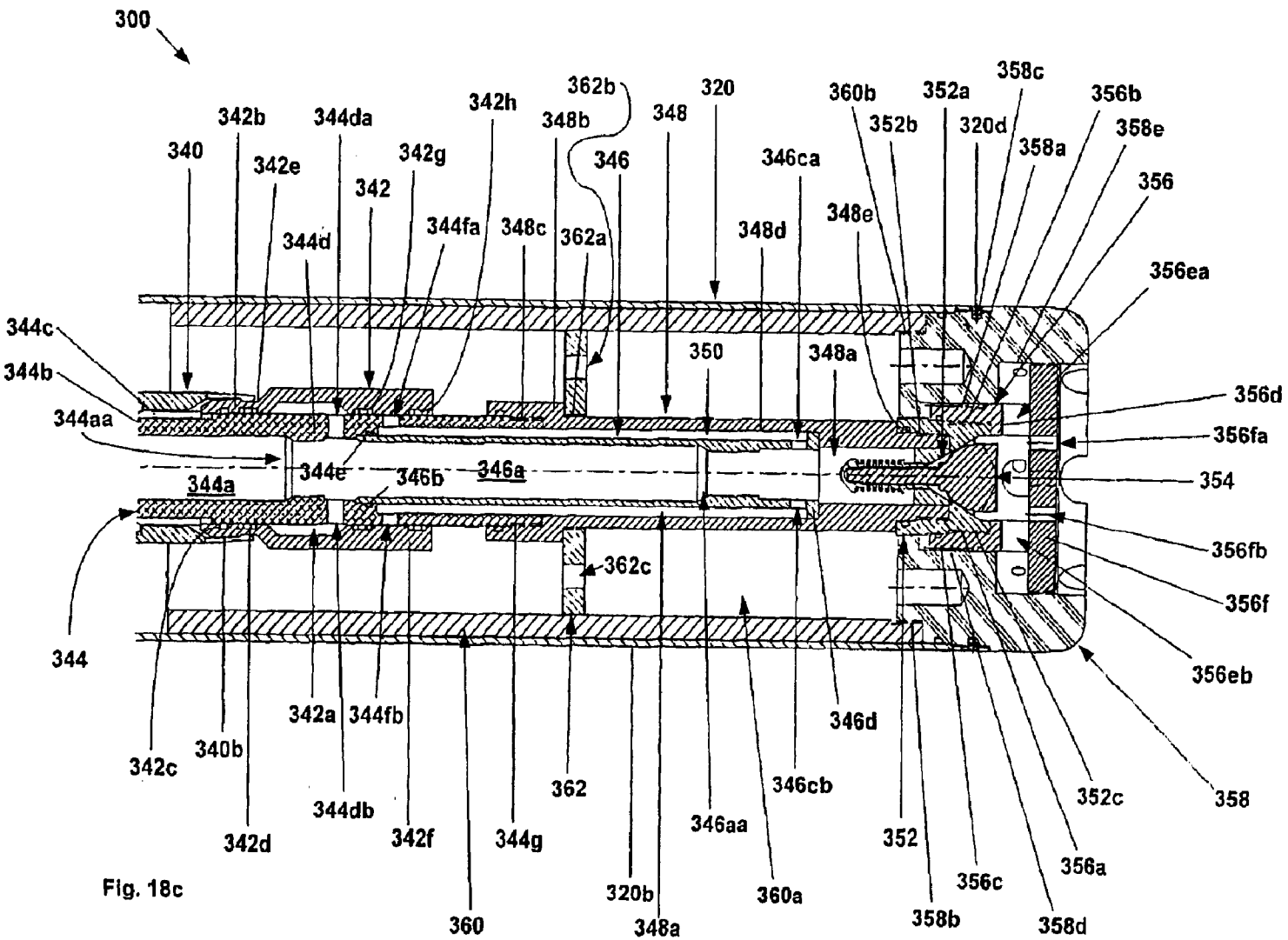

Referring to FIGS. 17*a*–17*c*, in step 268, the fluidic material 114 may be injected into the assembly 10. The continued injection of the fluidic material 114 may increase the operating pressure within the passages 14*a*, 30*a*, and 44*a* and the annular region 118. The pressurized fluidic material 114 within the annular region 118 directly applies a longitudinal force upon the fifth tubular support member 26 and the sixth tubular support member 38. The longitudinal force in turn is applied to the expansion cone 18. In this manner, the expansion cone 18 is displaced relative to the expansion cone launcher 20 thereby completing the radial expansion of the expansion cone launcher.

In an alternative embodiment of the method 250, the injection and placement of the top plug 116 into the liner hanger assembly 10 in step 264 may omitted.

In an alternative embodiment of the method 250, in step 252, the assembly 10 is positioned at the bottom of the wellbore 100.

In an alternative embodiment of the method 250: (1) in step 252, the assembly 10 is positioned proximate a position below a preexisting section of the wellbore casing 102, and (2) in step 258, the expansion cone launcher 20, and any expandable tubulars coupled to the threaded portion 20*c* of the expansion cone launcher, are radially expanded and plastically deformed until the shoe 54 of the assembly 10 is proximate the bottom of the wellbore 100. In this manner, the radial expansion process using the assembly 10 provides a telescoping of the radially expanded tubulars into the wellbore 100.

In several alternative embodiments, the assembly 10 may be operated to form a wellbore casing by including or excluding the float valve 50.

In several alternative embodiments, the float valve 50 may be operated in an auto-fill configuration in which tabs are positioned between the float valve 50 and the valve seat 48. In this manner, fluidic materials within the wellbore 100 may flow into the assembly 10 from below thereby decreasing surge pressures during placement of the assembly 10 within the wellbore 100. Furthermore, pumping fluidic materials through the assembly 10 at rate of about 6 to 8 bbl/min will displace the tabs from the valve seat 48 and thereby allow the float valve 50 to close.

In several alternative embodiments, prior to the placement of any of the plugs, 110 and 116, into the assembly 10, fluidic materials can be circulated through the assembly 10 and into the wellbore 100.

In several alternative embodiments, once the bottom plug 110 has been positioned into the assembly 10, fluidic materials can only be circulated through the assembly 10 and into the wellbore 100 if the sliding sleeve 42 is in the down position.

In several alternative embodiments, once the sliding sleeve 42 is positioned in the down position, the passage 30*a* and rupture disc 36 are fluidicly isolated from pressurized fluids within the assembly 10.

In several alternative embodiments, once the top plug 116 has been positioned into the assembly 10, no fluidic materials can be circulated through the assembly 10 and into the wellbore 100.

In several alternative embodiments, the assembly 10 may be operated to form or repair a wellbore casing, a pipeline, or a structural support.

Referring to FIGS. 18, 18*a*, 18*b*, and 18*c*, an alternative embodiment of a liner hanger assembly 300 includes a first tubular support member 312 defining an internal passage 312*a* that includes a threaded counterbore 312*b* at one end, and a threaded counterbore 312*c* at another end. A second tubular support member 314 defining an internal passage 314*a* includes a first threaded portion 314*b* at a first end that is coupled to the threaded counterbore 312*c* of the first tubular support member 312, a stepped flange 314*c*, a counterbore 314*d*, a threaded portion 314*e*, and internal splines 314*f* at another end. The stepped flange 314*c* of the second tubular support member 314 further defines radial passages 314*g*, 314*h*, 314*i*, and 314*j*.

A third tubular support member 316 defining an internal passage 316*a* for receiving the second tubular support member 314 includes a first flange 316*b*, a second flange 316*c*, a first counterbore 316*d*, a second counterbore 316*e* having an internally threaded portion 316*f*, and an internal flange 316*g*. The second flange 316*c* further includes radial passages 316*h* and 316*i*.

An annular expansion cone 318 defining an internal passage 318*a* for receiving the second and third tubular support members, 314 and 316, includes a counterbore 318*b* at one end, and a counterbore 318*c* at another end for receiving the flange 316*b* of the second tubular support member 316. The annular expansion cone 318 further includes an end face 318*d* that mates with an end face 316*j* of the flange 316*c* of the second tubular support member 316, and an exterior surface 318*e* having a conical shape in order to facilitate the radial expansion of tubular members. A tubular expansion cone launcher 320 is movably coupled to the exterior surface 318*e* of the expansion cone 318 and includes a first portion 320*a* having a first wall thickness, a second portion 320*b* having a second wall thickness, a threaded portion 320*c* at one end, and a threaded portion 320*d* at another end. In a preferred embodiment, the second portion 320*b* of the expansion cone launcher 320 mates with the conical outer surface 318*e* of the expansion cone 318. In a preferred embodiment, the second wall thickness of the second portion 320*b* is less than the first wall thickness of the first portion 320*a* in order to optimize the radial expansion of the expansion cone launcher 320 by the relative axial displacement of the expansion cone 318. In a preferred embodiment, one or more expandable tubulars are coupled to the threaded connection 320*c* of the expansion cone launcher 320. In this manner, the assembly 300 may be used to radially expand and plastically deform, for example, thousands of feet of expandable tubulars.

An annular spacer 322 defining an internal passage 322*a* for receiving the second tubular support member 314 is received within the counterbore 318*b* of the expansion cone 318, and is positioned between an end face 312*d* of the first tubular support member 312 and an end face of the counterbore 318*b* of the expansion cone 318. A fourth tubular support member 324 defining an internal passage 324*a* for receiving the second tubular support member 314 includes a flange 324*b* that is received within the counterbore 316*d* of the third tubular support member 316. A fifth tubular support member 326 defining an internal passage 326*a* for receiving the second tubular support member 314 includes an internal flange 326*b* for mating with the flange 314*c* of the second tubular support member and a flange 326*c* for mating with the internal flange 316*g* of the third tubular support member 316.

An annular sealing member 328, an annular sealing and support member 330, an annular sealing member 332, and an annular sealing and support member 334 are received within the counterbore 314*d* of the second tubular support member 314. The annular sealing and support member 330 further includes a radial opening 330*a* for supporting a rupture disc 336 within the radial opening 314*g* of the second tubular support member 314 and a sealing member 330*b* for sealing the radial opening 314*h* of the second tubular support member. The annular sealing and support member 334 further includes sealing members 334*a* and 334*b* for sealing the radial openings 314*i* and 314*j*, respectively, of the second tubular support member 314. In an exemplary embodiment, the rupture disc 336 opens when the operating pressure within the radial opening 330*b* is about 1000 to 5000 psi. In this manner, the rupture disc 336 provides a pressure sensitive valve for controlling the flow of fluidic materials through the radial opening 330*a*. In several alternative embodiments, the assembly 300 includes a plurality of radial passages 330*a*, each with corresponding rupture discs 336.

A sixth tubular support member 338 defining an internal passage 338*a* for receiving the second tubular support member 314 includes a threaded portion 338*b* at one end that is coupled to the threaded portion 316*f* of the third tubular support member 316 and a flange 338*c* at another end that is movably coupled to the interior of the expansion cone launcher 320. An annular collet 340 includes a threaded portion 340*a* that is coupled to the threaded portion 314*e* of the second tubular support member 314, and a resilient coupling 340*b* at another end.

An annular sliding sleeve 342 defining an internal passage 342*a* includes an internal flange 342*b*, having sealing members 342*c* and 342*d*, and an external groove 342*e* for releasably engaging the coupling 340*b* of the collet 340 at one end, and an internal flange 342*f*, having sealing members 342*g* and 342*h*, at another end. During operation, the coupling 340*b* of the collet 340 may engage the external groove 342*e* of the sliding sleeve 342 and thereby displace the sliding sleeve in the longitudinal direction. Since the coupling 340*b* of the collet 340 is resilient, the collet 340 may be disengaged or reengaged with the sliding sleeve 342. An annular valve member 344 defining an internal passage 344*a*, having a throat 344*aa*, includes a flange 344*b* at one end, having external splines 344*c* for engaging the internal splines 314*f* of the second tubular support member 314, an interior flange 344*d* having a first set of radial passages, 344*da* and 344*db*, and a counterbore 344*e*, a second set of radial passages, 344*fa* and 344*fb*, and a threaded portion 344*g* at another end.

An annular valve member 346 defining an internal passage 346*a*, having a throat 346*aa*, includes an end portion 346*b* that is received in the counterbore 344*e* of the annular valve member 344, a set of radial openings, 346*ca* and 346*cb*, and a flange 346*d* at another end. An annular valve member 348 defining an internal passage 348*a* for receiving the annular valve members 344 and 346 includes a flange 348*b* having a threaded counterbore 348*c* at one end for engaging the threaded portion 344*g* of the annular valve member, a counterbore 348*d* for mating with the flange 346*d* of the annular valve member, and a threaded annular recess 348*e* at another end.

The annular valve members 344, 346, and 348 define an annular passage 350 that fluidicly couples the radial passages 344*fa*, 344*fb*, 346*ca*, and 346*cb*. Furthermore, depending upon the position of the sliding sleeve 342, the fluid passages, 344*da* and 344*db*, may be fluidicly coupled to the passages 344*fa*, 344*fb*, 346*ca*, 346*cb*, and 350. In this manner, fluidic materials may bypass the portion of the passage 346*a* between the passages 344*da*, 344*db*, 346*ca*, and 346*cb*.

Furthermore, the sliding sleeve 342 and the valve members 344, 346, and 348 together define a sliding sleeve valve for controllably permitting fluidic materials to bypass the intermediate portion of the passage 346*a* between the passages, 344*da*, 344*db*, 346*ca*, and 346*cb*. During operation of the sliding sleeve valve, the flange 348*b* limits movement of the sliding sleeve 342 in the longitudinal direction.

In a preferred embodiment, the collet 340 includes a set of couplings 340*b* that engage the external groove 342*e* of the sliding sleeve 342. During operation, the collet couplings 340*b* latch over and onto the external groove 342*e* of the sliding sleeve 342. In a preferred embodiment, a longitudinal force of at least about 10,000 to 13,000 lbf is required to pull the couplings 340*b* off of, and out of engagement with, the external groove 342*e* of the sliding sleeve 342. In an exemplary embodiment, the application of a longitudinal force less than about 10,000 to 13,000 lbf indicates that the collet couplings 340*b* are latched onto the external shoulder of the sliding sleeve 342, and that the sliding sleeve 342 is in the up or the down position relative to the valve member 344. In a preferred embodiment, the collet 340 includes a conventional internal shoulder that transfers the weight of the first tubular support member 312 and expansion cone 318 onto the sliding sleeve 342. In a preferred embodiment, the collet 340 further includes a conventional set of internal lugs for engaging the splines 344*c* of the valve member 344.

An annular valve seat 352 defining a conical internal passage 352*a* for receiving a conventional float valve element 354 includes a threaded annular recess 352*b* for engaging the threaded portion 348*e* of the valve member 348, at one end, and an externally threaded portion 352*c* at another end. In an alternative embodiment, the float valve element 354 is omitted. An annular valve seat mounting element 356 defining an internal passage 356*a* for receiving the valve seat 352 and float valve 354 includes an internally threaded portion 356*b* for engaging the externally threaded portion 352*c* of the valve seat 352, an externally threaded portion 356*c*, an internal flange 356*d*, radial passages, 356*ea* and 356*eb*, and an end member 356*f*, having axial passages, 356*fa* and 356*fb*.

A shoe 358 defining an internal passage 358*a* for receiving the valve seat mounting element 356 includes a first threaded annular recess 358*b*, and a second threaded annular recess 358*c* for engaging the threaded portion 320*d* of the expansion cone launcher 320, at one end, a first threaded counterbore 358*d* for engaging the threaded portion 356*c* of the of the valve seat mounting element, and a second counterbore 358*e* for mating with the end member 356*f* of the mounting element. In a preferred embodiment, the shoe 358 is fabricated from a ceramic and/or a composite material in order to facilitate the subsequent removal of the shoe by drilling.

A seventh tubular support member 360 defining an internal passage 360*a* for receiving the sliding sleeve 342 and the valve members 344, 346, and 348 is positioned within the expansion cone launcher 320 that includes an internally threaded portion 360*b* at one end for engaging the externally threaded portion of the annular recess 358*b* of the shoe 358. In a preferred embodiment, during operation of the assembly, the end of the seventh tubular support member 360 limits the longitudinal movement of the expansion cone 318 in the direction of the shoe 358 by limiting the longitudinal movement of the sixth tubular support member 338. An annular centralizer 362 defining an internal passage 362 for supporting the valve member 348 is positioned within the seventh tubular support member 360 that includes axial passages 362*b* and 362*c*.

Figure 19A:
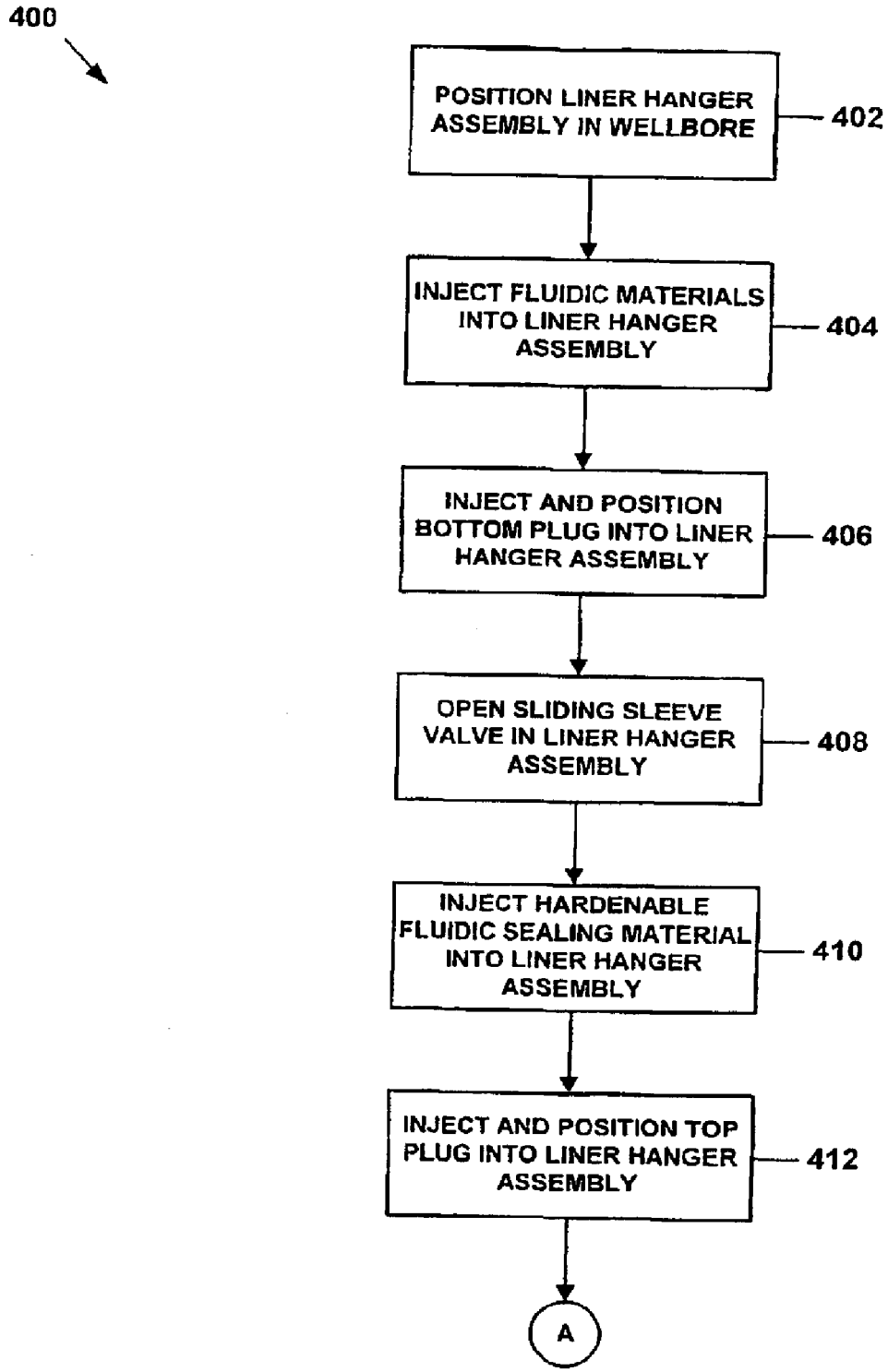
FIGS. 19*a*–19*b* is a flow chart illustration of an embodiment of a method for forming a wellbore casing using the liner hanger assembly of FIGS. 18 and 18*a*–18*c*.
Figure 19B:
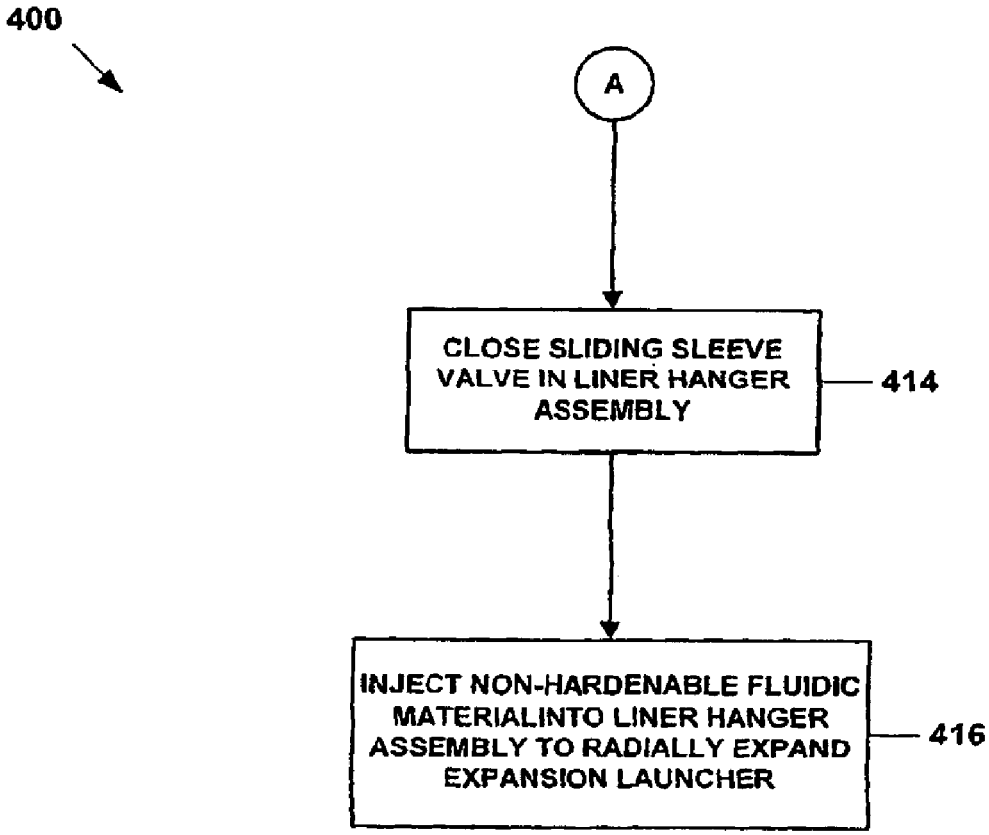
Figure 20A:
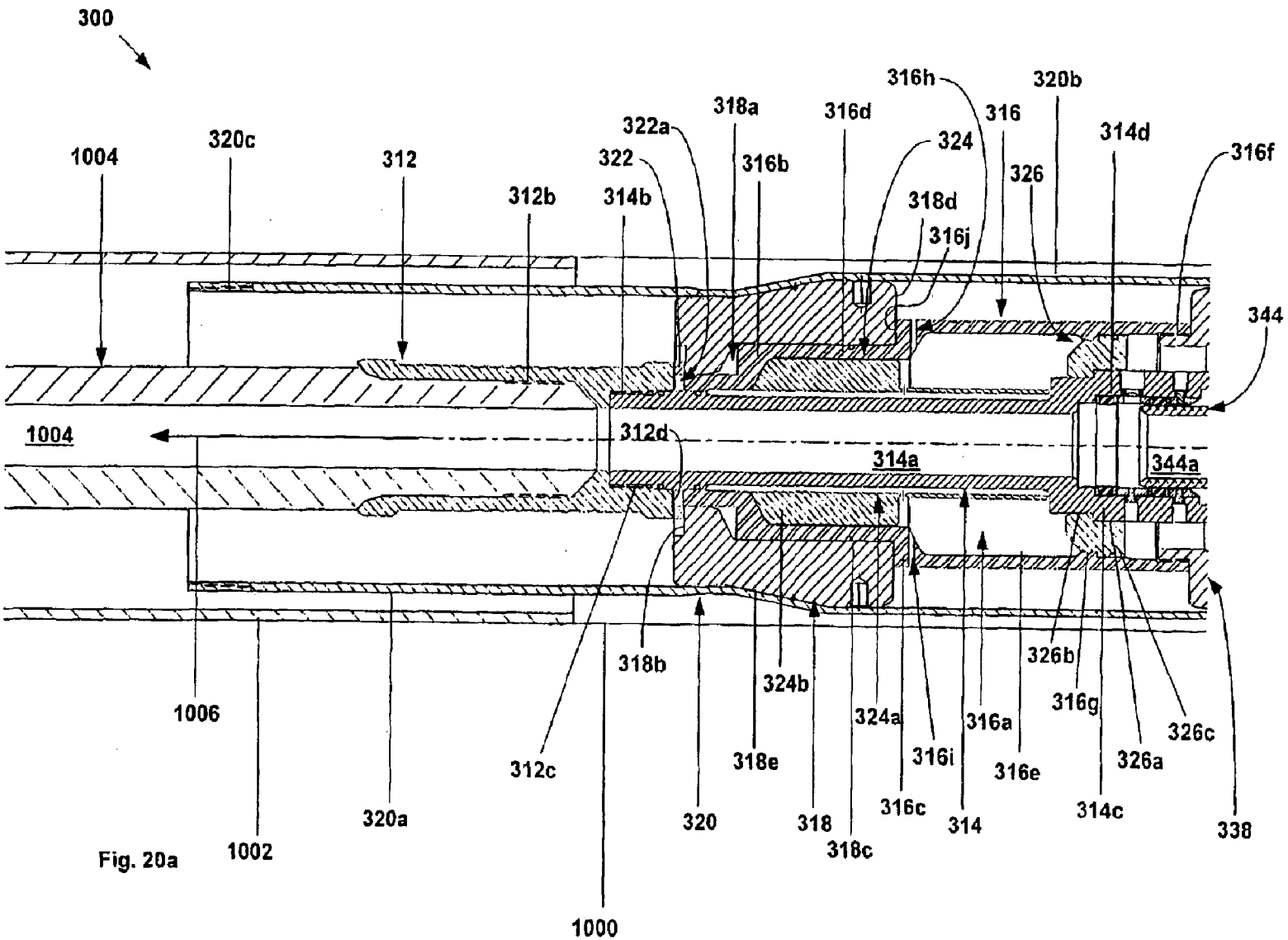
FIGS. 20*a*–20*c* are cross sectional illustrations of the placement of the liner hanger assembly of FIGS. 18 and 18*a*–18*c* into a wellbore.
Figure 20B:
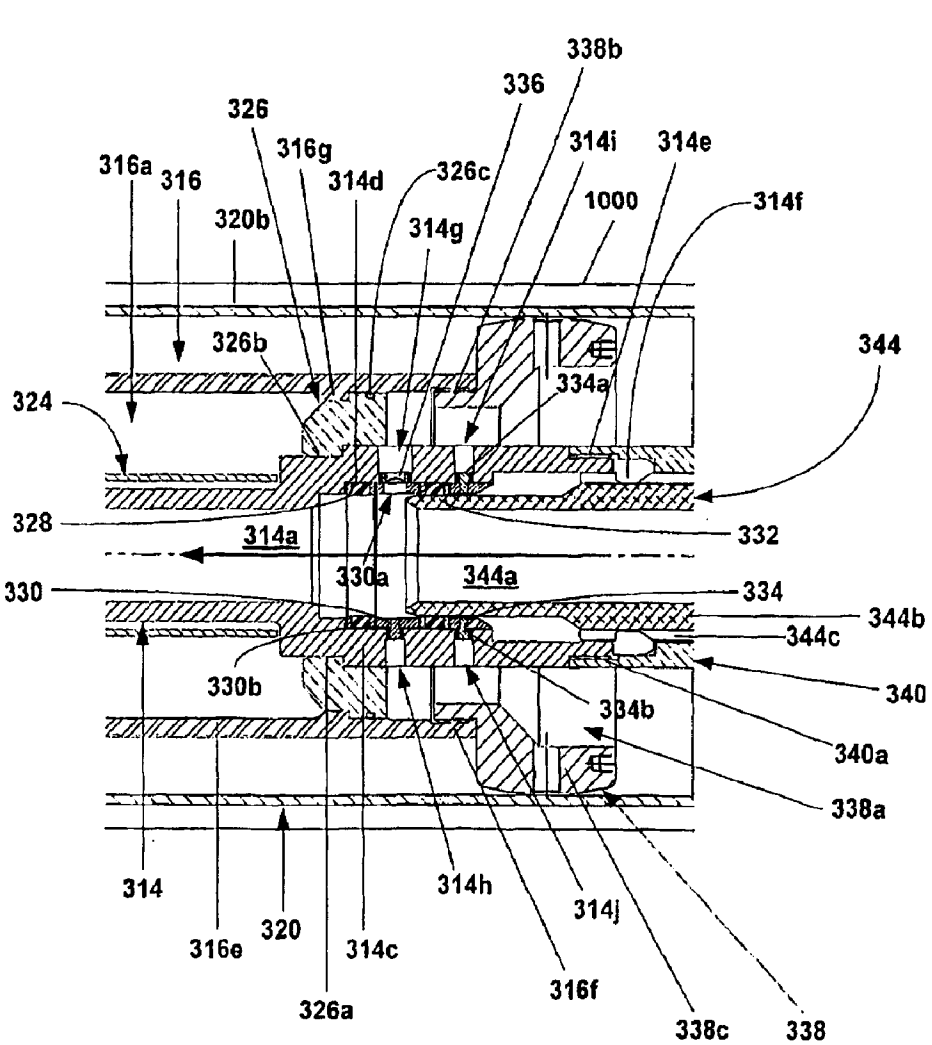
Figure 20C:
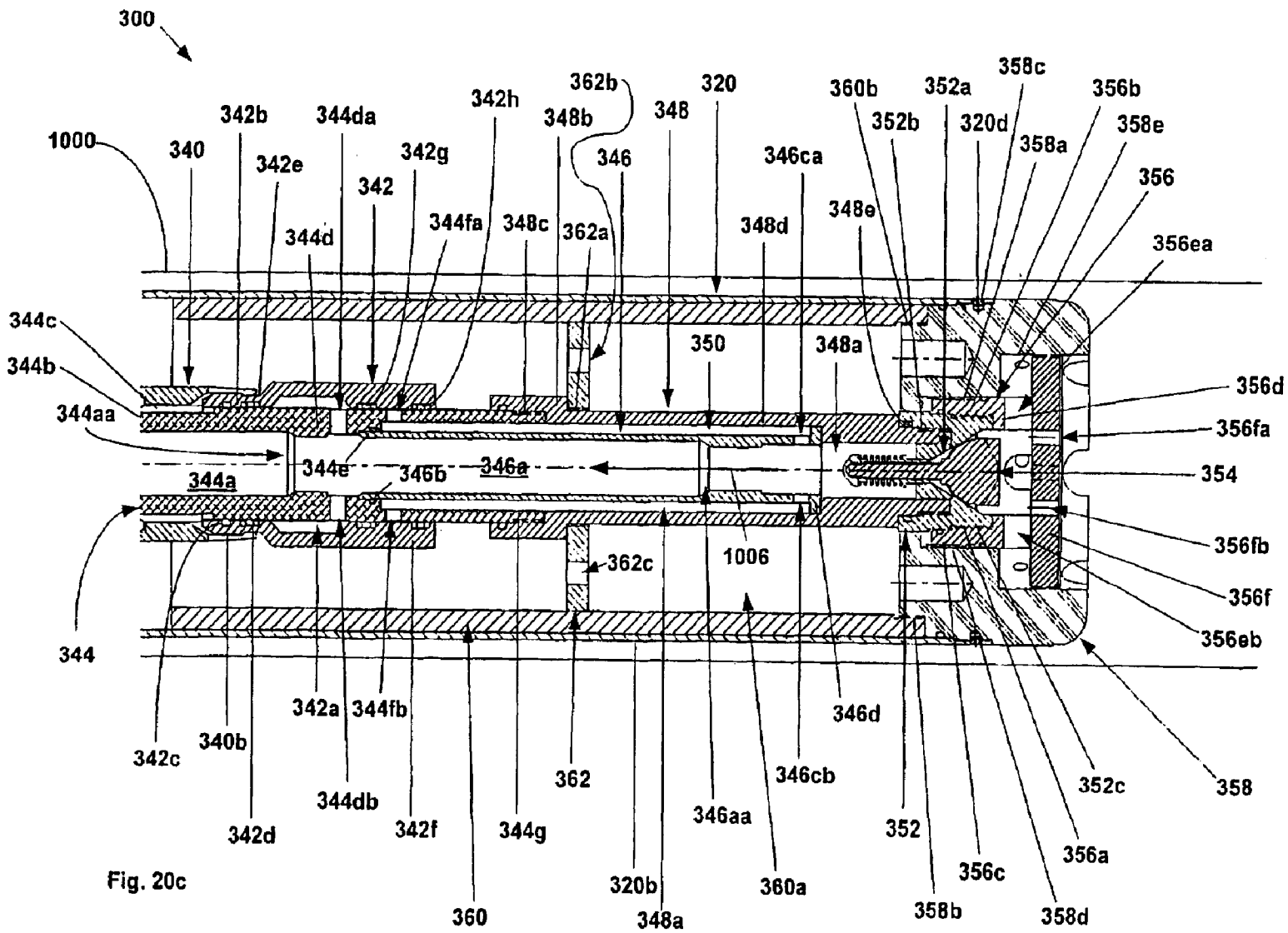

Referring to FIGS. 19*a*–19*b*, during operation, the assembly 300 may be used to form or repair a wellbore casing by implementing a method 400 in which, as illustrated in FIGS. 20*a*–20*c*, the assembly 300 may initially be positioned within a wellbore 1000 having a preexisting wellbore casing 1002 by coupling a conventional tubular member 1004 defining an internal passage 1004*a* to the threaded portion 312*b* of the first tubular support member 312 in step 402. In a preferred embodiment, during placement of the assembly 300 within the wellbore 1000, fluidic materials 1006 within the wellbore 1000 below the assembly 300 are conveyed through the assembly 300 and into the passage 1004*a* by the fluid passages 356*fa*, 356*fb*, 352*a*, 348*a*, 346*a*, 344*a*, and 314*a*. In this manner, surge pressures that can be created during placement of the assembly 300 within the wellbore 1000 are minimized. In a preferred embodiment, the float valve element 354 is pre-set in an auto-fill configuration to permit the fluidic materials 1006 to pass through the conical passage 352*a* of the valve seat 352.

Figure 21A:
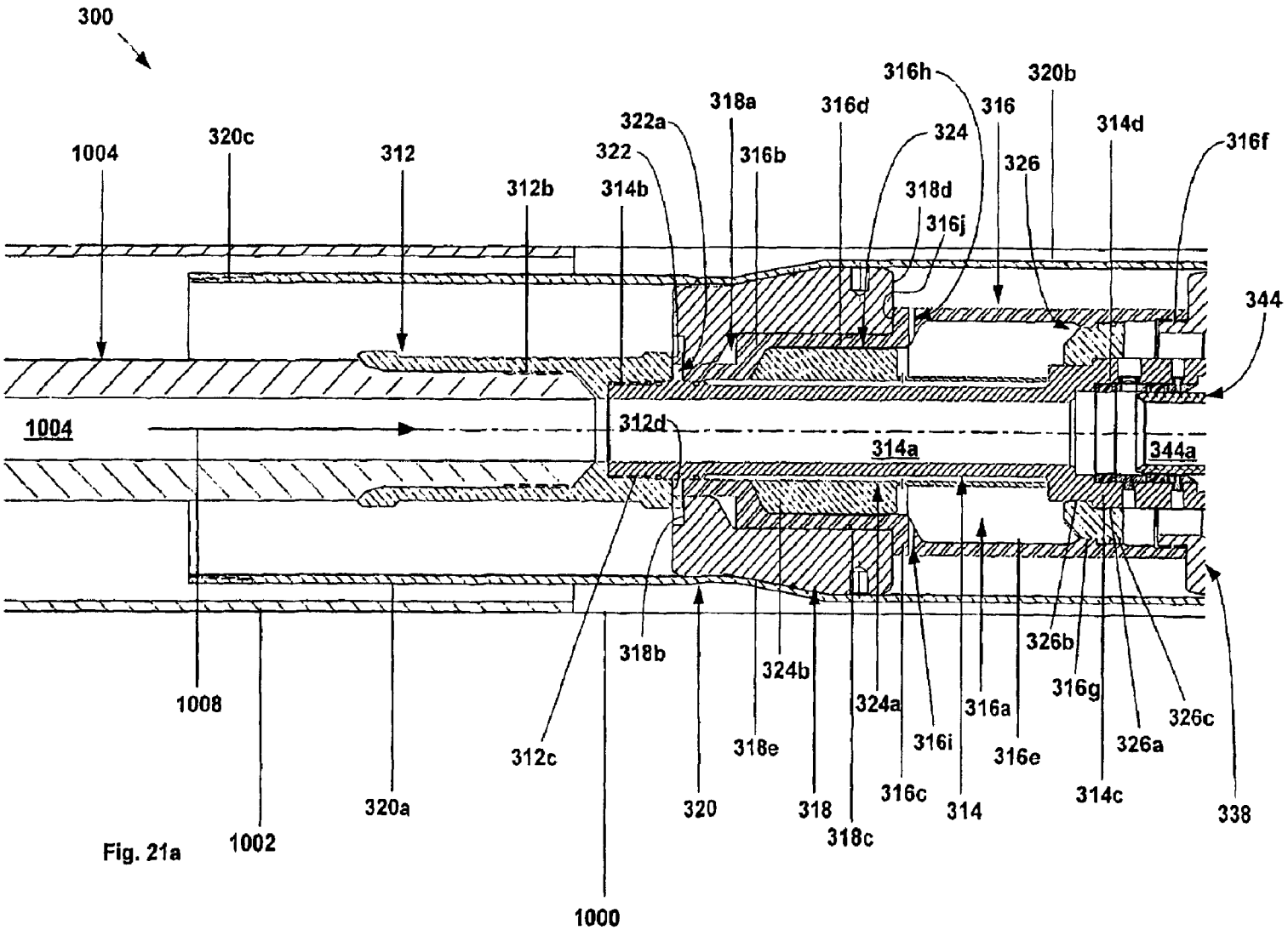
FIGS. 21*a*–21*c* are cross sectional illustrations of the injection of a fluidic materials into the liner hanger assembly of FIGS. 20*a*–20*c*.
Figure 21B:
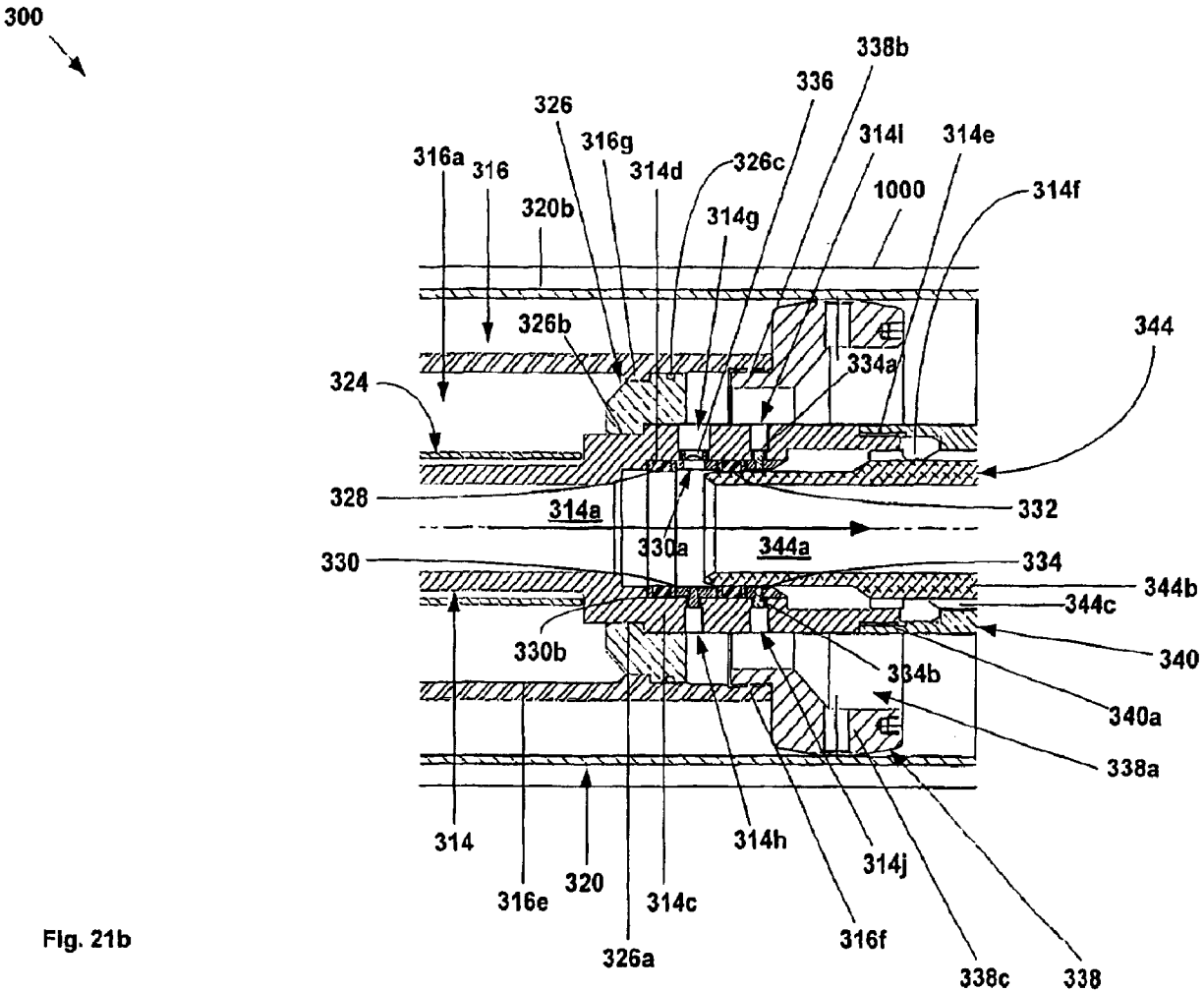
Figure 21C:
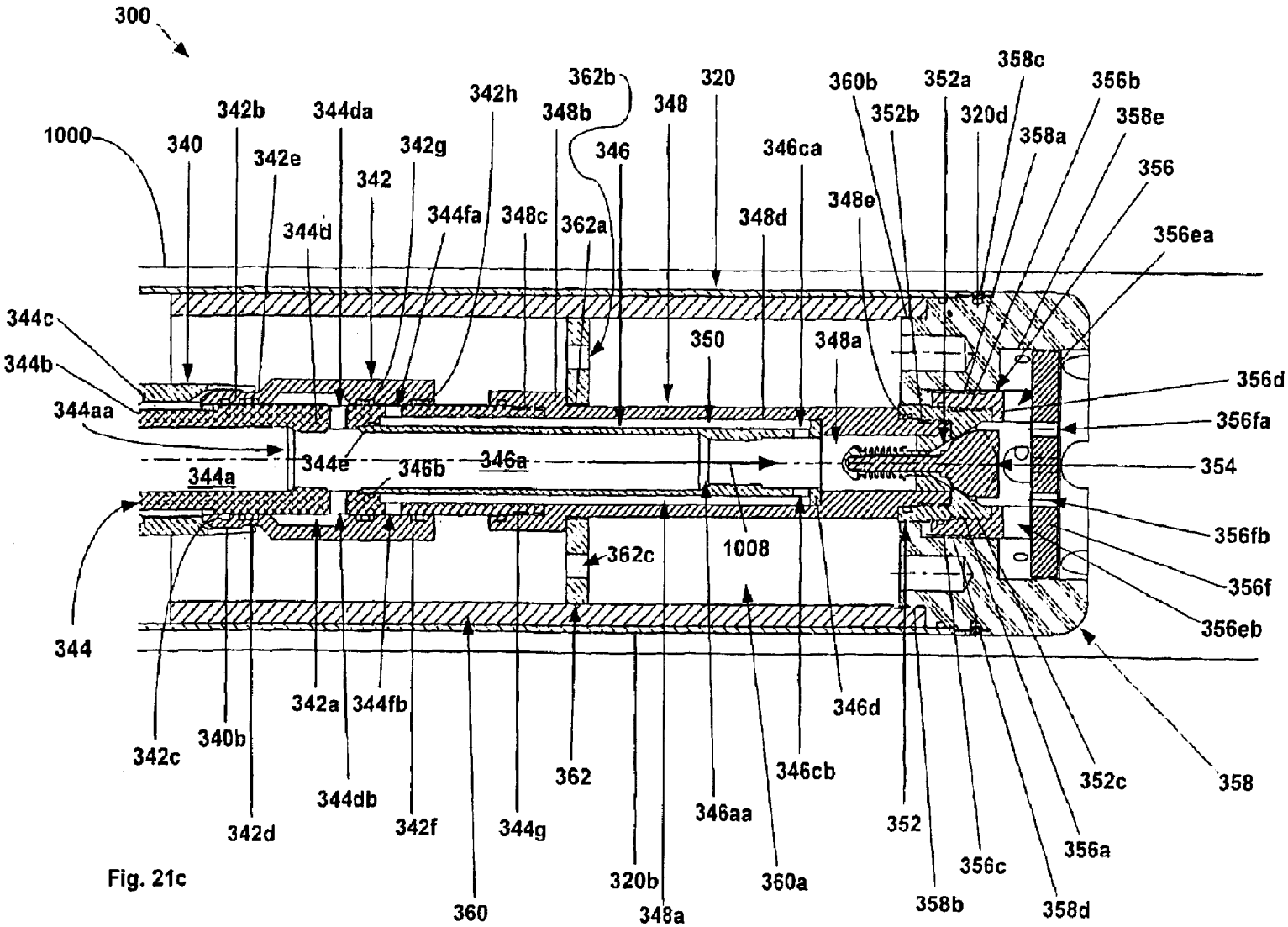

Referring to FIGS. 21*a*–21*c*, in step 404, fluidic materials 1008 may then be injected into and through the tubular member 1004 and assembly 300 to thereby ensure that all of the fluid passages 1004*a*, 314*a*, 344*a*, 346*a*, 348*a*, 352*a*, 356*fa*, and 356*fb* are functioning properly.

Figure 22A:
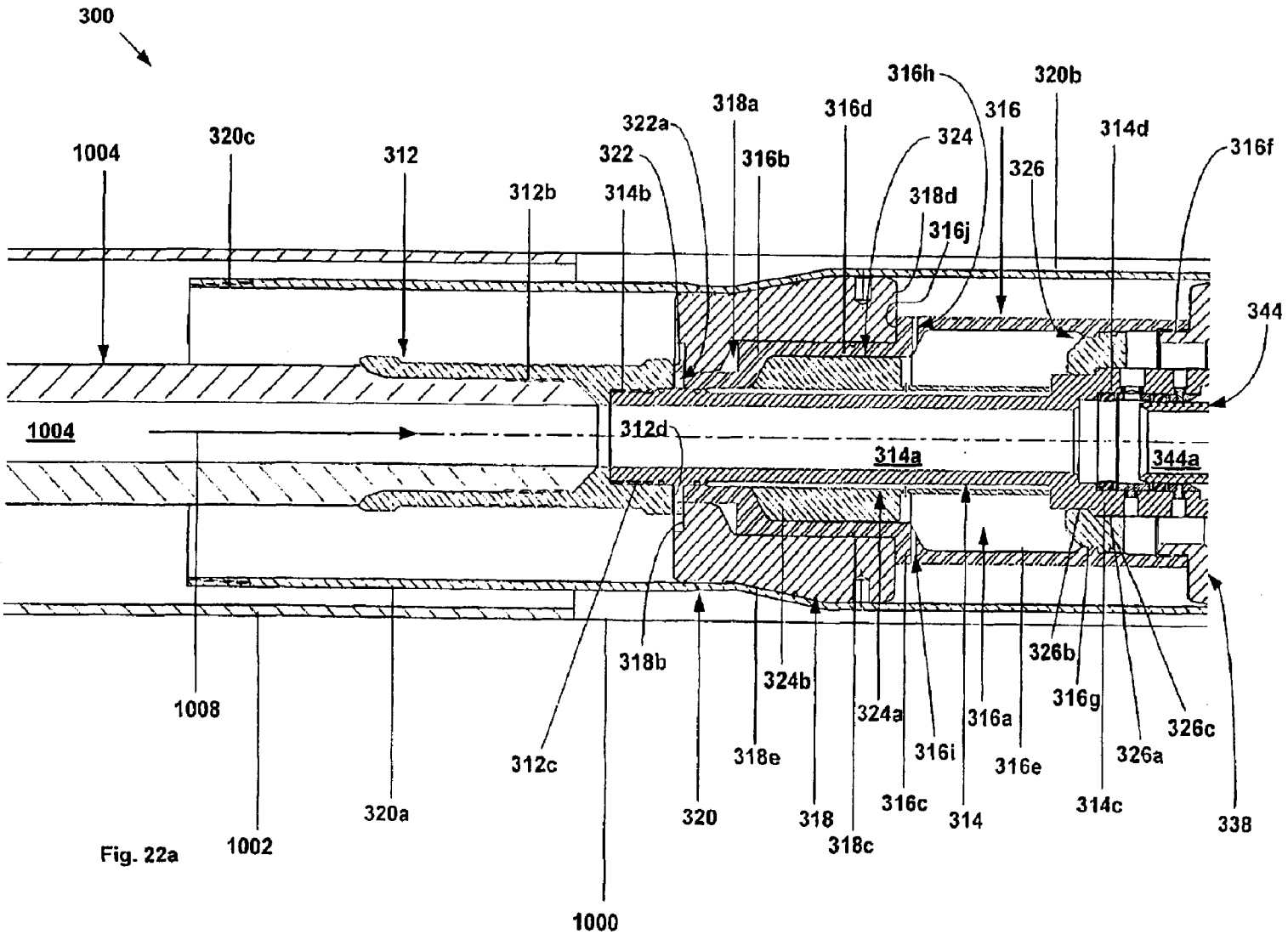
FIGS. 22*a*–22*c* are cross sectional illustrations of the placement of a bottom plug into the liner hanger assembly of FIGS. 21*a*–21*c*.
Figure 22B:
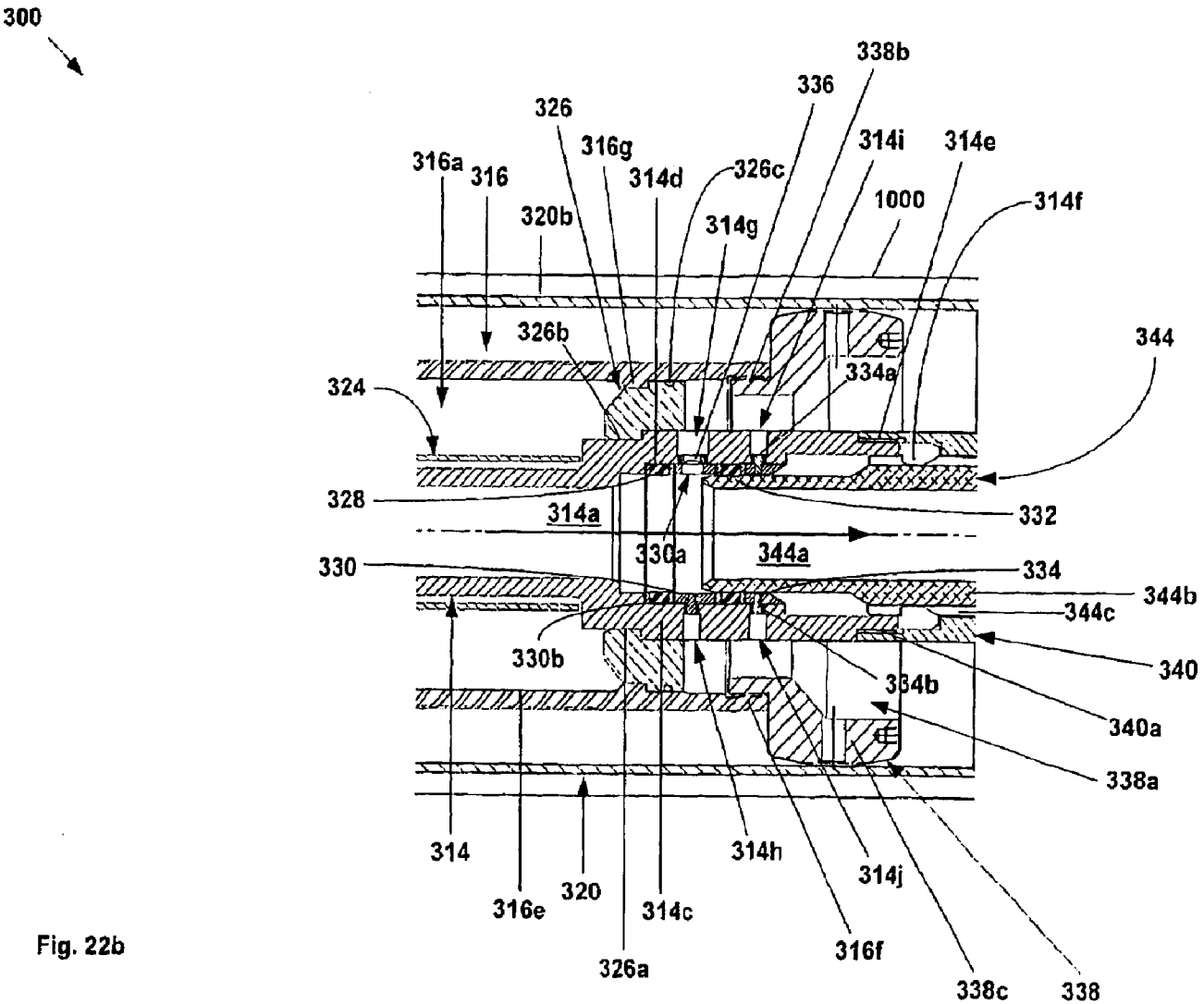
Figure 22C:
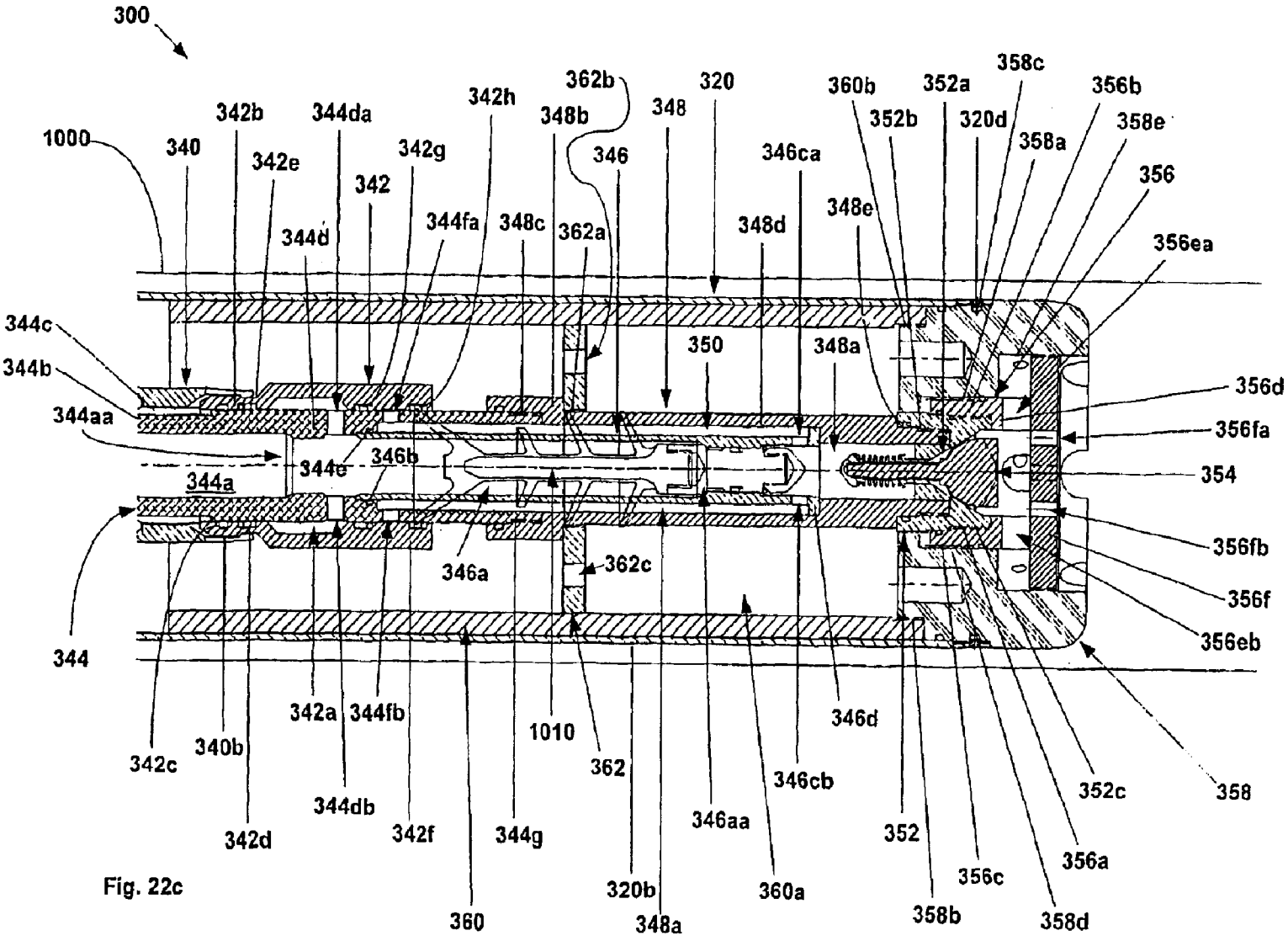

Referring to FIGS. 22*a*–22*c*, in step 406, a bottom plug 1010 may then be injected into the fluidic materials 1008 and into the assembly 300 and then positioned in the throat passage 346*aa* of the valve member 346. In this manner, the region of the passage 346*a* upstream from the plug 1010 may be fluidicly isolated from the region of the passage 346*a* downstream from the plug 1010. In a preferred embodiment, the proper placement of the plug 1010 may be indicated by a corresponding increase in the operating pressure of the fluidic material 1008.

Figure 23A:
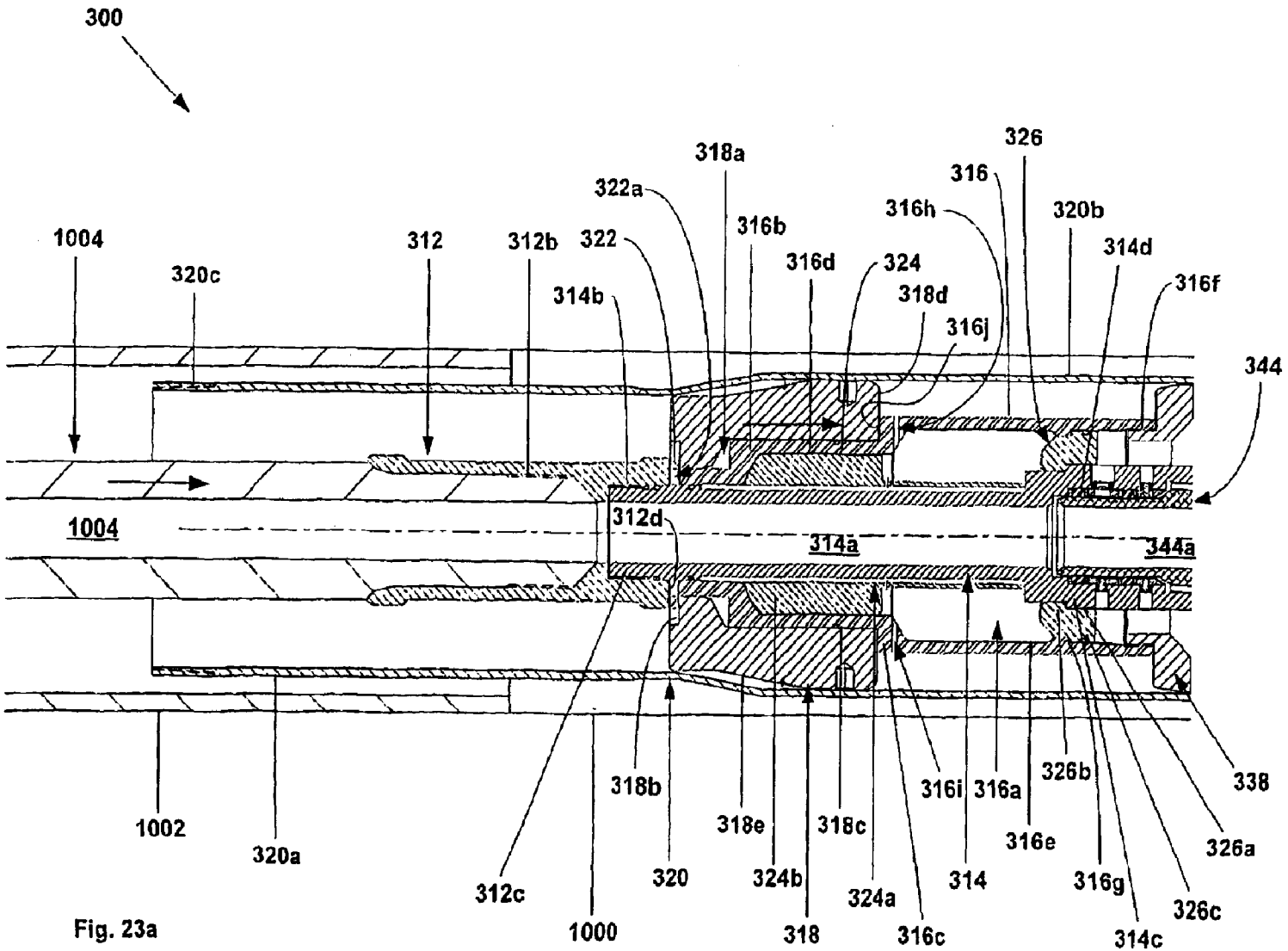
FIGS. 23*a*–23*c* are cross sectional illustrations of the downward displacement of sliding sleeve of the liner hanger assembly of FIGS. 22*a*–22*c*.
Figure 23B:
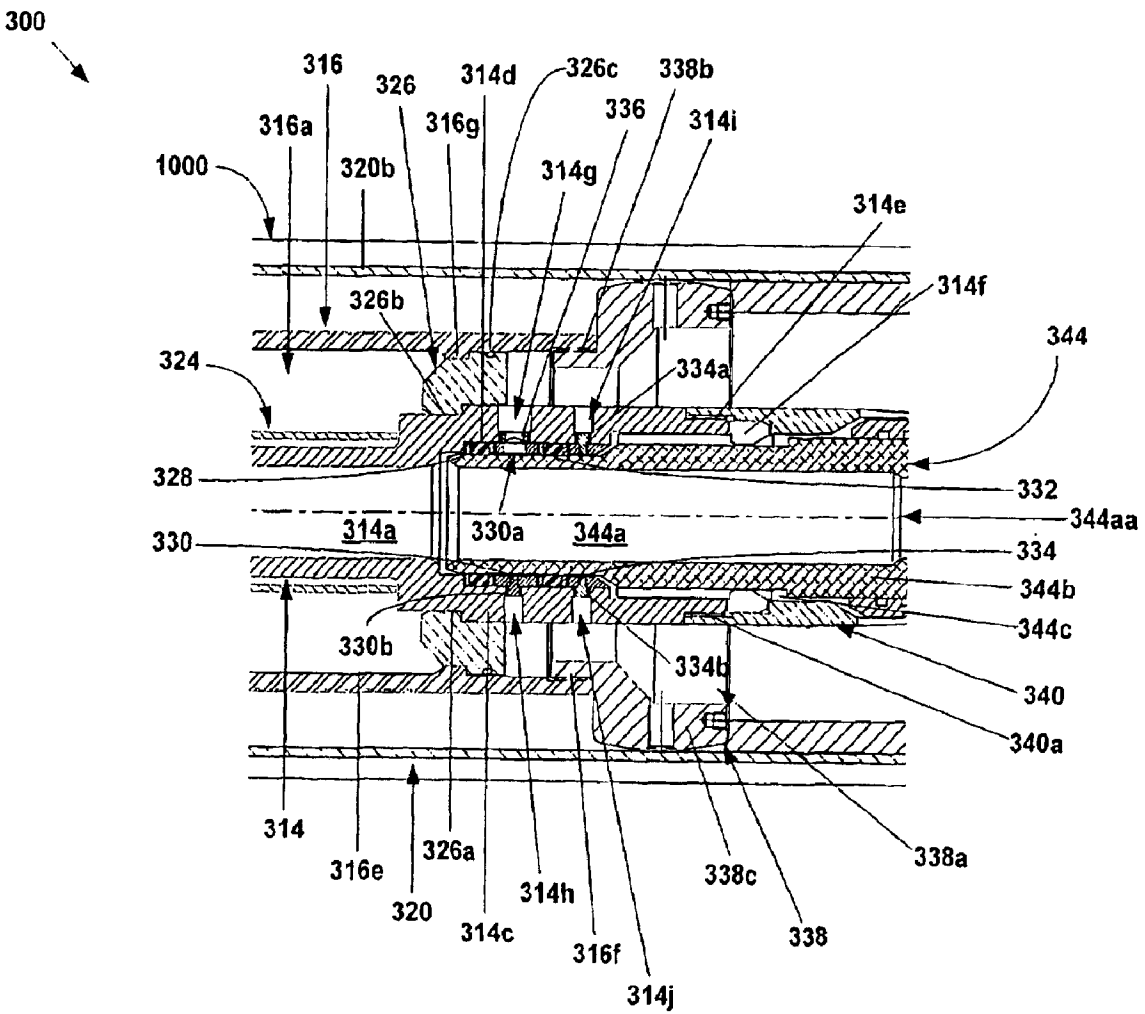
Figure 23C:
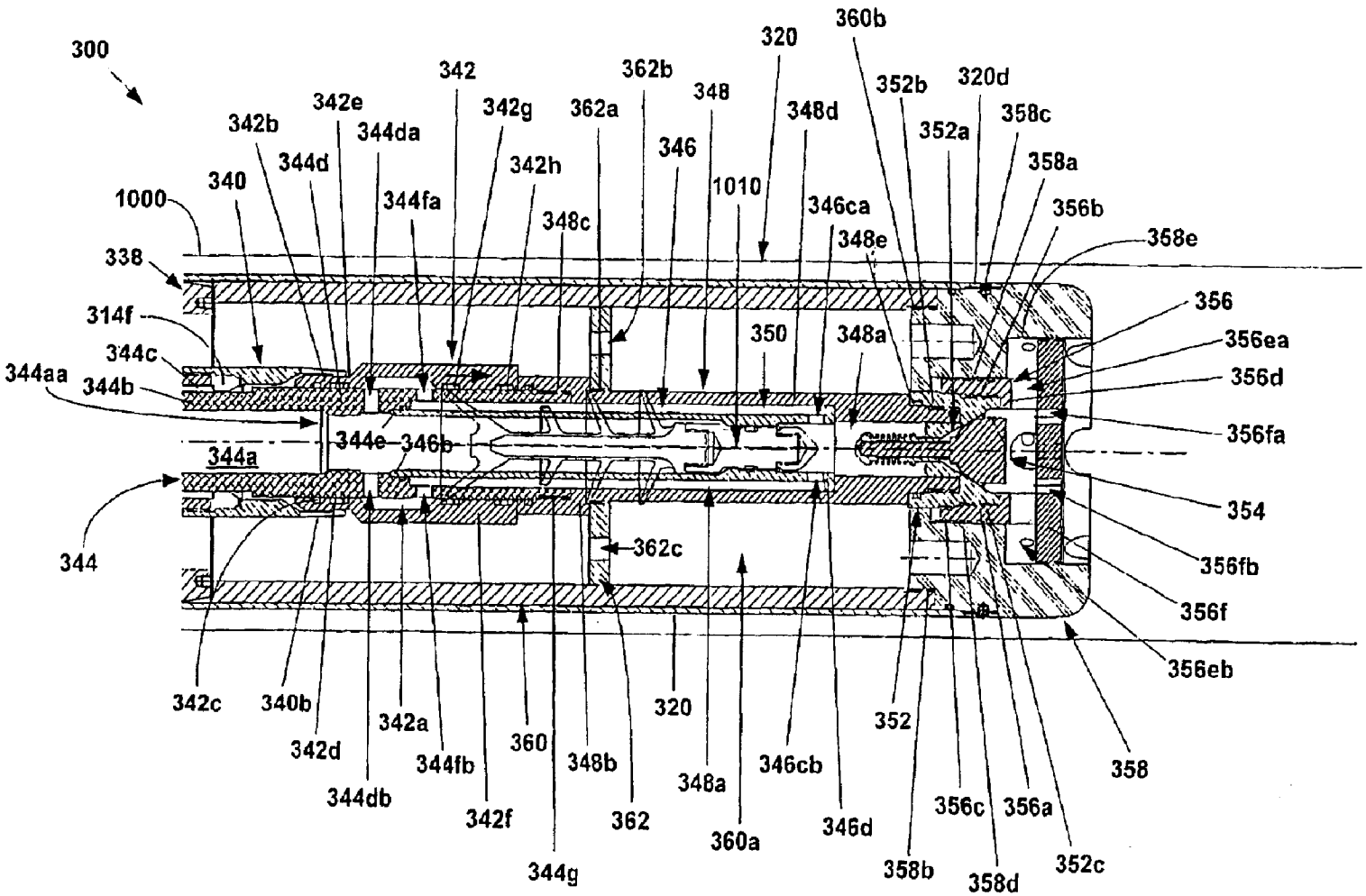

Referring to FIGS. 23*a*–23*c*, in step 408, the sliding sleeve 342 may then be displaced relative to the valve member 344 by displacing the tubular member 1004 by applying, for example, a downward force of approximately 5,000 lbf on the assembly 300. In this manner, the tubular member 1004, the first tubular support member 312, the second tubular support member 314, the third tubular support member 316, the expansion cone 318, the annular spacer 322, the fourth tubular support member 324, the fifth tubular support member 326, the sixth tubular support member 338, the collet 340, and the sliding sleeve 342 are displaced in the longitudinal direction relative to the expansion cone launcher 320 and the valve member 344. In this manner, fluidic materials within the passage 344*a* upstream of the plug 1010 may bypass the plug by passing through the first passages, 344*da* and 344*db*, through the annular passage 342*a*, through the second passages, 344*fa* and 344*fb*, through the annular passage 350, through the passages, 346*ca* and 346*cb*, into the region of the passage 348*a* downstream from the plug. Furthermore, in this manner, the rupture disc 336 is fluidicly isolated from the passages 314*a* and 344*a*.

Figure 24A:
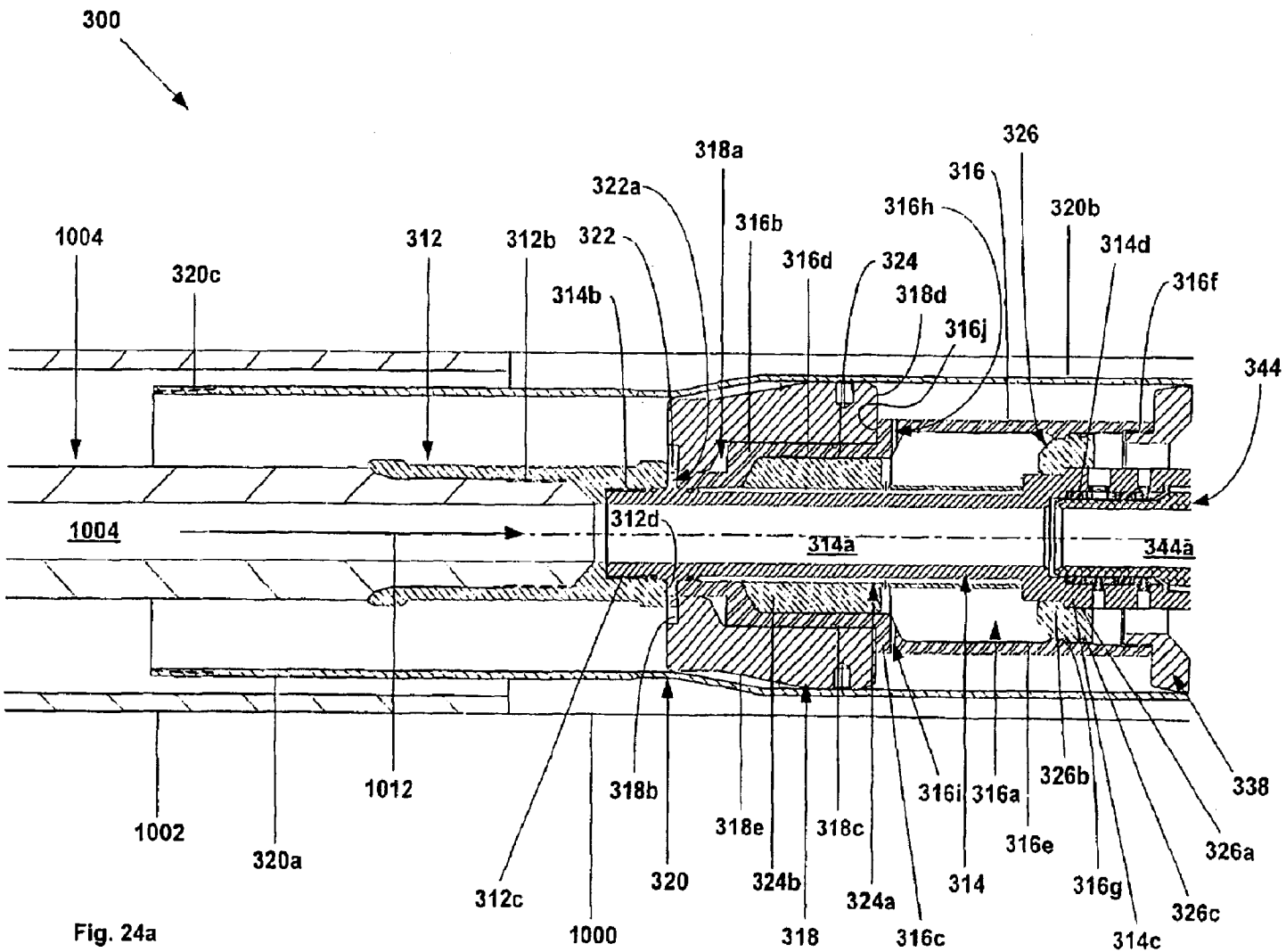
FIGS. 24*a*–24*c* are cross sectional illustrations of the injection of a hardenable fluidic sealing material into the liner hanger assembly of FIGS. 23*a*–23*c* that bypasses the bottom plug.
Figure 24B:
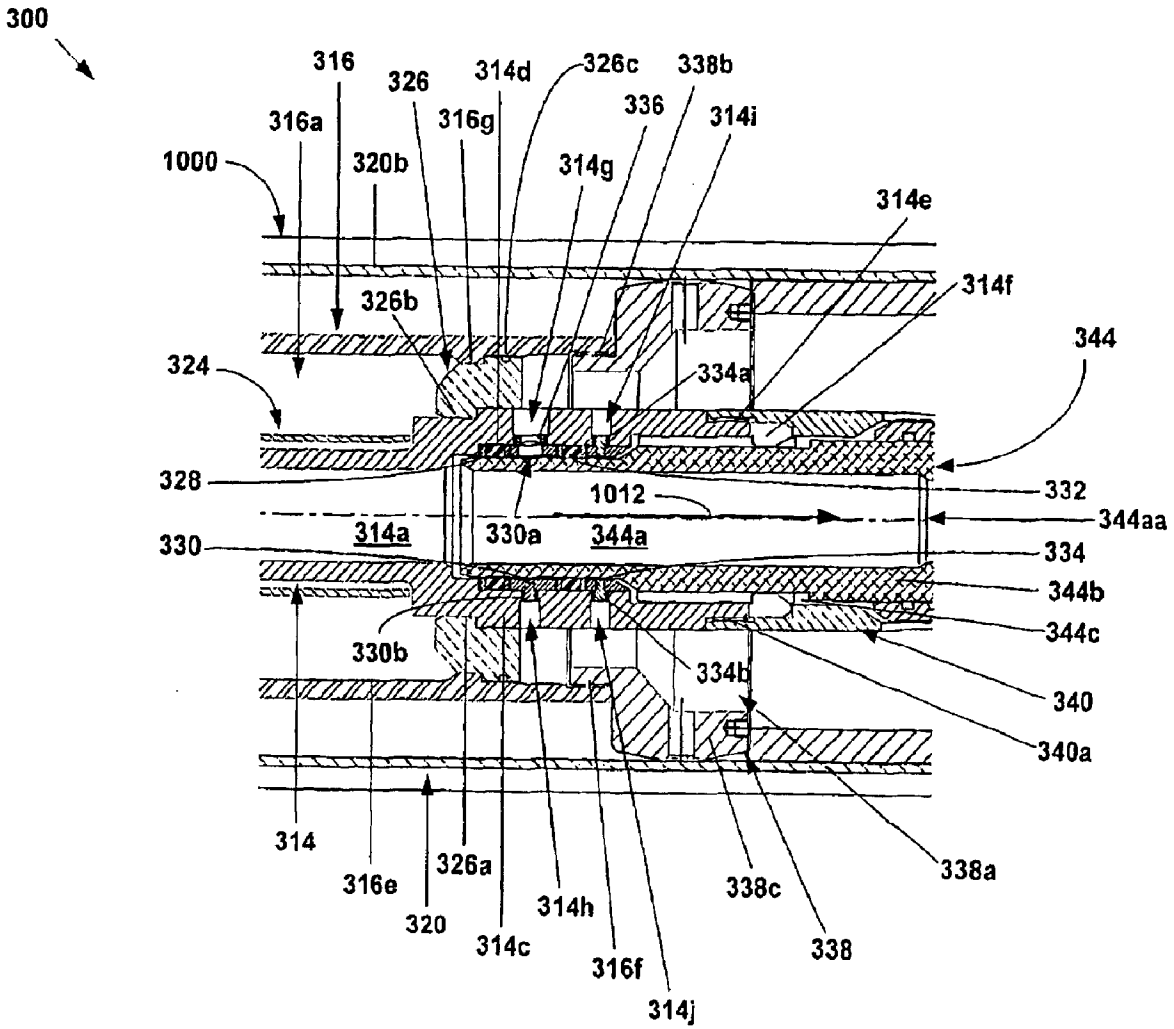
Figure 24C:
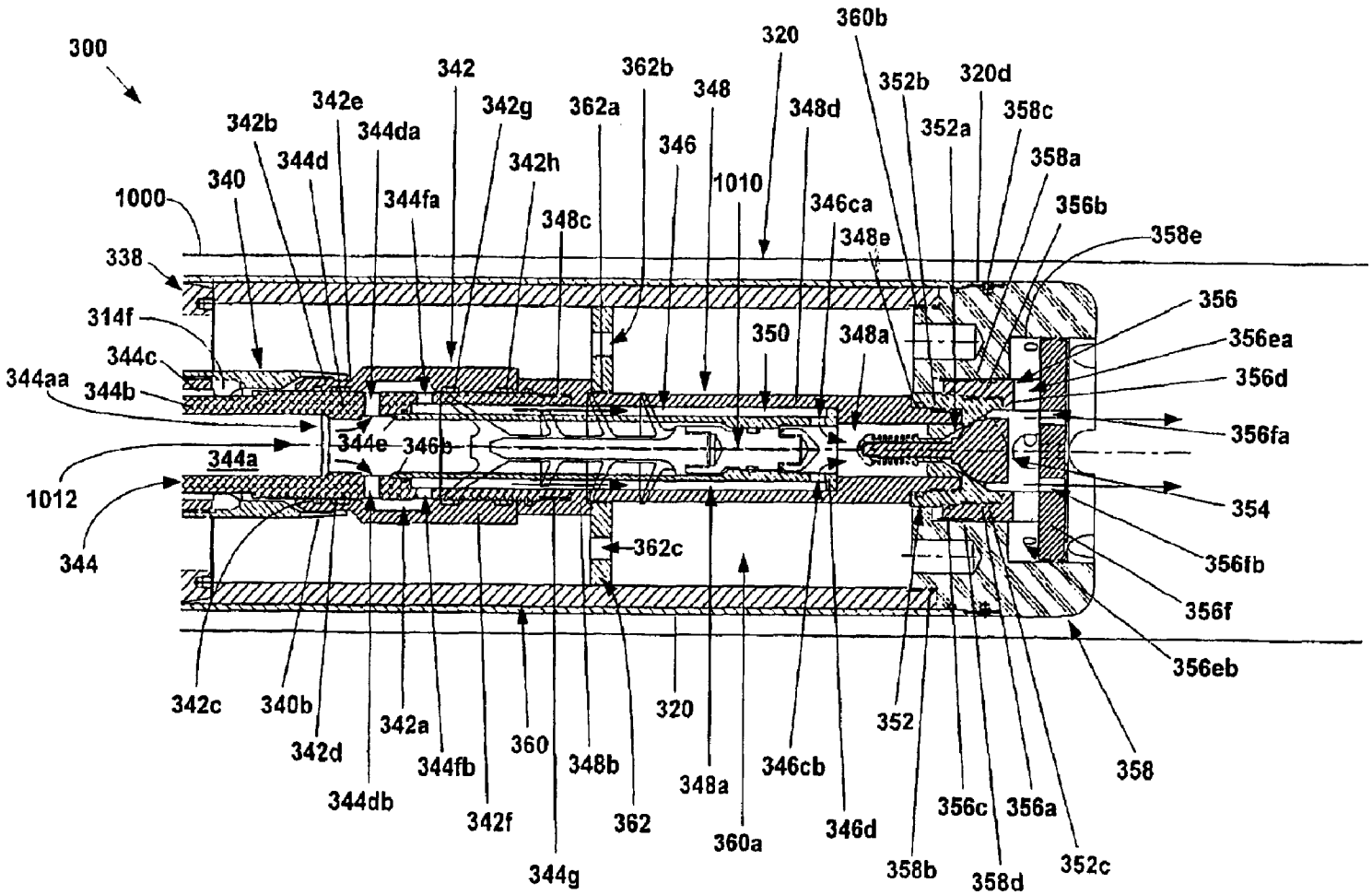

Referring to FIGS. 24*a*–24*c*, in step 410, a hardenable fluidic sealing material 1012 may then be injected into the assembly 300 and conveyed through the passages 1004*a*, 314*a*, 344*a*, 344*da*, 344*db*, 342*a*, 344*fa*, 344*fb*, 350, 346*ca*, 346*cb*, 348*a*, 352*a*, 356*fa*, and 356*fb* into the wellbore 1000. In this manner, a hardenable fluidic sealing material such as, for example, cement, may be injected into the annular region between the expansion cone launcher 320 and the wellbore 1000 in order to subsequently form an annular body of cement around the radially expanded expansion cone launcher 320. Furthermore, in this manner, the radial passage 330*a* and the rupture disc 336 are not exposed to the hardenable fluidic sealing material 1012.

Figure 25A:
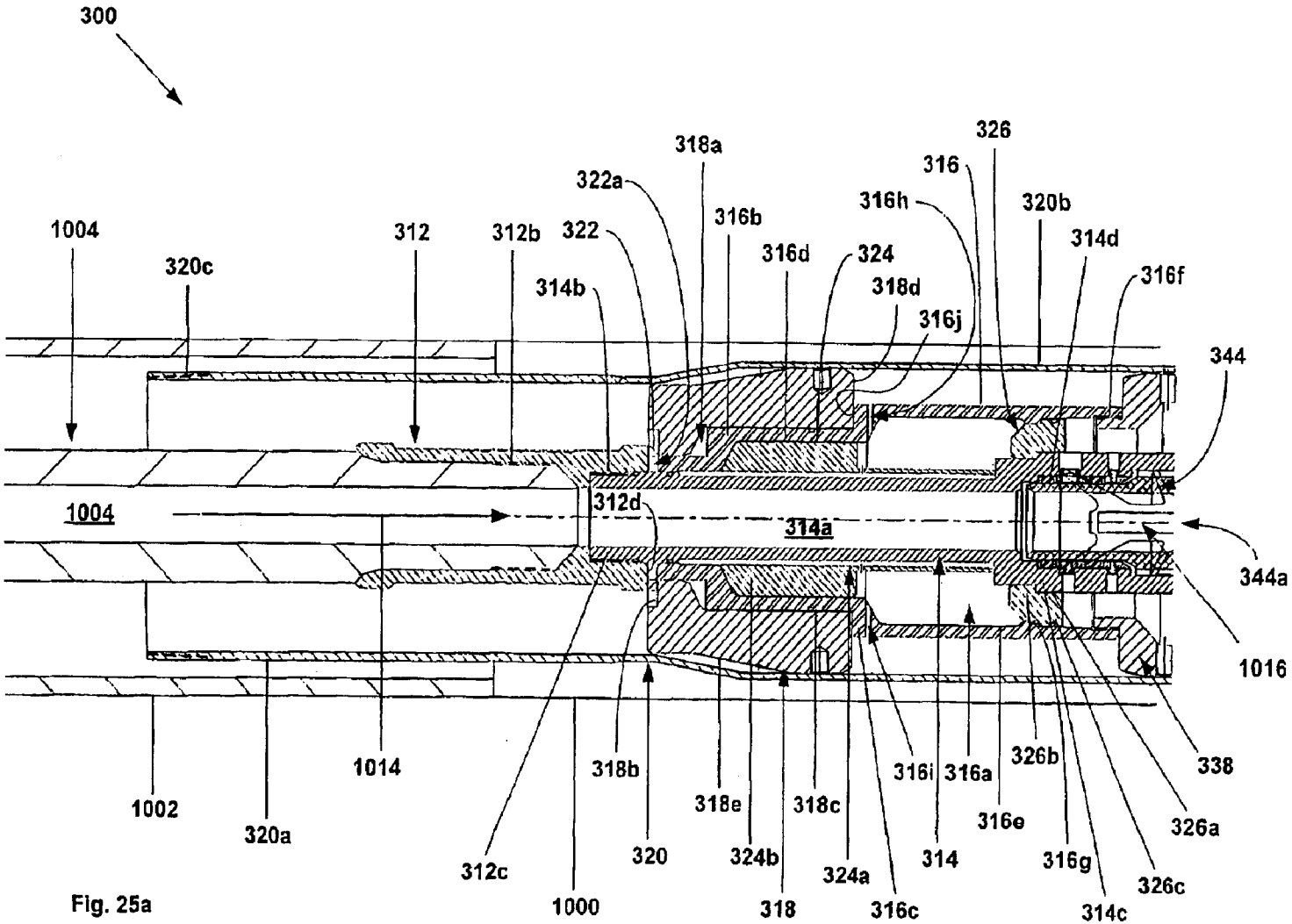
FIGS. 25*a*–25*c* are cross sectional illustrations of the placement of a top plug into the liner hanger assembly of FIGS. 24*a*–24*c*.
Figure 25B:
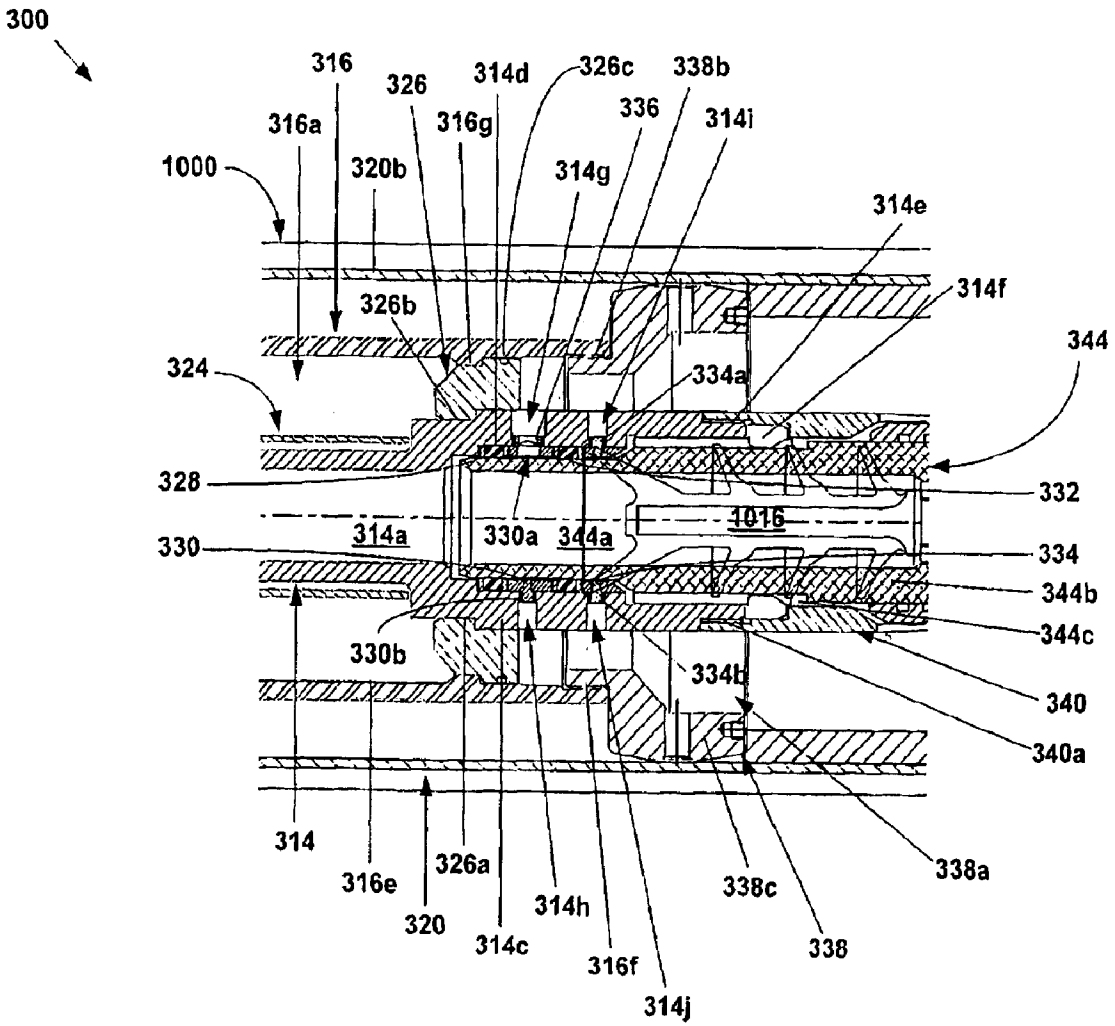
Figure 25C:
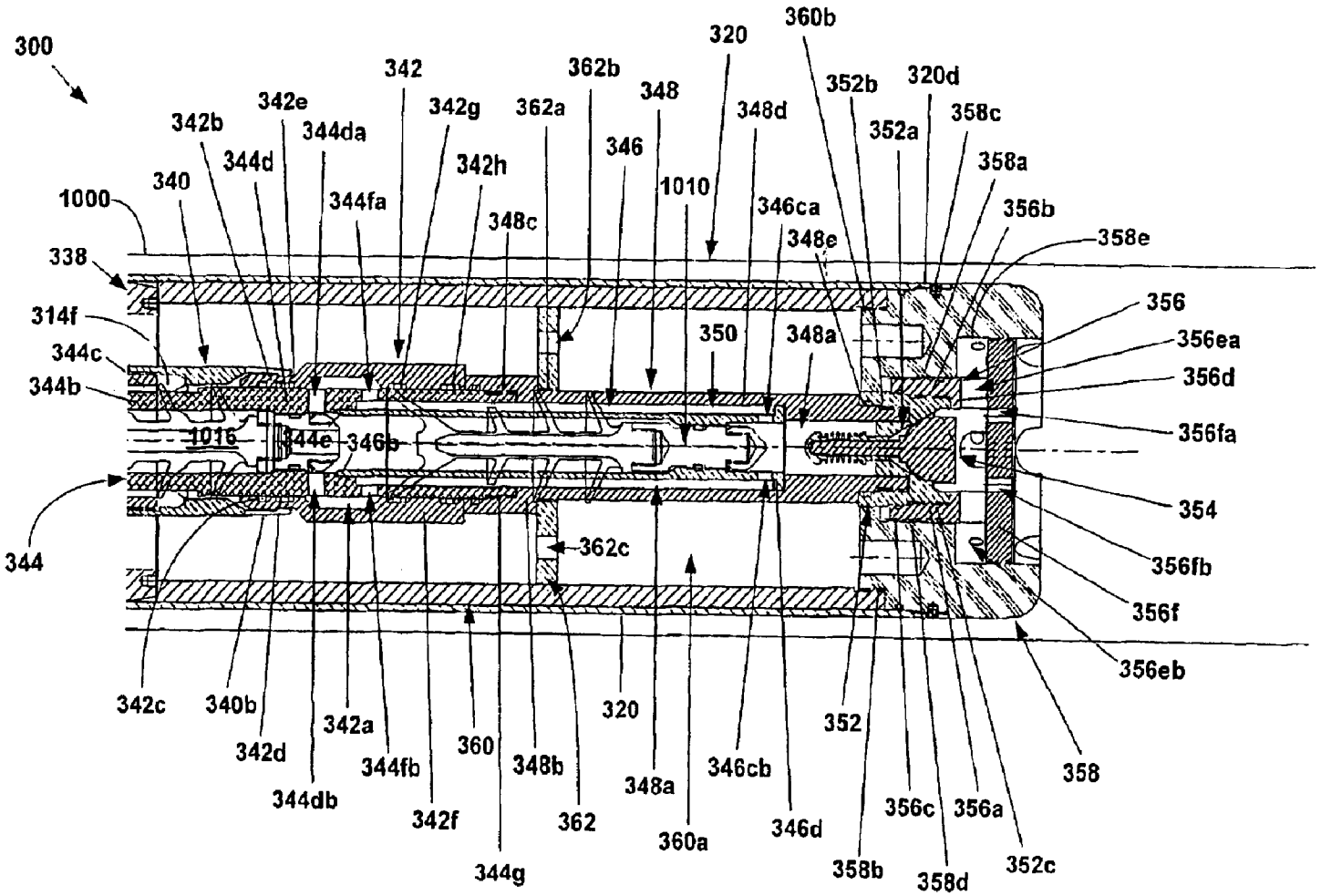

Referring to FIGS. 25*a*–25*c*, in step 412, upon the completion of the injection of the hardenable fluidic sealing material 1012, a non-hardenable fluidic material 1014 may be injected into the assembly 300, and a top plug 1016 may then be injected into the assembly 300 along with the fluidic materials 1014 and then positioned in the throat passage 344*aa* of the valve member 344. In this manner, the region of the passage 344*a* upstream from the top plug 1016 may be fluidicly isolated from region downstream from the top plug. In a preferred embodiment, the proper placement of the plug 1016 may be indicated by a corresponding increase in the operating pressure of the fluidic material 1014.

Figure 26A:
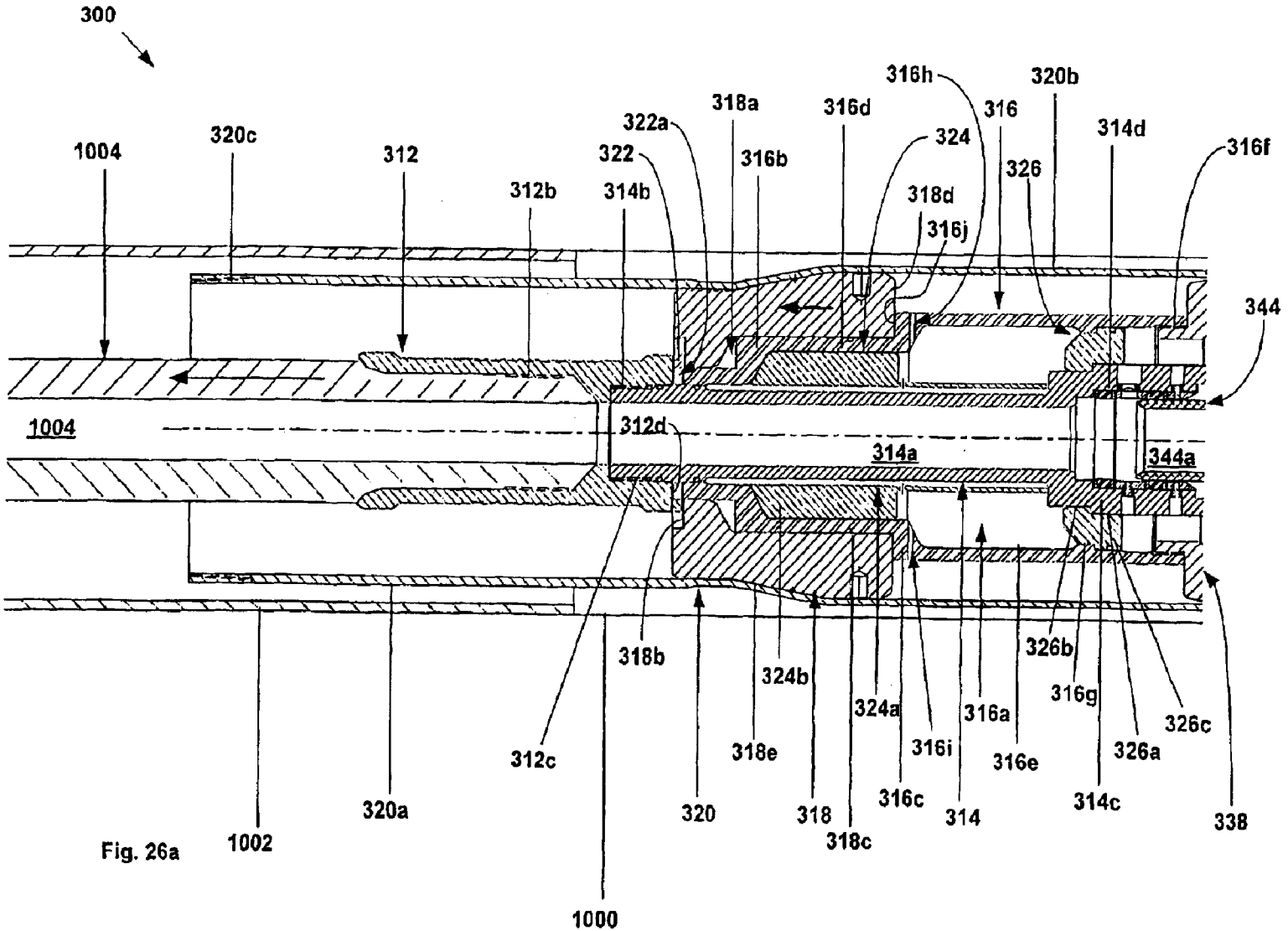
FIGS. 26*a*–26*c* are cross sectional illustrations of the upward displacement of sliding sleeve of the liner hanger assembly of FIGS. 25*a*–25*c*.
Figure 26B:
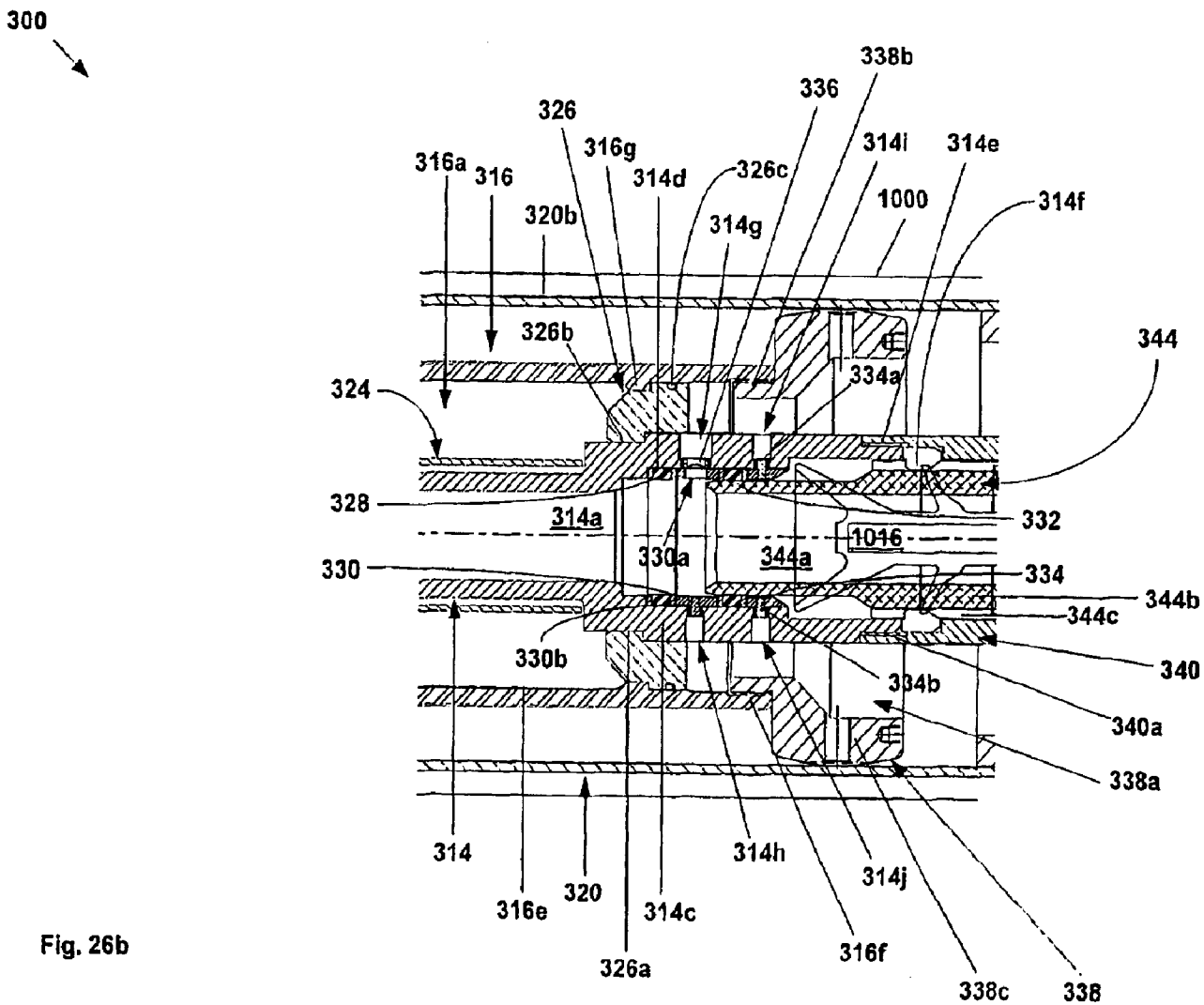
Figure 26C:
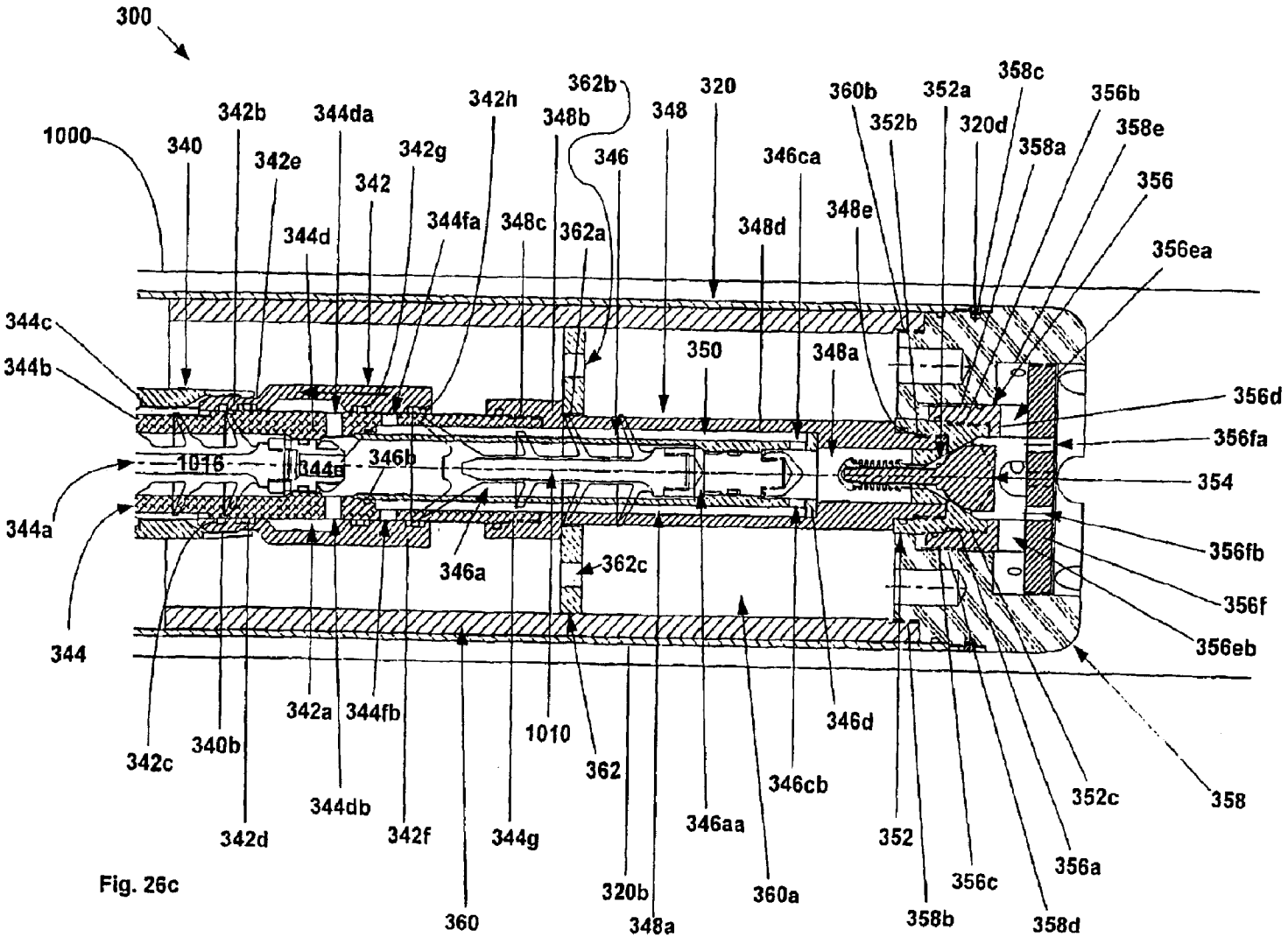

Referring to FIG. 26*a*–26*c*, in step 414, the sliding sleeve 42 may then be displaced relative to the valve member 344 by displacing the tubular member 1004 by applying, for example, an upward force of approximately 13,000 lbf on the assembly 300. In this manner, the tubular member 1004, the first tubular support member 312, the second tubular support member 314, the third tubular support member 316, the expansion cone 318, the annular spacer 322, the fourth tubular support member 324, the fifth tubular support member 326, the sixth tubular support member 338, the collet 340, and the sliding sleeve 342 are displaced in the longitudinal direction relative to the expansion cone launcher 320 and the valve member 344. In this manner, fluidic materials within the passage 344*a* upstream of the bottom plug 1010 may no longer bypass the bottom plug by passing through the first passages, 344*da* and 344*db*, through the annular passage 342*a*, through the second passages, 344*fa* and 344*fb*, through the annular passage 350, and through the passages, 346*ca* and 346*cb*, into region of the passage 348*a* downstream from the bottom plug. Furthermore, in this manner, the rupture disc 336 is no longer fluidicly isolated from the fluid passages 314*a* and 344*a*.

Figure 27A:
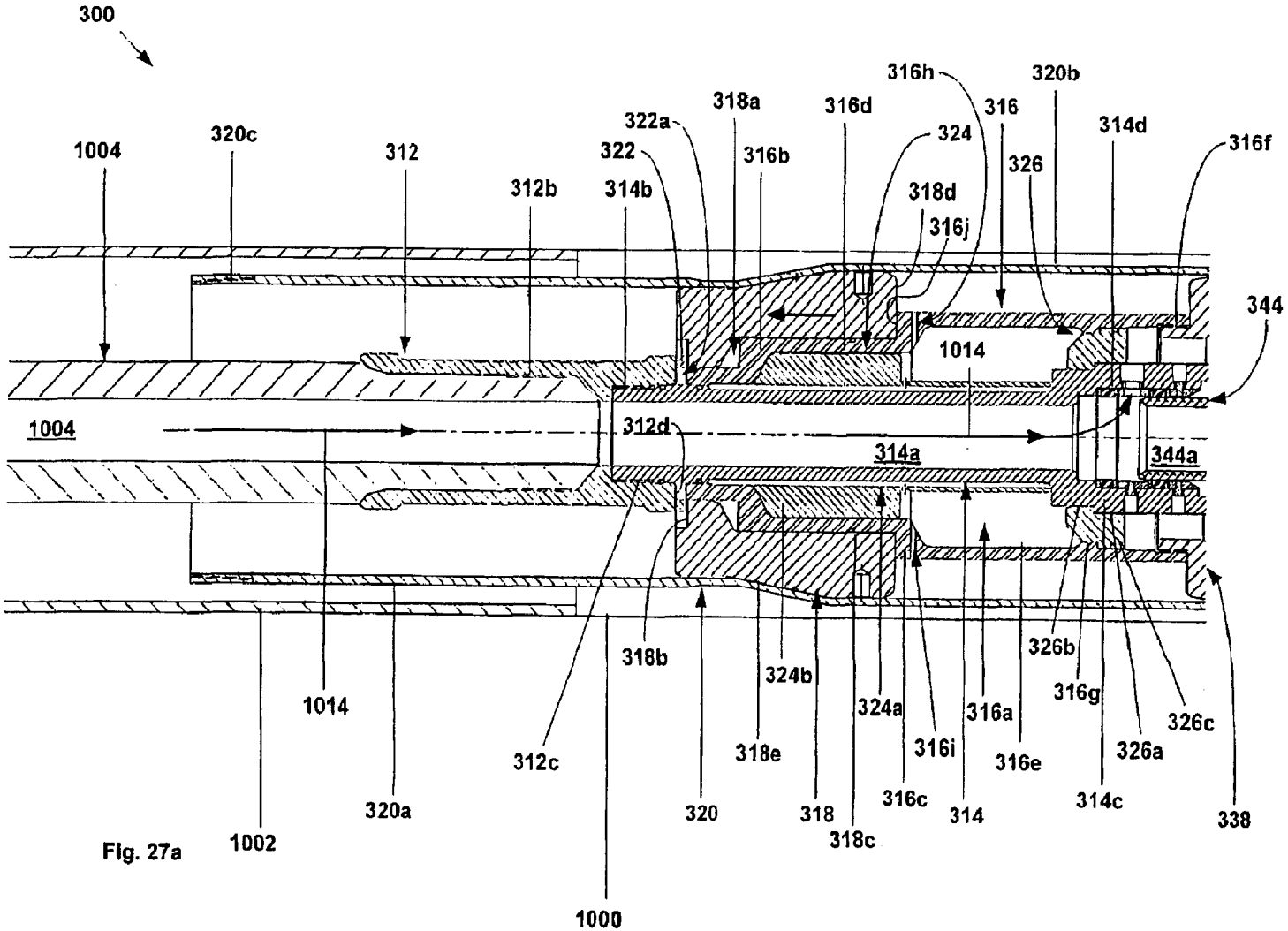
Figure 27B:
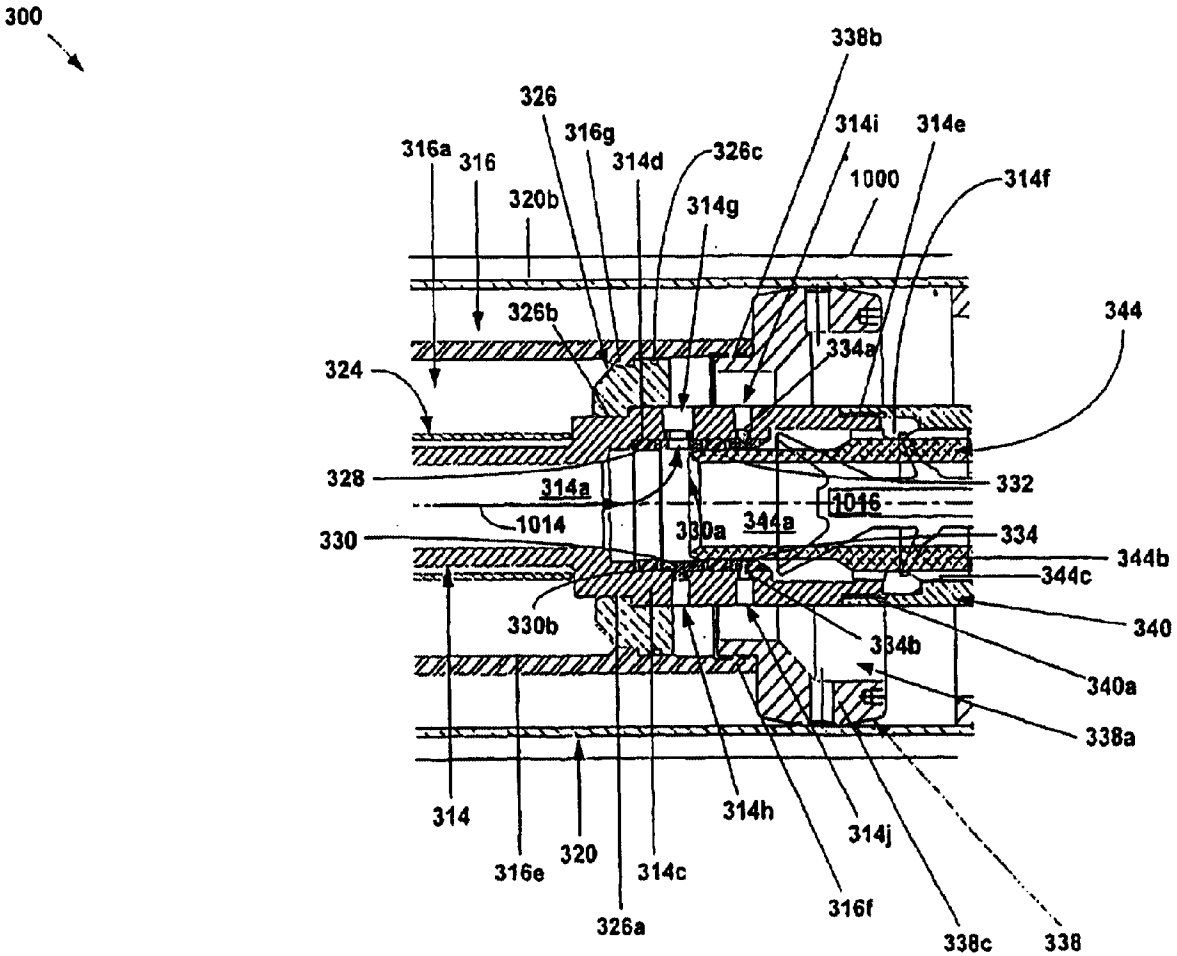

Referring to FIGS. 27*a*–27*c*, in step 416, the fluidic material 1014 may be injected into the assembly 300. The continued injection of the fluidic material 1014 may increase the operating pressure within the passages 314*a* and 344*a* until the burst disc 336 is opened thereby permitting the pressurized fluidic material 1014 to pass through the radial passage 330*a* and into an annular region 1018 defined by the second tubular support member 314, the third tubular support member 316, the sixth tubular support member 338, the collet 340, the sliding sleeve 342, the valve members, 344 and 348, the shoe 358, and the seventh tubular support member 360. The pressurized fluidic material 1014 within the annular region 1018 directly applies a longitudinal force upon the fifth tubular support member 326 and the sixth tubular support member 338. The longitudinal force in turn is applied to the expansion cone 318. In this manner, the expansion cone 318 is displaced relative to the expansion cone launcher 320 thereby radially expanding and plastically deforming the expansion cone launcher.

In an alternative embodiment of the method 400, the injection and placement of the top plug 1016 into the liner hanger assembly 300 in step 412 may omitted.

In an alternative embodiment of the method 400, in step 402, the assembly 300 is positioned at the bottom of the wellbore 1000.

Figure 28A:
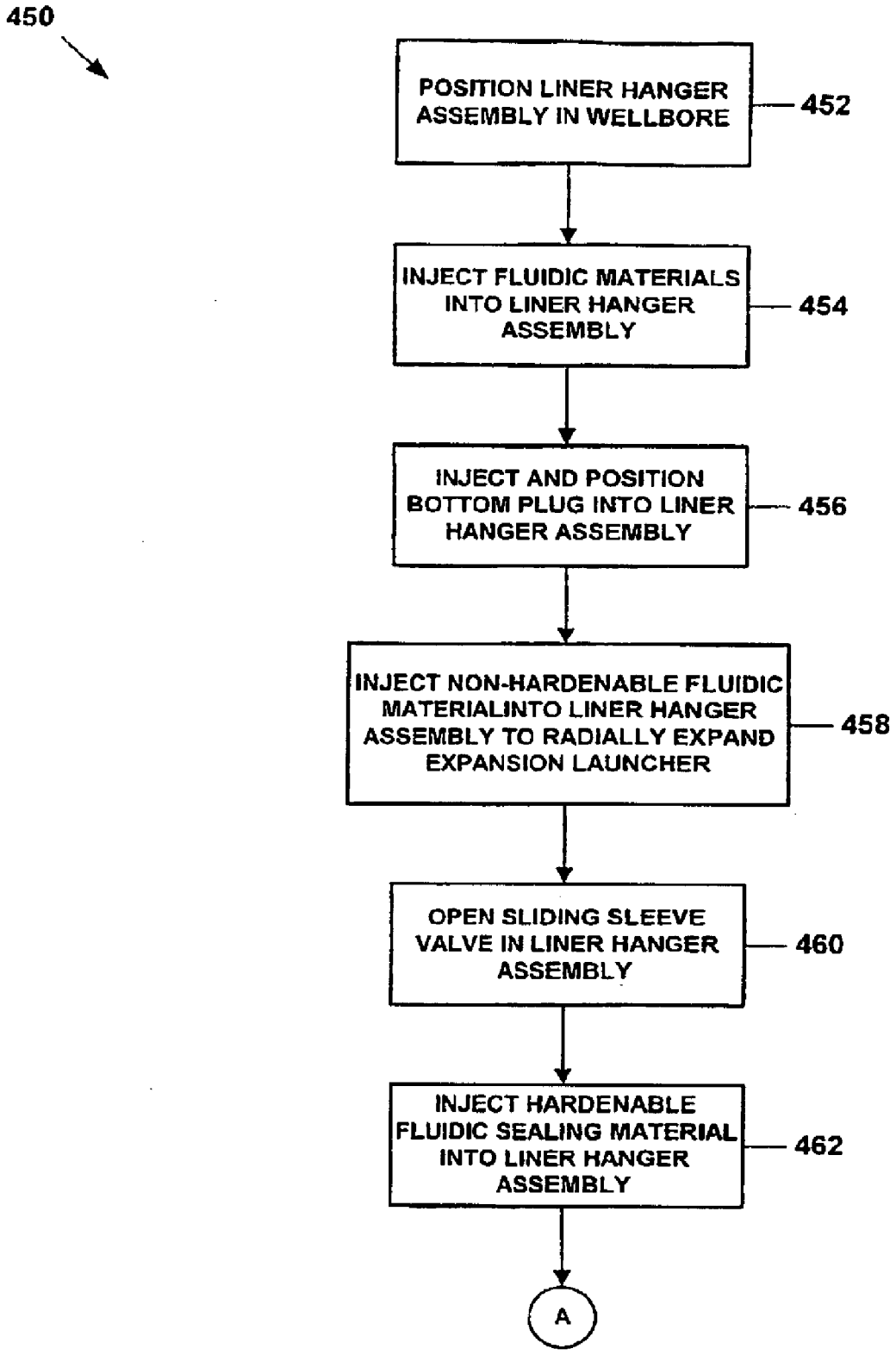
FIGS. 28*a*–28*b* is a flow chart illustration of an alternative embodiment of a method for forming a wellbore casing using the liner hanger assembly of FIGS. 18 and 18*a*–18*c*.
Figure 28B:
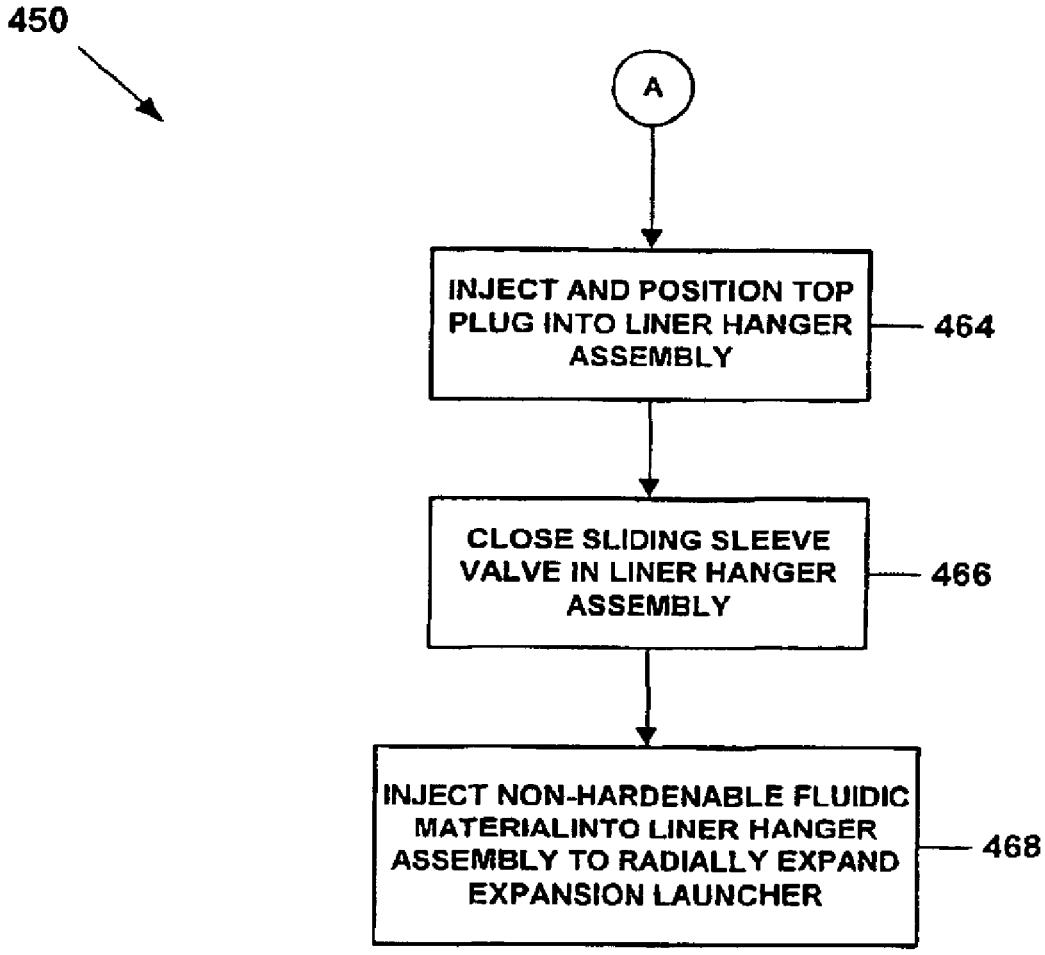

In an alternative embodiment, as illustrated in FIGS. 28*a*–28*b*, during operation, the assembly 300 may be used to form or repair a wellbore casing by implementing a method 450 in which, as illustrated in FIGS. 20*a*–20*c*, the assembly 300 may initially be positioned within a wellbore 1000 having a preexisting wellbore casing 1002 by coupling a conventional tubular member 1004 defining an internal passage 1004*a* to the threaded portion 312*b* of the first tubular support member 312 in step 452. In a preferred embodiment, during placement of the assembly 300 within the wellbore 1000, fluidic materials 1006 within the wellbore 1000 below the assembly 300 are conveyed through the assembly 300 and into the passage 1004*a* by the fluid passages 356*fa*, 356*fb*, 352*a*, 348*a*, 346*a*, 344*a*, and 314*a*. In this manner, surge pressures that can be created during placement of the assembly 300 within the wellbore 1000 are minimized. In a preferred embodiment, the float valve element 354 is pre-set in an auto-fill configuration to permit the fluidic materials 1006 to pass through the conical passage 352*a* of the valve seat 352.

Referring to FIGS. 21*a*–21*c*, in step 454, in step 454, fluidic materials 1008 may then be injected into and through the tubular member 1004 and assembly 300 to thereby ensure that all of the fluid passages 1004*a*, 314*a*, 344*a*, 346*a*, 348*a*, 352*a*, 356*fa*, and 356*fb* are functioning properly.

Referring to FIGS. 22*a*–22*c*, in step 456, the bottom plug 1010 may then be injected into the fluidic materials 1008 and into the assembly 300 and then positioned in the throat passage 346*aa* of the valve member 346. In this manner, the region of the passage 346*a* upstream from the plug 1010 may be fluidicly isolated from the region of the passage 346*a* downstream from the plug 1010. In a preferred embodiment, the proper placement of the plug 1010 may be indicated by a corresponding increase in the operating pressure of the fluidic material 1008.

Figure 29A:
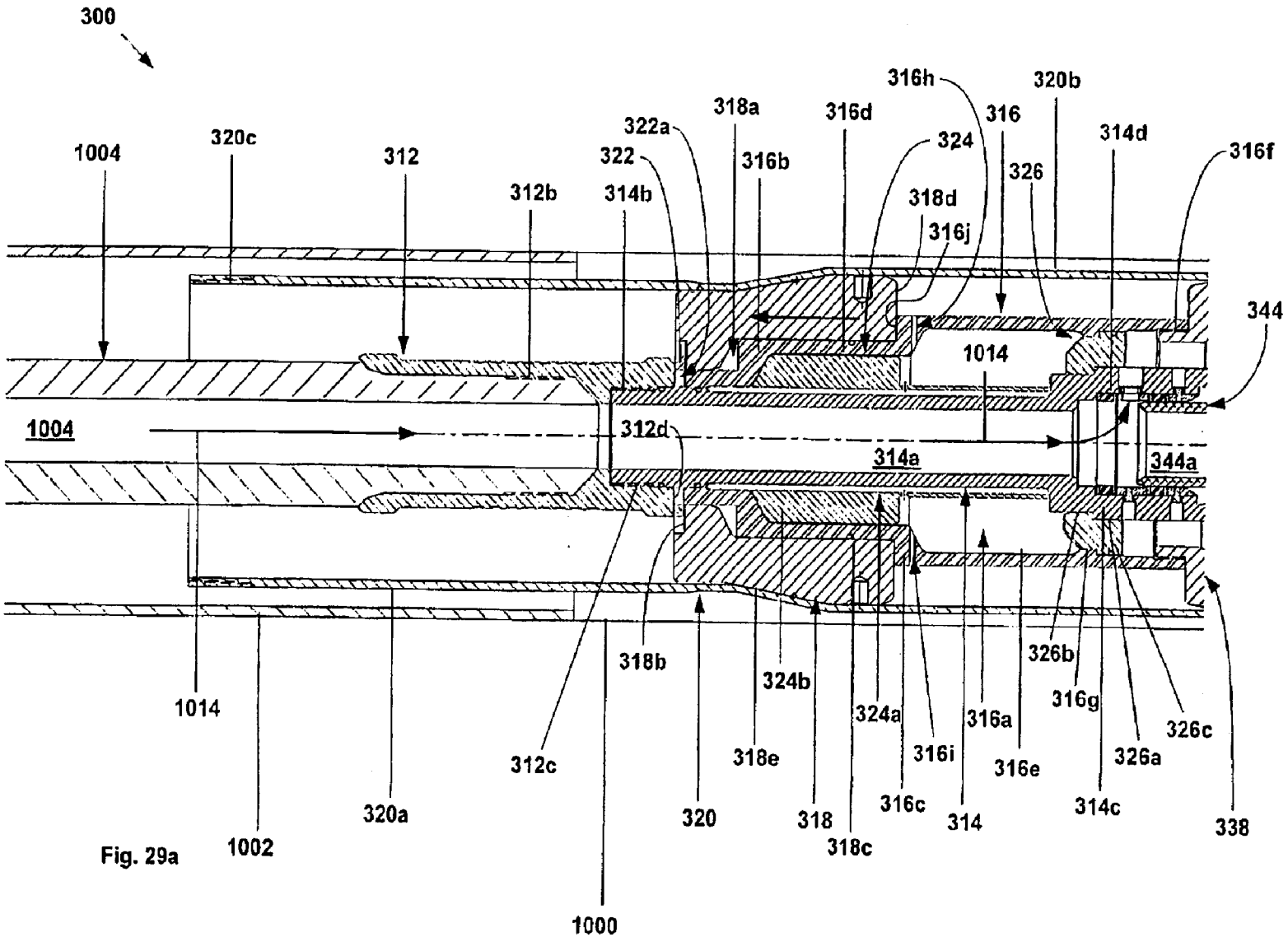
FIGS. 29*a*–29*c* are cross sectional illustrations of the injection of a pressurized fluidic material into the liner hanger assembly of FIGS. 22*a*–22*c* in order to at least partially radially expand and plastically deform the expansion cone launcher.
Figure 29B:
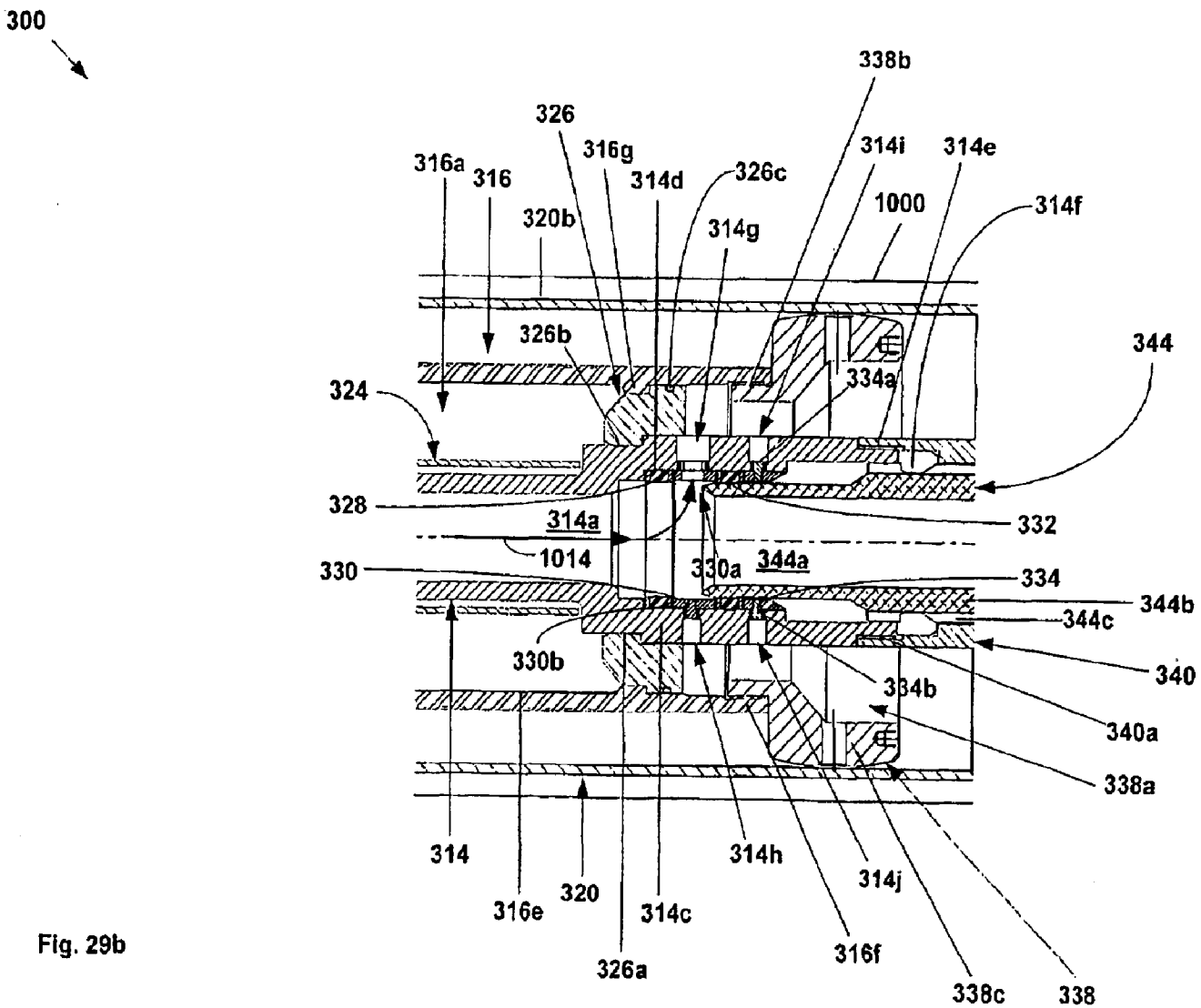
Figure 29C:
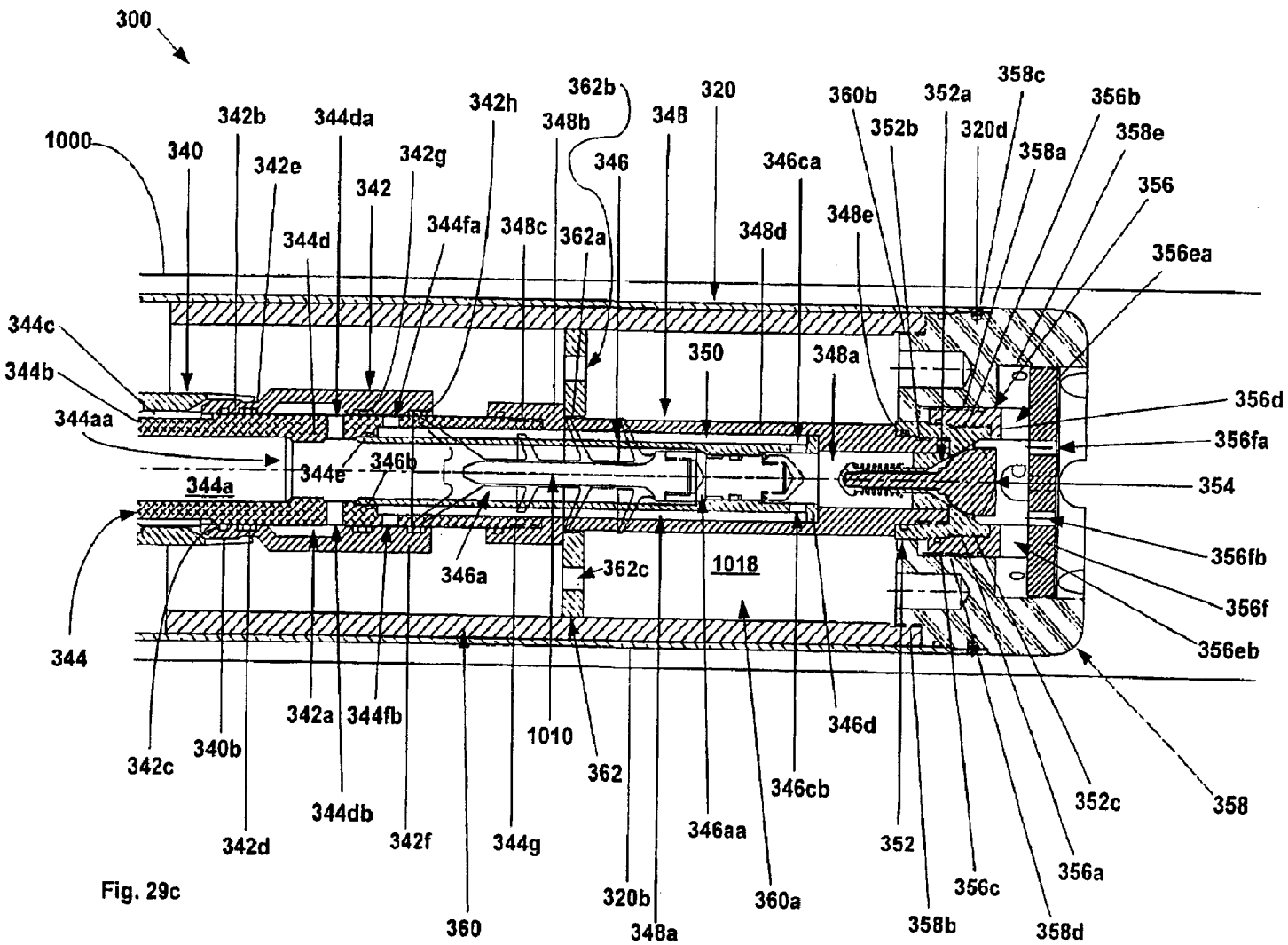

Referring to FIGS. 29*a*–29*c*, in step 458, the fluidic material 1014 may then be injected into the assembly 300 to thereby increase the operating pressure within the passages 314*a* and 344*a* until the burst disc 336 is opened thereby permitting the pressurized fluidic material 1014 to pass through the radial passage 330*a* and into an annular region 1018 defined by the defined by the second tubular support member 314, the third tubular support member 316, the sixth tubular support member 338, the collet 340, the sliding sleeve 342, the valve members, 344 and 348, the shoe 358, and the seventh tubular support member 360. The pressurized fluidic material 1014 within the annular region 1018 directly applies a longitudinal force upon the fifth tubular support member 326 and the sixth tubular support member 338. The longitudinal force in turn is applied to the expansion cone 318. In this manner, the expansion cone 318 is displaced relative to the expansion cone launcher 320 thereby disengaging the collet 340 and the sliding sleeve 342 and radially expanding and plastically deforming the expansion cone launcher. In a preferred embodiment, the radial expansion process in step 458 is continued to a location below the overlap between the expansion cone launcher 320 and the preexisting wellbore casing 1002.

Figure 30A:
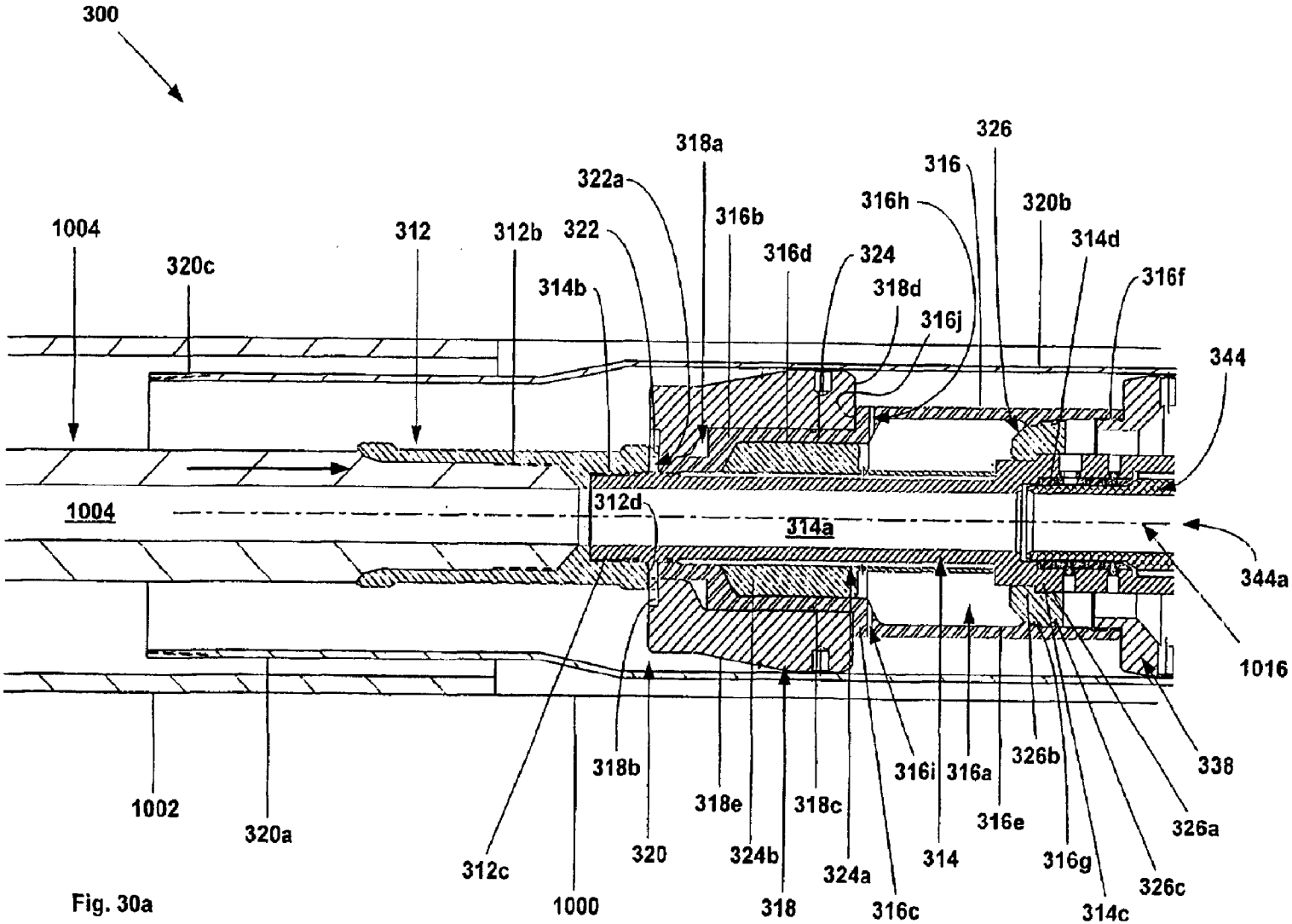
FIGS. 30*a*–30*c* are cross sectional illustrations of the downward displacement of the sliding sleeve of the liner hanger assembly of FIGS. 29*a*–29*c*.
Figure 30B:
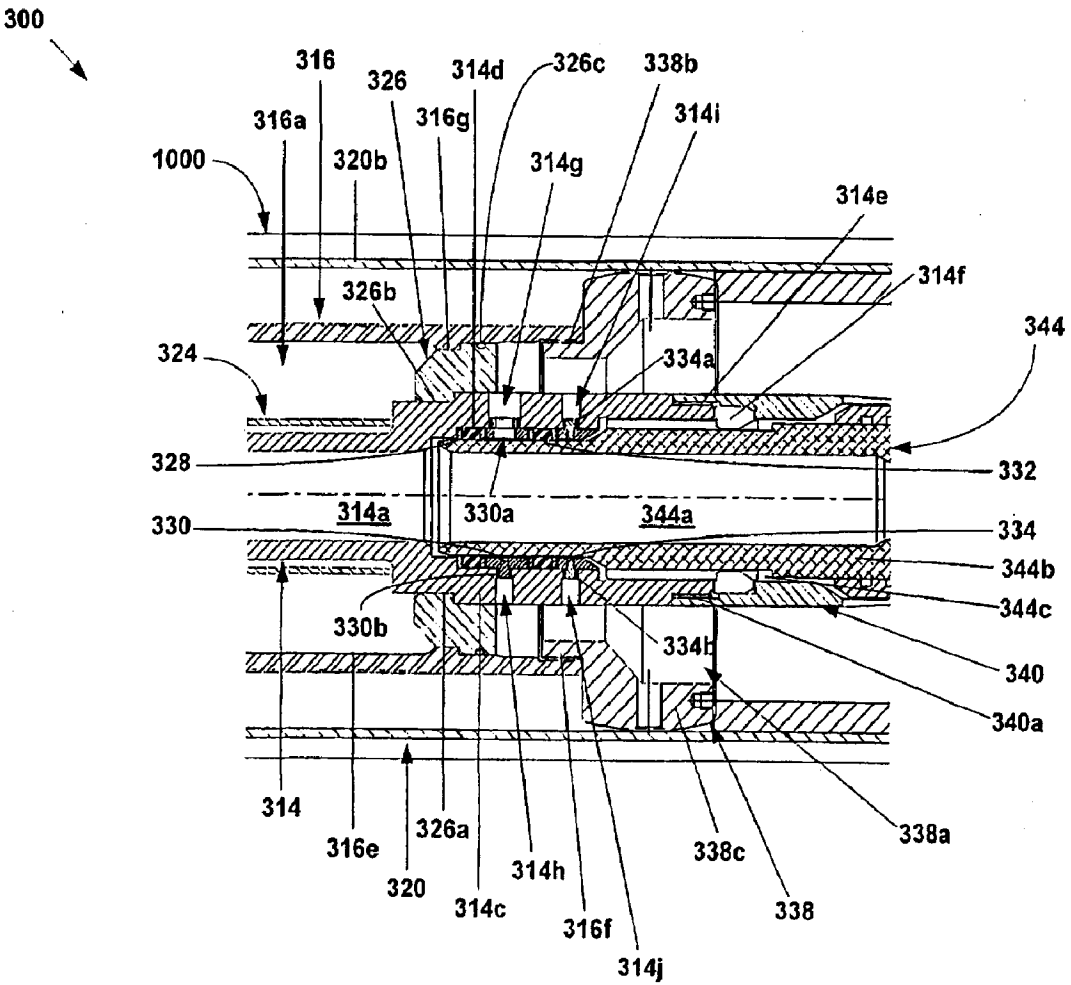
Figure 30C:
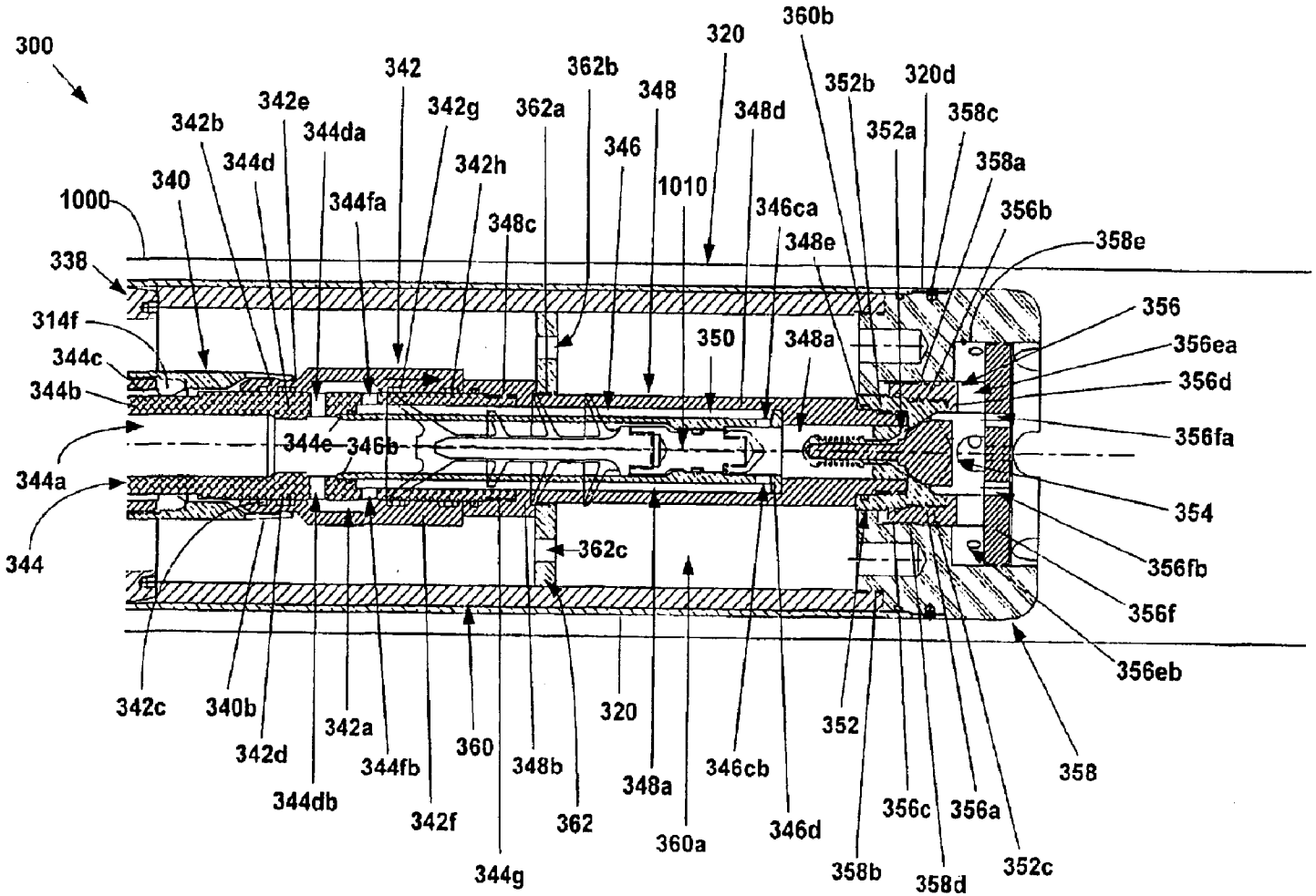

Referring to FIGS. 30*a*–30*c*, in step 460, the sliding sleeve 342 may then be displaced relative to the valve member 344 by (1) displacing the expansion cone 318 in a downward direction using the tubular member 1004 and (2) applying, using the tubular member 1004 a downward force of, for example, approximately 5,000 lbf on the assembly 300. In this manner, the coupling 340*b* of the collet 340 reengages the external groove 342*e* of the sliding sleeve 342. Furthermore, in this manner, the tubular member 1004, the first tubular support member 312, the second tubular support member 314, the third tubular support member 316, the expansion cone 318, the annular spacer 322, the fourth tubular support member 324, the fifth tubular support member 326, the sixth tubular support member 338, the collet 340, and the sliding sleeve 342 are displaced in the longitudinal direction relative to the expansion cone launcher 320 and the valve member 344. In this manner, fluidic materials within the passage 344*a* upstream of the bottom plug 1010 may bypass the plug by passing through the passages, 344*da* and 344*db*, the annular passage 342*a*, the passages, 344*fa* and 344*fb*, the annular passage 350, and the passages, 346*ca* and 346*cb*, into the passage 348*a* downstream from the plug. Furthermore, in this manner, the fluid passage 330*a* is fluidicly isolated from the passages 314*a* and 344*a*.

Figure 31A:
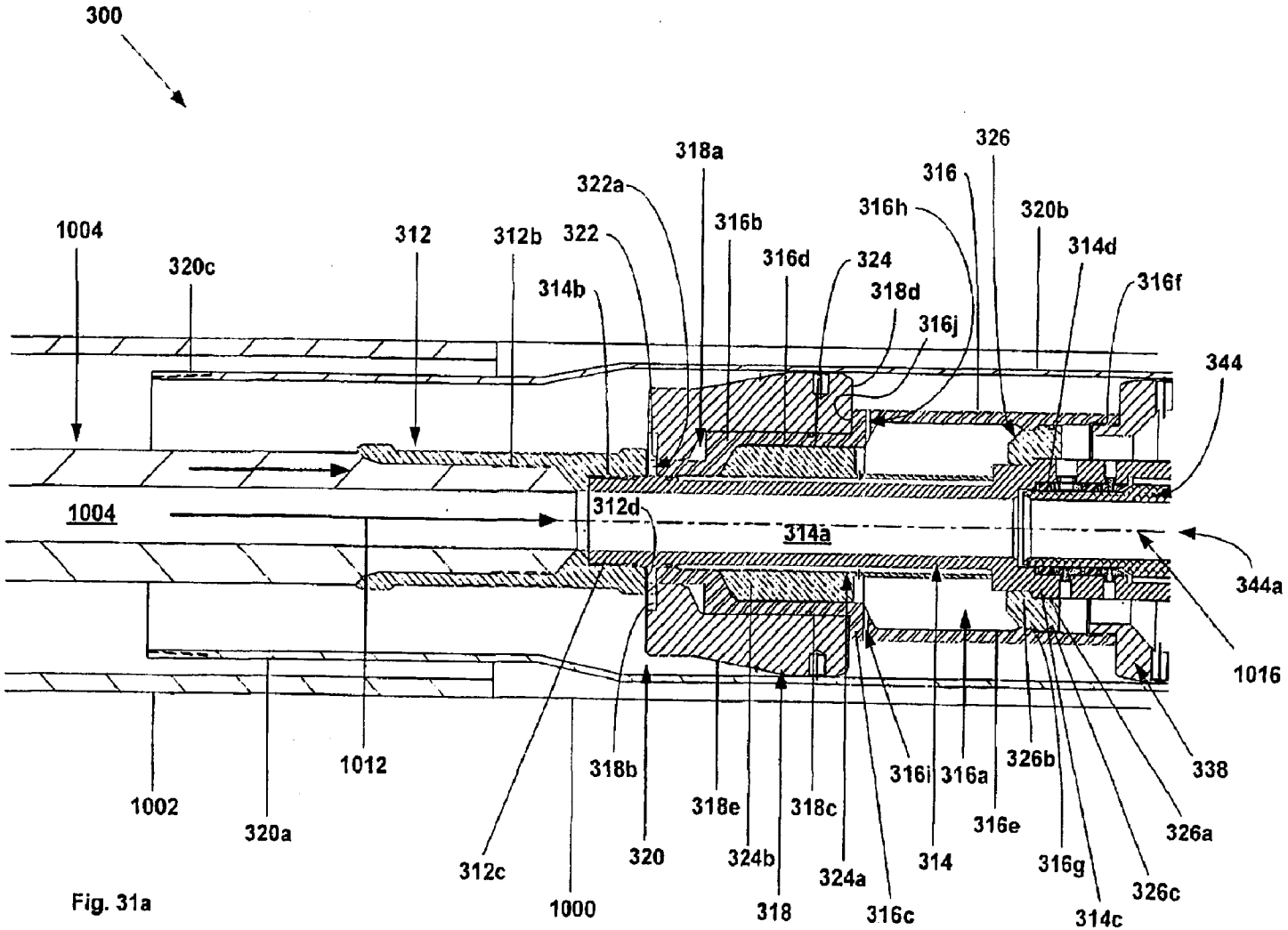
FIGS. 31*a*–31*c* are cross sectional illustrations of the injection of a hardenable fluidic sealing material through the liner hanger assembly of FIGS. 30*a*–30*c*.
Figure 31B:
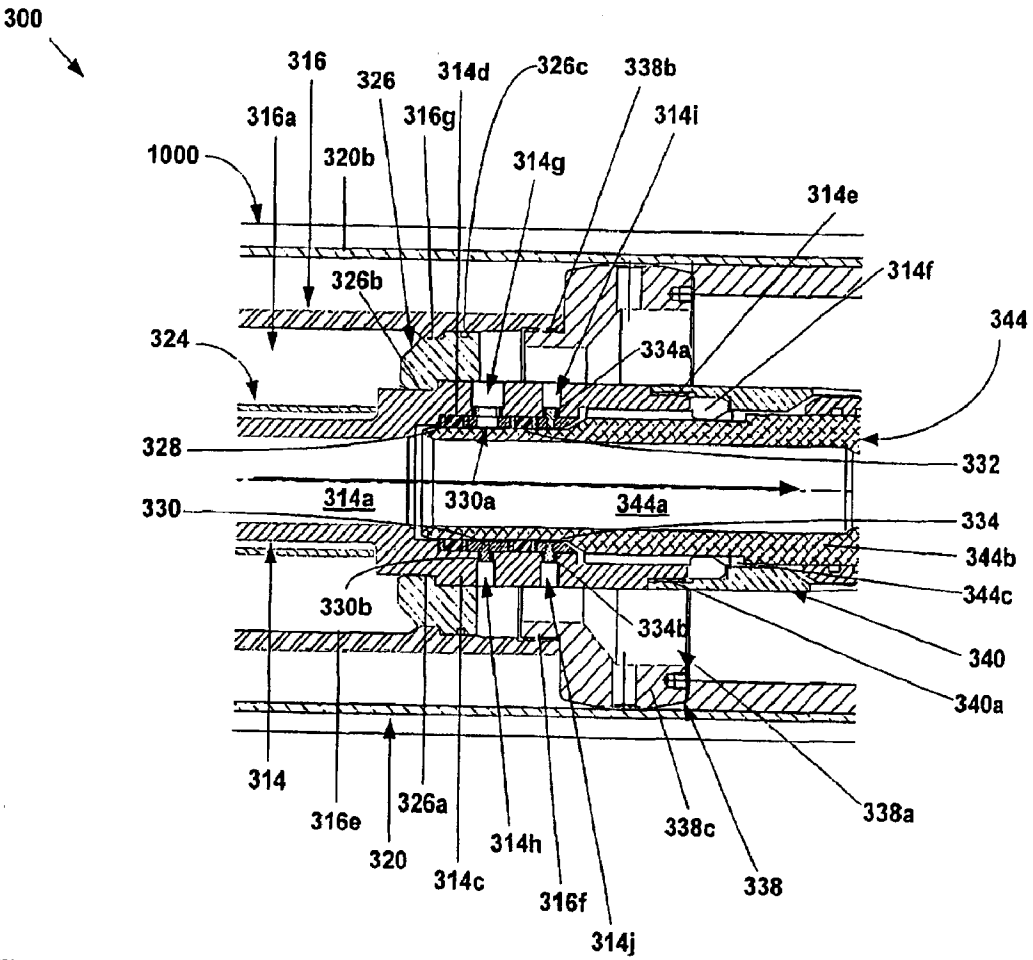
Figure 31C:
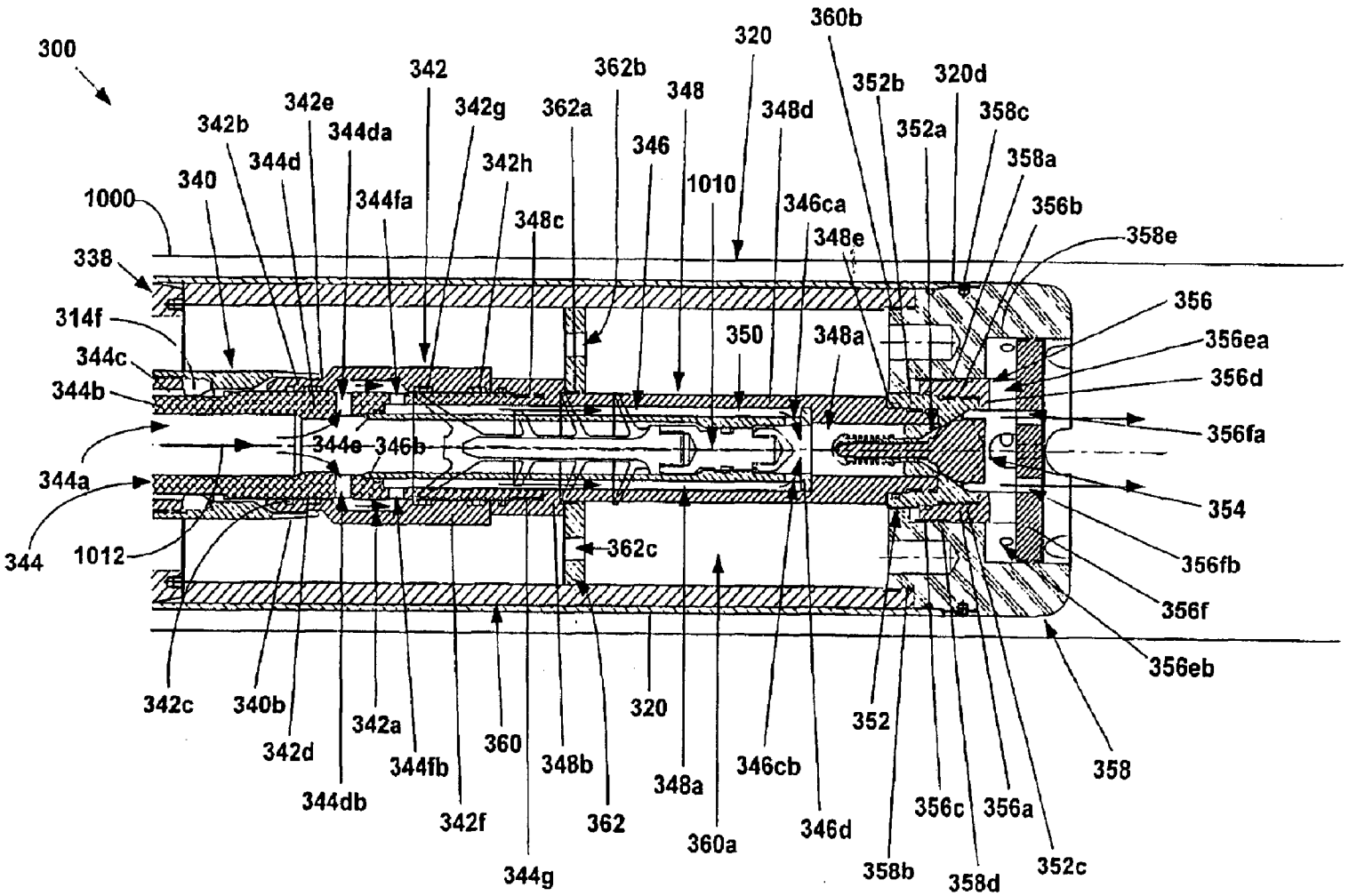

Referring to FIGS. 31*a*–31*c*, in step 462, the hardenable fluidic sealing material 1012 may then be injected into the assembly 300 and conveyed through the passages 1004*a*, 314*a*, 344*a*, 344*da*, 344*db*, 342, 344*fa*, 344*fb*, 350, 346*ca*, 346*cb*, 348*a*, 352*b*, 356*fa*, and 356*fb* into the wellbore 1000. In this manner, a hardenable fluidic sealing material such as, for example, cement, may be injected into the annular region between the expansion cone launcher 320 and the wellbore 1000 in order to subsequently form an annular body of cement around the radially expanded expansion cone launcher 320. Furthermore, in this manner, the radial passage 330*a* and the rupture disc 336 are not exposed to the hardenable fluidic sealing material 1012.

Figure 32A:
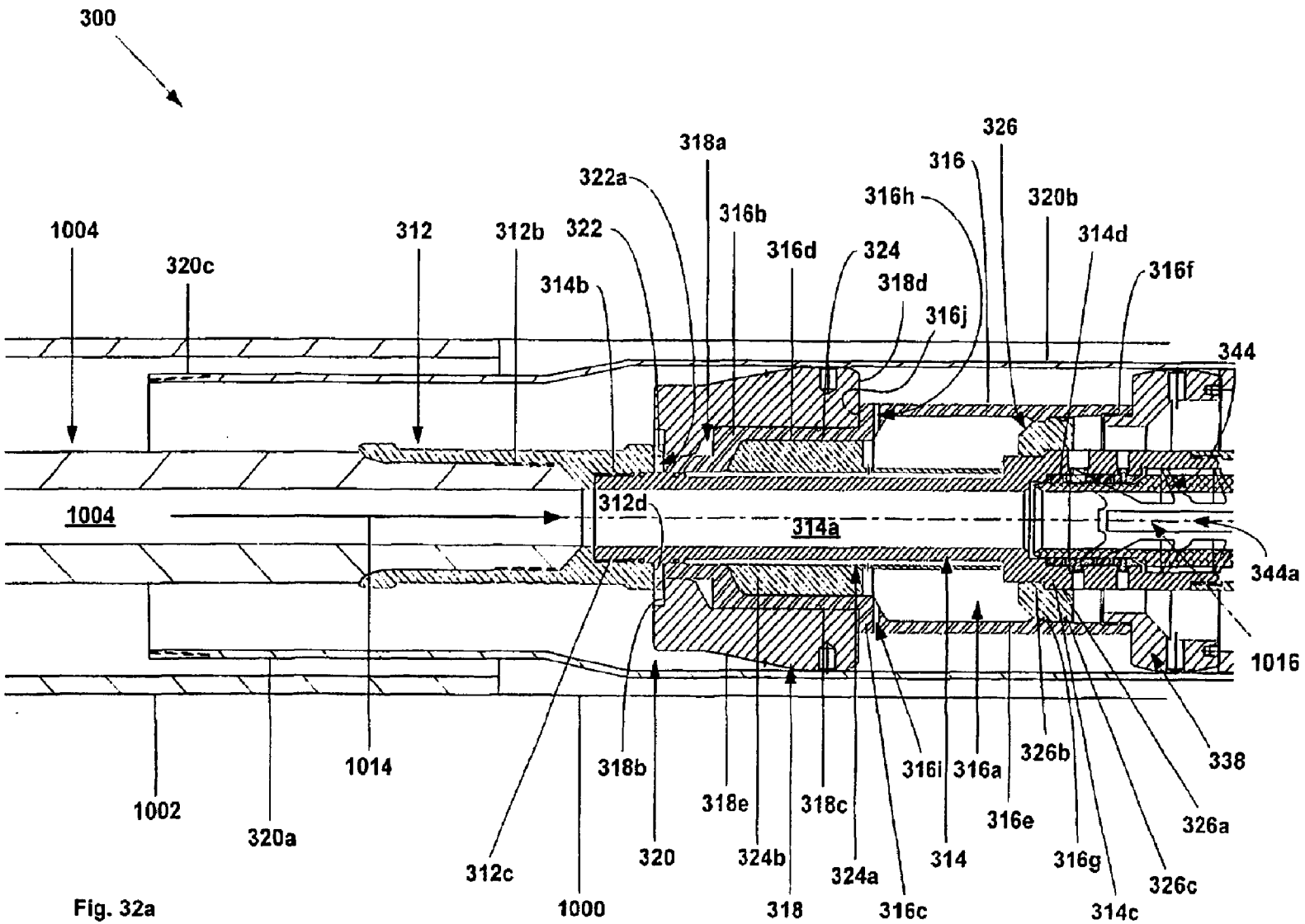
FIGS. 32*a*–32*c* are cross sectional illustrations of the injection and placement of a top plug into the liner hanger assembly of FIGS. 31*a*–31*c*.
Figure 32B:
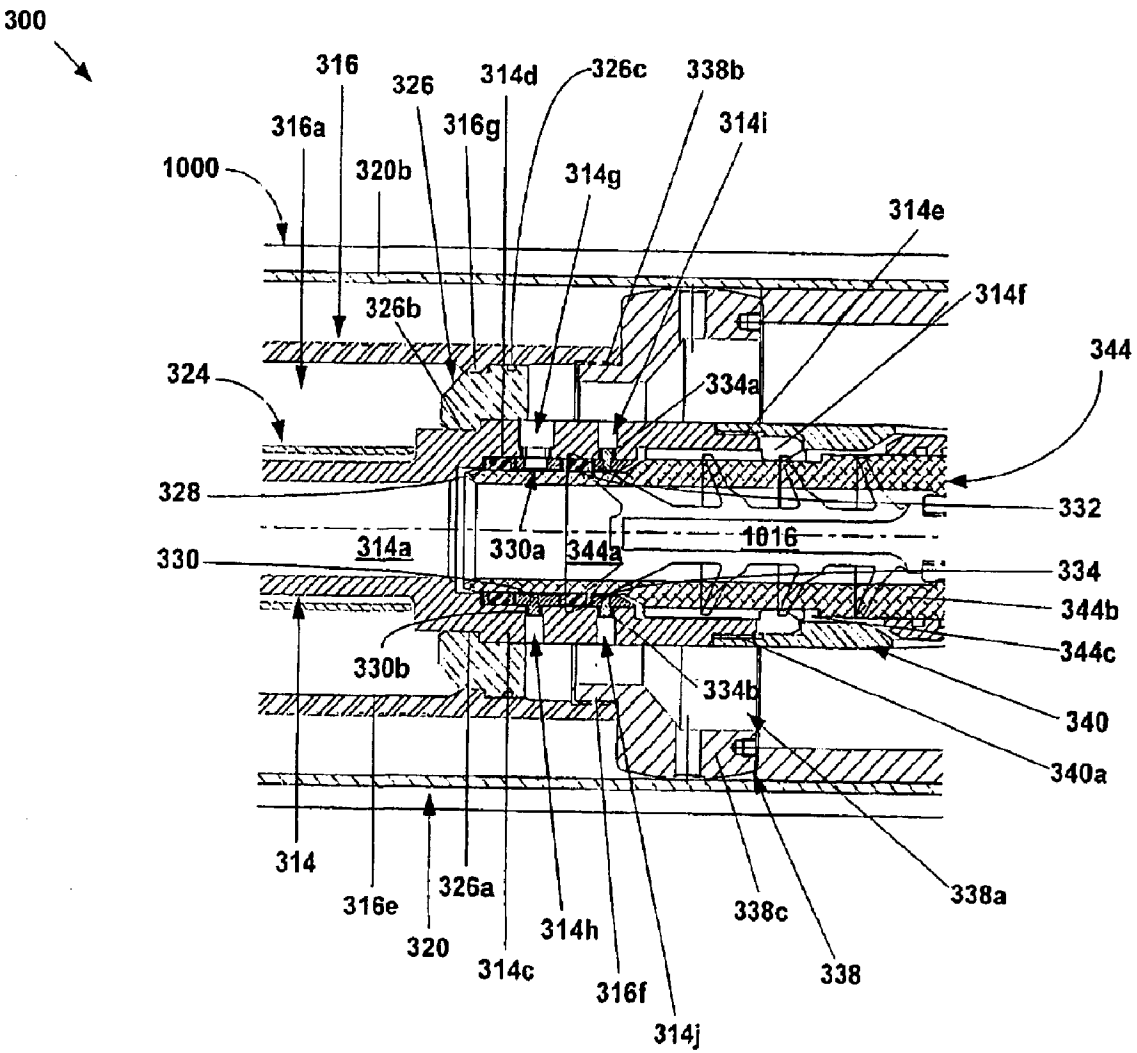
Figure 32C:
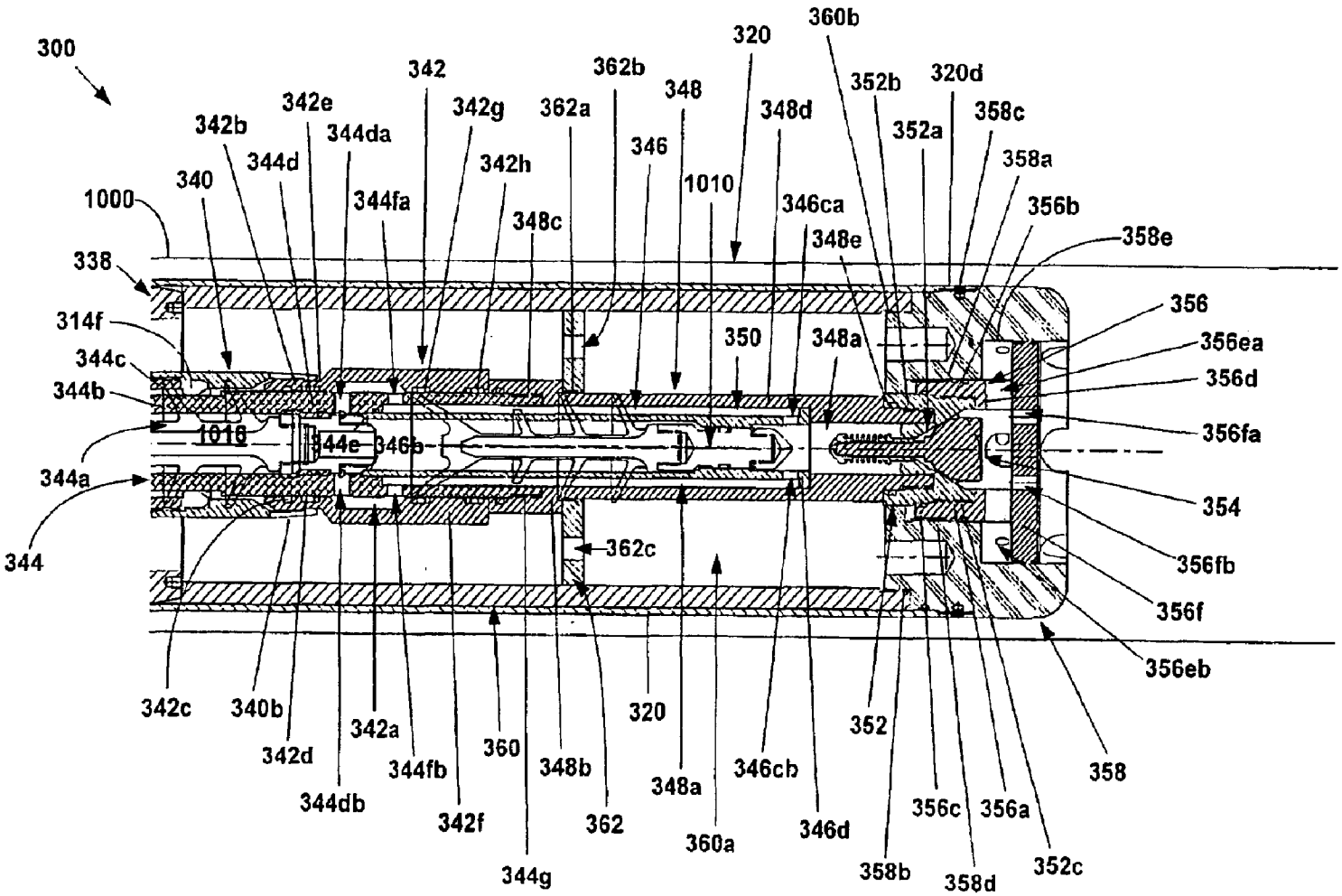

Referring to FIGS. 32*a*–32*c*, in step 464, upon the completion of the injection of the hardenable fluidic sealing material 1012, the non-hardenable fluidic material 1014 may be injected into the assembly 300, and the top plug 1016 may then be injected into the assembly 300 along with the fluidic materials 1014 and then positioned in the throat passage 344*aa* of the valve member 344. In this manner, the region of the passage 344*a* upstream from the top plug 1016 may be fluidicly isolated from the region within the passage downstream from the top plug. In a preferred embodiment, the proper placement of the plug 1016 may be indicated by a corresponding increase in the operating pressure of the fluidic material 1014.

Figure 33A:
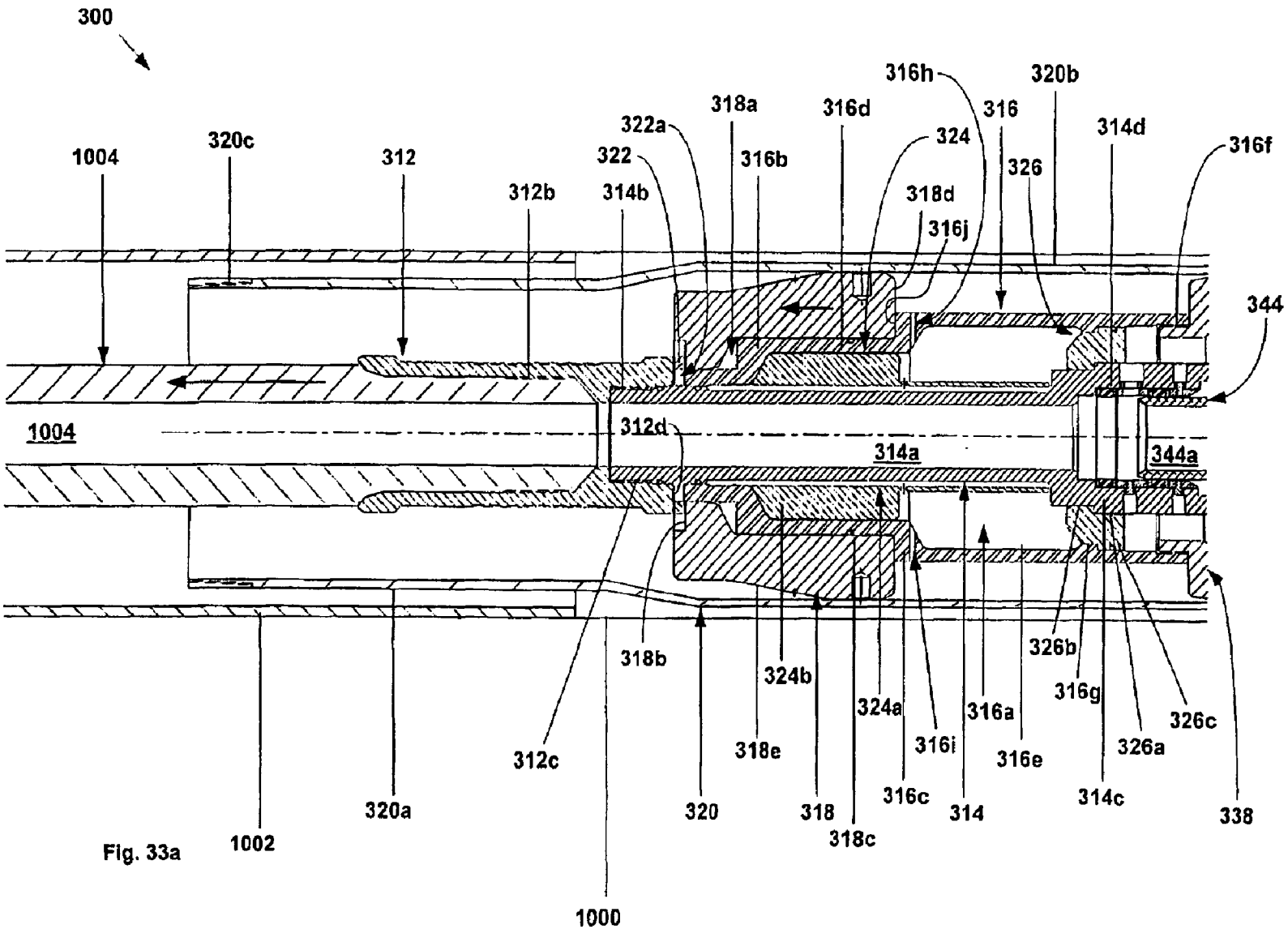
FIGS. 33*a*–33*c* are cross sectional illustrations of the upward displacement of the sliding sleeve of the liner hanger assembly of FIGS. 32*a*–32*c*.
Figure 33B:
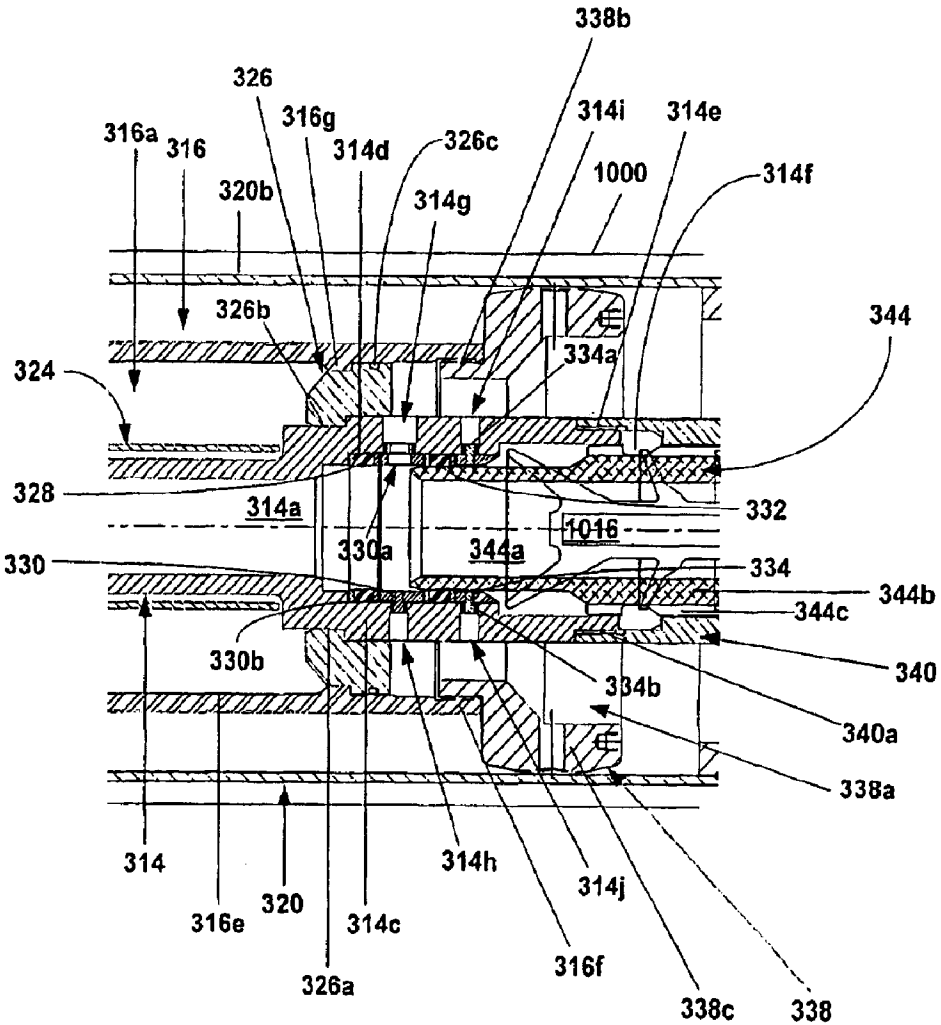
Figure 33C:
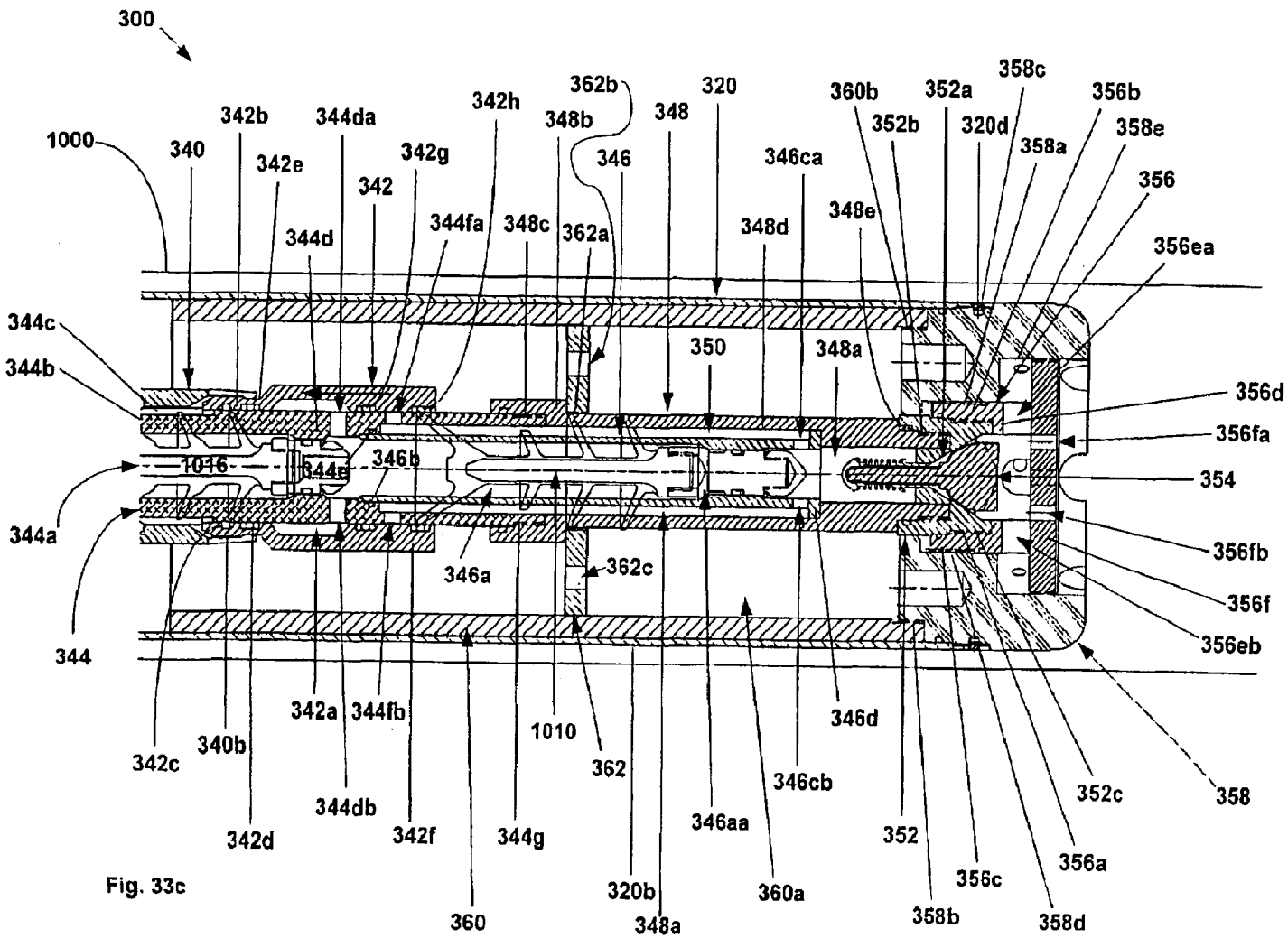

Referring to FIGS. 33*a*–33*c*, in step 466, the sliding sleeve 342 may then be displaced relative to the valve member 344 by displacing the tubular member 1004 by applying, for example, an upward force of approximately 13,000 lbf on the assembly 300. In this manner, the tubular member 1004, the first tubular support member 312, the second tubular support member 314, the third tubular support member 316, the expansion cone 318, the annular spacer 322, the fourth tubular support member 324, the fifth tubular support member 326, the sixth tubular support member 338, the collet 340, and the sliding sleeve 342 are displaced in the longitudinal direction relative to the expansion cone launcher 320 and the valve member 344. In this manner, fluidic materials within the passage 344*a* upstream of the bottom plug 110 may no longer bypass the plug by passing through the passages, 344*da* and 344*db*, the annular passage 342*a*, the passages, 344*fa* and 344*fb*, the annular passage 350, and the passages, 346*ca* and 346*cb*, into the passage 348*a* downstream from the plug. Furthermore, in this manner, the passage 330*a* is no longer fluidicly isolated from the fluid passages 314*a* and 344*a*.

Figure 34A:
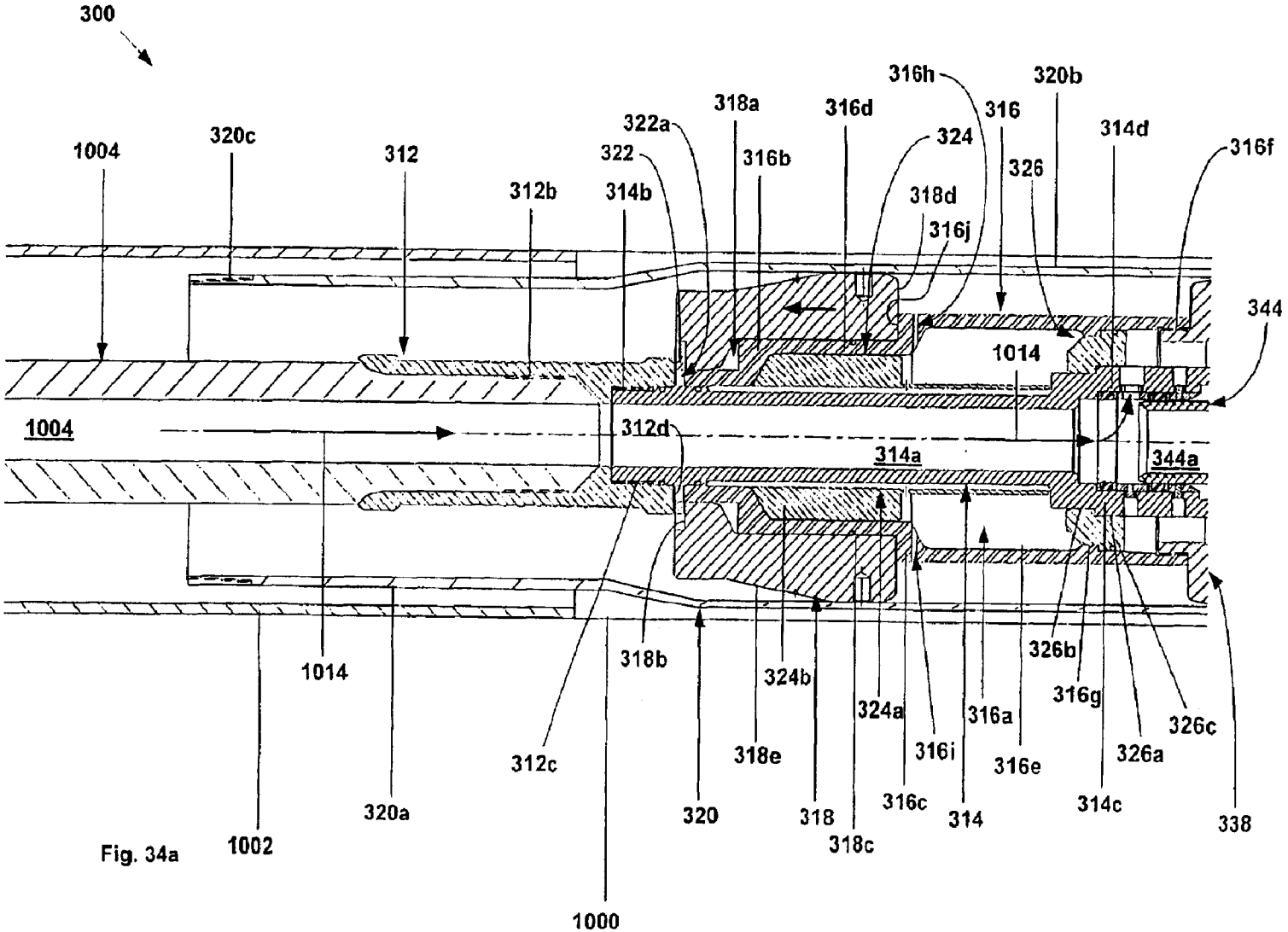
FIGS. 34*a*–34*c* are cross sectional illustrations of the injection of a pressurized fluidic material into the liner hanger assembly of FIGS. 33*a*–33*c* in order to complete the radial expansion of the expansion cone launcher.
Figure 34B:
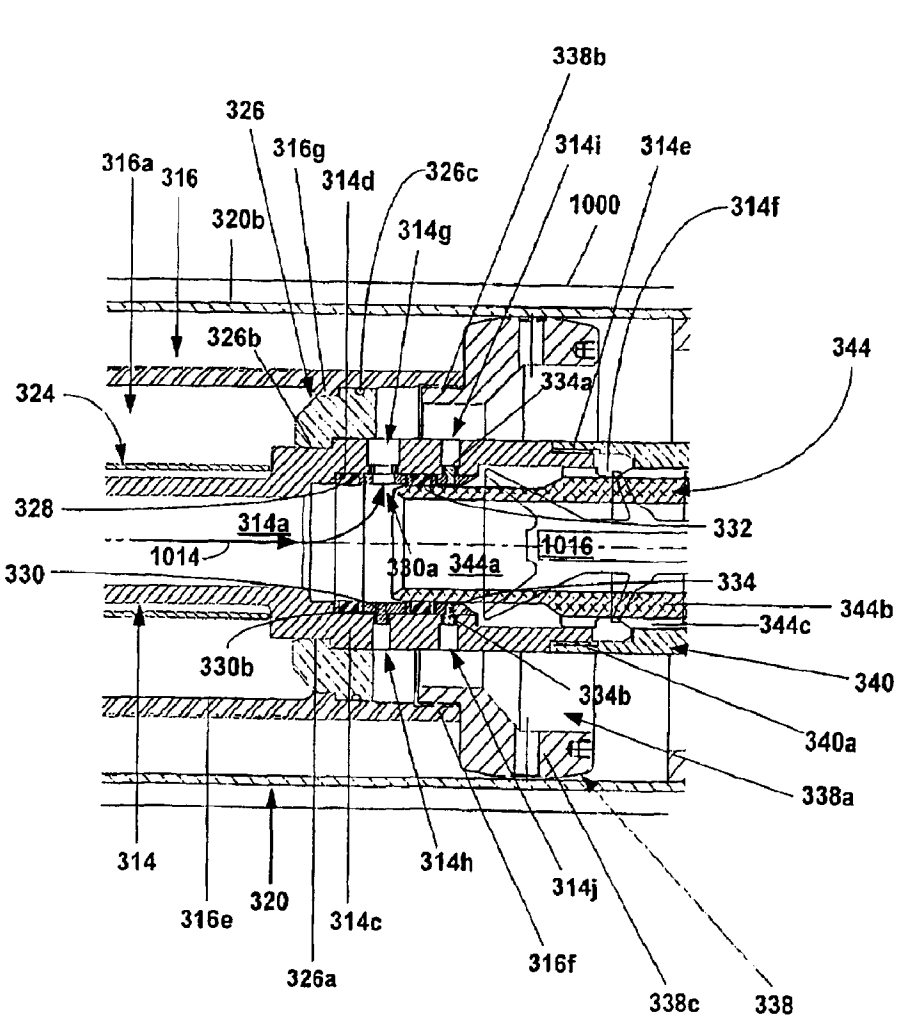
Figure 34C:
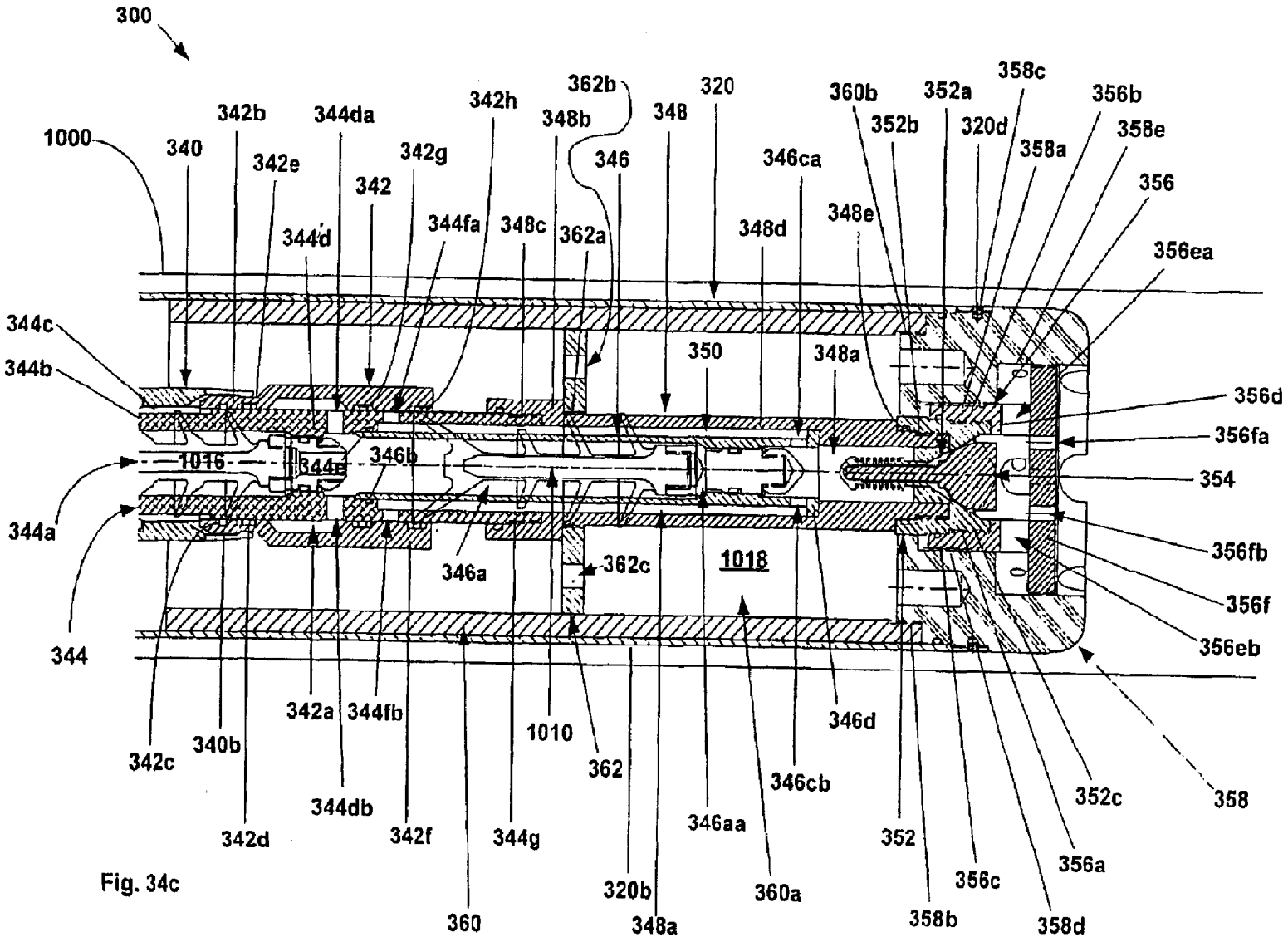

Referring to FIGS. 34*a*–34*c*, in step 468, the fluidic material 1014 may be injected into the assembly 300. The continued injection of the fluidic material 1014 may increase the operating pressure within the passages 314*a*, 330*a*, and 344*a* and the annular region 1018. The pressurized fluidic material 1014 within the annular region 1018 directly applies a longitudinal force upon the fifth tubular support member 326 and the sixth tubular support member 338. The longitudinal force in turn is applied to the expansion cone 318. In this manner, the expansion cone 318 is displaced relative to the expansion cone launcher 320 thereby completing the radial expansion of the expansion cone launcher.

In an alternative embodiment of the method 450, the injection and placement of the top plug 1016 into the liner hanger assembly 300 in step 464 may omitted.

In an alternative embodiment of the method 450, in step 452, the assembly 300 is positioned at the bottom of the wellbore 1000.

In an alternative embodiment of the method 450: (1) in step 452, the assembly 300 is positioned proximate a position below a preexisting section of the wellbore casing 1002, and (2) in step 458, the expansion cone launcher 320, and any expandable tubulars coupled to the threaded portion 320*c* of the expansion cone launcher, are radially expanded and plastically deformed until the shoe 358 of the assembly 300 is proximate the bottom of the wellbore 1000. In this manner, the radial expansion process using the assembly 300 provides a telescoping of the radially expanded tubulars into the wellbore 1000.

In several alternative embodiments, the assembly 300 may be operated to form a wellbore casing by including or excluding the float valve 354.

In several alternative embodiments, the float valve 354 may be operated in an auto-fill configuration in which tabs are positioned between the float valve 354 and the valve seat 352. In this manner, fluidic materials within the wellbore 1000 may flow into the assembly 300 from below thereby decreasing surge pressures during placement of the assembly 300 within the wellbore 1000. Furthermore, pumping fluidic materials through the assembly 300 at rate of about 6 to 8 bbl/min will displace the tabs from the valve seat 352 and thereby allow the float valve 354 to close.

In several alternative embodiments, prior to the placement of any of the plugs, 1010 and 1016, into the assembly 300, fluidic materials can be circulated through the assembly 300 and into the wellbore 1000.

In several alternative embodiments, once the bottom plug 1010 has been positioned into the assembly 300, fluidic materials can only be circulated through the assembly 300 and into the wellbore 1000 if the sliding sleeve 342 is in the down position.

In several alternative embodiments, once the sliding sleeve 342 is positioned in the down position, the passage 330*a* and rupture disc 336 are fluidicly isolated from pressurized fluids within the assembly 300.

In several alternative embodiments, once the top plug 1016 has been positioned into the assembly 300, no fluidic materials can be circulated through the assembly 300 and into the wellbore 1000.

In several alternative embodiments, the assembly 300 may be operated to form or repair a wellbore casing, a pipeline, or a structural support.

In a preferred embodiment, the design and operation of the liner hanger assemblies 10 and 300 are provided substantially as described and illustrated in the drawings of the present application.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. A method of forming a wellbore casing within a borehole within a subterranean formation, comprising:

positioning an expandable tubular member within the borehole;

injecting fluidic materials into the expandable tubular member;

fluidicly isolating a first region from a second region within the expandable tubular member;

fluidicly coupling the first and second regions;

injecting a hardenable fluidic sealing material into the expandable tubular member;

fluidicly decoupling the first and second regions; and injecting a non-hardenable fluidic material into the expandable tubular member to radially expand the tubular member.

2. The method of claim 1, wherein positioning the expandable tubular member within the borehole comprises:

positioning an end of the expandable tubular member adjacent to the bottom of the borehole.

3. The method of claim 1, further comprising:

fluidicly isolating the second region from a third region within the expandable tubular member.

4. An apparatus for forming a wellbore casing within a borehole within a subterranean formation, comprising:

means for positioning an expandable tubular member within the borehole;

means for injecting fluidic materials into the expandable tubular member;

means for fluidicly isolating a first region from a second region within the expandable tubular member;

means for fluidicly coupling the first and second regions;

means for injecting a hardenable fluidic sealing material into the expandable tubular member;

means for fluidicly decoupling the first and second regions; and means for injecting a non-hardenable fluidic material into the expandable tubular member to radially expand the tubular member.

5. The apparatus of claim 4, wherein the means for positioning the expandable tubular member within the borehole comprises:

means for positioning an end of the expandable tubular member adjacent to the bottom of the borehole.

6. The apparatus of claim 4, further comprising:

means for fluidicly isolating the second region from a third region within the expandable tubular member.

7. A method of forming a wellbore casing within a borehole within a subterranean formation, comprising:

positioning an expandable tubular member within the borehole;

injecting fluidic materials into the expandable tubular member;

fluidicly isolating a first region from a second region within the expandable tubular member;

injecting a non-hardenable fluidic material into the expandable tubular member to radially expand at least a portion of the tubular member;

fluidicly coupling the first and second regions;

injecting a hardenable fluidic sealing material into the expandable tubular member;

fluidicly decoupling the first and second regions; and injecting a non-hardenable fluidic material into the expandable tubular member to radially expand another portion of the tubular member.

8. The method of claim 7, wherein positioning the expandable tubular member within the borehole comprises:

positioning an end of the expandable tubular member adjacent to the bottom of the borehole.

9. The method of claim 7, wherein positioning the expandable tubular member within the borehole comprises:

positioning an end of the expandable tubular member adjacent to a preexisting section of wellbore casing within the borehole.

10. The method of claim 7, wherein injecting a non-hardenable fluidic material into the expandable tubular member to radially expand at least a portion of the tubular member comprises:

injecting a non-hardenable fluidic material into the expandable tubular member to radially expand at least a portion of the tubular member until an end portion of the tubular member is positioned proximate the bottom of the borehole.

11. The method of claim 7, further comprising:

fluidicly isolating the second region from a third region within the expandable tubular member.

12. An apparatus for forming a wellbore casing within a borehole within a subterranean formation, comprising:

means for positioning an expandable tubular member within the borehole;

means for injecting fluidic materials into the expandable tubular member;

means for fluidicly isolating a first region from a second region within the expandable tubular member;

means for injecting a non-hardenable fluidic material into the expandable tubular member to radially expand at least a portion of the tubular member;

means for fluidicly coupling the first and second regions;

means for injecting a hardenable fluidic sealing material into the expandable tubular member;

means for fluidicly decoupling the first and second regions; and means for injecting a non-hardenable fluidic material into the expandable tubular member to radially expand another portion of the tubular member.

13. The apparatus of claim 12, wherein means for positioning the expandable tubular member within the borehole comprises:

means for positioning an end of the expandable tubular member adjacent to the bottom of the borehole.

14. The apparatus of claim 12, wherein means for positioning the expandable tubular member within the borehole comprises:

means for positioning an end of the expandable tubular member adjacent to a preexisting section of wellbore casing within the borehole.

15. The apparatus of claim 12, wherein means for injecting a non-hardenable fluidic material into the expandable tubular member to radially expand at least a portion of the tubular member comprises:

means for injecting a non-hardenable fluidic material into the expandable tubular member to radially expand at least a portion of the tubular member until an end portion of the tubular member is positioned proximate the bottom of the borehole.

16. The apparatus of claim 12, further comprising:

means for fluidicly isolating the second region from a third region within the expandable tubular member.

17. An apparatus for forming a wellbore casing within a borehole within a subterranean formation, comprising:

a first annular support member defining a first fluid passage and one or more first radial passages having pressure sensitive valves fluidicly coupled to the first fluid passage;

an annular expansion cone coupled to the first annular support member;

an expandable tubular member movably coupled to the expansion cone;

a second annular support member defining a second fluid passage coupled to the expandable tubular member;

an annular valve member defining a third fluid passage fluidicly coupled to the first and second fluid passages having first and second throat passages, defining second and third radial passages fluidicly coupled to the third fluid passage, coupled to the second annular support member, and movably coupled to the first annular support member; and an annular sleeve releasably coupled to the first annular support member and movably coupled to the annular valve member for controllably fluidicly coupling the second and third radial passages; and wherein an annular region is defined by the region between the tubular member and the first annular support member, the second annular support member, the annular valve member, and the annular sleeve.

18. A method of operating an apparatus for forming a wellbore casing within a borehole within a subterranean formation, the apparatus comprising:

a first annular support member defining a first fluid passage and one or more first radial passages having pressure sensitive valves fluidicly coupled to the first fluid passage;

an annular expansion cone coupled to the first annular support member;

an expandable tubular member movably coupled to the expansion cone;

a second annular support member defining a second fluid passage coupled to the expandable tubular member;

an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member; and an annular sleeve releasably coupled to the first annular support member and movably coupled to the annular valve member for controllably fluidicly coupling the second and third radial passages; and wherein an annular region is defined by the region between the tubular member and the first annular support member, the second annular support member, the annular valve member, and the annular sleeve;

the method comprising:

positioning the apparatus within the borehole;

injecting fluidic materials into the first, second and third fluid passages;

positioning a bottom plug in the bottom throat passage;

displacing the annular sleeve to fluidicly couple the second and third radial passages;

injecting a hardenable fluidic sealing material through the first, second, and third fluid passages, and the second and third radial passages;

displacing the annular sleeve to fluidicly decouple the second and third radial passages; and injecting a non-hardenable fluidic material through the first fluid passage and the first radial passages and pressure sensitive valves into the annular region to radially expand the expandable tubular member.

19. The method of claim 18, wherein positioning the apparatus within the borehole comprises:

positioning an end of the expandable tubular member adjacent to the bottom of the borehole.

20. The method of claim 18, further comprising:

positioning a top plug in the top throat passage.

21. A method of operating an apparatus for forming a wellbore casing within a borehole within a subterranean formation, the apparatus comprising:

a first annular support member defining a first fluid passage and one or more first radial passages having pressure sensitive valves fluidicly coupled to the first fluid passage;

an annular expansion cone coupled to the first annular support member;

an expandable tubular member movably coupled to the expansion cone;

a second annular support member defining a second fluid passage coupled to the expandable tubular member;

an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member; and an annular sleeve releasably coupled to the first annular support member and movably coupled to the annular valve member for controllably fluidicly coupling the second and third radial passages; and wherein an annular region is defined by the region between the tubular member and the first annular support member, the second annular support member, the annular valve member, and the annular sleeve;

the method comprising:

positioning the apparatus within the borehole;

injecting fluidic materials into the first, second and third fluid passages;

positioning a bottom plug in the bottom throat passage;

injecting a non-hardenable fluidic material through the first fluid passages and the first radial passages and pressure sensitive valves into the annular region to radially expand a portion of the expandable tubular member;

displacing the annular sleeve to fluidicly couple the second and third radial passages;

injecting a hardenable fluidic sealing material through the first, second, and third fluid passages, and the second and third radial passages;

displacing the annular sleeve to fluidicly decouple the second and third radial passages; and injecting a non-hardenable fluidic material through the first fluid passage and the first radial passages and pressure sensitive valves into the annular region to radially expand another portion of the expandable tubular member.

22. The method of claim 21, wherein positioning the apparatus within the borehole comprises:

positioning an end of the expandable tubular member adjacent to the bottom of the borehole.

23. The method of claim 21, wherein positioning the apparatus within the borehole comprises:

positioning an end of the expandable tubular member adjacent to a preexisting section of wellbore casing within the borehole.

24. The method of claim 21, wherein injecting a non-hardenable fluidic material into the first fluid passage and first radial passages and pressure sensitive valves to radially expand a portion of the expandable tubular member comprises:

injecting a non-hardenable fluidic material into the first fluid passage and first radial passages and pressure sensitive valves to radially expand the expandable tubular member until an end portion of the tubular member is positioned proximate the bottom of the borehole.

25. The method of claim 21, further comprising:

positioning a top plug in the top throat passage.

26. A method of coupling an expandable tubular member to a preexisting structure, comprising:

positioning the expandable tubular member within the preexisting structure;

injecting fluidic materials into the expandable tubular member;

fluidicly isolating a first region from a second region within the expandable tubular member;

fluidicly coupling the first and second regions;

injecting a hardenable fluidic sealing material into the expandable tubular member;

fluidicly decoupling the first and second regions; and injecting a non-hardenable fluidic material into the expandable tubular member to radially expand the tubular member.

27. The method of claim 26, wherein positioning the expandable tubular member within the preexisting structure comprises:

positioning an end of the expandable tubular member adjacent to the bottom of the preexisting structure.

28. The method of claim 26, further comprising:

fluidicly isolating the second region from a third region within the expandable tubular member.

29. An apparatus for coupling an expandable tubular member to a preexisting structure, comprising:

means for positioning the expandable tubular member within the preexisting structure;

means for injecting fluidic materials into the expandable tubular member;

means for fluidicly isolating a first region from a second region within the expandable tubular member;

means for fluidicly coupling the first and second regions;

means for injecting a hardenable fluidic sealing material into the expandable tubular member;

means for fluidicly decoupling the first and second regions; and means for injecting a non-hardenable fluidic material into the expandable tubular member to radially expand the tubular member.

30. The apparatus of claim 29, wherein the means for positioning the expandable tubular member within the preexisting structure comprises:

means for positioning an end of the expandable tubular member adjacent to the bottom of the preexisting structure.

31. The apparatus of claim 29, further comprising:

means for fluidicly isolating the second region from a third region within the expandable tubular member.

32. A method of coupling an expandable tubular member to a preexisting structure, comprising:

positioning the expandable tubular member within the preexisting structure;

injecting fluidic materials into the expandable tubular member;

fluidicly isolating a first region from a second region within the expandable tubular member;

injecting a non-hardenable fluidic material into the expandable tubular member to radially expand at least a portion of the tubular member;

fluidicly coupling the first and second regions;

injecting a hardenable fluidic sealing material into the expandable tubular member;

fluidicly decoupling the first and second regions; and injecting a non-hardenable fluidic material into the expandable tubular member to radially expand another portion of the tubular member.

33. The method of claim 32, wherein positioning the expandable tubular member within the preexisting structure comprises:

positioning an end of the expandable tubular member adjacent to the bottom of the preexisting structure.

34. The method of claim 32, wherein positioning the expandable tubular member within the preexisting structure comprises:

positioning an end of the expandable tubular member adjacent to a preexisting tubular structural element within the preexisting structure.

35. The method of claim 32, wherein injecting a non-hardenable fluidic material into the expandable tubular member to radially expand at least a portion of the tubular member comprises:

injecting a non-hardenable fluidic material into the expandable tubular member to radially expand at least a portion of the tubular member until an end portion of the tubular member is positioned proximate the bottom of the preexisting structure.

36. The method of claim 32, further comprising:

fluidicly isolating the second region from a third region within the expandable tubular member.

37. An apparatus for coupling an expandable tubular member to a preexisting structure, comprising:

means for positioning the expandable tubular member within the preexisting structure;

means for injecting fluidic materials into the expandable tubular member;

means for fluidicly isolating a first region from a second region within the expandable tubular member;

means for injecting a non-hardenable fluidic material into the expandable tubular member to radially expand at least a portion of the tubular member;

means for fluidicly coupling the first and second regions;

means for injecting a hardenable fluidic sealing material into the expandable tubular member;

means for fluidicly decoupling the first and second regions; and means for injecting a non-hardenable fluidic material into the expandable tubular member to radially expand another portion of the tubular member.

38. The apparatus of claim 37, wherein means for positioning the expandable tubular member within the preexisting structure comprises:

means for positioning an end of the expandable tubular member adjacent to the bottom of the preexisting structure.

39. The apparatus of claim 37, wherein means for positioning the expandable tubular member within the preexisting structure comprises:

means for positioning an end of the expandable tubular member adjacent to a preexisting structural element within the preexisting structure.

40. The apparatus of claim 37, wherein means for injecting a non-hardenable fluidic material into the expandable tubular member to radially expand at least a portion of the tubular member comprises:

means for injecting a non-hardenable fluidic material into the expandable tubular member to radially expand at least a portion of the tubular member until an end portion of the tubular member is positioned proximate the bottom of the preexisting structure.

41. The apparatus of claim 37, further comprising:

means for fluidicly isolating the second region from a third region within the expandable tubular member.

42. An apparatus for coupling an expandable tubular member to a preexisting structure, comprising:

a first annular support member defining a first fluid passage and one or more first radial passages having pressure sensitive valves fluidicly coupled to the first fluid passage;

an annular expansion cone coupled to the first annular support member;

an expandable tubular member movably coupled to the expansion cone;

a second annular support member defining a second fluid passage coupled to the expandable tubular member;

an annular valve member defining a third fluid passage fluidicly coupled to the first and second fluid passages having first and second throat passages, defining second and third radial passages fluidicly coupled to the third fluid passage, coupled to the second annular support member, and movably coupled to the first annular support member; and an annular sleeve releasably coupled to the first annular support member and movably coupled to the annular valve member for controllably fluidicly coupling the second and third radial passages; and wherein an annular region is defined by the region between the tubular member and the first annular support member, the second annular support member, the annular valve member, and the annular sleeve.

43. A method of operating an apparatus for coupling an expandable tubular member to a preexisting structure, the apparatus comprising:

a first annular support member defining a first fluid passage and one or more first radial passages having pressure sensitive valves fluidicly coupled to the first fluid passage;

an annular expansion cone coupled to the first annular support member;

an expandable tubular member movably coupled to the expansion cone;

a second annular support member defining a second fluid passage coupled to the expandable tubular member;

an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member; and an annular sleeve releasably coupled to the first annular support member and movably coupled to the annular valve member for controllably fluidicly coupling the second and third radial passages; and wherein an annular region is defined by the region between the tubular member and the first annular support member, the second annular support member, the annular valve member, and the annular sleeve;

the method comprising:

positioning the apparatus within the preexisting structure;

injecting fluidic materials into the first, second and third fluid passages;

positioning a bottom plug in the bottom throat passage;

displacing the annular sleeve to fluidicly couple the second and third radial passages;

injecting a hardenable fluidic sealing material through the first, second, and third fluid passages, and the second and third radial passages;

displacing the annular sleeve to fluidicly decouple the second and third radial passages; and injecting a non-hardenable fluidic material through the first fluid passage and the first radial passages and pressure sensitive valves into the annular region to radially expand the expandable tubular member.

44. The method of claim 43, wherein positioning the apparatus within the preexisting structure comprises:

positioning an end of the expandable tubular member adjacent to the bottom of the preexisting structure.

45. The method of claim 43, further comprising:

positioning a top plug in the top throat passage.

46. A method of operating an apparatus for coupling an expandable tubular member to a preexisting structure, the apparatus comprising:

a first annular support member defining a first fluid passage and one or more first radial passages having pressure sensitive valves fluidicly coupled to the first fluid passage;

an annular expansion cone coupled to the first annular support member;

an expandable tubular member movably coupled to the expansion cone;

a second annular support member defining a second fluid passage coupled to the expandable tubular member;

an annular valve member defining a third fluid passage fluidicly coupled to the first and second fluid passages having top and bottom throat passages, defining second and third radial passages fluidicly coupled to the third fluid passage, coupled to the second annular support member, and movably coupled to the first annular support member; and an annular sleeve releasably coupled to the first annular support member and movably coupled to the annular valve member for controllably fluidicly coupling the second and third radial passages; and wherein an annular region is defined by the region between the tubular member and the first annular support member, the second annular support member, the annular valve member, and the annular sleeve;

the method comprising:

positioning the apparatus within the preexisting structure;

injecting fluidic materials into the first, second and third fluid passages;

positioning a bottom plug in the bottom throat passage;

injecting a non-hardenable fluidic material through the first fluid passages and the first radial passages and pressure sensitive valves into the annular region to radially expand a portion of the expandable tubular member;

displacing the annular sleeve to fluidicly couple the second and third radial passages;

injecting a hardenable fluidic sealing material through the first, second, and third fluid passages, and the second and third radial passages;

displacing the annular sleeve to fluidicly decouple the second and third radial passages; and injecting a non-hardenable fluidic material through the first fluid passage and the first radial passages and pressure sensitive valves into the annular region to radially expand another portion of the expandable tubular member.

47. The method of claim 46, wherein positioning the apparatus within the preexisting structure comprises:

positioning an end of the expandable tubular member adjacent to the bottom of the preexisting structure.

48. The method of claim 46, wherein positioning the apparatus within the preexisting structure comprises:

positioning an end of the expandable tubular member adjacent to a preexisting section of a structural element within the preexisting structure.

49. The method of claim 46, wherein injecting a non-hardenable fluidic material into the first fluid passage and first radial passages and pressure sensitive valves to radially expand a portion of the expandable tubular member comprises:

injecting a non-hardenable fluidic material into the first fluid passage and first radial passages and pressure sensitive valves to radially expand the expandable tubular member until an end portion of the tubular member is positioned proximate the bottom of the preexisting structure.

50. The method of claim 46, further comprising:

positioning a top plug in the top throat passage.

* * * * *